US012789052B2

(12) United States Patent
Bacon et al.

(10) Patent No.: US 12,789,052 B2
(45) Date of Patent: Nov. 10, 2026

(54) MULTI-MATERIAL GOLF CLUB HEAD WITH BALANCED PERFORMANCE CHARACTERISTICS

(71) Applicant: KARSTEN MANUFACTURING CORPORATION, Phoenix, AZ (US)

(72) Inventors: Cory S. Bacon, Scottsdale, AZ (US); Evan R. Greer, Peoria, AZ (US); Travis D. Milleman, Cave Creek, AZ (US); Joshua A. Degerness, Scottsdale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 328 days.

(21) Appl. No.: 18/393,485

(22) Filed: Dec. 21, 2023

(65) Prior Publication Data

US 2024/0131402 A1 Apr. 25, 2024

Related U.S. Application Data

(63) Continuation-in-part of application No. 18/353,354, filed on Jul. 17, 2023, now Pat. No. 12,370,421, and (Continued)

(51) Int. Cl.
*A63B 53/04* (2015.01)
*A63B 53/06* (2015.01)

(52) U.S. Cl.
CPC ..... *A63B 53/0412* (2020.08); *A63B 53/0416* (2020.08); *A63B 53/06* (2013.01); *A63B 2053/0491* (2013.01)

(58) Field of Classification Search
CPC ..... A63B 53/0433; A63B 53/0437; A63B 53/0466
See application file for complete search history.

(56) References Cited

U.S. PATENT DOCUMENTS 7,326,125 B2 2/2008 Moriyama
7,371,191 B2 5/2008 Sugimoto
(Continued)

FOREIGN PATENT DOCUMENTS

CN 219110788 6/2023
JP 4754452 8/2011
(Continued)

OTHER PUBLICATIONS

International Search Report, dated Mar. 6, 2024, and Written Opinion, dated Feb. 7, 2024, from PCT Appl. No. PCT/US2023/085561.

*Primary Examiner* — Raeann Gorden

(57) ABSTRACT

A golf club head that achieves high performance by improving and/or balancing physical properties and performance characteristics. The golf club heads described herein achieve an $I_{YY}$ at or near the allowable limit, an $I_{XX}/I_{YY}$ ratio near 1, and a club head CG position that is centered relative to the club head perimeter and located at or near the loft-normal axis. The golf club head comprises one or more structures that create discretionary mass to be redistributed into a heavy weight member in an extreme rearward and soleward position, and/or a central mass pad at or near the Y'-axis.

20 Claims, 79 Drawing Sheets

Related U.S. Application Data a continuation-in-part of application No. 18/450,359, filed on Aug. 15, 2023, now Pat. No. 12,390,699.

(60) Provisional application No. 63/503,134, filed on May 18, 2023, provisional application No. 63/370,482, filed on Aug. 4, 2022, provisional application No. 63/368,626, filed on Jul. 15, 2022, provisional application No. 63/371,449, filed on Aug. 15, 2022, provisional application No. 63/510,076, filed on Jun. 23, 2023, provisional application No. 63/476,624, filed on Dec. 21, 2022, provisional application No. 63/476,625, filed on Dec. 21, 2022, provisional application No. 63/589,953, filed on Oct. 12, 2023.

(56) References Cited

U.S. PATENT DOCUMENTS

| | | | |
|---|---|---|---|
| 7,399,237 | B2 | 7/2008 | Evans |
| 7,497,789 | B2 | 3/2009 | Burnett |
| 7,632,195 | B2 | 12/2009 | Jorgensen |
| 7,691,008 | B2 | 4/2010 | Oyama |
| 7,699,719 | B2 | 4/2010 | Sugimoto |
| 7,717,807 | B2 | 5/2010 | Evans |
| 7,749,103 | B2 | 7/2010 | Nakano |
| 7,771,291 | B1 | 8/2010 | Willett |
| 7,775,905 | B2 | 8/2010 | Beach |
| 7,887,431 | B2 | 2/2011 | Beach |
| 7,887,436 | B2 | 2/2011 | Hirano |
| 8,167,737 | B2 | 5/2012 | Oyama |
| 8,172,697 | B2 | 5/2012 | Cackett |
| 8,187,115 | B2 | 5/2012 | Bennett |
| 8,272,974 | B2 | 9/2012 | Mickelson |
| 8,337,327 | B2 | 12/2012 | Dawson |
| 8,393,977 | B1 | 3/2013 | Hettinger |
| 8,414,422 | B2 | 4/2013 | Peralta |
| 8,435,137 | B2 | 5/2013 | Hirano |
| 8,608,589 | B2 | 12/2013 | Ferguson |
| 8,617,000 | B2 | 12/2013 | Ferguson |
| 8,636,609 | B2 | 1/2014 | Chao |
| 8,641,550 | B2 | 2/2014 | Golden |
| 8,668,596 | B2 | 3/2014 | Cackett |
| 8,684,863 | B2 | 4/2014 | Bezilla |
| 8,727,909 | B2 | 5/2014 | Guerrette |
| 8,758,165 | B1 | 6/2014 | Abbott |
| 8,783,086 | B2 | 7/2014 | Hirano |
| 8,894,506 | B1 | 11/2014 | Myers |
| 9,119,994 | B2 | 9/2015 | Nakamura |
| 9,259,625 | B2 | 2/2016 | Sargent |
| 9,757,630 | B2 | 9/2017 | Mata |
| 10,155,142 | B2 | 12/2018 | Kato |
| 10,183,203 | B1 | 1/2019 | Yi |
| 10,195,497 | B1 | 2/2019 | Greaney |
| 10,207,160 | B2 * | 2/2019 | Johnson ..... A63B 53/06 |
| 10,213,663 | B2 | 2/2019 | Goudarzi |
| 10,279,224 | B1 | 5/2019 | Webb |
| 10,286,264 | B2 | 5/2019 | Yoshida |
| 10,420,987 | B2 | 9/2019 | Kimizuka |
| 10,532,254 | B1 | 1/2020 | Evans |
| 10,653,926 | B2 | 5/2020 | Story |
| 10,716,974 | B2 | 7/2020 | Mizutani |
| 10,850,168 | B2 | 12/2020 | Kato |
| 10,888,751 | B1 | 1/2021 | Frederickson |
| 11,033,782 | B1 | 6/2021 | Evans |
| 11,040,257 | B2 | 6/2021 | Nakamura |
| 11,110,327 | B2 | 9/2021 | Mizutani |
| 11,207,574 | B2 | 12/2021 | Motokawa |
| 11,207,577 | B1 | 12/2021 | Evans |
| 11,213,727 | B2 | 1/2022 | Mizutani |
| 11,305,163 | B2 | 4/2022 | Johnson |
| 11,406,881 | B2 | 8/2022 | Harbert |
| 11,654,336 | B2 | 5/2023 | Penney |
| 11,679,311 | B1 | 6/2023 | Bennett |
| 11,712,606 | B2 | 8/2023 | Johnson |
| 12,070,666 | B2 | 8/2024 | Nielson |
| 12,274,925 | B2 | 4/2025 | Motokawa |
| 2009/0149276 | A1 | 6/2009 | Golden |
| 2010/0234126 | A1 | 9/2010 | Cackett |
| 2022/0387863 | A1 | 12/2022 | Tsai |
| 2023/0191211 | A1 | 6/2023 | Hsu |
| 2023/0277902 | A1 | 9/2023 | Nakamura |
| 2024/0017137 | A1 | 1/2024 | Yi |
| 2024/0424358 | A1 | 12/2024 | Takahashi |

FOREIGN PATENT DOCUMENTS

| | | |
|---|---|---|
| JP | 5074841 | 11/2012 |
| JP | 6717332 | 7/2020 |
| JP | 6795776 | 12/2020 |
| JP | 6964342 | 11/2021 |
| JP | 2021194120 | 12/2021 |
| JP | 2022136423 | 9/2022 |
| JP | 2023024180 | 2/2023 |
| JP | 7528667 | 8/2024 |
| JP | 7639374 | 3/2025 |

* cited by examiner

MULTI-MATERIAL GOLF CLUB HEAD WITH BALANCED PERFORMANCE CHARACTERISTICS

CROSS REFERENCE PRIORITIES

This is a continuation-in-part of U.S. Nonprovisional application Ser. No. 18/353,354, filed Jul. 17, 2023, which claims the benefit of U.S. Provisional Application No. 63/368,626 filed Jul. 15, 2022, U.S. Provisional Application No. 63/370,482 filed Aug. 4, 2022, and U.S. Provisional Application No. 63/503,134 filed May 18, 2023, the contents of which are fully incorporated herein by reference.

This is also a continuation-in-part of U.S. Nonprovisional application Ser. No. 18/450,359, filed Aug. 15, 2023, which claims the benefit of U.S. Provisional Application No. 63/371,449, filed Aug. 15, 2022, and U.S. Provisional Application No. 63/510,076, filed Jun. 23, 2023, the contents of which are fully incorporated herein by reference.

This also claims the benefit of U.S. Provisional Application No. 63/476,624, filed Dec. 21, 2022, U.S. Provisional Application No. 63/476,625, filed Dec. 21, 2022, and U.S. Provisional Application No. 63/589,953, filed Oct. 12, 2023, the contents of which are fully incorporated herein by reference.

TECHNICAL FIELD

The present disclosure relates generally to golf equipment, and more particularly, to golf heads. In particular, the present invention is directed to a driver-type golf club head with a multi-material construction that balances physical properties and/or performance characteristics.

BACKGROUND

Golf club head design, particularly driver-type golf club head design, typically requires balancing and/or maximizing several physical properties of the club head to achieve desired performance characteristics. For example, mass properties such as moment of inertia and center of gravity position influence performance characteristics such as forgiveness, ball speed, launch angle, and spin rate. Club head shape influences said mass properties, as well as club head bending and aerodynamic properties. Bending properties can influence the amount of energy transfer between the golf club head and the golf ball, while aerodynamic properties can improve swing speed, and therefore carry distance, for a given player. Vibrations generated at impact give the golf club head a particular sound and feel. Further, golf club heads can be customized for a given player through CG and/or loft and lie angle adjustability features.

Certain physical properties and/or performance characteristics can complement one another, such that an improvement in a first property or characteristic creates an improvement in a second property or characteristic. Other properties and/or characteristics can be noncomplementary to one another, such that an improvement in a first property or characteristic can create an adverse effect in a second property or characteristic. The tradeoffs between noncomplementary properties and/or characteristics must be considered. The relationships between all properties and/or characteristics, including the tradeoffs between non-complementary properties and/or characteristics, must be considered and balanced to provide a high-performing club head.

Historically, golf club head designs, particularly wood-type golf club heads, seek to increase club head moment of inertia to increase forgiveness and minimize decreases in ball speed for mishits. Most commonly, prior-art club head designs prioritize increasing $I_{YY}$ moment of inertia (i.e., the moment of inertia about a Y-axis extending vertically through the club head center of gravity), as $I_{YY}$ is a main contributor to club head performance and forgiveness, particularly on shots mishit toward the heel or the toe. However, in prioritizing $I_{YY}$, prior-art club head designs often neglect other physical properties and/or performance characteristics. Further, the USGA limits moment of inertia, in any direction, to 6000 g-cm$^2$. Maximizing $I_{YY}$ in a driver-type club head is thereby constrained, because $I_{YY}$ is typically the highest MOI value in a driver-type golf club head. There is a need in the art for a driver-type golf club head that 1) achieves an $I_{YY}$ at or near the USGA limit and 2) improves and balances physical properties and performance characteristics with respect to said $I_{YY}$.

Figure 1:
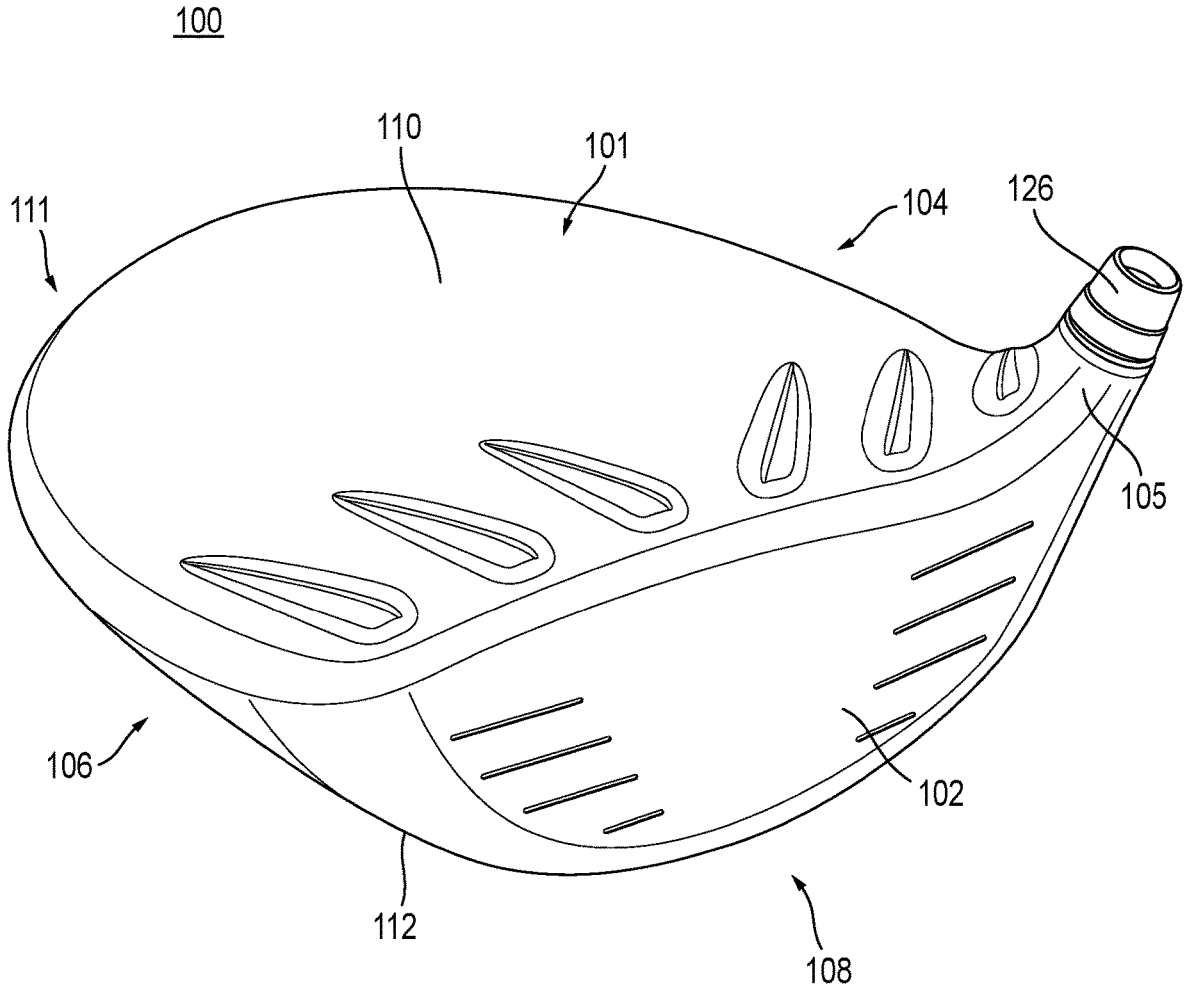
FIG. 1 illustrates a front perspective view of a golf club head according to the present invention.

Other aspects of the disclosure will become apparent by consideration of the detailed description and accompanying drawings.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

Definitions

The terms "first," "second," "third," "fourth," and the like in the description and in the claims, if any, are used herein for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used herein for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like as used herein broadly refer to connecting two or more elements or signals, electrically, mechanically and/or otherwise.

Various embodiments of a golf club are illustrated in the figures. A golf club is generally understood to comprise a club head, which is configured to receive a shaft. A golf club further comprises a grip, which is secured to the shaft.

FIGS. 1-11 schematically illustrate various embodiments of a driver-type golf club head in various views. The features discussed below are demonstrated on the golf club head 100. For ease of discussion, the features shown on the golf club head 100 are applicable to various embodiments of the club head according to the present invention. Any one or more of the features described in the various embodiments below can be used in combination with one another. Further, while different embodiments may comprise different numbering schemes (i.e., 1xx, 2xx, 3xx numbering schemes, etc.) similar elements are numbered similarly between embodiments (i.e., golf club head 100 comprises a crown 110 and a sole 112, whereas club head 200 comprises a crown 210 and a sole 212).

Figure 2:
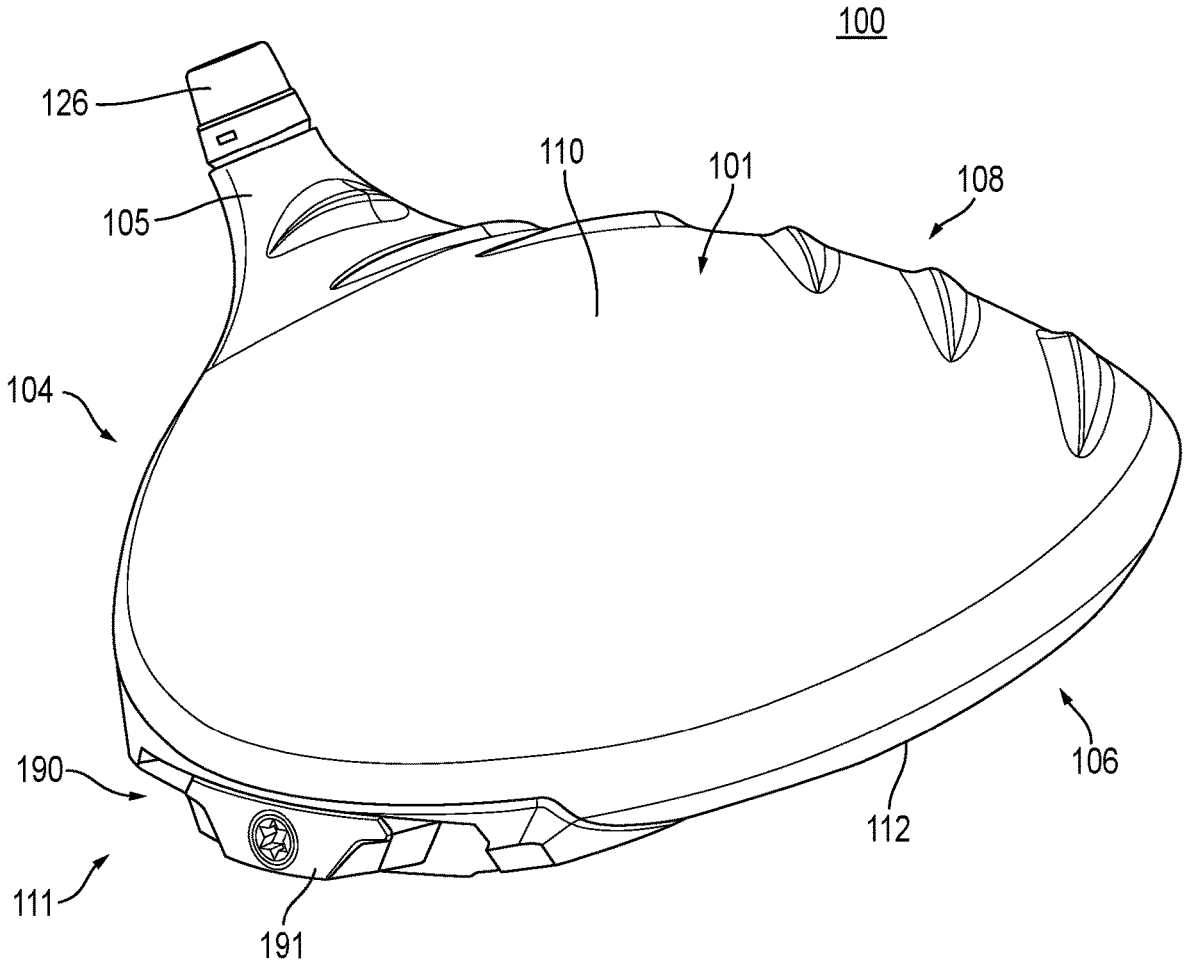
FIG. 2 illustrates a rear perspective view of the golf club head of FIG. 1.

The golf club head 100 comprises a body 101 that defines a substantially closed/hollow interior cavity 107. Referring to FIGS. 1 and 2, the body 101 defines a front end 108, a rear end 111 opposite the front end 108, a heel end 104, and a toe end 106 opposite the heel end 104. The body 101 comprises a strike face 102 near the front end 108, a crown 110 near an upper portion of the club head, and a sole 112 near a lower portion of the club head. The body 101 further comprises a hosel 105 near the heel end 104 for receiving either a shaft or an adjustable hosel feature.

The body 101 further defines a body perimeter that defines a transition between the crown 110 and the sole 112. The body perimeter is defined by a series of points around the golf club head 100, each having a tangent to a line drawn perpendicular to the ground plane 10 when the golf club head 100 is in the address position (defined below). The body perimeter divides the crown 110 from the sole 112 such that when viewed from a top view, the crown 110 is visible when the golf club head 100 is in the address position. Similarly, the sole 112 is viewed from a bottom view when the golf club head 100 is in the address position. The body perimeter defines a change from the crown surface to the sole surface through a curved transition surface, at any point along the body 101, other than the strike face 102.

Figure 9:
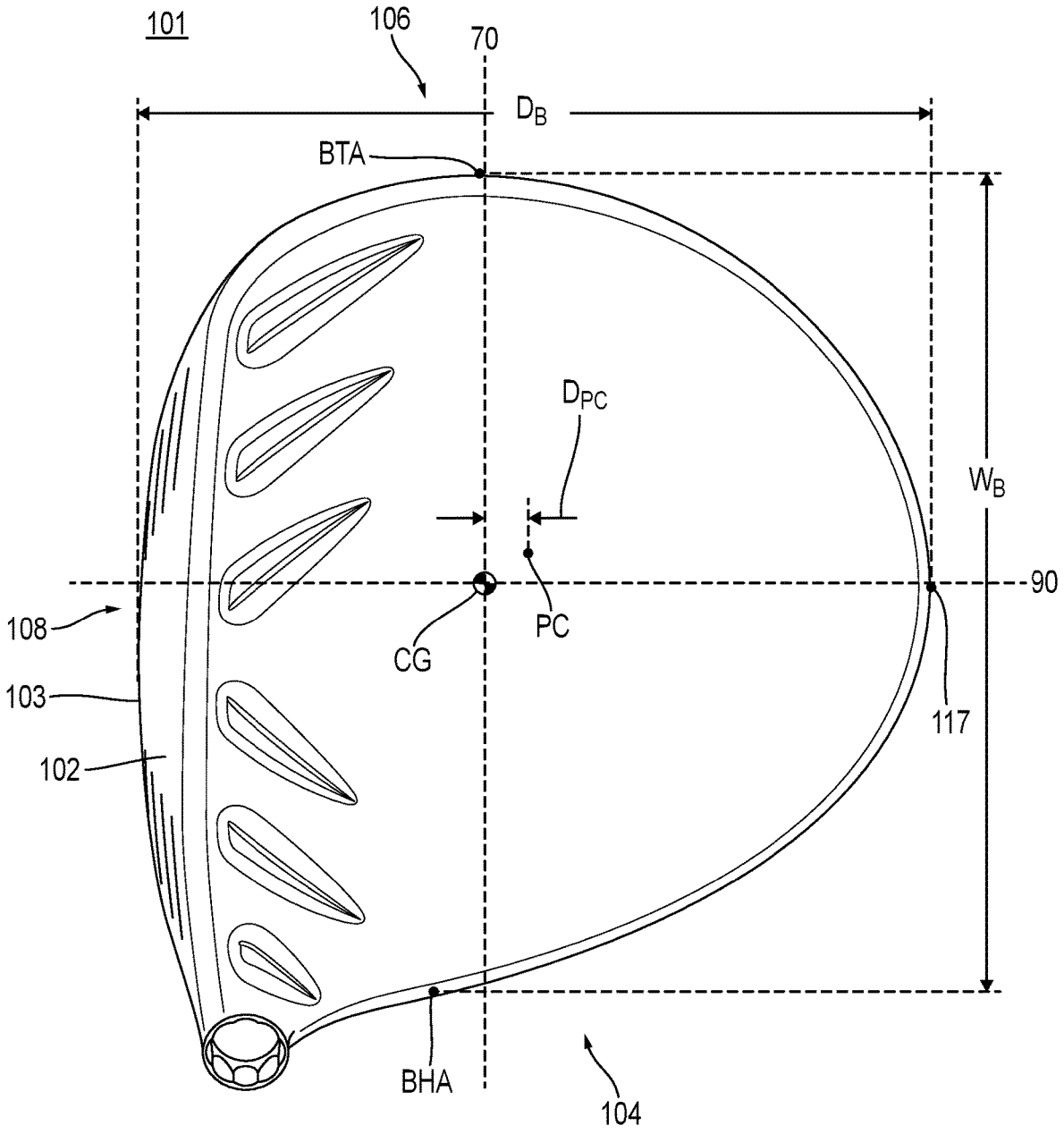
FIG. 9 illustrates a top plan view of the golf club head of FIG. 1, highlighting the club head body dimensions.

A perimetrical centroid (PC) is defined with respect to the body perimeter. The perimetrical centroid (PC) is the geometric center of the body perimeter as measured from a plan view. The perimetrical centroid (PC) is illustrated in FIG. 9.

Figure 3:
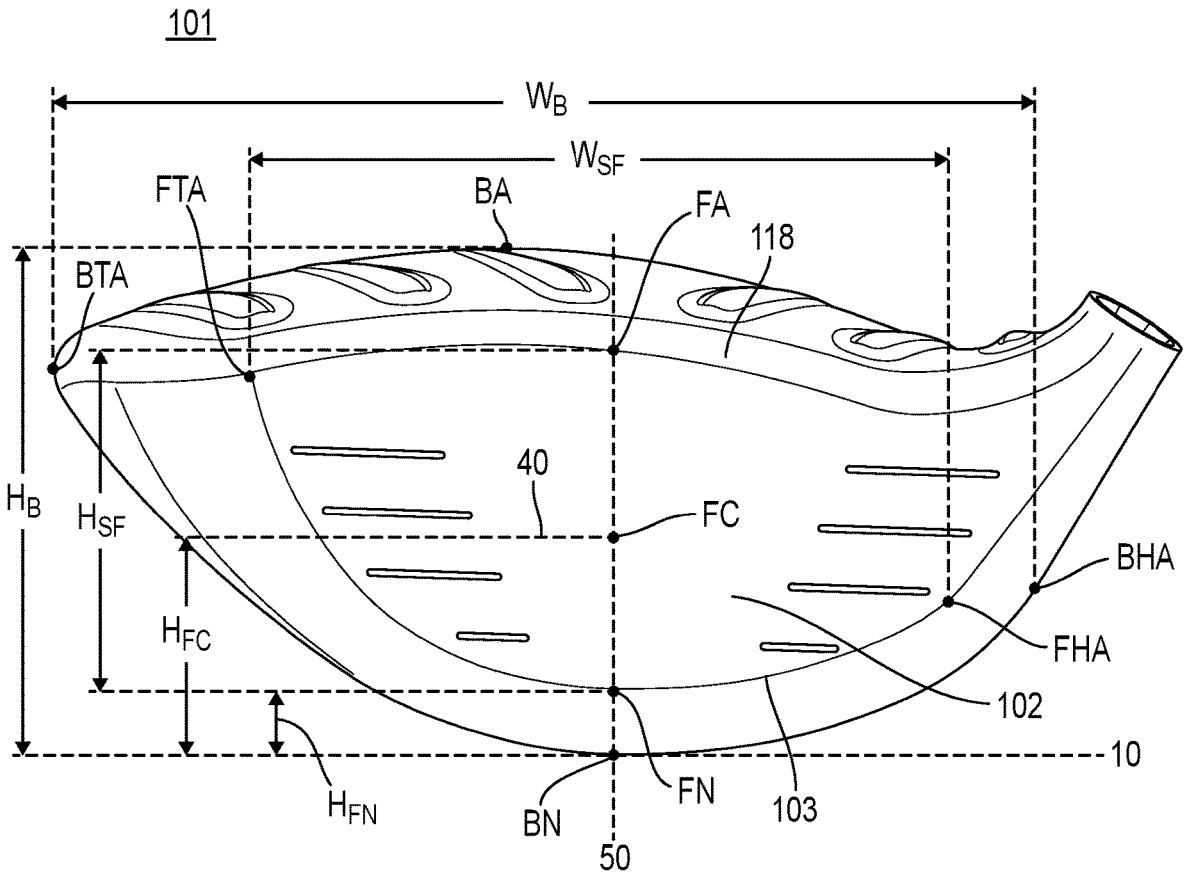
FIG. 3 illustrates a front side elevation view of the golf club head of FIG. 1, highlighting the strike face dimensions.

The crown 110 is the upward facing portion of the body 101. The crown 110 is defined as the portion of the body 101, excluding the strike face 102, above the body perimeter. The crown 110 is bounded by the body perimeter on the rear end 111, the heel end 104, and the toe end 106. The crown 110 is bounded on the front end 108 by the upper edge 118 of the strike face 102. The crown 110 is bounded by the perimeter on the rear end 111, the heel end 104, and the toe end 106. The crown 110 is bounded on the front end 108 by the upper edge 118 of the strike face 102. Referring to FIG. 3, the crown 110 defines a body apex (BA), which is the highest point of the body 101. In certain embodiments that include surface features located on the crown 110, the body apex (BA) may be located on said surface features. The crown 110 further defines a crown surface area measured along the curved surface of the crown 110, including any surface features. The crown surface area is measured within the boundary of the crown 110, including the surface area of the hosel 105.

The sole 112 is the lower, groundward facing portion of the golf club head 100. The sole 112 is defined as the portion of the golf club head 100, excluding the strike face 102, that is below the body perimeter. Referring to FIG. 3, the sole 112 defines a body nadir (BN), which is the lowest point of the body 101. The sole 112 further defines a sole surface area measured along the curved surface of the sole 112, including any surface features. The sole surface area is measured within the boundary of the sole 112.

The strike face is a surface that is configured to strike a golf ball. The strike face 102 is bounded by an outer edge referred to as a "strike face perimeter." The strike face perimeter is defined where the curvature of the golf club head 100 deviates from a bulge and/or roll curvature of the strike face 102 (defined below). Referring to FIG. 3, the strike face perimeter includes at least an upper edge 118 and a leading edge 103. The upper edge 118 is the most crown-ward portion of the strike face perimeter and defines a transition from the strike face 102 to the crown 110. The upper edge 118 defines a face apex (FA), located at the intersection between the upper edge 118 and the YZ plane (described below). The leading edge 103 is the most sole-ward portion of the strike face perimeter and defines a transition from the strike face 102 to the sole 112. The leading edge 103 defines a face nadir (FN) located at the intersection between the leading edge 103 and the YZ plane. The strike face perimeter further defines a face heel apex (FHA), which is the heelward-most point on the strike face perimeter, and a face toe apex (FTA), which is the toeward-most point on the strike face perimeter. The strike face 102 defines a face center (FC), which is the geometric center-point of the strike face perimeter, illustrated in FIG. 3. The face center (FC) can be located in accordance with the definition of a golf governing body such as the United States Golf Association (USGA).

The golf club head 100 defines a ground plane 10 as a reference plane associated with the surface on which a golf ball is placed. The ground plane 10 is a horizontal plane tangent to the sole 112 in the address position. The ground plane 10 is illustrated in FIG. 3.

Figure 4:
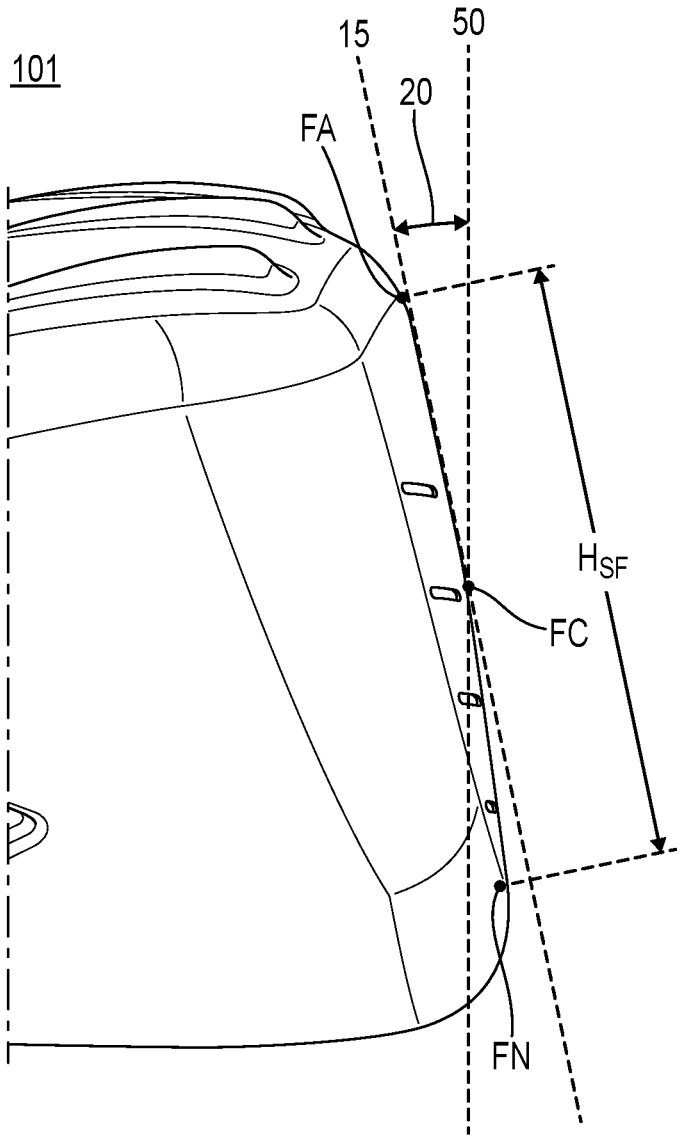
FIG. 4 illustrates an enlarged, partial toe-side elevation view of the golf club head of FIG. 1, highlighting the strike face dimensions.

The golf club head 100 defines a loft plane 15 as a plane that is tangent to the face center (FC). The loft plane 15 is illustrated in FIG. 4.

The golf club head 100 defines a loft angle 20 as the angle measured between the loft plane 15 and the XY plane (defined below). The loft angle 20 is illustrated in FIG. 4.

The golf club head 100 defines a lie angle 25 as the angle between a hosel axis 30, extending through the hosel 105, and the ground plane 10. The lie angle 25 is measured from a front view of the golf club head 100, as illustrated in FIG. 6.

The golf club head 100 can define an address position, wherein the golf club head 100 is oriented such that the golf club head 100 forms its intended loft angle 20 and lie angle 25. For example, in the address position, the loft plane 15 and the XY plane form the intended loft angle 20 between one another. Likewise, in the address position, the hosel axis 30 and the ground plane 10 form the intended lie angle 25 between one another.

Figure 6:
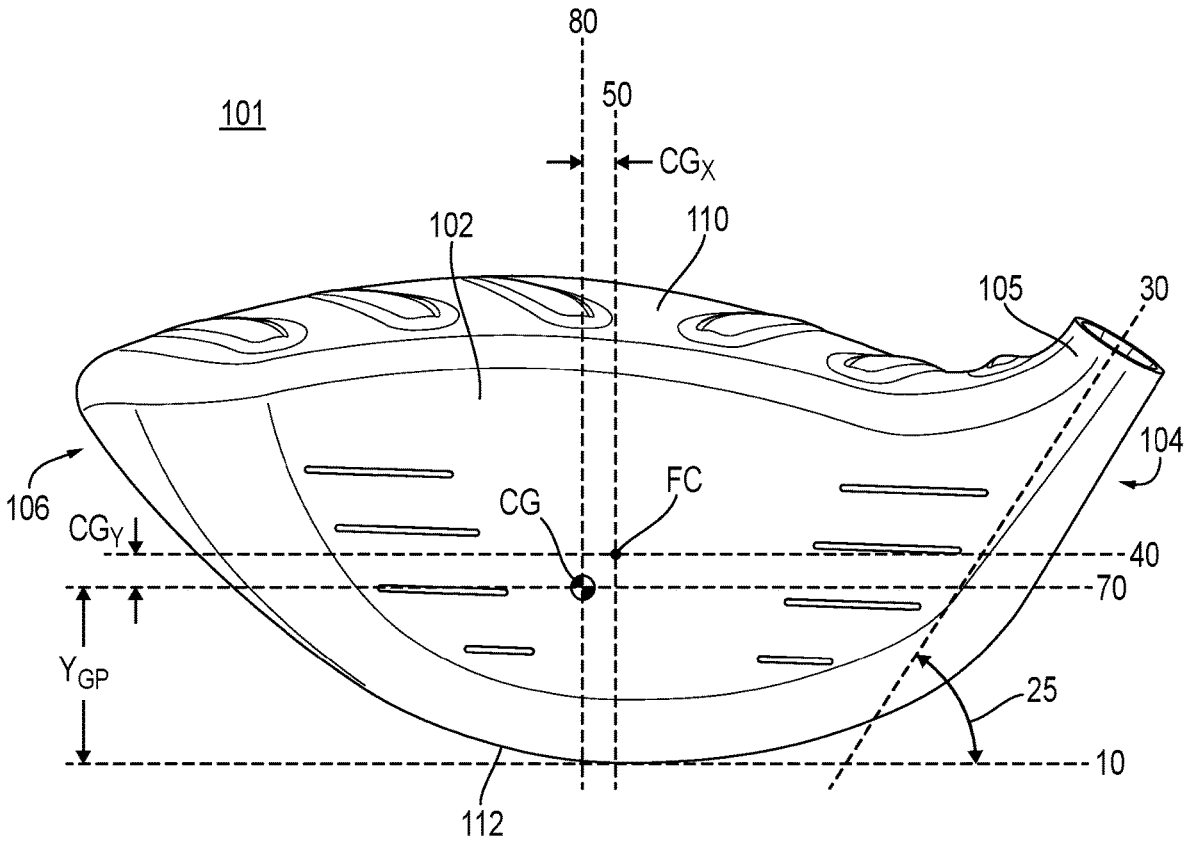
FIG. 6 illustrates a front side elevation view of the golf club head of FIG. 1, highlighting the club head coordinate axes.
Figure 7:
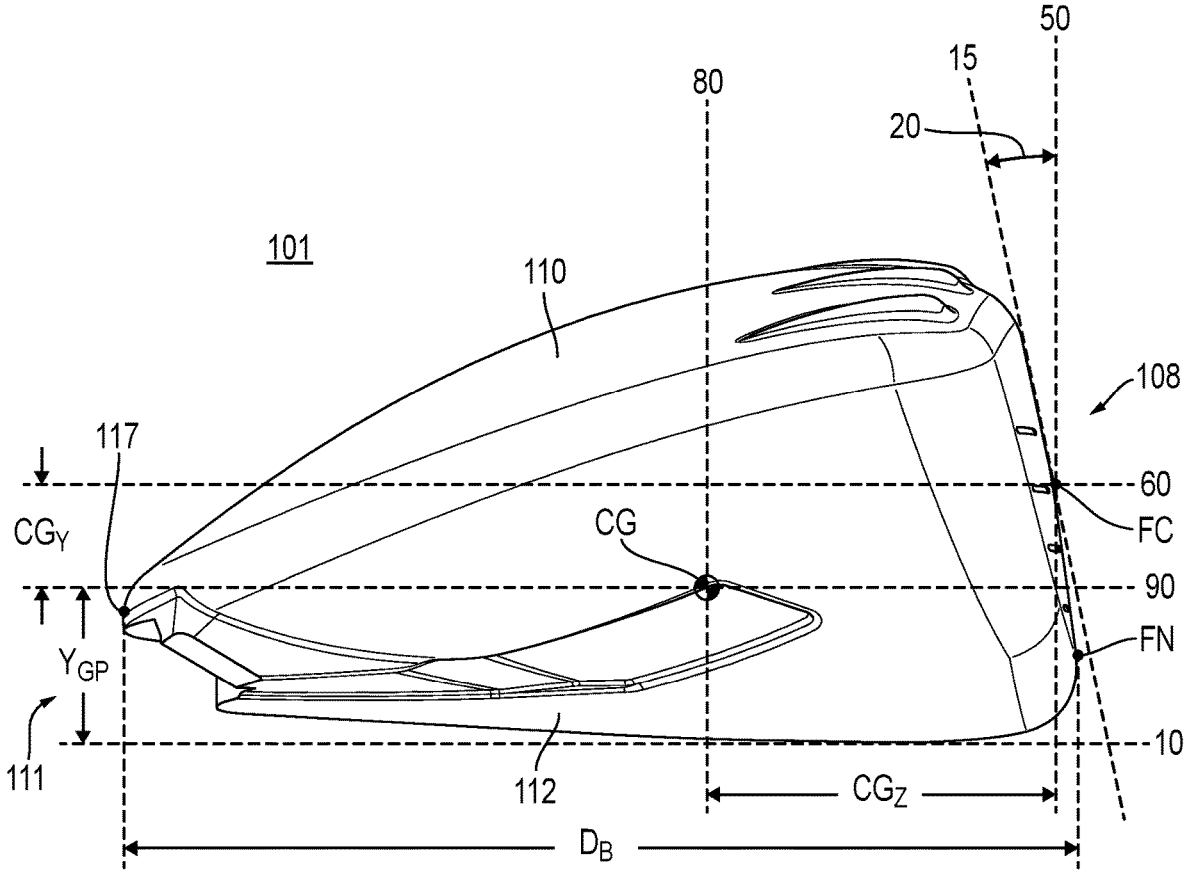
FIG. 7 illustrates a toe-side elevation view of the golf club head of FIG. 1, highlighting the club head coordinate axes.

As illustrated in FIGS. 6 and 7, the golf club head 100 defines a primary coordinate system centered about the face center (FC). The primary coordinate system comprises an X-axis 40, a Y-axis 50, and a Z-axis 60. The X-axis 40 extends in a heel-to-toe direction, parallel to the ground plane 10. The X-axis 40 is positive towards the heel end 104 and negative towards the toe end 106. The Y-axis 50 extends in a crown-to-sole direction and is orthogonal to both the ground plane 10 and the X-axis 40. The Y-axis 50 is positive towards the crown 110 and negative towards the sole 112. The Z-axis 60 extends in a front-to-rear direction, parallel to the ground plane 10, and is orthogonal to both the X-axis 40 and the Y-axis 50. The Z-axis 60 is positive towards the strike face 102 and negative towards the rear end 111.

The primary coordinate system, as described herein, defines an XY plane as a vertical plane extending along the X-axis 40 and the Y-axis 50. The primary coordinate system defines an XZ plane as a horizontal plane extending along the X-axis 40 and the Z-axis 60. The primary coordinate system further defines a YZ plane as a vertical plane extending along the Y-axis 50 and the Z-axis 60. The XY plane, the XZ plane, and the YZ plane are all perpendicular to one another and intersect at the primary coordinate system origin located at the face center (FC). In these or other embodiments, the golf club head 100 can be viewed from a front view when the strike face 102 is viewed from a direction perpendicular to the XY plane. Further, in these or other embodiments, the golf club head 100 can be viewed from a side view or side cross-sectional view when the heel end 104 or the toe end 106 is viewed from a direction perpendicular to the YZ plane.

The strike face 102 defines a strike face height ($H_{SF}$). Referring to FIGS. 3 and 4, the strike face height ($H_{SF}$) is measured parallel to the loft plane 15 between the face nadir (FN) and the face apex (FA).

The strike face 102 defines a strike face width ($W_{SF}$) referring to a horizontal distance measured across the strike face 102 in a heel-to-toe direction. Referring to FIG. 3, the strike face width ($W_{SF}$) is measured parallel to the ground plane 10, between the face heel apex (FHA) and the face toe apex (FTA).

Figure 5:
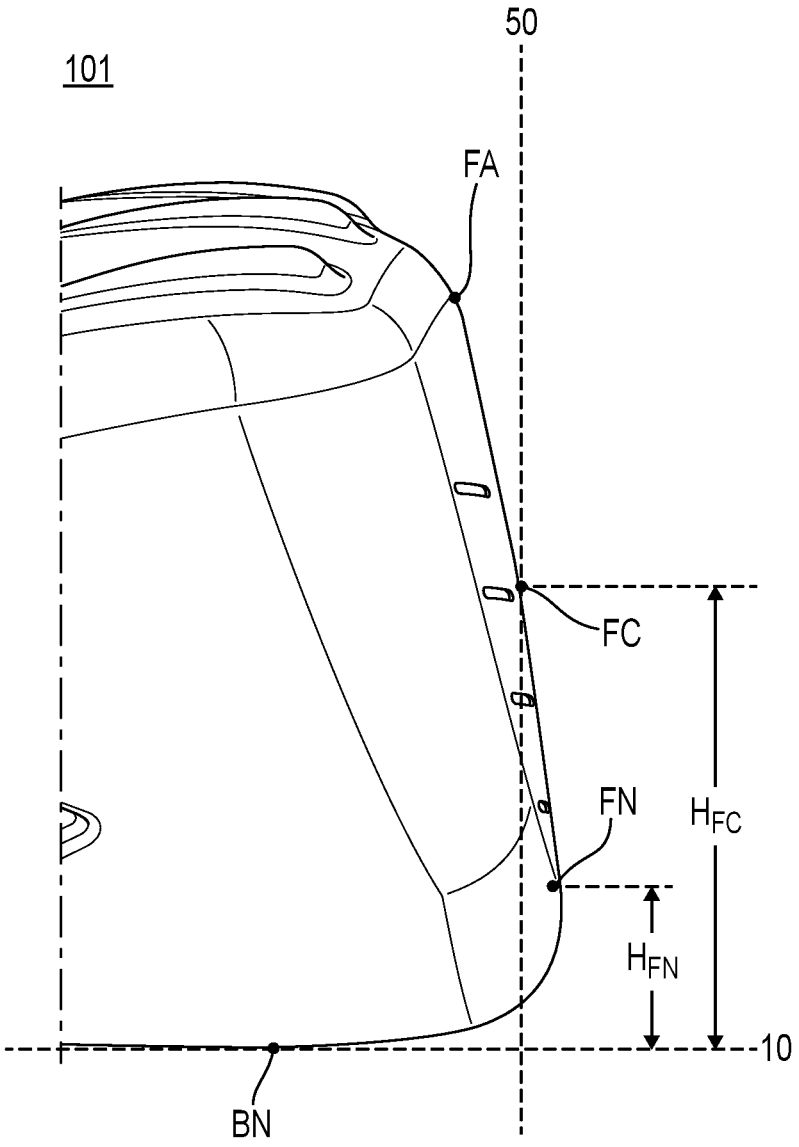
FIG. 5 illustrates an enlarged, partial toe-side elevation view of the golf club head of FIG. 1, highlighting additional strike face dimensions.

The strike face 102 defines a face center height ($H_{FC}$). Referring to FIGS. 3 and 5 the face center height ($H_{FC}$) is measured perpendicular to the ground plane 10 between the ground plane 10 and the face center (FC).

The strike face 102 comprises a bulge curvature and a roll curvature. The bulge curvature is the curvature of the strike face in the heel-to-toe direction. The roll curvature is the curvature of the strike face in a crown-to-sole direction. The bulge curvature and the roll curvature each respectively comprise a bulge radius and a roll radius defining the radii of curvature associated with each of the bulge curvature and the roll curvature. The bulge curvature and/or the roll curvature can comprise one or more radii.

The golf club head 100 defines a body depth ($D_B$), referring to a front-to-rear dimension measured across the body 101. Referring to FIGS. 7 and 9, the body depth ($D_B$) is measured parallel to the Z-axis 60 from the leading edge 103 to the rearward-most point 117 of the body 101.

The golf club head 100 defines a body height ($H_B$) of the golf club head 100, referring to a crown-to-sole dimension measured across the body 101. Referring to FIG. 3, the body height ($H_B$) can be measured as a vertical distance (parallel to the Y-axis 50) between the ground plane 10 and the body apex (BA). In many embodiments, the body height ($H_B$) can be measured according to a golf governing body such as the United States Golf Association (USGA).

The golf club head 100 defines a body width ($W_B$), referring to a heel-to-toe dimension measured across the body 101. Referring to FIGS. 3 and 9, the body width ($W_B$) can be measured parallel to the X-axis 40 from a body heel apex (BHA) to a body toe apex (BTA). The body toe apex (BTA) is defined as the toeward-most point of the body 101. The body heel apex (BHA) is heelward-most point of the heel end 104 that is located at a height 0.875 mm from the ground plane 10. In many embodiments, the body width ($W_B$) can be measured according to a golf governing body such as the United States Golf Association (USGA). The ranges specified for the body depth ($D_B$), body height ($H_B$), and body width ($W_B$) can be designed in accordance with the USGA regulations.

The golf club head 100 comprises a club head CG, referring to the point at which the mass is centered within the golf club head 100. The club head CG is illustrated in FIGS. 6 and 7.

The club head CG position can be described with respect to the primary coordinate system, wherein the club head CG position is characterized by locations along the X-axis 40, the Y-axis 50, and the Z-axis 60. The term "$CG_X$" can refer to the club head CG location along the X-axis 40, measured from the face center (FC). The term "CG height" can refer to the club head CG location along the Y-axis 50, measured from the face center (FC). The term "$CG_Y$" can be synonymous with the CG height. The term "CG depth" can refer to the club head CG location along the Z-axis 60, measured from the face center (FC). The term "$CG_Z$" can be synonymous with the CG depth. Alternatively, the club head CG position can be described with respect to the leading edge 103, the ground plane 10, or any other reference point, reference plane, or coordinate system.

The golf club head 100 further comprises a secondary coordinate system centered about the club head CG. As illustrated in FIGS. 6 and 7, the secondary coordinate system comprises an X'-axis 70, a Y'-axis 80, and a Z'-axis 90. The X'-axis 70 extends in a heel-to-toe direction. The X'-axis 70 is positive towards the heel end 104 and negative towards the toe end 106. The Y'-axis 80 extends in a sole-to-crown direction and is orthogonal to both the Z'-axis 90 and the X'-axis 70. The Y'-axis 80 is positive towards the crown 110 and negative towards the sole 112. The Z'-axis 90 extends front-to-rear, parallel to the ground plane 10 and is orthogonal to both the X'-axis 70 and the Y'-axis 80. The Z'-axis 90 is positive towards the strike face 102 and negative towards the rear end 111.

The golf club head 100 comprises one or more moment of inertia values (hereafter "club head MOI") with respect to the secondary coordinate system. The term "$I_{XX}$" can refer to the club head MOI measured about the X'-axis 70. The term "$I_{YY}$" can refer to the club head MOI measured about the Y'-axis 80. The term "$I_{ZZ}$" can refer to the club head MOI measured about the Z'-axis 90.

Figure 8:
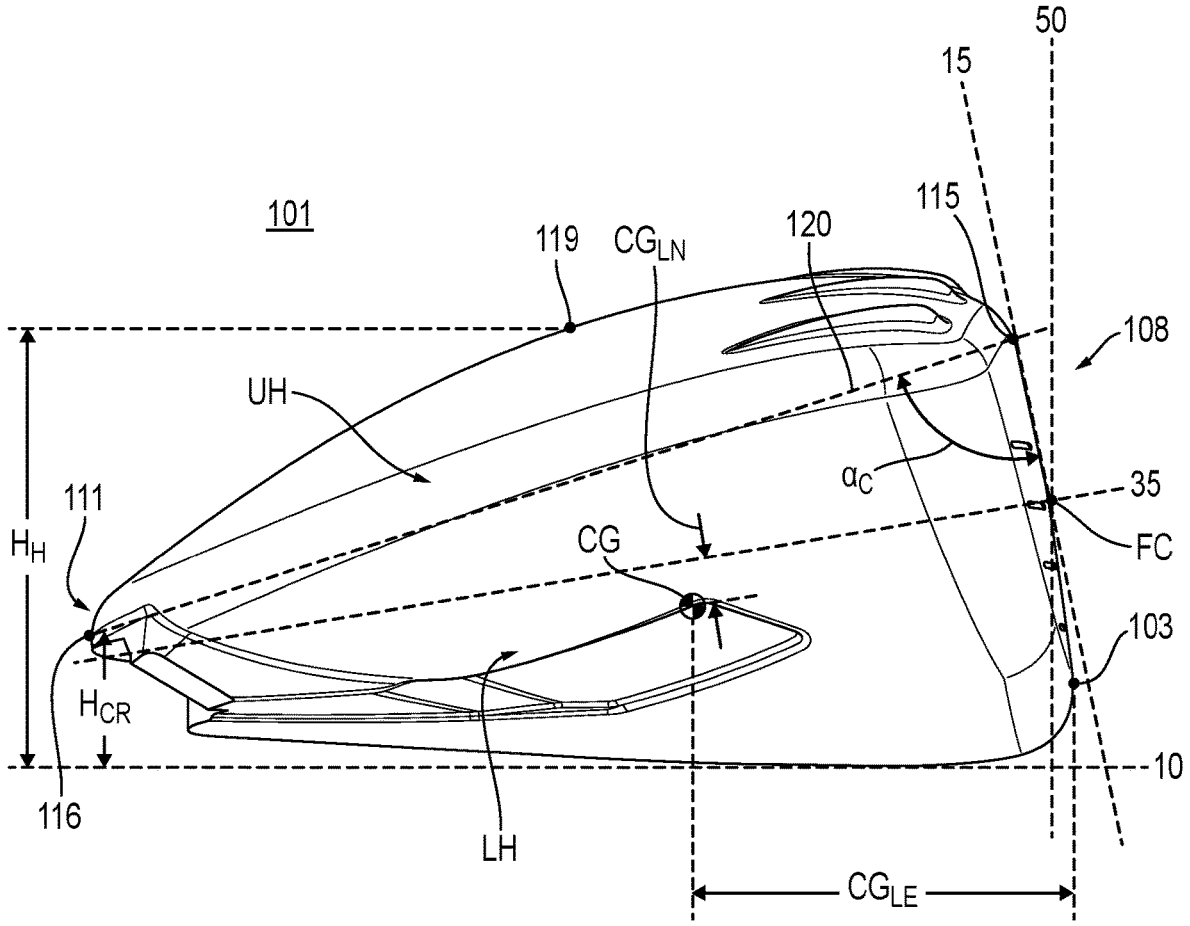
FIG. 8 illustrates a toe-side elevation view of the golf club head of FIG. 1, highlighting additional club head coordinate axes.

As illustrated in FIG. 8, the golf club head 100 further comprises a loft-normal axis 35 intersecting the face center (FC) and extending perfectly normal or substantially normal to the loft plane 15. As used herein, "substantially normal" in reference to the loft-normal axis 35 provides tolerance in the angle of the loft-normal axis 35 relative to the loft plane 15. Rather than being perfectly normal to the loft plane 15, in some embodiments, the loft-normal axis 35 can remain within the YZ plane but be tilted upward (i.e., toward the crown 110) about the face center (FC) by up to 4°. In some embodiments, the loft-normal axis 35 can be tilted by between 0.1 and 0.5, between 0.5° and 1.0°, between 1.0°, between 1.0° and 1.5°, between 1.5° and 2.0°, between 2.0° and 2.5°, between 2.5° and 3.0°, between 3.0° and 3.5°, or between 3.5° and 4.0° relative to a "perfectly normal" orientation (wherein the loft-normal axis 35 is tilted by 0°. The tolerance in the orientation of the loft-normal axis 35 accounts for frictional force that acts on the golf ball in a crown-to-sole direction parallel to the strike face 102 at impact.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being conducted in various ways.

DETAILED DESCRIPTION

Described herein are golf club heads that achieve high performance by improving and/or balancing physical properties and performance characteristics. The key performance characteristics, ball speed and forgiveness, are primarily driven by club head MOI and CG position. The golf club heads described herein achieve an $I_{YY}$ at or near the allowable limit, an $I_{XX}/I_{YY}$ ratio near 1, and a club head CG position that is centered about the club head perimeter and located at or near the loft-normal axis 35. The golf club head heads described herein create discretionary mass through one or more lightweight composite inserts and distribute said discretionary mass into a heavy weight member in an extreme rearward and soleward position, and/or a central mass pad at or near the Y'-axis. Additionally, ball speed can be driven by energy transfer between the strike face and the golf ball, which depends on the strike face height ($H_{SF}$) and thickness, and forgiveness can be driven by the strike face bulge and roll curvatures.

The golf club heads further achieve improved performance by balancing ball speed and forgiveness with properties and/or characteristics that influence the golfer's experience with the golf club head. Such properties and characteristics include aerodynamic properties that increase the player's swing speed and customizable CG, loft angle 20, and/or lie angle 25. While all of the physical properties and performance characteristics described herein contribute to performance, the MOI and CG properties described above are prioritized.

In particular, to achieve a high $I_{YY}$ value, the club head comprises a multi-material construction with a frame and one or more lightweight composite inserts. The composite inserts create discretionary mass that can be redistributed to the body perimeter to increase $I_{YY}$. The discretionary mass created by the lightweight composite inserts can also increase $I_{YY}$ by providing a club head CG centered relative to the body perimeter. In many embodiments, the multi-material construction of the golf club head can achieve an $I_{YY}$ greater than 5700 g-cm$^2$.

For a golf club head that is at or near the $I_{YY}$ limit, forgiveness can further be improved by increasing $I_{XX}$. However, such $I_{XX}$ improvements must be achieved without any further increase to $I_{YY}$. Overall forgiveness of the golf club head can be expressed by a ratio of Ixx relative to Iyy. An $I_{XX}/I_{YY}$ ratio of 1 would indicate that the MOI about the X'-axis 70 is equal to the MOI about the Y'-axis 80. Furthermore, where $I_{YY}$ is at the allowable limit, the maximum desirable $I_{XX}/I_{YY}$ ratio is 1 to conform with USGA limits on MOI. When balancing the $I_{XX}/I_{YY}$ ratio with other physical parameters, many of the golf club heads disclosed herein have an $I_{XX}/I_{YY}$ ratio between 0.77 and 1. The golf club head can comprise various features or characteristics that provide an $I_{XX}/I_{YY}$ ratio close to 1, including but not limited to the multi-material construction described above, a cube-like body shape, large body dimensions, a large club head volume, one or more heavy weight members coupled in a rearward and/or soleward portion of the body, one or more internal mass pads placed at strategic locations, and/or a mass distribution wherein between 5% and 15% of the golf club head mass is located within a central mass zone (CMZ) centered around the Y'-axis 80.

Ball speed is primarily driven by the efficiency with which the golf club head transfers force to the golf ball at impact. Force transfer can be improved by providing a club head CG position that is substantially along a loft-normal axis 35 extending normal to the loft plane 15 and tangent to the face center (FC). In many embodiments described herein, the golf club head comprises a club head CG that is located within 0.150 inch of the loft-normal axis 35. The golf club head can comprise various features or characteristics that provide a club head CG at or near the loft-normal axis 35, including but not limited to: the multi-material construction comprising one or more lightweight composite inserts, a heavy weight member located below the loft-normal axis 35, a face center height ($H_{FC}$) greater than 1.17 inches that raises the loft-normal axis 35, a face center height to body height ratio ($H_{FC}/H_B$) between 1.75 and 2.25, and/or one or more internal mass pads located below the club head CG.

The golf club heads described herein achieve an $I_{YY}$ at or near the allowable limit, an $I_{XX}/I_{YY}$ ratio near 1, and a club head CG position that is centered relative to the club head perimeter and located at or near the loft-normal axis 35, while balancing other properties and/or characteristics that further increase ball speed and forgiveness and/or influence the golfer's experience with the golf club head.

As described above, ball speed also depends on the energy transfer between the strike face and the golf ball at impact. Such energy transfer can be improved by providing a relatively short and thin strike face (hereafter a "shallow" strike face). The shallow strike face increases energy transfer and ball speed without exceeding Characteristic Time (hereafter "CT") limits imposed by the USGA. As disclosed herein, strike face energy transfer can be improved by providing a strike face height ($H_{SF}$) between 1.40 inches and 1.80 inches, an average strike face thickness between 0.085 inch and 0.110 inch.

The golf club head can further comprise a strike face with optimized bulge and roll curvatures to further increase forgiveness. The bulge and roll curvatures can be tailored to a specific golf club head based on physical properties of said golf club head, including $I_{XX}$, $I_{YY}$, CG position, and/or other club head properties and characteristics. The golf club head can satisfy one or more bulge radius or roll radius relationships to maximize distance and forgiveness. The bulge and roll radii of the present golf club head counteract the gearing effect imparted on the golf ball on an off-center strike. Providing bulge and roll radii as a function of the golf club head physical properties can increase forgiveness to provide a high-performing golf club head.

The aerodynamic properties of the golf club head affect the amount of wind resistance experienced as the player swings the golf club. Changing the overall shape of the club head, including crown and body geometries can reduce wind resistance, thereby improving the aerodynamic profile of the golf club head. In some embodiments, the crown can comprise one or more aerodynamic features, such as turbulators, that further reduce the drag force acting against the golf club head during the golf swing.

In many embodiments, the golf club head comprises an adjustable weighting system that provides CG adjustability. CG adjustability can correct shot bend (i.e., influencing the ball to go right or left) for players that tend to miss shots in one particular direction. The adjustable weighting system can include one or more weight members that can be secured to a plurality of discrete attachment points, wherein each attachment point provides a different club head CG position to promote different shot shapes. The adjustable weighting system can move the club head $CG_X$ position between 0.50 inch and 0.90 inch between discrete attachment points while providing less than 200 g-cm$^2$ in $I_{XX}$ and $I_{YY}$ drop off and less than 0.50 inch variability in $CG_Z$ location between weight positions. The golf club head can comprise various features and characteristics that provide such substantial club head $CG_X$ adjustability without sacrificing MOI, including, but not limited to an adjustable weight member greater than 30 grams, a weight member housing structure with a slot length less than 2.0 inches, and/or a distance between adjacent discrete attachment points less than 0.60 inch.

The golf club head designs described herein not only consider the above-referenced physical properties and performance characteristics individually, but also the relationships between these physical properties and performance characteristics. Doing so provides a holistic approach to driver-type golf club head design, wherein the complements and tradeoffs between various factors are balanced to achieve a high-performing club head. Relationships between these physical properties and performance characteristics are described in further detail below, as well as specific designs that balance all relevant factors to improve performance of the golf club head. Embodiments of the golf club heads described herein can be configured to achieve a balance of all the above-referenced physical properties and performance characteristics, or a subset thereof.

I. Physical Properties, Performance Characteristics, and Relationships Therebetween a. Moment of Inertia

The club head moment of inertia (hereafter "club head MOI") is a significant factor in providing a forgiving golf club head. Golf club heads, particularly driver-type golf club heads, are generally optimized for impacts at or near the face center (FC). A forgiving golf club head responds to off-center strikes (i.e., impacts between the club head and the golf ball that are located away from the face center (FC)) more like center strikes (i.e., impacts between the club head and that golf ball that are located at or near the face center (FC)). A more forgiving golf club head produces off-center strikes that act more similarly to a center strike than the off-center strikes of a less forgiving golf club head.

An off-center strike typically has less ball speed and accuracy. During an off-center strike, the impact force creates an angular acceleration that rotates the golf club head about the club head CG. Energy lost to the rotation of the golf club head, and its delivery to a golf ball, reduces the amount of energy transferred to the golf ball, thereby reducing ball speed. Further, golf club head rotation causes a "gearing effect," wherein the strike face imparts spin in a direction opposite the direction the strike face is rotating. Off-center strikes that are heelward or toeward of the face center (FC) will influence a sidespin gearing effect that causes the golf ball to curve left or right through the air. The sidespin gearing effect leads to golf shots that land away from the intended target line (i.e., shots that are "offline"). Off-center strikes that are crownward or soleward of the face center (FC) will influence a backspin gearing effect. The backspin gearing effect provides golf shots that have either too much or too little backspin. Golf shots with too much backspin tend to "balloon" up into the air rather than flying with a piercing forward trajectory. Golf shots with too little backspin tend to drop out of the air, because there is not enough spin to provide lift to the golf ball. The backspin gearing effect of a crownward or soleward strike therefore leads to a loss of distance. In many cases, an off-center strike occurs away from the face center (FC) in both the heel/toe direction and the crown/sole direction. Such golf shots experience both the sidespin gearing effect and the backspin gearing effect, leading to golf shots that are both offline and shorter.

As described above, the loss of ball speed and accuracy from off-center strikes are caused by the angular acceleration of the golf club head about the club head CG. A high-MOI club head resists such rotation to provide a more forgiving club that mitigates ball speed and accuracy losses from off-center strikes.

With respect to MOI, the golf club heads described improve performance by 1) maximizing $I_{YY}$ relative to the allowable limit and 2) achieving an $I_{XX}/I_{YY}$ ratio near 1. $I_{YY}$ depends on the distribution of mass relative to the Y'-axis 80. The one or more lightweight composite inserts, or any other mass-reducing structure described herein, creates discretionary mass that can be used in strategic locations throughout the club head, thereby improving MOI. Embodiments of said lightweight composite inserts and mass-saving structures are described in detail below.

The golf club head described herein places discretionary mass at the perimeter of the club head to maximize $I_{YY}$. In particular, mass can be removed from the club head midsection (MS), near the Y'-axis 80, and is relocated near the body perimeter. The multi-material golf club heads described herein can comprise sufficient perimeter weighting to achieve an $I_{YY}$ at or near the USGA limit. With the $I_{YY}$ at or near the USGA limit, the golf club head provides an increased $I_{XX}/I_{YY}$ ratio to further improve forgiveness. Doing so requires $I_{XX}$ to be increased without raising $I_{YY}$ over the allowable limit.

A golf club head can provide a high $I_{XX}/I_{YY}$ ratio in several ways. The golf club head can comprise a club head CG position that is substantially centered relative to the body perimeter, which centers the Y'-axis 80 relative to the body to naturally increase $I_{YY}$. Therefore, all the mass located near the body perimeter is more evenly distributed away from the Y'-axis 80. Centering the club head CG relative to the body perimeter means that less discretionary mass is required to increase perimeter weighting, allowing placement of extra discretionary mass in locations that provide an $I_{XX}/I_{YY}$ ratio close to 1. In many prior art golf club heads, the club head CG is positioned substantially forward of the club head perimetrical centroid (PC). Removing mass from the front of the golf club head and adding mass to the rear moves the CG rearward thereby centering the CG about the body perimeter and increasing the club head $I_{XX}/I_{YY}$ ratio.

Further, placing discretionary mass near the Y'-axis 80 improves the $I_{XX}/I_{YY}$ ratio. In a prior-art club head with a club head CG that is not centered relative to the body perimeter, all available discretionary mass is typically placed as far away from the Y'-axis 80 as possible to maximize $I_{YY}$. The present golf club head, which provides an advantageous club head CG position centered relative to the body perimeter has extra discretionary mass (i.e., discretionary mass that is not needed to maximize $I_{YY}$) available to place in strategic locations that contribute to $I_{XX}$ without significantly contributing to $I_{YY}$. The golf club head adds discretionary mass to locations that are near the Y'-axis 80 and spaced from the X'-axis 70. In many embodiments, the extra discretionary mass can be reintroduced in a central portion of the crown or sole.

Further, a cube-like body shape of the golf club head can improve the $I_{XX}/I_{YY}$ ratio. As used herein, a "cube-like" body shape means the body height ($H_B$) is a substantial proportion of the body width ($W_B$) and body depth ($D_B$). The body shape dictates where the club head mass can be placed. A cube-like profile spaces the masses of the crown and sole further from the X'-axis 70, while the positions of these masses relative to the Y'-axis 80 remain unchanged. Therefore, the masses of the crown and the sole increases $I_{XX}$ without increasing $I_{YY}$.

b. Force Transfer

The launch characteristics (i.e., ball speed, launch angle, spin rate, etc.) of the golf ball at impact are dependent on the force transfer between the golf club head and the golf ball. The club head CG position relative to the geometry of the golf club head determines how efficient the force transfer will be. As described above, the golf club head comprises a loft-normal axis 35. The loft-normal axis 35 determines an optimal club head CG position for force transfer. The launch characteristics of a golf ball are dependent on the relationship between the loft-normal axis 35 and the club head CG. To optimize force transfer, it is desirable for the club head CG to be located on or near the loft-normal axis 35. The closer the club head CG is to the loft-normal axis 35, the more efficient the force transfer between the golf club head and the golf ball at impact.

The face center (FC) represents the average and/or target impact location for a golf shot. Because the loft-normal axis 35 extends normal to the loft plane 15, a club head CG located on the loft-normal axis 35 will project directly onto the face center (FC), and the impact force will be transferred along a vector that is substantially normal to the strike face (i.e., in the shot direction). Conversely, a club head CG located away from the loft-normal axis 35 will project on to the strike face at a location away from the face center (FC). In this case, a center strike will impart side force vectors that expend energy in directions other than the shot direction, thereby reducing force transfer efficiency. Further, the side vectors can impart excessive spin on the ball in the side direction, or the up/down direction. If the club head CG is located above the loft-normal axis 35, a center strike will impart a backspin gearing effect on the golf ball. If the club head CG is located below the loft-normal axis 35, a center strike will impart a topspin gearing effect on the golf ball.

According to certain aspects of this disclosure, the club head CG is positioned at or near the loft-normal axis 35 to maximize the force transfer along the shot direction and minimize the force lost to side vectors. Positioning the club head CG close to the loft-normal axis 35 improves launch characteristics (i.e., high ball speeds, a desirable launch angle that produces a piercing trajectory, and a spin rate that provides lift to the golf ball without the ball ballooning into the air). All of these factors produce golf shots with improved distance. Further, the launch characteristics remain substantially consistent as long as the distance between the club head CG and the loft-normal axis 35 is constant, even if the club head CG moves relative to the rest of the golf club head.

The club head comprises a CG that is lowered toward the loft-normal axis 35. The club head CG position can be lowered relative to the loft-normal axis 35 by distributing a large amount of mass in the lower hemisphere (LH) (defined above as the portion of the golf club head below a plane defined by the loft-normal axis 35). The club head CG position can also be lowered relative to the loft-normal axis 35 by raising the face center (FC) relative to the body height ($H_B$). Raising the face center (FC) inherently raises the loft-normal axis 35 relative to the body and relative to the ground plane 10. As such, the club head CG does not need to be lowered as far (relative to the ground plane 10) to reach the loft-normal axis 35. Further, raising the loft-normal axis 35 relative to the body inherently places more of the club head mass and volume in the lower hemisphere (LH), thereby improving alignment between the club head CG and the loft-normal axis 35.

The club head balances club head CG position and MOI. A club head CG position at or near the loft-normal axis 35 is noncomplementary to a high $I_{XX}/I_{YY}$ ratio. As described above, moving the club head CG rearward, toward the perimetrical centroid (PC), increases the $I_{XX}/I_{YY}$ ratio. The further rearward the club head CG is moved, the more difficult it becomes to keep the club head CG near the loft-normal axis 35, because the loft-normal axis 35 is angled such that it is lower toward the rear end of the golf club head. The further rearward the club head CG is, the lower the club head CG must be relative to the ground plane 10 in order to remain proximate the loft-normal axis 35. The golf club head balances force transfer and club head MOI by moving the club head CG rearward toward the perimetrical centroid (PC), without moving the club head CG too far rearward, which would make it increasingly difficult for the club head CG to be lowered to the loft-normal axis 35.

Further, a cube-like body shape, as described above, increases $I_{XX}/I_{YY}$. However, a cube-like body shape increases body height ($H_B$) and therefore places a significant amount of mass in crownward and/or rearward portions of the golf club head. A cube-like body shape therefore raises the location of club head CG above the loft-normal axis 35. Concentrating mass in the lower hemisphere (LH), such as by mass pads and/or weight members, lowers the club head CG, thereby mitigating the upward shift due to the cube-like body shape.

c. Strike Face Energy Transfer

The ball speed at impact is highly dependent on the energy transferred between the strike face and the golf ball. The energy transfer between the strike face and the golf ball is related to the ability of the strike face to bend or flex at impact. The strike face can be analogous to a drum surface or a trampoline. In general, the larger and thinner the strike face, the greater the strike face can flex and the more ball speed is generated. However, the flexure of the strike face is limited by USGA conformance limits placed on CT values.

The golf club head comprises a strike face with a substantially short strike face height ($H_{SF}$) and a reduced strike face thickness (hereafter referred to as a "shallow" strike face), which provides an increased ball speed while maintaining a conforming CT value. Adjusting both the strike face height ($H_{SF}$) and the strike face thickness affects the ball speed and CT value of the golf club head. Specifically, reducing the strike face height will decrease ball speed and decrease CT and reducing the strike face thickness will increase ball speed and CT. However, the change in face thickness provides a greater ball speed increase relative to the increase in CT value than adjusting the face height ($H_{SF}$). As such, reducing the strike face height ($H_{SF}$) allows the strike face thickness to be reduced, thereby resulting in a net increase in ball speed for the same CT value.

The golf club head balances providing a shallow strike face with maximizing $I_{YY}$, maximizing the $I_{XX}/I_{YY}$ ratio, and providing a club head CG position at or near the loft-normal axis 35. Regarding MOI, providing a shallow strike face is primarily noncomplementary to improving the $I_{XX}/I_{YY}$ ratio. Reducing the strike face height ($H_{SF}$) influences a shorter body height ($H_B$). Therefore, providing a shallow strike face makes it more difficult to simultaneously achieve a cube-like body shape. However, the shallow strike face does have discretionary mass benefits. The shallow face increases discretionary mass by reducing the strike face height ($H_{SF}$) and the strike face thickness dimensions, thereby requiring less material to form the strike face. The mass saved from these adjustments can be reallocated to adjust the club head CG more rearward to improve the club head MOI and other mass properties, as described above. For example, the mass saved by providing a shallow strike face (as described above) can be utilized to maximize the $I_{YY}$ according to the limit set out by the USGA, and/or to improve the $I_{XX}/I_{YY}$ ratio, according to aspects of the present invention.

Providing a shallow strike face is also noncomplementary to optimizing the club head force transfer, because shortening the strike face height ($H_{SF}$) generally influences a lower face center (FC) Because the loft-normal axis 35 is defined by the face center (FC), lowering the face center (FC) also lowers the loft-normal axis 35. As such, it can become more difficult to provide a club head CG position at or near the loft-normal axis 35. As discussed in further detail below, the club head can comprise a shallow strike face while retaining a tall face center height ($H_{FC}$). An increased strike face height to face center height ratio ($H_{SF}/H_{FC}$) mitigates this adverse effect of a shallow face on the club head CG position.

d. Aerodynamics

Aerodynamic characteristics also affect golf club head performance. A more aerodynamic golf club head will allow the user to swing the golf club faster, thereby increasing ball speed and distance. When air flows around a golf club head during a golf swing, a wake, or an area of disturbed air flow, is formed behind the club head. In many cases, the wake creates a drag force on the golf club head, thereby slowing the speed of the golf club head throughout the swing. The body shape, especially in the crown, influences the aerodynamic characteristics of the golf club head by changing the air flow and wake profiles around the golf club head, as well as the overall air resistance working against the golf club head throughout the swing. In general, drag force is reduced when the flow remains attached to the body longer, such that flow separates as close to the rear of the golf club head as possible, rather than towards the front of the golf club head.

The golf club head has an improved aerodynamic profile and reduced drag. Primarily, the golf club head comprises one or more aerodynamic features on the crown, such as turbulators (described in detail below) to control the air flow over the crown. In particular, such aerodynamic features can cause the flow to "trip" from laminar to turbulent immediately or shortly after transitioning to the crown, so that the flow remains attached to the crown longer. Aerodynamic features influence the optimal aerodynamic crown profile. A shallow crown angle ($\alpha_C$) (i.e., at or near 90°) is optimal for a golf club head devoid of aerodynamic features, because a shallow crown angle ($\alpha_C$) promotes laminar flow attachment. A steeper crown angle ($\alpha_C$) (i.e., less than approximately 80°) is optimal for a golf club head including aerodynamic features, because a steeper crown angle ($\alpha_C$) promotes turbulent flow attachment. However, flow attachment is diminished by too steep of a crown angle ($\alpha_C$) (i.e., less than approximately 60°) The golf club head combines aerodynamic features with a steep crown angle ($\alpha_C$) within an optimal range. The body can also have a gradual or elongated transition between the strike face and the crown. In general, the combination of aerodynamic features (such as turbulators), a steep crown angle ($\alpha_C$), and a gradual transition between the strike face and the crown delays flow separation. Finally, the body can be provided with a substantially great body depth ($D_B$). An increased body depth ($D_B$) allows the body height ($H_B$) to decrease gradually towards the rear of the golf club head, providing a flatter crown angle ($\alpha_C$) and promoting flow attachment.

The aerodynamic characteristics of the golf club head are balanced with other physical properties, such as improved club head CG position at or near the loft-normal axis 35, maximizing $I_{YY}$, providing an $I_{XX}/I_{YY}$ ratio close to 1, and providing a shallow strike face, as described above. A high-MOI club head that comprises an $I_{YY}$ near the allowable USGA limit typically entails providing a large volume golf club head with maximized body dimensions. Such a large golf club head provides a large surface area that increases air resistance during the golf swing. Improving the aerodynamic characteristics of the golf club head is, however, generally complementary to providing an $I_{XX}/I_{YY}$ ratio close to 1. As described above, a cube-like body shape is conducive to providing an $I_{XX}/I_{YY}$ ratio close to 1. A cube-like body shape also promotes a crown angle ($\alpha_C$) within the optimal range, thereby promoting flow attachment.

The aerodynamic crown profile described above is generally non-complementary to providing a club head CG position at or near the loft-normal axis 35. The optimal aerodynamic crown angle ($\alpha_C$) for a golf club head comprising aerodynamic features places a significant amount of mass in crownward and/or rearward portions of the golf club head, thereby raising the club head CG away from the loft-normal axis 35. The aerodynamic features described herein, such as turbulators, allow for a steeper crown angle ($\alpha_C$). While such aerodynamic features introduce mass on the crown, their effect on the club head CG is typically negligible. In some cases, the club head CG position can be prioritized over an aerodynamic crown angle ($\alpha_C$), because the aerodynamic features can provide sufficient reduction in drag.

Gradual transitions between the strike face and the crown can complement energy transfer between the strike face and the golf ball. A more gradual transition between the strike face and the crown permits a shorter strike face height ($H_{SF}$). A short strike face height ($H_{SF}$) also complements the aerodynamic characteristics by reducing the projected area of the front of the golf club head, thereby reducing the air resistance during the golf swing.

e. CG Adjustability

In many cases, it may be desirable for the club head CG position to be adjustable. Adjusting the club head CG position can correct shot bend (i.e., influencing the ball to go right or left) for players that tend to miss shots in one particular direction. Generally, every 0.01 inch of $CG_X$ movement corrects approximately 1 yard of shot bend for a driver impact imparting a ball speed of a 150 mph. In general, it can be desirable to correct up to 3-10 yards of shot bend in either direction along the X-axis 40. An adjustable club head CG position can also allow the club head CG location to be aligned with the typical impact position for players that tend to hit the ball on one side of the strike face, rather than near face center (FC). In such cases, aligning the $CG_X$ position with the player's typical impact location can increase the player's average ball speed.

Typically, an adjustable weighting system is used to adjust club head CG, whereby a weight member (or multiple weight members) can be moved to different locations and/or configurations along the body. However, these systems generally have two main disadvantages. Adjustable weighting systems require weight housing structures to support the weight member. Larger weight housing structures require additional structural mass, thereby reducing the amount of discretionary mass available to increase MOI or improve other physical properties and/or performance characteristics. Further, as described above, moving the club head CG rearward to reach the perimetrical centroid (PC) is desirable for improving club head MOI. As such, it can be desirable to place the weight member at a rearward location along the body perimeter. However, due to the curved nature of the body perimeter, moving the weight member in the X-axis 40 direction requires moving the weight member along an arc substantially following the body perimeter. Following said arc, moving the weight member in the X-axis 40 direction (hereafter "$CG_X$ movement") also moves the weight member forward in the Z-axis 60 direction, thereby moving the club head CG forward and reducing club head MOI. For an adjustable weighting system located on the body perimeter, the further the weight member moves in the X-axis 40 direction, the further forward the weight member moves in the Z-axis 60 direction. To allow for the desired $CG_X$ movement, the adjustable weight system must either comprise a heavy weight member that moves a small distance along a short arc, or a lighter weight member that moves a large distance along a longer arc.

In many embodiments, the golf club head has an adjustable club head CG, while retaining club head CG position at or near the loft-normal axis 35 and maintaining a high club head MOI at all weight member configurations. In many embodiments, the golf club head comprises an adjustable weighting system with a substantially heavy weight member located in an extreme rearward and soleward location on the golf club head and disposed within a small-arced weight housing structure. Providing a heavy weight member allows for significant $CG_X$ movement without requiring significant weight member movement in the X-axis 40 direction. In comparison to a weighting system comprising a lighter weight member the heavy weight member allows for adjustment along a relatively smaller arc to achieve the same club head $CG_X$ adjustability. This allows the weight member to be housed within a substantially small-arced housing structure and retain an extreme rearward position even at different adjustment locations.

The golf club head balances club head CG adjustability with the other physical properties described herein. As described above, the heavy weight member and small-arced housing structure mitigates the adverse effects on club head MOI and club head CG position. The extreme rearward and soleward position of the weight member is beneficial in providing an $I_{XX}/I_{YY}$ ratio close to 1. Providing a heavy weight at an extreme rearward position moves the club head CG rearward and towards the perimetrical centroid (PC). The extreme rearward position of the weight member also distributes a large amount of discretionary mass far away from both the X-axis 40 and the Y-axis 50. The extreme soleward position of the weight member improves the $I_{XX}/I_{YY}$ ratio by distributing a large amount of discretionary mass away from the X-axis 40, thereby increasing $I_{XX}$ without increasing $I_{YY}$. Further, the extreme soleward position of the weight member helps to lower the club head CG toward the loft-normal axis 35. A significant portion of the club head's discretionary mass created by the one or more lightweight composite inserts, or any other mass-saving structures described herein can be used in the weight member. There are no particular tradeoffs for maximizing the mass of the weight member, given that that $I_{YY}$ does not exceed the allowable limit.

f. Bulge and Roll

The bulge and roll curvatures of the golf club head influence performance by further increasing club head forgiveness. The golf club head is provided with bulge and roll curvatures to counteract the gearing effect (described above) imparted on the golf ball by an off-center strike. The bulge curvature provides forgiveness for mishits that are toeward and heelward of the face center (FC). For a toeward mishit, the gearing sidespin causes the golf ball to draw in a toeward to heelward direction. Conversely, for a heelward mishit, the gearing sidespin causes the golf ball to fade in a heelward to toeward direction. The bulge curvature counteracts the effects of the gearing sidespin by 1) altering the starting direction of the golf shot and 2) mitigating the severity of the gearing effect.

The bulge curvature imparts a sidespin influence on the golf ball in the opposite direction of the gearing sidespin effect by creating an oblique contact between the golf ball and the strike face on heelward and toeward mishits. The bulge curvature orients points on the toe side of the strike face toeward of face center (FC), causing the ball to start offline in the toeward direction to counteract the draw sidespin gearing effect associated with a toeward mishit. The oblique contact provides a fade sidespin influence on toeward mishits that counteracts the draw gearing sidespin effect associated with the rotation of the golf club head on toeward mishits. The bulge curvature also angles orients on the heel side of the strike face heelward of face center (FC), causing the ball to start offline in the heelward direction to counteract the fade sidespin gearing effect associated with a heelward mishit. The oblique contact provides a draw sidespin influence on heelward mishits that counteracts the fade gearing sidespin effect associated with the rotation of the golf club head on heelward mishits. The bulge curvature thereby helps normalize the sidespin imparted on the golf ball on heelward and toeward mishits.

The roll curvature provides forgiveness for crownward and soleward mishits. For a crownward mishit, the gearing effect reduces the backspin of the golf ball. Conversely, for a soleward mishit, the gearing effect increases the backspin of the golf ball. The roll curvature counteracts the gearing effect on backspin by 1) altering the launch angle of the golf shot and 2) mitigating the severity of the gearing effect.

Regarding the launch angle of the golf shot, the roll curvature orients points above the face center (FC) crownward, causing the ball to launch higher. The higher launch angle counteracts the loss in backspin caused by the gearing effect associated with a crownward mishit. Golf shots with less backspin do not lift into the air as much as high backspin golf shots. The increased launch angle helps the ball stay in the air longer on crownward mishits, despite the loss in backspin, thereby increasing distance. Additionally, the roll curvature angles points below the face center (FC) soleward, causing the ball to launch lower. The lower launch counteracts the increase in backspin caused by the gearing effect associated with a soleward mishit. Because higher backspin golf shots lift into the air more than low backspin golf shots, the decreased launch angle prevents the ball from ballooning too high into the air and losing distance.

Regarding the severity of the gearing effect, the roll curvature imparts a backspin or topspin influence on the golf ball in the opposite direction of the gearing backspin effect. The roll curvature creates an oblique contact between the golf ball and the strike face on crownward and toeward mishits. The oblique contact provides a backspin influence on crownward mishits that counteracts the topspin gearing effect associated with the rotation of the club head on crownward mishits. Additionally, the oblique contact provides a topspin influence on soleward mishits that counteracts the backspin gearing effect associated with the rotation of the club head on soleward mishits. The roll curvature thereby helps normalize the backspin imparted on the golf ball on crownward and soleward mishits.

The bulge and roll curvatures can be specifically tailored based on properties of said golf club head, including $I_{XX}$, $I_{YY}$, club head CG position, and/or other golf club head properties or characteristics. The present golf club head can satisfy one or more bulge radius or roll radius relationships to maximize distance and forgiveness. The MOI and CG position each influence the amount of rotation at impact and gearing effect for mishits. Therefore, each characteristic must be factored into determining the optimal bulge and roll curvatures for a particular golf club head. A higher club head MOI translates to less twisting, decreasing the gearing effect and permitting flatter bulge and roll curvatures. If the bulge and roll curvatures are too tight on a high-MOI golf club head, the gearing effect may be overcorrected, leading to a loss in accuracy and/or distance. Tighter bulge and roll curvatures are optimal for golf club heads with further rearward CG positions. If the bulge and roll curvatures are too flat on a golf club head with a substantially rearward club head CG position, the gearing effect will not be sufficiently corrected, leading to a loss in accuracy and/or distance. For a given club head MOI and CG position, the optimal bulge and roll curvatures balance the start line, launch angle, and gearing effect, providing the correct amount of sidespin and backspin to maintain both accuracy and distance on mishits.

Optimized bulge and roll curvatures counteract the gearing effect imparted on the golf ball on an off-center strike. Providing bulge and roll curvatures as a function of the golf club head characteristics can increase forgiveness and distance to provide a higher-performing golf club head. As described above, the optimal bulge and roll curvatures for a given golf club head are determined by the club head MOI, and the club head CG position. However, providing optimal bulge and roll curvatures corresponding to the golf MOI and CG position ranges associated with the present invention does not significantly affect the other physical properties or performance characteristics discussed herein. Therefore, providing optimal bulge and roll curvatures can be accomplished without any adverse effects to the other physical properties or performance characteristics described herein.

II. Structures Producing High-Performing Club Head

As discussed above, the club heads described herein comprise various structures achieve an $I_{YY}$ at or near the allowable limit, an $I_{XX}/I_{YY}$ ratio near 1, and a club head CG position that is centered relative to the club head perimeter and located at or near the loft-normal axis 35, while balancing other properties and/or characteristics that further increase ball speed and forgiveness and/or influence the golfer's experience with the golf club head. The complementary and adverse effects between different physical properties and/or performance characteristics are considered and factored into the values and ranges relating to any dimensions, geometries, or structures described herein. Certain physical property ranges disclosed herein may not necessarily be individually for every performance characteristic, particularly for noncomplementary properties and/or characteristics. Generally, the designs prioritize the MOI and CG properties listed above and holistically balance all properties and characteristics.

a. General Club Head Structures i. Body Shape

The golf club heads describe herein comprise a body shape that balances key performance characteristics. Specifically, the body shape significantly affects the club head MOI, CG position, strike face energy transfer, and aerodynamic properties. The golf club heads described herein comprise a body shape that considers the relationships between all key performance characteristics and balances said characteristics to provide a high-performing golf club head. FIGS. 1-11 are used to illustrate the various body shapes. The body shapes discussed below are demonstrated on the golf club head 100. For ease of discussion, the body shape characteristics shown on the golf club head 100 are applicable to various embodiments of the club head according to the present invention. Any one or more of the body shape characteristics described in the various embodiments below can be used in combination with one another.

A. General Body Dimensions

As described above, in some embodiments, the golf club head 100 can comprise a body 101 with a cube-like shape that balances the club head MOI, CG, strike face energy transfer, and aerodynamics. As described above, a cube-like shape, wherein the body height ($H_B$) is a substantial proportion of both the body width ($W_B$) and the body depth ($D_B$), helps maximize the $I_{XX}/I_{YY}$ ratio and provides a more aerodynamic crown shape. However, the cube-like shape can make it more difficult to achieve other desired physical properties, such as positioning the club head CG at or near the loft-normal axis 35 and providing a short and thin strike face 102.

The club head of the present invention may comprise a body height ($H_B$) that is a substantial proportion of the body width ($W_B$) and the body depth ($D_B$). Compared to the prior art, the cube-like body dimensions can be achieved by increasing the body height ($H_B$), relative to the body width ($W_B$) and body depth ($D_B$). Referring to FIG. 3, the golf club head 100 can comprise a body height ($H_B$) between 2.0 inches and 3.0 inches. In some embodiments, the body height ($H_B$) can be between 2.0 inches and 2.1 inches, 2.1 inches and 2.2 inches, 2.2 inches and 2.3 inches, 2.3 inches and 2.4 inches, 2.4 inches and 2.5 inches, 2.5 inches and 2.6 inches, 2.6 inches and 2.7 inches, 2.7 inches and 2.8 inches, 2.8 inches and 2.9 inches, or between 2.9 inches and 3.0 inches. The body height ($H_B$) ranges described above are specifically provided to balance the club head MOI, CG position, face height, and aerodynamic characteristics. If the body height ($H_B$) is too short (i.e., lower than the ranges provided), the crown and sole mass are not spaced sufficiently far from the X'-axis 70 to provide a cube-like shape that provides an $I_{XX}/I_{YY}$ ratio close to 1. Further, if the body height ($H_B$) is too tall (i.e., higher than the ranges provided), the mass of the crown 110 can raise the club head CG too far away from the loft-normal axis 35. Further, if the body height ($H_B$) is too tall, the face height ($H_{SF}$) can become too tall, leading to ball speed losses.

Referring to FIGS. 3 and 9, the golf club head 100 can further comprise a body width ($W_B$) between 4.4 inches and 5.0 inches. In some embodiments, the body width ($W_B$) can be between 4.4 inches and 4.6 inches, 4.6 inches and 4.8 inches, or between 4.8 inches and 5.0 inches. In some embodiments, the body width ($W_B$) can be less than 5.0 inches, 4.8 inches, or less than 4.6 inches. In general, the body width ($W_B$) is maximized to naturally increase the club head MOI.

Referring to FIGS. 7 and 9, the golf club head 100 can further comprise a body depth ($D_B$) between 4.4 inches and 5.0 inches. In some embodiments, the body depth ($D_B$) can be between 4.4 inches and 4.6 inches, 4.6 inches and 4.8 inches, or between 4.8 inches and 5.0 inches. In some embodiments, the body depth ($D_B$) can be less than 5.0 inches, 4.8 inches, or less than 4.6 inches. In many low-MOI embodiments, the body depth ($D_B$) can be substantially narrow relative to the body depth ($D_B$) of a prior art golf club head. In general, the body depth ($D_B$) is maximized to naturally increase club head MOI. Further, as discussed above, maximizing the body depth ($D_B$) promotes a more aerodynamic crown angle.

The cube-like shape of the body 101 can be characterized by a $H_B/W_B$ ratio defined as the body height ($H_B$) divided by the body width ($W_B$). In many embodiments, the $H_B/W_B$ ratio can be between 0.50 and 0.75. In some embodiments, the $H_B/W_B$ ratio can be between 0.50 and 0.55, 0.55 and 0.60, 0.60 and 0.65, 0.65 and 0.70, or between 0.70 and 0.75. Similarly, the cube-like shape of the body 101 can be characterized by a $H_B/D_B$ ratio defined as the body height ($H_B$) divided by the body depth ($D_B$). In many embodiments, the $H_B/D_B$ ratio can be between 0.50 and 0.75. In some embodiments, the $H_B/D_B$ ratio can be between 0.50 and 0.55, 0.55 and 0.60, 0.60 and 0.65, 0.65 and 0.70, or between 0.70 and 0.75. By providing a high $H_B/W_B$ ratio and/or a high $H_B/Ds$ ratio, the golf club head 100 is provided with a cube-like body shape that spaces the crown and sole mass away from the X'-axis 70 and near the Y'-axis 80, thereby influencing a higher $I_{XX}/I_{YY}$ ratio.

B. Shallow Face

As discussed above, the golf club heads described herein can comprise a shallow strike face 102, comprising a substantially short face height ($H_{SF}$) and a reduced strike face thickness, within the ranges disclosed below. As described above, the shallow strike face 102 provides increased ball speed within the allowable CT limits.

The general structures of the shallow strike face 102 discussed herein can be substantially similar to those found in U.S. patent application Ser. No. 18/450,359 filed Aug. 15, 2023, which is incorporated herein in entirety. As illustrated in FIGS. 3 and 4, the strike face height ($H_{SF}$), as described above, is measured as the distance between the face nadir (FN) and the face apex (FA) in the YZ plane, parallel to the loft plane 15.

In many embodiments, the strike face height ($H_{SF}$) is between 1.40 inches and 1.80 inches. In some embodiments, the strike face height ($H_{SF}$) is between 1.40 inches and 1.45 inches, 1.45 inches and 1.50 inches, 1.50 inches and 1.55 inches, 1.55 inches and 1.60 inches, 1.60 inches and 1.65 inches, 1.65 inches and 1.70 inches, 1.70 inches and 1.75 inches, or 1.75 inches and 1.80 inches. Further, in some embodiments, the strike face height ($H_{SF}$) can be less than 1.80 inches, 1.78 inches, 1.76 inches, 1.74 inches, 1.72 inches, 1.70 inches, 1.68 inches, 1.66 inches, 1.64 inches, 1.62 inches, 1.60 inches, 1.58 inches, 1.54 inches, 1.52 inches, 1.50 inches, 1.48 inches, 1.46 inches, 1.44 inches, 1.42 inches, or less than 1.40 inches. In other embodiments, the strike face height ($H_{SF}$) can be between 1.73 inches and 1.62 inches. The strike face height ($H_{SF}$) ranges described above are specifically provided to balance club head MOI, CG position, strike face energy transfer, and aerodynamic characteristics. If the strike face height ($H_{SF}$) is too short (i.e., lower than the ranges provided), club head durability will become diminished as, in order to preserve ball speed, the strike face thickness would need to be reduced to a point that the strike face 102 would be unable withstand impact stresses. If the strike face height ($H_{SF}$) is too tall (i.e., greater than the ranges provided), the strike face thickness would need to be increased to a point where ball speed is diminished. Further, if the strike face height ($H_{SF}$) is too tall, the club head MOI and CG position will be negatively affected due to the increase in mass needed to create a larger and thicker strike face.

The strike face height ($H_{SF}$) can be reduced by decreasing the distance between the face apex (FA) and face nadir (FN). This can be done in several ways. For example, the strike face height ($H_{SF}$) can be reduced by reducing the height of the face apex (FA) without adjusting the height of the face nadir (FN). Alternatively, the strike face height ($H_{SF}$) can be reduced by reducing the height of the face nadir (FN) without adjusting the height of the face apex (FA). Further, the strike face height ($H_{SF}$) can be reduced by simultaneously adjusting both the face nadir (FN) and face apex (FA) heights.

Although the strike face height ($H_{SF}$) may be reduced by any of the above-described methods, the location of the face center (FC) must be considered. As described above, if the club head CG is moved further away from the loft-normal axis 35, the force transfer effectiveness is reduced, and performance lost. The location of the face center (FC), specifically the face center height ($H_{FC}$), may be changed when the strike face height ($H_{SF}$) is reduced. If lowering the strike face height ($H_{SF}$) causes the face center height ($H_{SF}$) to be reduced, performance can be negatively affected. Reducing the face center height ($H_{SF}$) lowers the loft-normal axis 35, thereby making it more difficult to provide a club head CG position at or near the loft-normal axis. Therefore, the strike face height ($H_{SF}$) must be reduced in a way that does not also reduce the face center height ($H_{SF}$).

Raising the face nadir height ($H_{FN}$) combats any potential negative effects of adjusting the strike face height ($H_{SF}$), by raising the face center height ($H_{FC}$). The face nadir height ($H_{FN}$) is the perpendicular distance from the ground plane 10 to the face nadir (FN). Raising the face nadir (FN) while reducing the strike face height ($H_{SF}$) provides an improved face center (FC) location so that the loft-normal axis 35 is better aligned with the club head CG to improve force transfer.

Referring to FIGS. 3 and 5, the face nadir height ($H_{FN}$) can be between 0.35 inch and 0.45 inch. In some embodiments, the face nadir height ($H_{FN}$) can be between 0.35 inch and 0.37 inch, 0.36 inch and 0.38 inch, 0.37 inch and 0.39 inch, 0.38 inch and 0.39 inch, 0.39 inch and 0.41 inch, 0.40 inch and 0.43 inch, or 0.42 inch and 0.45 inch. In some embodiments, the face nadir height ($H_{FN}$) can be greater than 0.35 inch, 0.36 inch, 0.37 inch, 0.38 inch, 0.39 inch, 0.40 inch, 0.41 inch, 0.42 inch, 0.43 inch, or greater than 0.44 inch. The face nadir height ($H_{FN}$) ranges described above are specifically provided to balance club head CG position, strike face energy transfer, and aerodynamic characteristics. As described above, if the face nadir height ($H_{FN}$) is too short (i.e., lower than the ranges provided), the face center (FC) and loft-normal axis 35 will be lowered. When the loft-normal axis 35 drops, the club head CG location will be too far crownward of the loft-normal axis 35 and negatively affect force transfer performance. Similarly, if the face nadir height ($H_{FN}$) is too large (i.e., greater than the ranges provided), then the loft-normal axis 35 will be raised and the club head CG will be too far soleward of the loft-normal axis 35 and negatively affect force transfer performance.

Referring to FIGS. 3 and 5, the face center height ($H_{FC}$) can be between 1.17 inches and 1.40 inches. In some embodiments, the face center height ($H_{FC}$) can be between 1.17 inches and 1.19 inches, 1.19 inches and 1.21 inches, 1.21 and 1.23 inches, 1.23 and 1.25 inches, 1.25 inches and 1.27 inches, 1.27 inches and 1.29 inches, 1.29 and 1.31 inches, 1.31 inches and 1.33 inches, 1.33 inches and 1.35 inches, 1.35 inches and 1.37 inches, 1.37 inches and 1.39 inches, or between 1.39 inches and 1.40 inches. In some embodiments, the face center height ($H_{FC}$) can be greater than 1.17 inches, 1.19 inches, 1.21 inches, 1.22 inches, 1.23 inches, 1.24 inches, 1.25 inches. 1.26 inches, 1.27 inches, 1.28 inches, 1.29 inches, 1.30 inches, 1.31 inches, 1.32 inches, 1.33 inches, 1.34 inches, 1.35 inches, 1.36 inches, 1.37 inches, 1.38 inches, or greater than 1.39 inches. The face center height ($H_{FC}$) ranges described above are specifically provided to balance club head CG positions relative to the loft-normal axis 35. If the face center height ($H_{FC}$) is too small (i.e., lower than the ranges provided), then the CG will be too far crownward of the loft-normal axis 35 and impart undesired spin on impact and negatively affect the force transfer. Similarly, if the face center height ($H_{FC}$) is too large (i.e., greater than the ranges provide), then the CG will be too far below the loft-normal axis 35 and impart undesired spin on impact and negatively affect force transfer.

Relative to the short face height ($H_{FC}$), the face center height ($H_{FC}$) is substantially tall. The golf club head 100 can comprise a ratio of the strike face height ($H_{SF}$) to the face center height ($H_{FC}$). The $H_{SF}/H_{FC}$ ratio can be found by dividing the strike face height ($H_{SF}$) by the face center height ($H_{FC}$). In many embodiments, the $H_{SF}/H_{FC}$ ratio can be between 1.25 and 1.40. In some embodiments, the $H_{SF}/H_{FC}$ ratio can be between 1.25 and 1.30, 1.30 and 1.35, or between 1.35 and 1.40. In some embodiments, the $H_{SF}/H_{FC}$ ratio can be greater than 1.25, 1.30, or greater than 1.35.

The golf club head 100 can further comprise a ratio of the strike face height ($H_{SF}$) to the face nadir height ($H_{FN}$) between 3.50 to 5.10. In some embodiments, the $H_{SF}/H_{FN}$ ratio can be between 3.50 to 3.70, 3.70 to 3.90, 3.90 to 4.10, 4.10 to 4.30, 4.30 to 4.50, 4.50 to 4.70, 4.70 to 4.90, or between 4.90 to 5.10.

The golf club head 100 can further comprise a ratio of body height ($H_B$) to face center height ($H_{FC}$). The $H_B/H_{FC}$ ratio can be between 1.75 and 2.25. In many embodiments, the $H_B/H_{FC}$ ratio can be between 1.75 and 1.80, 1.80 and 1.85, 1.85 and 1.90, 1.90 and 1.95, 1.95 and 2.00, 2.00 and 2.05, 2.05 and 2.10, 2.10 and 2.15, 2.15 and 2.20, or between 2.20 and 2.25. These ranges provide a body height ($H_B$) that creates a cube-like body shape while simultaneously producing a shallow strike face 102 (i.e., a reduced face height and face thickness) with a face center height ($H_{FC}$) that aligns the loft-normal axis 35 with the club head CG.

As described above, the shallow strike face 102 (i.e., a reduced face height and reduced face thickness) comprises a substantially thin strike face thickness to increase ball speed. The strike face thickness is measured as the average thickness of the strike face 102 within the boundary of the strike face perimeter. The average strike face thickness may be calculated by taking the volume of the strike face 102 within the strike face perimeter boundary and dividing it by the front surface area of the strike face within the strike face perimeter boundary. In many embodiments, the strike face thickness ranges from approximately 0.085 inch and 0.110 inch. The strike face thickness can be between 0.085 inch and 0.090 inch, 0.090 inch and 0.095 inch, 0.095 inch and 0.100 inch, 0.100 inch and 0.105 inch, or 0.105 inch and 0.110 inch. In other embodiments, the strike face thickness can be between 0.094 inch and 0.099 inch, 0.090 inch and 0.097 inch, or 0.095 inch and 0.103 inch. The strike face thickness can be less than 0.100 inch, 0.099 inch, 0.098 inch, 0.097 inch, 0.096 inch, 0.095 inch, 0.094 inch, 0.093 inch, 0.092 inch, 0.091 inch, or less than 0.091 inch. The strike face thickness can be reduced by between 5% and 15% due to the reduction of the strike face height ($H_{SF}$). The combination of a thin strike face and small strike face height ($H_{SF}$) improves ball speed while maintaining a conforming CT value.

As described above, the shallow nature of the strike face 102 improves MOI by reducing the mass required to form the strike face 102. In many embodiments, the strike face mass, measured within the strike face perimeter, can be between 28 and 37 grams. For example, the strike face mass can be between 28 grams and 30 grams, 30 grams and 32 grams, 32 grams and 34 grams, or between 34 grams and 37 grams. In some embodiments, the strike face mass can be less than 37 grams, 36 grams, 35 grams, 34 grams, 33 grams, 32 grams, 31 grams, 30 grams, or less than 29 grams. In some embodiments, the mass of the strike face can be about 28 grams, 29 grams, 30 grams, 31 grams, 32 grams, 33 grams, 34 grams, 35 grams, 36 grams, or 37 grams.

As such, the golf club head 100 comprising a shallow strike face 102 (i.e., a reduced face height and face thickness) along with a raised face nadir height ($H_{FN}$) increases ball speed per CT value, improves club head MOI, and maintains or improves the force transfer of the golf club head 100 by aligning the club head CG and the loft-normal axis 35. Combining these benefits of the reduced strike face height ($H_{FC}$) and thickness with other various features described herein can provide a high-performing club head which has a high $I_{YY}$ and balances other performance characteristics such as the $I_{XX}/I_{YY}$ ratio, force transfer, aerodynamics, and CG adjustability as described above.

C. Crown Profile

The crown profile of the golf club head 100 balances various physical properties and/or performance characteristics. As discussed above, the shape (or "profile") of the crown 110 impacts the aerodynamic properties of the golf club head 100. Further, the crown profile influences the mass distribution by dictating where mass can be placed. The crown profile influences club head MOI and CG position.

Referring to FIG. 8, the crown 110 comprises a crown angle ($\alpha_C$) that characterizes the general shape of the crown 110 in a front-to-rear direction. As illustrated in FIG. 8, the golf club head 100 defines a crown axis 120 that extends between a crown transition point 115 and a rear transition point 116. The crown transition point 115 and the rear transition point 116 are both located within the YZ plane. The crown transition point 115 is located at a forwardmost point of the crown 110 within the YZ plane. The rear transition point 116 is located at a rearward-most point of the crown 110 within YZ plane. The crown angle ($\alpha_C$) is the acute angle between the crown axis 120 and the Y-axis 50. In many embodiments, the crown angle ($\alpha_C$) can be between 650 and 75°. In some embodiments, the crown angle ($\alpha_C$) can be between 65° and 67°, 67° and 69°, 69° and 71°, 71° and 73°, or between 73° and 75°.

The crown angle ($\alpha_C$) ranges described above are specifically provided to balance club head MOI, CG position, and aerodynamic characteristics. The crown angle ($\alpha_C$) ranges provided above are consistent with the optimal aerodynamic profile for a golf club head comprising aerodynamic features on the crown, such as the turbulators described below. If the crown angle ($\alpha_C$) is too steep (i.e., lower than the ranges provided), the aerodynamic flow will separate from the crown 110 prematurely and drag force will increase. If the crown angle ($\alpha_C$) is too shallow (i.e., greater than the ranges provided), the mass of the rearward portion of the crown 110 will be raised and will raise the club head CG away from the loft-normal axis 35. In some embodiments, the crown angle ($\alpha_C$) design may prioritize MOI and CG characteristics, rather than necessarily achieving an optimal value for aerodynamics.

The height of the crown 110 at various locations further characterizes the crown profile. Referring to FIG. 8, the golf club head 100 defines a halfway height ($H_H$) measured as the perpendicular distance between the ground plane 10 and a halfway crown point 119 defined as the point on the crown 110 within the YZ plane that is located at a midpoint of the body depth ($D_B$). In many embodiments, the halfway height ($H_H$) can be between 2.10 inches and 2.30 inches. In some embodiments, the halfway height ($H_H$) can be between 2.10 inches and 2.15 inches, 2.15 inches and 2.20 inches, 2.20 inches and 2.25 inches, or between 2.25 inches and 2.30 inches. A substantially low halfway height ($H_H$) lowers the club head CG toward the loft-normal axis 35.

The crown profile can be further characterized by a ratio between the halfway height ($H_H$) and the body height ($H_B$). A substantially small $H_H/H_B$ ratio is indicative of a club head with a steep crown angle ($\alpha_C$) within the ranges disclosed above. In some embodiments, the $H_H/H_B$ ratio can be less than 0.9. In other embodiments, the $H_H/H_B$ ratio can be between 0.75 and 0.80, 0.80 and 0.85, or between 0.85 and 0.90. A low $H_H/H_B$ ratio ensures that the crown profile remains flat and balances mass above and below the loft-normal axis.

The golf club head 100 can further comprise a rear crown height ($H_{CR}$) measured as the perpendicular distance between the ground plane 10 and the rear transition point 116. In many embodiments, the rear crown height ($H_{CR}$) can be between 0.60 inch and 0.70 inch. In some embodiments, the halfway height ($H_{CR}$) can be less than 0.70 inch, 0.68 inch, 0.66 inch, 0.64 inch, or less than 0.62 inch. The golf club head 100 can comprise a substantially low rear crown height ($H_{CR}$). The low rear crown height ($H_{CR}$) helps the rear end 111 of the body 101 come substantially to a point, keeping mass low and rearward and improving flow attachment to the crown 110.

The crown profile can be further characterized by a ratio between the crown rear transition point height ($H_{CR}$) and the body height ($H_B$). In some examples, the $H_{CR}/H_B$ ratio can be between 0.15 and 0.4. In other embodiments, the $H_{CR}/H_B$ ratio can be between 0.15 and 0.20, 0.20 and 0.25, 0.25 and 0.30, 0.30 and 0.35, or between 0.35 and 0.40. A small $H_{CR}/H_B$ ratio is indicative of low and rearward mass placement. A $H_{CR}/H_B$ ratio which is too large indicates that the crown rear transition point height ($H_{CR}$) is proportionally large, thereby increasing mass above the loft-normal axis 35. A $H_{CR}/H_B$ ratio which is too small indicates that the crown rear transition point height ($H_{CR}$) is proportionally small, thereby providing too steep of a crown angle ($\alpha_C$).

The crown profile can further be characterized by a crown arc length, defined as the distance between the crown transition point 115 and the rear transition point 116. The crown arc length is measured within the YZ plane and follows the curvature of the crown 110. The golf club head 100 can comprise a substantially flat crown profile characterized by a substantially short crown arc length. In many embodiments, the crown arc length can be between 5.00 inches and 5.30 inches. In some embodiments, the crown arc length can be less than 5.30 inches, 5.25 inches, 5.20 inches, 5.15 inches, 5.10 inches, or less than 5.05 inches. Providing a substantially short crown arc length has benefits for both aerodynamics and club head CG position. In comparison to a more bulbous crown having a longer crown arc length, a short crown arc length is characteristic of a crown 110 that tapers more gradually in height from the strike face 102 to the rear end 111 (given equal crown angles). A more gradual taper promotes flow attachment, thereby reducing drag. Further, a flatter crown with a shorter crown arc length tends to lower the mass of the crown 110 toward the ground plane 10, thereby lowering the club head CG position toward the loft-normal axis 35.

The crown arc length can further be characterized relative to the body depth ($D_B$). In many embodiments, the crown arc length can be substantially short for a given body depth ($D_B$). In many embodiments, the golf club head 100 can comprise a first crown arc length ratio defined as the ratio of crown arc length divided by the body depth ($D_B$). In many embodiments, the first crown arc length ratio can be between 1.05 and 1.10. In some embodiments, the first crown arc length ratio can be less than 1.10, 1.09, 1.08, 1.07, or less than 1.06. Providing the crown 110 with a substantially small first crown arc length ratio, which represents a substantially flat crown profile, contrasts to more bulbous crown profiles, which may comprise a short crown arc length due to a reduced body depth.

The crown arc length can further be characterized relative to the halfway height ($H_H$). In many embodiments, the golf club head 100 can comprise a second crown arc length ratio defined as the ratio of the crown arc length divided by the halfway height ($H_H$). In many embodiments, the second crown arc length ratio can be between 7.40 and 7.80. In some embodiments, the second crown arc length ratio can be less than 7.8, 7.7, 7.6, or less than 7.5. These ratios provide a flat crown profile that provides the aerodynamic and club head CG benefits described above.

As discussed above, the golf club head 100 may comprise several features to maximize aerodynamic properties, while still balancing the $I_{XX}/I_{YY}$ ratio. Generally, the aerodynamic drag is associated with the body shape causing flow separation (i.e., pressure drag/form drag). To mitigate aerodynamic drag, modern golf club heads typically implement a shallow crown angle ($\alpha_C$) and a generally bulbous crown shape. This approach to mitigating aerodynamic drag places a significant amount of club head mass above the loft-normal axis 35. Moving club head mass away from the loft-normal axis 35 moves the club head CG away from the loft-normal axis 35, thereby reducing ball speed.

The aerodynamic features described below reduce drag without requiring a flattened crown angle ($\alpha_C$) or a bulbous crown shape. Such aerodynamic features can include turbulators, a sole transition profile, a crown transition profile, and/or a rear transition profile. Additionally, the aerodynamic features described below do not place significant amounts of the club head mass above the loft-normal axis 35. Thereby, the aerodynamic features of the present invention increase club head speed without compromising the club head CG and MOI properties.

In some embodiments, the aerodynamic features can include a plurality of turbulators as described in U.S. patent application Ser. No. 13/536,753, filed on Jun. 28, 2021, now U.S. Pat. No. 8,608,587, granted on Dec. 17, 2013, entitled "Golf Club Heads with Turbulators and Methods to Manufacture Golf Club Heads with Turbulators," Which is incorporated fully herein by reference. Turbulators on the crown are known in the art to reduce drag. Turbulators alter the optimal aerodynamic crown profile by disrupting and delaying flow separation. Therefore, turbulators reduce drag produced by the golf club head during a swing and increase ball speed.

The club head can further comprise a crown transition profile, a sole transition profile, and/or a rear transition profile similar to the crown transition, sole transition, and rear transition profiles described in U.S. patent application Ser. No. 15/233,486, filed on Aug. 10, 2016, now U.S. Pat. No. 10,035,048 granted on Jul. 31, 2018, entitled "Golf Club Head with Transition Profiles to Reduce Aerodynamic Drag." The golf club head can comprise a front radius of curvature, a sole radius of curvature and/or a rear radius of curvature that can be similar to the first crown radius of curvature, the first sole radius of curvature, and/or the rear radius of curvature described in U.S. patent application Ser. No. 15/233,486, filed on Aug. 10, 2016, now U.S. Pat. No. 10,035,048 granted on Jul. 31, 2018, entitled "Golf Club Head with Transition Profiles to Reduce Aerodynamic Drag."

In many embodiments, the front radius of curvature can be between 0.18 inch and 0.30 inch. In some embodiments, the front radius of curvature can be less than 0.40 inch, 0.375 inch, 0.35 inch, 0.325 inch, or less than 0.30 inch. In many embodiments, the sole radius of curvature can be between 0.25 inch and 0.50 inch. In some embodiments, the sole radius of curvature can be less than 0.50 inch, 0.475 inch, 0.45 inch, or less than 0.40 inch. In many embodiments, the rear radius of curvature can be between 0.10 inch and 0.25 inch. In some embodiments, the rear radius of curvature can be less than 0.30 inch, 0.275 inch, 0.25 inch, 0.225 inch, or less than 0.20 inch.

ii. Mass Properties

A. Club Head Moment of Inertia

As described above, the golf club heads according to the present invention comprise an $I_{YY}$ at or near the allowable limit. The $I_{YY}$ can be maximized by removing mass from the midsection (MS) and/or near the Y'-axis 80 and increasing the perimeter weighting of the golf club head 100. An $I_{YY}$ at or near the allowable limit is allowed by the discretionary mass created by the one or more lightweight composite inserts, the lightweight shaft-receiving structure, a small-arced weight member housing structure, or any other mass-saving structure disclosed herein. In many embodiments, the $I_{YY}$ can be between 5600 g-cm$^3$ and 6000 g-cm$^3$. In some embodiments, the $I_{YY}$ can be between 5600 g-cm$^3$ and 5700 g-cm$^3$, between 5700 g-cm$^3$ and 5800 g-cm$^3$, between 5800 g-cm$^3$ and 5900 g-cm$^3$, or between 5900 g-cm$^3$ and 6000 g-cm$^3$. In some embodiments, the $I_{YY}$ can be greater than 5600 g-cm$^3$, greater than 5700 g-cm$^3$, greater than 5800 g-cm$^3$, greater than 5900 g-cm$^3$, or greater than 6000 g-cm$^3$.

Despite having a high $I_{YY}$ value at or near the allowable limit, the golf club heads according to the present invention further comprise a high $I_{XX}/I_{YY}$ ratio. The high $I_{XX}/I_{YY}$ ratio is achieved by providing the club head CG near the perimetrical centroid (PC) and distributing discretionary mass in strategic locations that increase $I_{XX}$ without increasing $I_{YY}$ beyond the allowable limit. The high $I_{XX}/I_{YY}$ ratio is enabled by distributing discretionary mass into a heavy weight member located in an extreme rearward and soleward position (described in further detail below), and/or distributing a large portion of the club head mass into a central mass zone (defined below) centered about the Y'-axis 80.

In many embodiments, the $I_{XX}$ can be between 4200 g-cm$^3$ and 6000 g-cm$^3$. In some embodiments, the $I_{XX}$ can be between 4200 g-cm$^3$ and 4400 g-cm$^3$, between 4400 g-cm$^3$ and 4600 g-cm$^3$, between 4600 g-cm$^3$ and 4800 g-cm$^3$, between 4800 g-cm$^3$ and 5000 g-cm$^3$, between 5000 g-cm$^3$ and 5200 g-cm$^3$, or between 5200 g-cm$^3$ and 5600 g-cm$^3$, between 5600 g-cm$^3$ and 5700 g-cm$^3$, between 5700 g-cm$^3$ and 5800 g-cm$^3$, between 5800 g-cm$^3$ and 5900 g-cm$^3$, or between 5900 g-cm$^3$ and 6000 g-cm$^3$. In some embodiments, the $I_{XX}$ can be greater than 4200 g-cm$^3$, greater than 4400 g-cm$^3$, greater than 4600 g-cm$^3$, greater than 4800 g-cm$^3$, greater than 5000 g-cm$^3$, greater than 5200 g-cm$^3$, greater than 5400 g-cm$^3$, greater than 5500 g-cm$^3$, greater than 5600 g-cm$^3$, greater than 5700 g-cm$^3$, greater than 5800 g-cm$^3$, greater than 5900 g-cm$^3$, or greater than 6000 g-cm$^3$.

In many embodiments, the club head can comprise an $I_{XX}/I_{YY}$ ratio between 0.77 and 1.0. In some embodiments, the club head can comprise an $I_{XX}/I_{YY}$ ratio between 0.77 and 0.80, between 0.80 and 0.85, or between 0.85 and 0.90. In some embodiments, the $I_{XX}/I_{YY}$ ratio can be greater than 0.77, greater than 0.78, greater than 0.80, greater than 0.82, greater than 0.84, greater than 0.85, greater than 0.86, greater than 0.88, or greater than 0.90. In some embodiments, the $I_{XX}/I_{YY}$ ratio can be between 0.77 and 0.78, 0.78 and 0.79, 0.79 and 0.80, 0.80 and 0.81, 0.81 and 0.82, 0.82 and 0.83, 0.83 and 0.84, 0.84 and 0.85, 0.85 and 0.86, 0.86 and 0.87, 0.87 and 0.88, 0.88 and 0.89, 0.89 and 0.90, 0.90 and 0.91, 0.91 and 0.92, 0.92 and 0.93, 0.93 and 0.94, 0.94 and 0.95, 0.95 and 0.96, 0.96 and 0.97, 0.97 and 0.98, 0.98 and 0.99, or between 0.99 and 1.00. In embodiments where $I_{YY}$ is at the allowable limit, the maximum $I_{XX}/I_{YY}$ ratio is 1 to still conform with current USGA limits on MOI.

B. Club Head CG Position

The club head CG position can be described with respect to the primary coordinate system. Referring to FIG. 6, the $CG_X$ can refer to the club head CG location along the X-axis 40, measured from the face center (FC). In many embodiments, the absolute value of the $CG_X$ can be between 0 inch and 0.10 inch. In some embodiments, the absolute value of the $CG_X$ can be between 0 inch and 0.03 inch, 0.02 inch and 0.05 inch, 0.04 inch and 0.08 inch, or between 0.06 inch and 0.10 inch. In many embodiments, the absolute value of the $CG_X$ can be less than 0.10 inch. In some embodiments, the $CG_X$ can be less than 0.10 inch, 0.09 inch, 0.08 inch, 0.07 inch, 0.06 inch, 0.05 inch, 0.04 inch, 0.03 inch, 0.02 inch, or less than 0.01 inch.

Referring to FIGS. 6 and 7, the $CG_Y$ can refer to the club head CG location along the Y-axis 50, measured from the face center (FC). A negative $CG_Y$ value indicates a club head CG that is located below the face center (FC). In many embodiments, the $CG_Y$ can be between −0.50 inch and −0.25 inch. In some embodiments, the $CG_Y$ can be between −0.50 inch and −0.45 inch, −0.45 inch and −0.40 inch, −0.40 inch and −0.35 inch, −0.35 inch and −0.30 inch, or between −0.30 inch and −0.25 inch. In many embodiments, the $CG_Y$ can be less than −0.25 inch. In some embodiments, the $CG_Y$ can be less −0.25 inch, −0.30 inch, −0.35 inch, −0.40 inch, or less than −0.45 inch. The $CG_Y$ ranges described herein are representative of a club head CG position located at or near the loft-normal axis 35, in combination with the $CG_Z$ values disclosed below.

Referring to FIG. 7, the $CG_Z$ can refer to the club head CG location along the Z-axis 60, measured from the face center (FC). In many embodiments, the $CG_Z$ can be between 1.50 inches and 2.20 inches. In some embodiments, the $CG_Z$ can be between 1.50 inches and 1.70 inches, 1.60 inches and 1.80 inches, 1.70 inches and 1.90 inches, 1.80 inches and 2.00 inches, 1.90 inches and 2.10 inches, or between 2.00 inches and 2.20 inches. In many embodiments, the $CG_Z$ can be greater than 1.50 inches. In some embodiments, the $CG_Z$ can be greater than 1.50 inches, 1.60 inches, 1.70 inches, 1.80 inches, 1.90 inches, 2.00 inches, 2.10 inches, or greater than 2.20 inches. The $CG_Z$ ranges described herein are representative of a club head CG position located at or near the loft-normal axis 35, in combination with the $CG_Y$ values disclosed above. The $CG_Z$ are also representative of a club head CG centered relative to the perimetrical centroid (PC).

Referring to FIG. 8, the $CG_{LN}$ can refer to the perpendicular distance between the club head CG and the loft-normal axis 35. In many embodiments, the absolute value of the $CG_{LN}$ can be less than 0.150 inch. In some embodiments, the absolute value of the $CG_{LN}$ can be between 0.001 inch and 0.005 inch, 0.005 inch and 0.010 inch, 0.010 inch and 0.015 inch, 0.015 inch and 0.020 inch, 0.020 inch and 0.025 inch, 0.025 inch and 0.030 inch, 0.030 inch and 0.035 inch, 0.035 inch and 0.040 inch, 0.040 inch and 0.045 inch, 0.045 inch and 0.050 inch, 0.050 inch and 0.060 inch, 0.060 inch and 0.070 inch, 0.070 inch and 0.080 inch, 0.080 inch and 0.100 inch, 0.100 inch and 0.120 inch, or between 0.100 inch and 0.150 inch. In many embodiments, the absolute value of the $CG_{LN}$ can be less than 0.150 inch. In some embodiments, the absolute value of the $CG_{LN}$ can be less than 0.150 inch, 0.140 inch, 0.130 inch, 0.120 inch, 0.110 inch, 0.100 inch, 0.090 inch, 0.080 inch, 0.070 inch, 0.060 inch, 0.050 inch, 0.045 inch, 0.040 inch, 0.035 inch, 0.030 inch, 0.025 inch, 0.020 inch, 0.015 inch, 0.010 inch, or less than 0.005 inch. As described in detail above, a low $CG_{LN}$ absolute value increases force transfer and ball speed. The $CG_{LN}$ values disclosed above can be apply to any loft-normal axis 35 orientation defined above, including a loft-normal axis 35 that is perfectly normal to the loft plane 15 or a loft-normal axis 35 that is substantially normal to the loft plane 15.

The club head CG location can be further described relative to the leading edge 103. Referring to FIG. 8, the $CG_{LE}$ can refer to the distance between the club head CG and the leading edge 103, measured parallel to the ground plane 10. In many embodiments, the $CG_{LE}$ can be between 2.05 inches and 2.60 inches. In some embodiments, the $CG_{LE}$ can be between 2.05 inches and 2.15 inches, 2.10 inches and 2.25 inches, 2.20 inches and 2.40 inches, 2.30 inches and 2.45 inches, 2.40 inches and 2.50 inches, or between 2.45 inches and 2.60 inches. In many embodiments, the $CG_{LE}$ can be greater than 2.00 inches. In some embodiments, the $CG_{LE}$ can be greater than 2.00 inches, 2.05 inches, 2.10 inches, 2.15 inches, 2.20 inches, 2.25 inches, 2.30 inches, 2.35 inches, 2.40 inches, 2.45 inches, 2.50 inches, or greater than 2.55 inches. The $CG_{LE}$ ranges described herein are representative of a club head CG position located at or near the loft-normal axis 35, in combination with the $CG_Y$ values disclosed above. The $CG_{LE}$ are also representative of a club head CG centered relative to the perimetrical centroid (PC).

The $CG_{LE}$ can be described in relation to the body depth ($D_B$). In many embodiments, the $CG_{LE}/D_B$ ratio can be between 0.40 and 0.55. In some embodiments, the $CG_{LE}/D_B$ ratio can be between 0.40 and 0.42, 0.41 and 0.44, 0.43 and 0.47, 0.45 and 0.49, between 0.47 and 0.50, between 0.48 and 0.51, between 0.49 and 0.52, between 0.50 and 0.53, between 0.51 and 0.54, or between 0.52 and 0.55. The ranges disclosed for the $CG_{LE}/D_B$ ratio are specifically tailored to provide a club head CG position centered about the perimetrical centroid (PC). If the $CG_{LE}/D_B$ ratio is too far above or below the enumerated ranges, the perimetrical centroid distance ($D_{PC}$) described below increases and discretionary mass is depleted, thereby diminishing the CG and MOI properties described herein.

Referring to FIG. 9, a perimetrical centroid distance ($D_{PC}$) can refer to a distance between the club head CG and the perimetrical centroid (PC) measured parallel to the Y-axis 50. In many embodiments, the absolute value of the distance ($D_{PC}$) can be less than 0.50 inch. In some embodiments, the absolute value of the distance ($D_{PC}$) can be between 0 inch and 0.10 inch, between 0.10 inch and 0.20 inch, between 0.20 inch and 0.30 inch, between 0.30 inch and 0.40 inch, 0.35 inch and 0.50 inch, or between 0.45 inch and 0.50 inch. In many embodiments, the absolute value of the distance ($D_{PC}$) can be less than 0.50 inch. In some embodiments, the absolute value of the distance ($D_{PC}$) can be less than 0.50 inch, 0.45 inch, 0.40 inch, less than 0.30 inch, less than 0.20 inch, or less than 0.10 inch. The club head 100 reduces the perimetrical centroid distance ($D_{PC}$) to center the club head CG relative to the body perimeter, thereby naturally improving $I_{YY}$ and increasing discretionary mass available to increase the $I_{XX}/I_{YY}$ ratio closer to 1.

As discussed above, in many prior art golf club heads, the club head CG is positioned substantially forward of the club head perimetrical centroid (PC). When the club head CG is positioned a substantial distance from the Y-axis 40, as indicated by a large perimetrical centroid distance ($D_{PC}$), a large amount of discretionary mass must be utilized to raise the club head $I_{YY}$. Accordingly, a small perimetrical centroid distance ($D_{PC}$) (0.5 inch or less) means less discretionary mass must be utilized to achieve a high club head $I_{YY}$. When less discretionary mass is utilized to increase $I_{YY}$ there is more discretionary mass available for structures which increase club head $I_{XX}$, such as weight members and/or mass pads. Therefore, an MOI-$D_{PC}$ ratio can be used to measure how effectively the discretionary mass created by a small perimetrical centroid distance ($D_{PC}$) is utilized to increase club head $I_{XX}$.

$$MOI - D_{PC} \text{ Ratio:}$$

$$\frac{I_{XX}}{1 + D_{PC}}$$

The MOI-$D_{PC}$ ratio is always positive as the absolute value of perimetrical centroid distance ($D_{PC}$) is used to calculate the ratio. In some embodiments, the MOI-$D_{PC}$ ratio can be greater than 500 g-in, 600 g-in, 700 g-in, 800 g-in, 900 g-in, or greater than 1000 g-in. In other embodiments, the MOI-$D_{PC}$ ratio can be between 500 and 600 g-in, 600 and 700 g-in, 700 and 800 g-in, 800 and 900 g-in, or between 900 and 1000 g-in. As discussed above, a high MOI-$D_{PC}$ ratio is indicative of efficient use of the discretionary mass made available by a small perimetrical centroid distance ($D_{PC}$) to increase the $I_{XX}/I_{YY}$ ratio.

C. Mass Distribution

In addition to the body shape and dimensions, the effectiveness in maximizing the $I_{XX}/I_{YY}$ ratio depends on the golf club head's mass distribution. In particular, achieving a high $I_{XX}/I_{YY}$ ratio depends on the amount of the club head's discretionary mass that is both proximate the Y'-axis 80 and spaced away from the X'-axis 70. In doing so, said discretionary mass provides a significant contribution to increasing $I_{XX}$ without raising $I_{YY}$ over the limit. The club head therefore comprises a relatively high percentage of its total mass around the Y'-axis 80. In contrast, many prior-art club heads, which focus only on maximizing $I_{YY}$ rather than the $I_{XX}/I_{YY}$ ratio, provide perimeter weighting by placing all discretionary mass as far from the Y'-axis 80 as possible.

Figure 10:
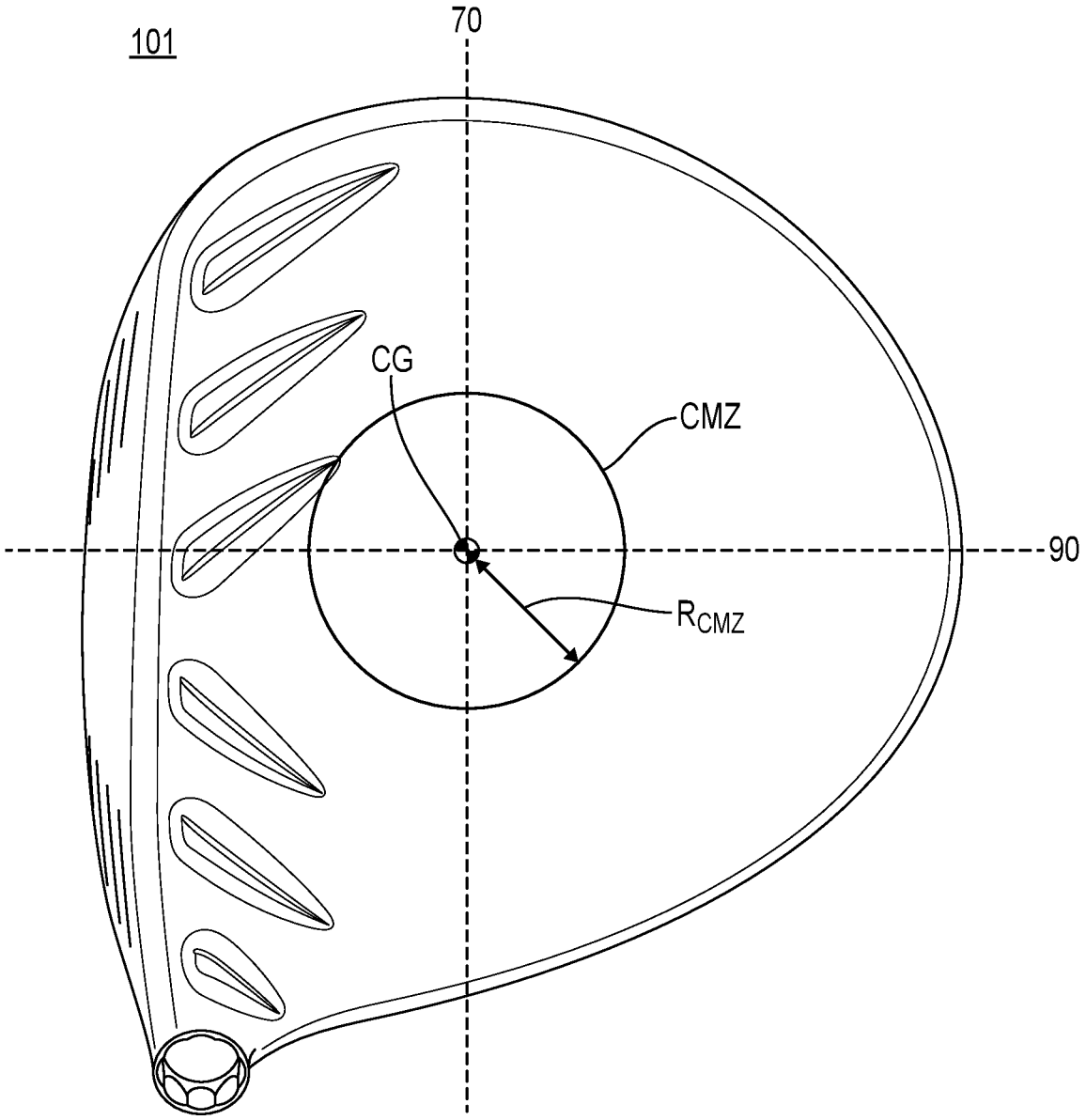
FIG. 10 illustrates a top plan view of the golf club head of FIG. 1, highlighting an imaginary central mass zone.
Figure 11:
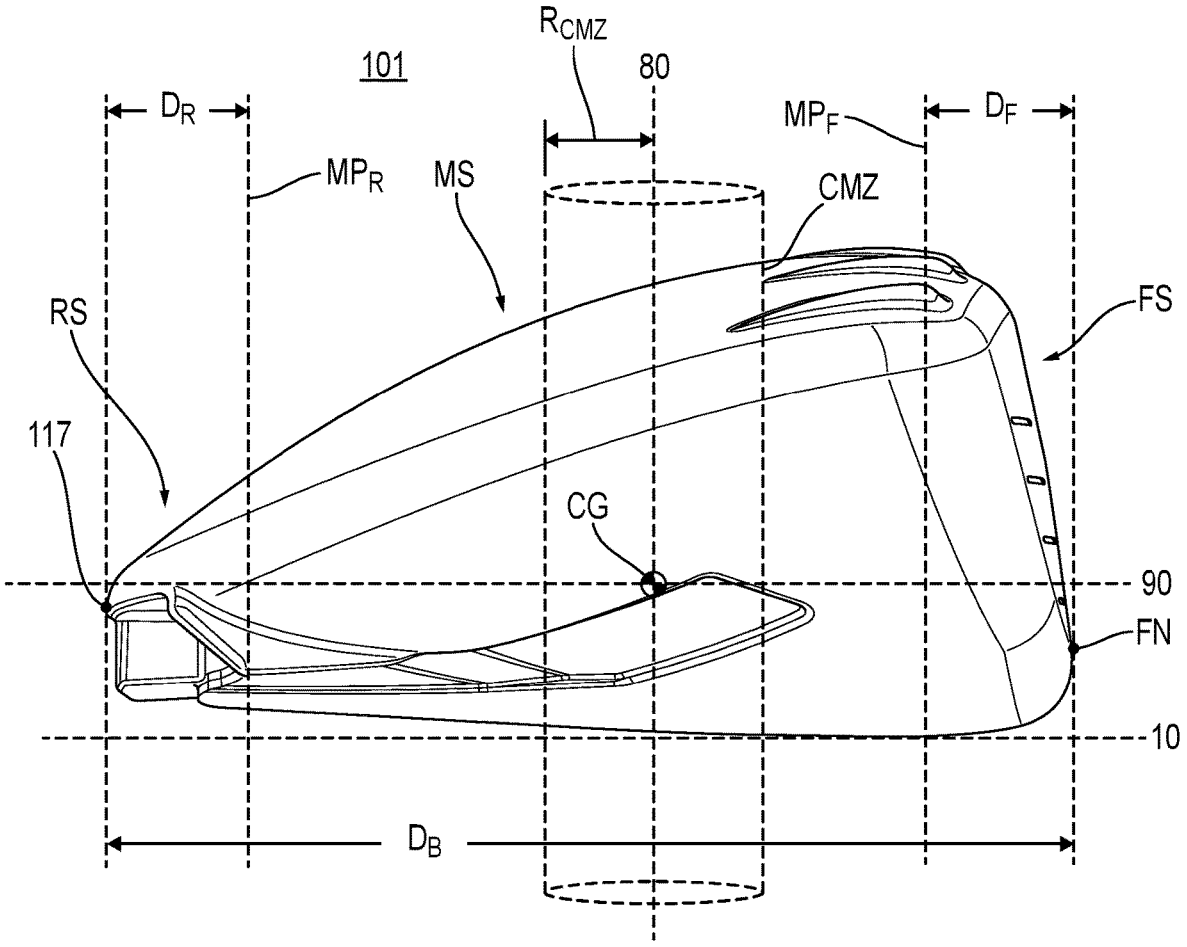
FIG. 11 illustrates a toe-side elevation view of the golf club head of FIG. 1, highlighting an imaginary central mass zone.

The club head's mass distribution can be characterized by the amount of club head mass located within a central mass zone (CMZ). Referring to FIGS. 10 and 11, the central mass zone (CMZ) is defined by an imaginary cylinder centered about the Y'-axis 80 and extending through the body 101 from the crown 110 to the sole 112. The size of the central mass zone (CMZ) is determined by the central mass zone radius ($R_{CMZ}$). The central mass zone radius ($R_{CMZ}$) can be between 0.50 inch and 1.5 inches, measured perpendicular to the Y'-axis 80. In some embodiments, the central mass zone radius ($R_{CMZ}$) can be 0.50 inch, 0.55 inch, 0.60 inch, 0.65 inch, 0.70 inch, 0.75 inch, 0.80 inch, 0.85 inch, 0.90 inch, 0.95 inch, 1.00 inch, 1.05 inch, 1.10 inch, 1.15 inch, 1.20 inch, 1.25 inch, 1.30 inch, 1.35 inch, 1.40 inch, 1.45 inch, or 1.50 inch. In many embodiments, the central mass zone radius ($R_{CMZ}$) is 1.00 inch. The greater the proportion of the club head mass located within the central mass zone (CMZ), the less said mass increases $I_{YY}$ while still providing a significant increase in $I_{XX}$. The club head's effectiveness in providing an $I_{XX}/I_{YY}$ ratio close to 1 is therefore directly related to the amount of club head mass located within the central mass zone (CMZ).

In many embodiments, the mass distribution of the golf club head 100 can be characterized by a percentage of the total club head mass that is bounded within the central mass zone (CMZ). In some embodiments, between 5% and 15% of the total club head mass can be located within the central mass zone (CMZ). In some embodiments, between 5% and 7%, 6% and 10%, or between 8% and 15% of the total club head mass can be located within the central mass zone (CMZ). The percentage of the total club head mass located within the central mass zone (CMZ) depends on the central mass zone radius $R_{CMZ}$ that is selected. In many embodiments, the mass percentage within the central mass zone (CMZ) can be evaluated in view of a central mass zone radius $R_{CMZ}$ of 1.00 inch. If the percentage of club head mass within the central mass zone (CMZ) is too low (i.e., lower than the ranges provided), the golf club head 100 will not be able to achieve a sufficiently high $I_{XX}/I_{YY}$ ratio. If the percentage of club head mass within the central mass zone (CMZ) is too high (i.e., greater than the ranges provided), there may not be enough perimeter weighting to achieve an $I_{YY}$ at or near the allowable limit. Further, If the percentage of club head mass within the central mass zone (CMZ) is too high, the golf club head 100 may fail to comprise sufficient mass near the rear end 111 to bring the club head CG in line with the perimetrical centroid (PC).

Referring to FIG. 8, the loft-normal axis 35 can divide the golf club head 100 into two hemispheres. The golf club head 100 defines an upper hemisphere (UH) as the portion located above a plane defined by the loft-normal axis 35, wherein said plane is perpendicular to both the loft plane 15 and the YZ plane. The golf club head 100 further defines a lower hemisphere (LH) as the portion located below said plane. In many embodiments, a majority of the club head volume can be located in the upper hemisphere (UH), yet a large portion of the club head mass can be located in the lower hemisphere (LH). As discussed above, it is beneficial for ball speed purposes to have a near 1 ratio of club head mass in the upper hemisphere (UH) to club head mass in the lower hemisphere (LH). To balance a large portion of the club head volume being located in the upper hemisphere (UH), heavier features such as the adjustable weighting system described herein and/or one or more mass pads can be positioned within the lower hemisphere (LH). In many embodiments, the volume within the upper hemisphere (UH) can be between 250 $cm^3$ and 355 $cm^3$. In some embodiments, the volume within the upper hemisphere (UH) can be between 250 $cm^3$ and 265 $cm^3$, 265 $cm^3$ and 280 $cm^3$, 280 $cm^3$ and 295 $cm^3$, 295 $cm^3$ and 310 $cm^3$, 310 $cm^3$ and 325 $cm^3$, 325 $cm^3$ and 340 $cm^3$, or between 340 $cm^3$ and 355 $cm^3$. In other embodiments, the volume within the upper hemisphere (UH) can be greater than 250 $cm^3$, 280 $cm^3$, 295 $cm^3$, 310 $cm^3$, 325 $cm^3$, 340 $cm^3$, or greater than 355 $cm^3$.

As described above, the lower hemisphere (LH) generally contains less volume than the upper hemisphere (UH), due to the angled nature of the loft-normal axis 35. In many embodiments, the volume within the lower hemisphere (LH) can be between 105 $cm^3$ and 215 $cm^3$. In some embodiments, the volume within the lower hemisphere (LH) can be between 105 $cm^3$ and 115 $cm^3$, 115 $cm^3$ and 125 $cm^3$, 125 $cm^3$ and 135 $cm^3$, 135 $cm^3$ and 145 $cm^3$, 145 $cm^3$ and 155 $cm^3$, 155 $cm^3$ and 165 $cm^3$, 165 $cm^3$ and 175 $cm^3$, 175 $cm^3$ and 185 $cm^3$, 185 $cm^3$ and 195 $cm^3$, 195 $cm^3$ and 205 $cm^3$, or between 205 $cm^3$ and 215 $cm^3$. In other embodiments, the volume within the lower hemisphere (LH) can be less than 105 $cm^3$, 115 $cm^3$, 125 $cm^3$, 135 $cm^3$, 145 $cm^3$, 155 $cm^3$, 165 $cm^3$, 175 $cm^3$, 185 $cm^3$, 195 $cm^3$, 205 $cm^3$, or less than 215 $cm^3$.

The ratio of club head volume in the upper hemisphere (UH) to club head volume in the lower hemisphere (LH) can be used to further describe the club head shape. In some embodiments, the ratio of club head volume in the upper hemisphere (UH) to club head volume in the lower hemisphere (LH) can be between 1.20 and 2.0. In some embodiments, the ratio of club head volume in the upper hemisphere (UH) to club head volume in the lower hemisphere (LH) can be between 1.20 and 1.35, 1.35 and 1.50, 1.50 and 1.65, 1.65 and 1.80, 1.80 and 1.95, or between 1.95 and 2.00.

While the upper hemisphere (UH) generally contains a significantly greater portion of the club head volume than the lower hemisphere (LH), a higher proportion of the total club head mass can be concentrated within the lower hemisphere (LH). For example, a near 1 ratio of club head mass in the upper hemisphere (UH) to club head mass in the lower hemisphere (LH) may be achieved.

The club head mass within the upper hemisphere (UH) can be between 80 grams and 120 grams. In some embodiments, the club head mass within the upper hemisphere (UH) can be less than 120 grams, 115 grams, 110 grams, 105 grams, 100 grams, 95 grams, 90 grams, or less than 85 grams. An upper hemisphere (UH) containing less than 120 grams of the club head mass generally characterizes a golf club head having a club head CG located proximate the loft-normal axis 35.

In many embodiments, the club head mass within the lower hemisphere (LH) can be between 80 grams and 120 grams. In some embodiments, the club head mass within the lower hemisphere (LH) can be greater than 80 grams, 85 grams, 90 grams, 95 grams, 100 grams, 105 grams, 110 grams, 115 grams, or greater than 120 grams.

The ratio of club head mass in the upper hemisphere (UH) to club head mass in the lower hemisphere (LH) can be used to gauge the efficiency of mass placement within the golf club head. In many embodiments, the ratio of club head mass in the upper hemisphere (UH) to club head mass in the lower hemisphere (LH) can be between 0.70 and 1.00. In some embodiments, the ratio of club head mass in the upper hemisphere (UH) to club head mass in the lower hemisphere (LH) can be between 0.70 and 0.75, 0.75 and 0.80, 0.80 and 0.85, 0.85 and 0.90, 0.90 and 0.95, or between 0.95 and 1.00. A ratio of club head mass in the upper hemisphere (UH) to club head mass in the lower hemisphere (LH) being less than 1 generally ensures that the club head CG will be located proximate the loft-normal axis 35 and ball speed will thereby be increased.

Referring to FIG. 11, the golf club head 100 defines a midsection (MS), which is a generally central portion of the body 101. The midsection (MS) is bounded by a midsection front plane $MP_F$ and a midsection rear plane $MP_R$. The midsection front plane $MP_F$ and the midsection rear plane $MP_R$ are each vertical planes extending in a heel-to-toe direction, parallel to the XY plane. The midsection front plane $MP_F$ is spaced rearward of the leading edge 103 by 15% of the body depth ($D_B$). The midsection rear plane $MP_R$ is spaced forward of the rearward-most point 117 by 15% of the body depth ($D_B$).

In many embodiments, the midsection (MS) can contain a proportionally small percentage of the club head total mass. In many embodiments, the midsection (MS) can contain between 25% and 50% of the total club head mass. In some embodiments, the midsection (MS) can contain less than 50%, 45%, 40%, 35%, 30%, 25%, 20%, 15%, or less than 10% of the total club head mass. While a concentration of mass is positioned within the central mass zone (CMZ), which is located within the midsection (MS), the midsection (MS) also contains mass saving structures (such as composite constructions) which balance out the mass of the central mass zone (CMZ) to ensure that the midsection (MS) is overall relatively lightweight in proportion to its volume. Thereby, the percentage of total club head mass within the midsection (MS) being low is a good indicator of the effectiveness of mass saving structures within the midsection (MS).

As described above, positioning club head mass within the central mass zone (CMZ) increases the $I_{XX}/I_{YY}$ ratio near 1. It is particularly advantageous to position club head mass already located within the midsection (MS) in the central mass zone (CMZ). A ratio of the club head mass within the central mass zone (CMZ) to mass within the midsection (MS) can indicate an effective placement of mass within the midsection (MS). In some embodiments, the ratio of the club head mass within the central mass zone (CMZ) to mass within the midsection (MS) can be greater than 0.22, 0.25, 0.30, 0.35, 0.40, 0.45, 0.50, 0.55, 0.60, 0.65. 0.70, or greater than 0.75. In other embodiments, the ratio of the club head mass within the central mass zone (CMZ) to mass within the midsection (MS) can be between 0.22 and 0.25, 0.25 and 0.30, 0.30 and 0.35, 0.35 and 0.40, 0.40 and 0.45, 0.45 and 0.50, 0.50 and 0.60, 0.60 and 0.65, 0.65 and 0.70, or between 0.70 and 0.75. Although the overall midsection (MS) comprises a low percentage of the overall club head mass, the mass within the central mass zone (CMZ), which is within the midsection (MS) can still be high.

As discussed above, it is advantageous to place mass rearward to increase the $I_{XX}/I_{YY}$ ratio. To measure efficiency of club head mass placement the percentage of total club head mass rearward of the midsection rear midplane ($MP_R$) can be measured. In many embodiments, a high percentage of the total club head mass can be located rearward of the midsection rear midplane ($MP_R$). In many embodiments, between 20% and 40% of the total club head mass can be located rearward of the midsection rear midplane ($MP_R$). In some embodiments, between 20% and 25%, 25% and 30%, 30% and 35%, or between 35% and 40% of the total club head mass can be located rearward of the midsection rear midplane ($MP_R$). A club head having between 20% and 40% of the total club head mass located rearward of the midsection rear midplane ($MP_R$) will typically have an improved $I_{XX}/I_{YY}$ ratio when compared to a club head with less than 20% of the total club head mass located rearward of the midsection rear midplane ($MP_R$). A high percentage of the club head mass rearward of the midsection rear midplane ($MP_R$) moves the club head CG position closer to the perimetrical centroid (PC).

The mass rearward of the midsection rear midplane ($MP_R$) offers a similar metric for gauging efficiency of mass placement. In many embodiments, a high amount of the total club head mass can be located rearward of the midsection rear midplane ($MP_R$). In many embodiments, the club head mass located rearward of the midsection rear midplane ($MP_R$) can be between 40 grams and 80 grams. In some embodiments, the club head mass located rearward of the midsection rear midplane ($MP_R$) can be between 40 grams and 46 grams, 45 grams and 50 grams, 50 grams and 55 grams, 55 grams and 60 grams, 60 grams and 65 grams, 65 grams and 70 grams, 70 grams and 75 grams, or between 75 grams and 80 grams. A club head having more than 40 grams of mass located rearward of the midsection rear midplane ($MP_R$) will typically have improved $I_{XX}$ and $I_{YY}$ values when compared to a club head with less than 40 grams of mass located rearward of the midsection rear midplane ($MP_R$).

b. Composite Constructions i. General

Described herein are various constructions of golf club heads with high amounts of discretionary mass utilized to maximize $I_{YY}$, provide an $I_{XX}/I_{YY}$ ratio close to 1, and/or position a club head CG at or near the loft-normal axis 35. Each of the golf club heads described below comprises a body having a frame and one or more lightweight composite inserts. The frame is formed from a metallic material to provide a sturdy structure for receiving the one or more composite inserts. The composite inserts can be crown inserts, sole inserts, central inserts, and various combinations thereof. The one or more composite inserts are secured to the frame to define the body. The frame is configured with openings and lightweight internal reinforcing features that reduce the amount of metallic material used to form the frame, thereby decreasing the structural mass of the frame. The one or more inserts are formed from a lightweight composite material, which effectively replaces portions of the body that would otherwise be formed of a metallic material. Providing at least a portion of the body formed by one or more composite inserts can allow extra discretionary mass to be placed near the body perimeter, within the central mass zone (CMZ), or used to increase the mass of any mass pads or weight members described herein.

The midsection (MS) of the body typically experiences relatively low stress during impact with a golf ball. Therefore, large amounts of composite or otherwise lightweight material can be placed near the midsection without compromising the durability of the golf club head. The remainder of the body provides the load bearing structure and the majority of the club head mass. Using one or more lightweight composite inserts increases the amount of discretionary mass available to strategically distribute throughout the remainder of the golf club head to improve the mass properties, such as the club head CG position and club head MOI. The lightweight composite create a maximum amount of additional discretionary mass while preserving durability.

The golf club heads described herein comprises a multi-material design. As discussed above, the golf club head comprises one or more composite inserts configured to form one or more portions of the body. The frame, which comprises the remainder of the body, can comprise a metal material, a composite material, metal-composite mixtures, or any combination thereof. The multi-material construction increases discretionary mass over all-metal golf club head, thereby allowing greater freedom to design the club head CG location and MOI. All-metal golf club heads have limitations in mass distribution (e.g., difficult to remove mass from the crown or sole) due to a lack of available discretionary mass.

The frame can comprise one or more materials such as steel, stainless steel, tungsten, aluminum, titanium, vanadium, chromium, cobalt, nickel, other metals, or metal alloys. In some embodiments, the frame material can comprise a Ti-8Al-1Mo-1V alloy, or a 17-4 stainless steel. In some embodiments, the frame material can be formed from C300, C350, Ni (Nickel)-Co(Cobalt)-Cr(Chromium)-Steel Alloy, 565 Steel, AISI type 304 or AISI type 630 stainless steel, 17-4 stainless steel, a titanium alloy, for example, but not limited to Ti-6-4, Ti-3-8-6-4-4, Ti-10-2-3, Ti 15-3-3-3, Ti 15-5-3, Ti185, Ti 6-6-2, Ti-7s, Ti-9s, Ti-92, or Ti-8-1-1 titanium alloy, an amorphous metal alloy, or other similar metals.

In some embodiments, the one or more composite inserts can comprise a carbon fiber composite material having multiple layers of unidirectional carbon fibers formed as a single, continuous piece. In some embodiments, the one or more composite inserts may comprise a bi-directional woven carbon fiber composite material having a single layer formed as a single, continuous piece. In some embodiments, the one or more composite inserts can comprise a fiber reinforced thermo-plastic material.

Described below are various embodiments of multi-material golf club heads that create discretionary mass to maximize $I_{YY}$, increase the $I_{XX}/I_{YY}$ ratio, and/or provide a club head CG position at or near the loft-normal axis 35. Each embodiment described below comprises either a central insert or one or more discrete inserts. Each discrete insert is designed to fit within a single, corresponding opening. Discrete inserts can include crown inserts and sole inserts. Each discrete insert can form portions of the crown, sole, heel end, toe end, rear end, perimeter, or any combination thereof. The golf club head can comprise any number of discrete inserts. The discrete inserts can form one or more portions of the body but do not extend continuously around the body to form portions of the crown, sole, heel end, and toe end. Various embodiments of golf club heads comprising one or more discrete inserts are illustrated in FIGS. 12-43. Alternatively, the one or more composite inserts can be central inserts, where the insert is designed to fit within a large void of the body. Continuous inserts can include a single component, or a multi-component construction. The central insert extends continuously around the body to form portions of the crown, sole, heel end, and toe end. Various embodiments of golf club heads comprising a central insert are illustrated in FIGS. 44-60.

As discussed above, the midsection (MS) of the body typically experiences relatively low stress during impact, which allows large amounts of composite or otherwise lightweight material to be placed near the midsection (MS) without compromising the durability of the golf club head. A large portion of the midsection (MS) can be formed by the one or more composite inserts. In many embodiments, the one or more composite inserts can form greater than 50%, 60%, 70%, 80%, 90%, or greater than 100% of the exterior surface area of the midsection (MS). Forming a large portion of the midsection (MS) with the one or more composite inserts naturally increases both $I_{XX}$ and $I_{YY}$ by removing mass proximate the X'-axis 70 and the Y'-axis 80. Forming a large portion of the midsection (MS) with the one or more composite inserts naturally increases the $I_{YY}$ toward the USGA limit, but also provides the discretionary mass to be strategically reallocated to provide an $I_{XX}/I_{YY}$ ratio close to 1.

Further, a large portion of the body perimeter can be formed by the one or more composite inserts. The club head mass near the body perimeter provides a disproportionately high contribution to $I_{YY}$ in comparison to its contribution to $I_{XX}$. Discretionary mass created by removing mass from the body perimeter can be redistributed to the central mass zone (CMZ) or other locations within the golf club head that increase $I_{XX}$ without significantly increasing $I_{YY}$, thereby improving the $I_{XX}/I_{YY}$ ratio. In many embodiments, the one or more composite inserts can form greater than 25%, 30%, 35%, 40%, 45%, 50%, 55%, 60%, 65%, 70%, 75%, or greater than 80% of the body perimeter.

Further, a large portion of the club head upper hemisphere (UH) can be formed by the one or more composite inserts. Removing mass from the upper hemisphere (UH) allows discretionary mass to be redistributed below the loft-normal axis 35 lowering the club head CG position nearer to the loft-normal axis 35. In many embodiments, the one or more composite inserts can form greater than 25%, 30%, 35%, 40%, 45%, 50%, 55%, 60%, 65%, 70%, 75%, or greater than 80% of the club head surface area in the upper hemisphere (UH).

Further, a large portion of the club head lower hemisphere (LH) can be formed by the one or more composite inserts. Although providing a large amount of lightweight material in the lower hemisphere (LH) reduces the mass in low portions of the body, the resulting discretionary mass can be added back to the golf club head and concentrated within structures that are located in lower portions of the golf club head, such as in a mass pad located on the sole and/or a weight member located in an extreme soleward position (both of which are described in further detail below). Not only does this configuration retain a low club head CG position near the loft-normal axis 35, but the mass distribution can be more specifically tailored to improve $I_{YY}$ and/or the $I_{XX}/I_{YY}$ ratio. In many embodiments, the one or more composite inserts can form greater than 25%, 30%, 35%, 40%, 45%, 50%, 55%, 60%, 65%, 70%, 75%, or greater than 80% of the club head surface area in the lower hemisphere (LH).

ii. Discrete Insert Embodiments

FIGS. 12-43 illustrate various embodiments of a golf club head comprising one or more discrete composite inserts. Each embodiment comprising one or more discrete composite inserts includes at least one crown insert and at least one sole insert. However, the golf club head can comprise any number of crown inserts and any number of sole inserts. The one or more composite inserts are secured to the frame to define the body. Each of the one or more discrete inserts is received within a corresponding opening located on the frame. Each opening is distinct and defined by one or more portions of the frame. As discussed above, the frame is formed from a metallic material to provide a sturdy structure for receiving the inserts, and the inserts are formed from a lightweight composite material, which creates discretionary mass that can be redistributed throughout the golf club head to maximize $I_{YY}$, provide an $I_{XX}/I_{YY}$ ratio close to 1, and/or to provide a club head CG position at or near the loft-normal axis 35.

The golf club head 1000 is used to illustrate various features of golf club heads comprising one or more discrete composite inserts. For example, the golf club head 1000 is used to illustrate various internal reinforcement structures, mass pads, and/or indentations. These structures, however, are not limited to golf club head 1000. The various clubs head embodiments comprising one or more discrete composite inserts as described herein can comprise any combination of said structures including, but not limited to, internal reinforcement structures, mass pads, and/or indentations.

A. Discrete Crown Insert and Sole Insert

Figure 12:
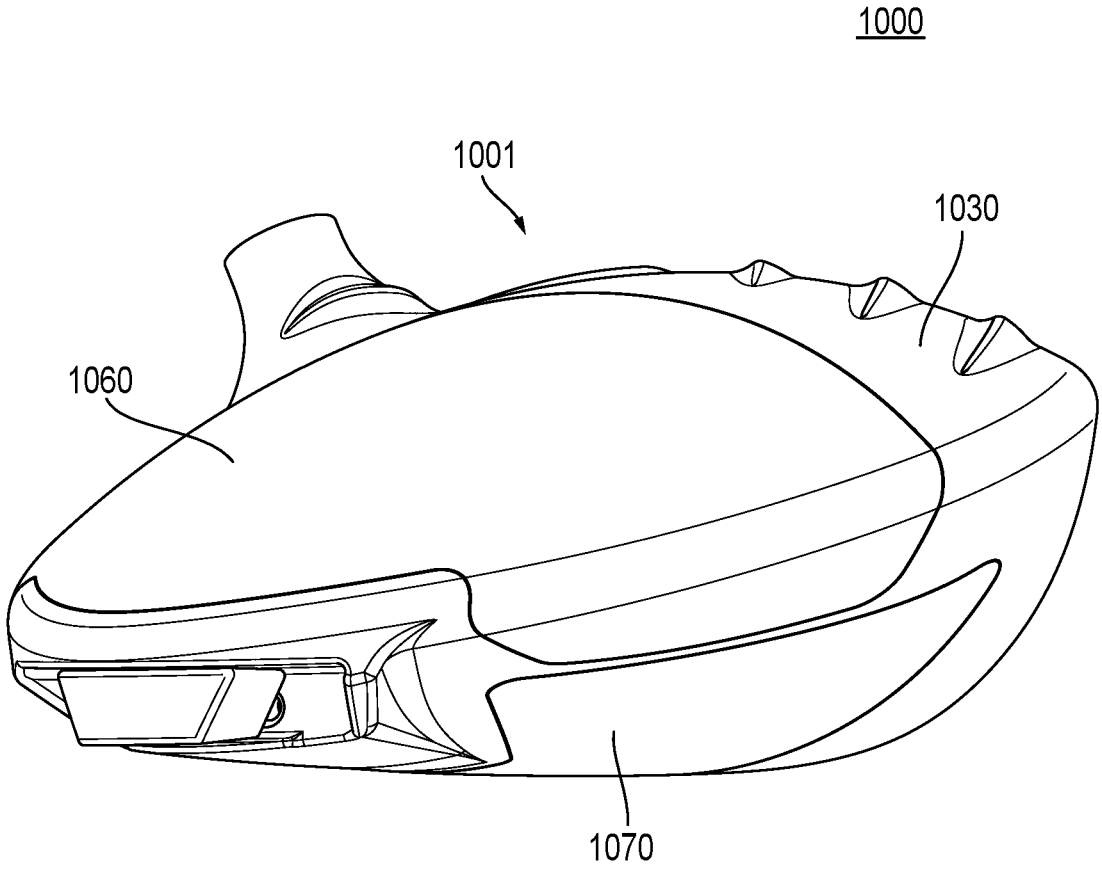
FIG. 12 illustrates a rear perspective view of a golf club head according to the present invention.
Figure 17:
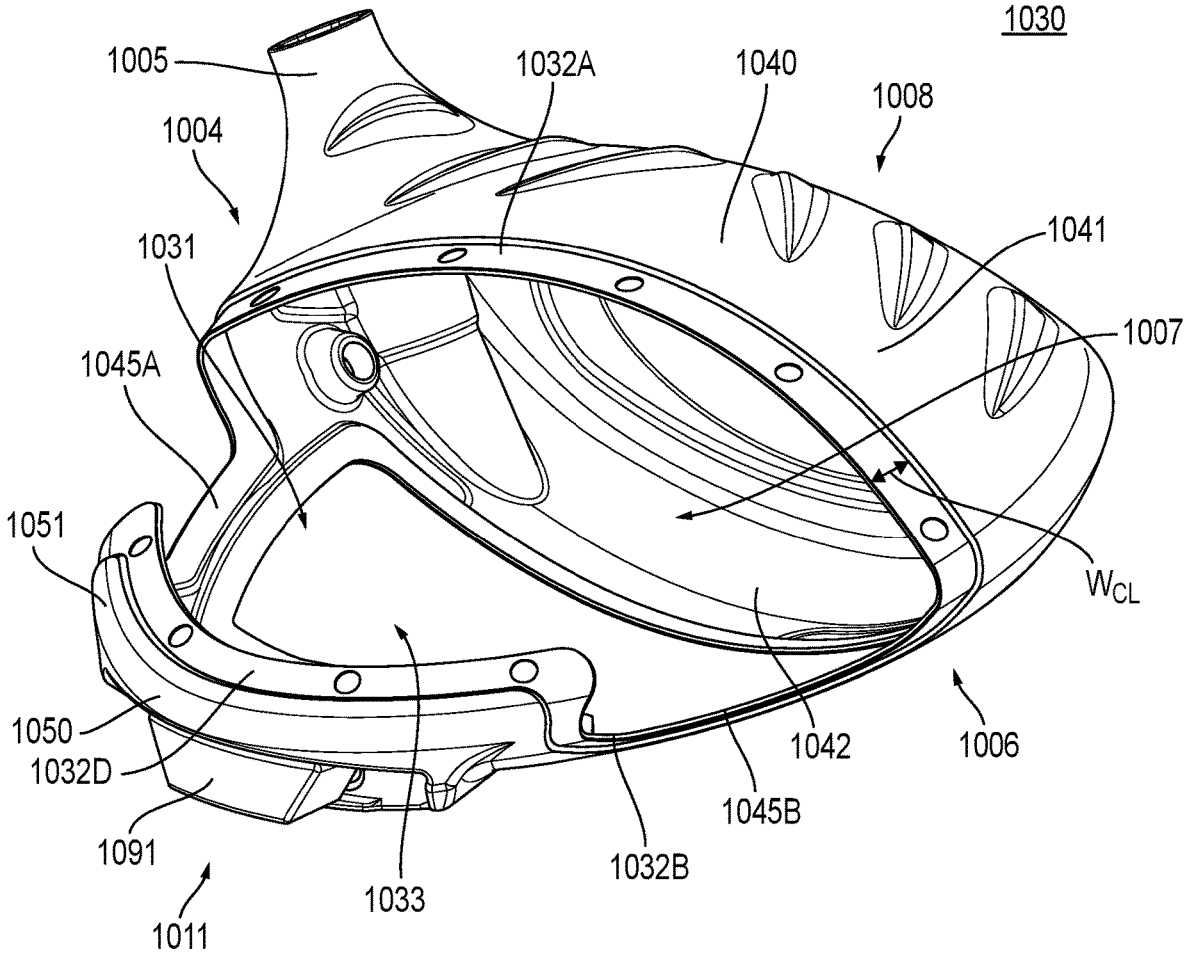
FIG. 17 illustrates a rear perspective view of the golf club head of FIG. 12, with portions removed to better show a frame of the golf club head.
Figure 18:
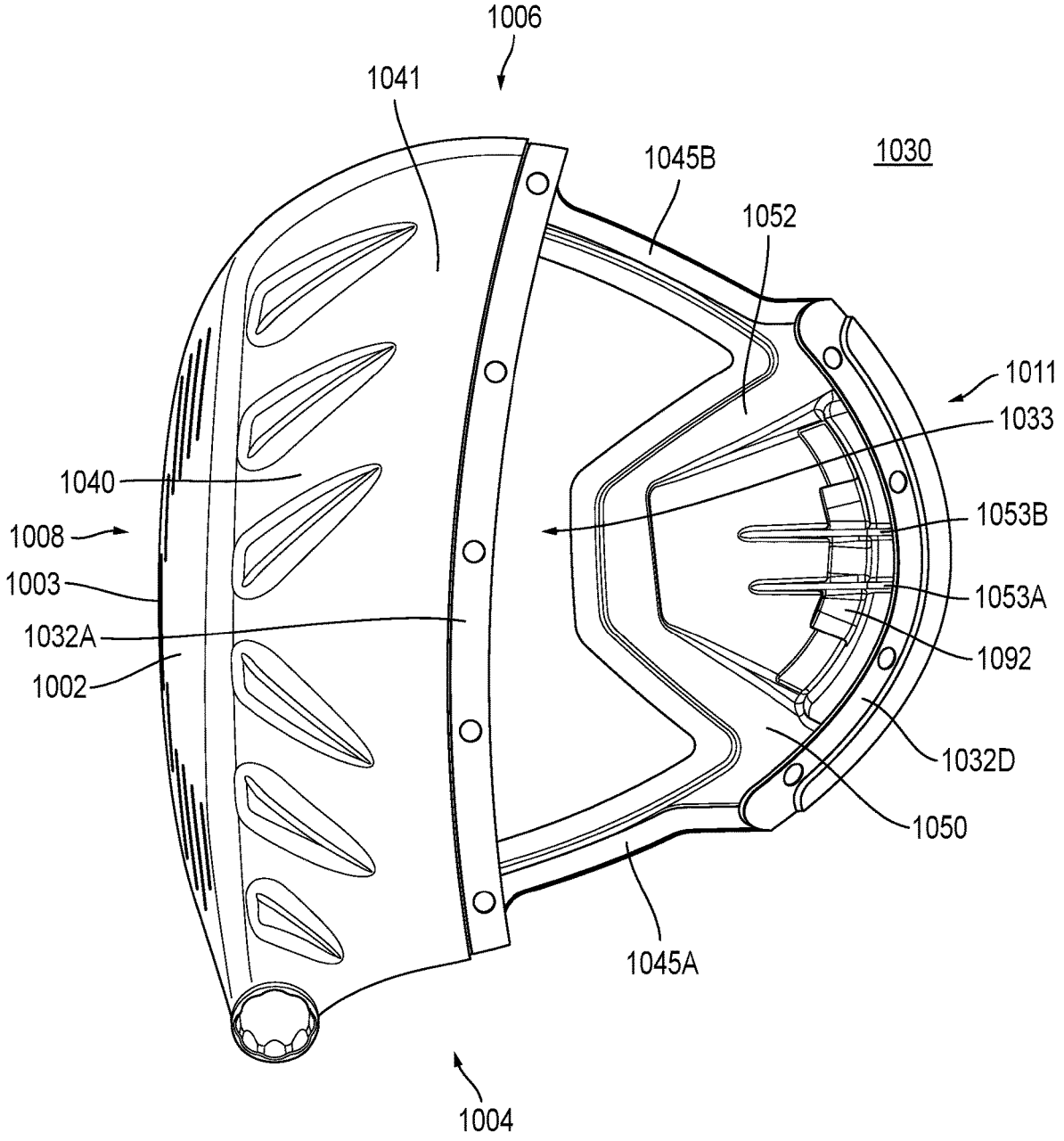
FIG. 18 illustrates a top plan view of the golf club head of FIG. 12, with portions removed to better show the frame.
Figure 19:
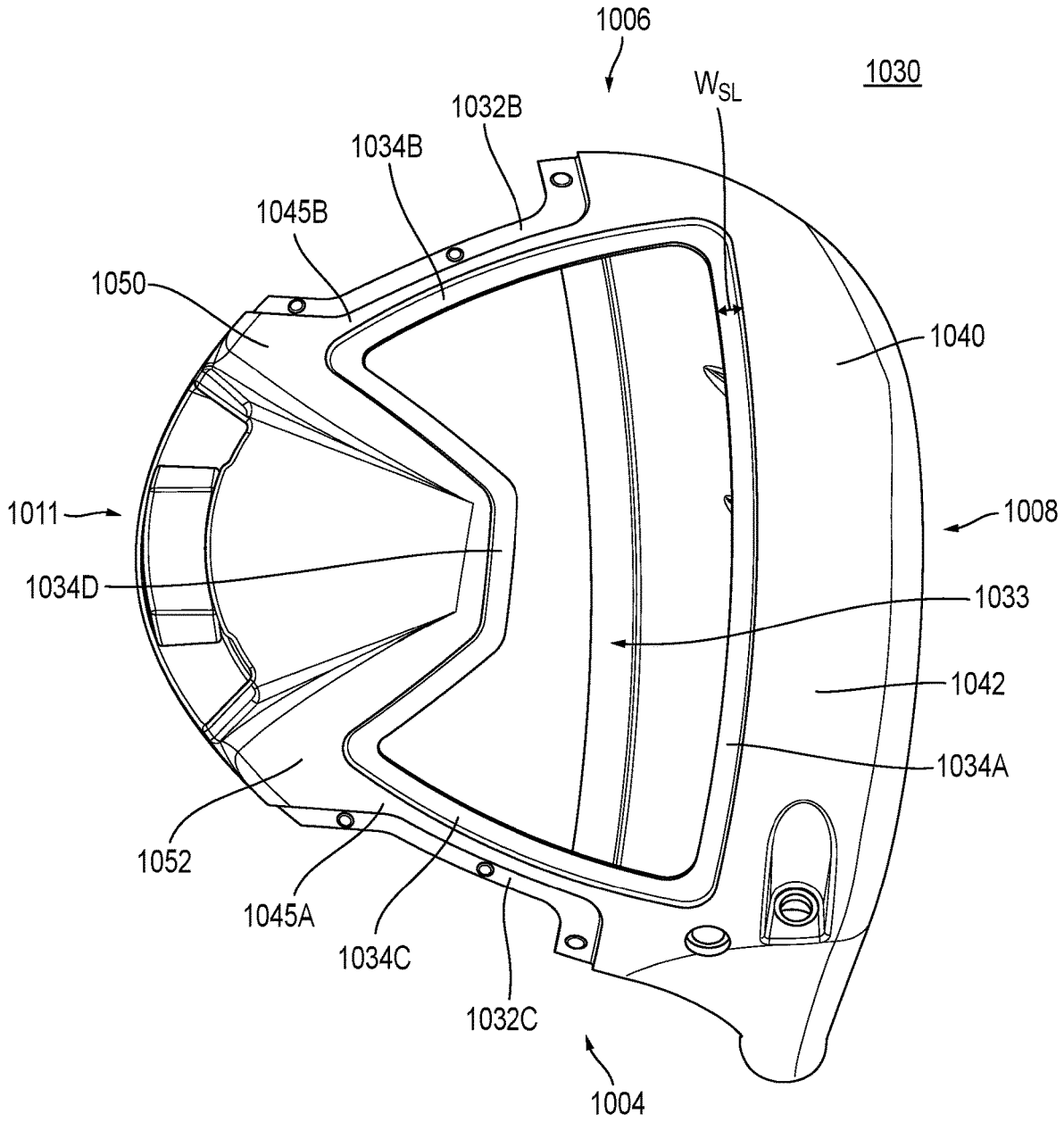
FIG. 19 illustrates a bottom plan view of the golf club head of FIG. 12, with portions removed to better show the frame.

FIGS. 12-30 illustrate one embodiment of a golf club head comprising one or more discrete composite inserts. The golf club head 1000 comprises two discrete composite inserts: a crown insert 1060 and a sole insert 1070. Referring to FIG. 12, the golf club head 1000 comprises a body 1001 having a frame 1030. The frame 1030 provides a structure for receiving the crown insert 1060 and the sole insert 1070. The combined frame 1030 and crown insert 1060 form portions of the crown 1010, the body perimeter, and the sole 1012, and the combined frame 1030 and sole insert 1070 form portions of the sole 1012. Referring to FIGS. 17-19, the frame 1030 comprises a forward frame 1040 near a front end 1008 of the golf club head 1000 and a rearward frame 1050 near a rear end 1011 of the golf club head 1000. The forward frame 1040 and the rearward frame 1050 are connected via one or more external bridges.

The forward frame 1040 is positioned near a front end 1008 of the golf club head 1000 and forms a forward portion of the frame 1030. Referring to FIGS. 17-19, the forward frame 1040 comprises a forward crown return 1041 that forms a forward portion of the crown 1010, and a forward sole return 1042 that forms a forward portion of the sole 1012. The forward frame 1040 includes a strike face 1002 and further forms the hosel 1005.

The forward crown return 1041 and the forward sole return 1042 are configured to withstand and dissipate the impact stresses associated with the golf club head 1000 striking a golf ball. Stress from a ball impact is largely or completely dissipated within the rearward extent of the forward crown return 1041 and the forward sole return 1042. The midsection (MS), which is rearward of the forward crown return 1041 and the forward sole return 1042, does not bear a significant portion of the ball striking impact stress. Therefore, the return portions 1041, 1042 allow for a large portion of the midsection (MS) to be formed from one or more composite inserts. Mass removed from the midsection (MS) can be allocated elsewhere in the golf club head 1000, such as into a weight member. The forward crown return 1041 and the forward sole return 1042 can extend rearwardly from the strike face 1002 a distance between 0.25 inch and 1.5 inches. In some embodiments, this distance can be between 0.25 inch and 0.75 inch, 0.50 inch and 1.00 inch, 0.75 inch and 1.25 inches, 1.00 inch and 1.25 inches, or between 1.10 inches and 1.50 inches.

The rearward frame 1050 is positioned near a rear end 1011 of the golf club head 1000 and forms a rearward portion of the frame 1030. Referring to FIGS. 17-19, the rearward frame 1050 comprises a rearward crown return 1051 that forms a rearward portion of the crown 1010, and a rearward sole return 1052 that forms a rearward portion of the sole 1012. In many embodiments, the rearward frame 1050 further comprises a weight housing structure 1092 for receiving a fixed or adjustable weight member 1091.

The forward frame 1040 and the rearward frame 1050 are connected via one or more external bridges. The external bridges span across the body 1001 and can connect various portions of the frame 1030 to one another. The external bridges are visible from the exterior of the golf club head 1000 and form a portion of the surface of the sole 1012. The external bridges help to define the one or more openings and provide separation between the one or more inserts. The external bridges are cast integrally with the forward frame 1040 and the rearward frame 1050. Referring to FIGS. 17-19, the frame 1030 comprises a heel-side external bridge 1045A and a toe-side external bridge 1045B connecting the forward sole return 1042 to the rearward sole return 1052 near the heel end 1004 and the toe end 1006, respectively.

The external bridges 1045A, 1045B can connect various portions of the forward frame 1040 to the rearward frame 1050. However, in most embodiments, the external bridges 1045A, 1045B are located closer to the sole 1012 to allow a portion of the crown insert 1060 to wrap over the body perimeter to the sole 1012 (discussed in more detail below). While the illustrated frame 1030 demonstrates two external bridges, the frame 1030 can comprise any number of external bridges. For example, frame 1030 can comprise one external bridge, two external bridges, three external bridges, four external bridges, five external bridges, six external bridges, or any suitable number of external bridges.

As discussed above, each of the one or more discrete inserts is received within a corresponding opening located on the frame. Each opening is configured with a ledge to create a bonding surface for the respective insert. The ledges are recessed into the frame 1030, away from the exterior surface of the frame 1030. The crown opening 1031 and the sole opening 1033 are separate and distinct openings that are separated by the heel-side external bridge 1045A and the toe-side external bridge 1045B.

Referring to FIGS. 17-19, the frame comprises a series of ledges 1032A, 1032B, 1032C, 1032D that collectively form a crown ledge and define a crown opening 1031. The crown opening 1031 is bounded by the forward frame 1040, the rearward frame 1050, the heel-side external bridge 1045A, and the toe-side external bridge 1045B. The crown ledge is recessed from an outer surface of the body 1001 to accommodate for the combined thickness of the overlap between the crown insert 1060, the crown ledge, and any adhesives used to secure these two components together. Therefore, the crown ledge allows an outer surface of the crown insert 1060 to sit flush with the adjacent surface of the frame 1030.

The crown ledge extends between the forward frame 1040 and the rearward frame 1050. The crown ledge is located primarily on the crown 1010 and wraps around the body perimeter to the sole 1012. The crown ledge comprises a forward crown ledge 1032A, a toeward crown ledge 1032B located on the sole proximate to the toe portion, a heelward crown ledge 1032C located on the sole proximate to the heel portion, and a rearward crown ledge 1032D located on the crown 1010 in the rear of the club head. The forward crown ledge 1032A is formed by a portion of the forward crown return 1041, and the rearward crown ledge 1032D is formed by a portion of the rearward crown return 1051. The toeward crown ledge 1032B is formed by a portion of the toe-side external bridge 1045B, and the heelward crown ledge 1032C is formed by a portion of the heel-side external bridge 1045A. The crown insert 1060 comprises complementary geometry to the crown opening 1031 such that the crown insert 1060 completely covers and seals the crown opening 1031 and overlaps the crown ledge 1032.

Referring to FIG. 17, the crown ledge defines a crown ledge width ($W_{CL}$) measured across the surface of the crown ledge between the beginning of the recessed portion and the edge of the crown opening 1031. In some embodiments, the crown ledge width ($W_{CL}$) can remain constant throughout the entire crown ledge. Alternatively, in other embodiments, the crown ledge width ($W_{CL}$) can vary throughout the forward crown ledge 1032A, the toeward crown ledge 1032B, the heelward crown ledge 1032C, and/or the rearward crown ledge 1032D. The crown ledge width ($W_{CL}$) is between 0.10 inch and 0.30 inch. For example, the crown ledge width ($W_{CL}$) can be between 0.10 inch and 0.15 inch, 0.10 inch and 0.25 inch, 0.15 inch and 0.20 inch, 0.15 inch and 0.25 inch, 0.20 inch and 0.25 inch, 0.20 inch and 0.30 inch, or between 0.25 inch and 0.30 inch. The crown ledge width ($W_{CL}$) is sized to provide sufficient bonding area for the crown insert 1060 without significantly increasing the structural mass of the frame 1030.

The crown ledge comprises an inner surface oriented to the hollow interior cavity 1007 and an outer surface opposite the inner surface. The crown ledge defines a crown ledge thickness measured between the outer surface and the inner surface of the crown ledge 1032. In some embodiments, the crown ledge thickness can remain constant throughout the entire crown ledge 1032. Alternatively, in other embodiments, the crown ledge thickness can vary throughout the forward crown ledge 1032A, the toeward crown ledge 1032B, the heelward crown ledge 1032C, and/or the rearward crown ledge 1032D. The crown ledge thickness can be between 0.015 inch and 0.035 inch. For example, the crown ledge thickness can be between 0.015 inch and 0.020 inch, 0.015 inch and 0.025 inch, 0.020 inch and 0.025 inch, 0.020 inch and 0.035 inch, 0.025 inch and 0.030 inch, or between 0.030 inch and 0.035 inch. In some embodiments, the rearward crown ledge 1032D is thicker than other portions of the crown ledge to withstand stresses imposed on the crown ledge due to a weight member located within the rearward frame 1050. In these embodiments, the crown ledge thickness can be greater than 0.020 inch near the rearward crown ledge 1032D. The crown ledge thickness is sized to provide structural support to the crown insert 1060 without significantly increasing the structural mass of the frame 1030.

Referring to FIGS. 17-19, the frame 1030 further comprises a series of ledges 1034A, 1034B, 1034C, 1034D that collectively form a sole ledge and define a sole opening 1033. The sole opening 1033 is bounded by the forward frame 1040, the rearward frame 1050, the heel-side external bridge 1045A, and the toe-side external bridge 1045B. The sole ledge is recessed from an outer surface of the body 1001 to accommodate the combined thickness of the overlap between the crown insert 1060, the sole ledge, and any adhesives used to secure the two components together, thereby allowing an outer surface of the sole insert 1070 to sit flush with the adjacent surface of the frame 1030.

The sole ledge extends between the forward frame 1040 and rearward frame 1050. In the illustrated embodiment, the sole ledge is contained entirely on the sole 1012 such that it does not wrap around the body perimeter to the crown 1010. However, in other embodiments, the sole ledge may wrap around the body perimeter to the crown 1010. The sole ledge comprises a forward sole ledge 1034A, a toeward sole ledge 1034B, a heelward sole ledge 1034C, and a rearward sole ledge 1034D. The forward sole ledge 1034A is formed by a portion of the forward sole return 1042, and the rearward sole ledge 1034D is formed by a portion of the rearward sole return 1052. The toeward sole ledge 1034B is formed by a portion of the toe-side external bridge 1045B, and the heelward sole ledge 1034C is formed by a portion of the heel-side external bridge 1045A. The sole insert comprises complementary geometry to the sole opening 1033 such that the sole insert completely covers and seals the sole opening 1033 and overlaps the sole ledge.

Referring to FIG. 19, the sole ledge defines a sole ledge width ($W_{SL}$) measured across the surface of the sole ledge between the beginning of the recessed portion and the edge of the sole opening 1033. The sole ledge width ($W_{SL}$) can remain constant throughout the entire sole ledge. Alternatively, the sole ledge width ($W_{SL}$) can vary throughout the forward sole ledge 1034A, the toeward sole ledge 1034B, the heelward sole ledge 1034C, and the rearward sole ledge 1034D. The sole ledge width ($W_{SL}$) can be between 0.10 inch and 0.80 inch. For example, the sole ledge width ($W_{SL}$) can be between 0.10 inch and 0.15 inch, 0.10 inch and 0.25 inch, 0.15 inch and 0.20 inch, 0.15 inch and 0.25 inch, 0.20 inch and 0.25 inch, 0.20 inch and 0.30 inch, 0.25 inch and 0.50 inch, 0.40 inch and 0.60 inch, 0.50 inch and 0.75 inch, or between 0.60 inch and 0.80 inch. The sole ledge width ($W_{SL}$) is sized to provide sufficient bonding area for the sole insert 1070 without significantly increasing the structural mass of the frame 1030.

The sole ledge comprises an inner surface oriented to the hollow interior cavity 1007 and an outer surface opposite the inner surface. The sole ledge defines a sole ledge thickness measured between the outer surface and the inner surface of the sole ledge. In some embodiments, the sole ledge thickness can remain constant throughout the entire sole ledge. Alternatively, in other embodiments, the sole ledge thickness can vary throughout the forward sole ledge 1034A, the toeward sole ledge 1034B, the heelward sole ledge 1034C, and/or the rearward sole ledge 1034D. The sole ledge thickness can be between 0.015 inch and 0.035 inch. For example, the sole ledge thickness can be between 0.015 inch and 0.020 inch, 0.015 inch and 0.025 inch, 0.020 inch and 0.025 inch, 0.020 inch and 0.035 inch, 0.025 inch and 0.030 inch, or between 0.030 inch and 0.035 inch. In some embodiments, the rearward sole ledge 1034D is thicker than other portions of the sole ledge to withstand stresses imposed on the sole ledge due to the weight member 1091. In these embodiments, the sole ledge thickness can be greater than 0.020 inch near the rearward sole ledge 1034D. The sole ledge thickness is sized to provide structural support to the sole insert 1070 without significantly increasing the structural mass of the frame 1030.

Figure 13:
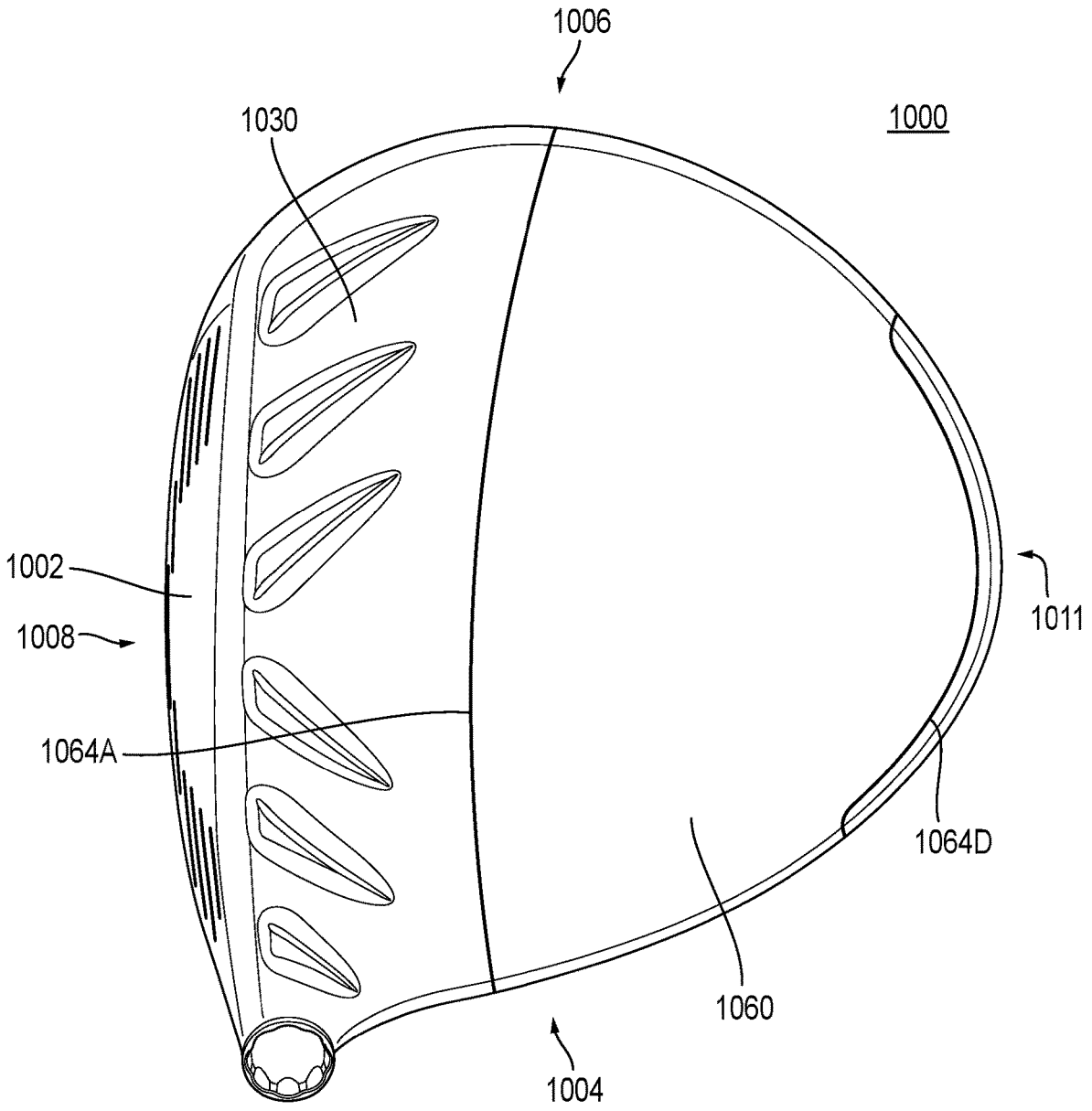
FIG. 13 illustrates a top plan view of the golf club head of FIG. 12.
Figure 14:
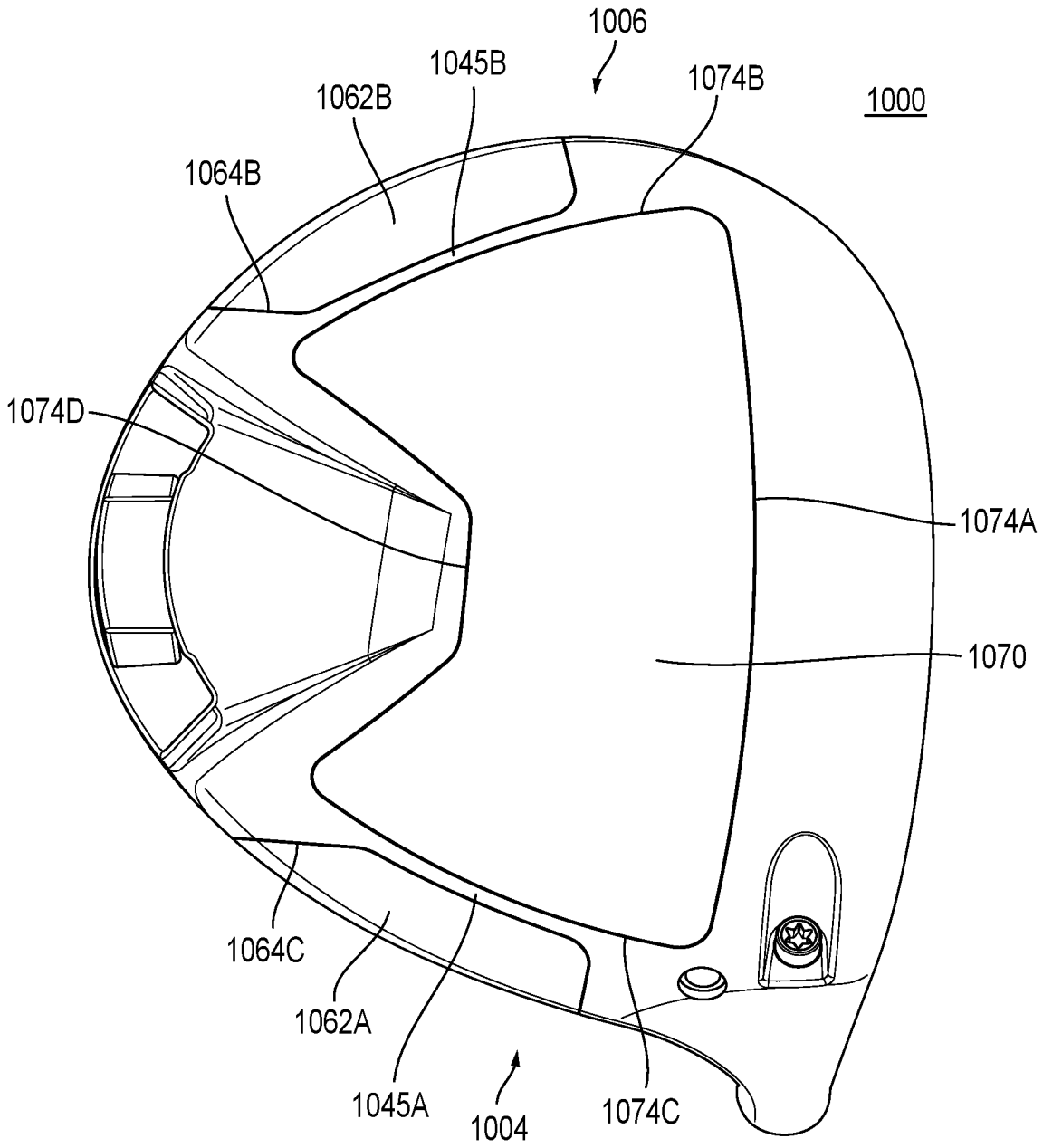
FIG. 14 illustrates a bottom plan view of the golf club head of FIG. 12.

As discussed above, the frame 1030 provides a sturdy structure for receiving one or more lightweight composite inserts. The one or more lightweight composite inserts provide a high-performing club head which has a high $I_{YY}$ and balances other performance characteristics such as the $I_{XX}/I_{YY}$ ratio, force transfer, aerodynamics, and CG adjustability as described above. Referring to FIGS. 12-14, the crown insert 1060 is received within the crown opening 1031, and the sole insert 1070 is received within the sole opening 1033 to enclose a hollow interior cavity 1007. The crown insert 1060 provides a lightweight structure that reduces the mass within the crown 1010 and allows for additional discretionary mass to be redistributed to other portions of the golf club head 1000. In particular, removing mass from the crown 1010 and the body perimeter via the crown insert 1060 is effective in lowering the club head CG toward the loft-normal axis 35.

The crown insert 1060 comprises an inner surface oriented to the hollow interior cavity 1007 and an outer surface opposite the inner surface. The forward crown return 1041 forms a forward portion of the crown 1010 proximate the strike face 1002, the rearward crown return 1051 forms a portion of the crown 1010 proximate the rear end 1011, and the crown insert outer surface can form the remainder of the crown 1010. In many embodiments, the crown insert outer surface forms a majority of the surface of the crown 1010.

The crown insert 1060 comprises a crown insert perimeter 1064 that traces an outline of the crown insert 1060. Referring to FIGS. 13 and 14, the crown insert perimeter 1064 comprises a crown insert forward edge 1064A, a crown insert toe edge 1064B, a crown insert heel edge 1064C, and a crown insert rear edge 1064D. The crown insert 1060 is bonded to the frame 1030 near the crown insert perimeter 1064.

Figure 15:
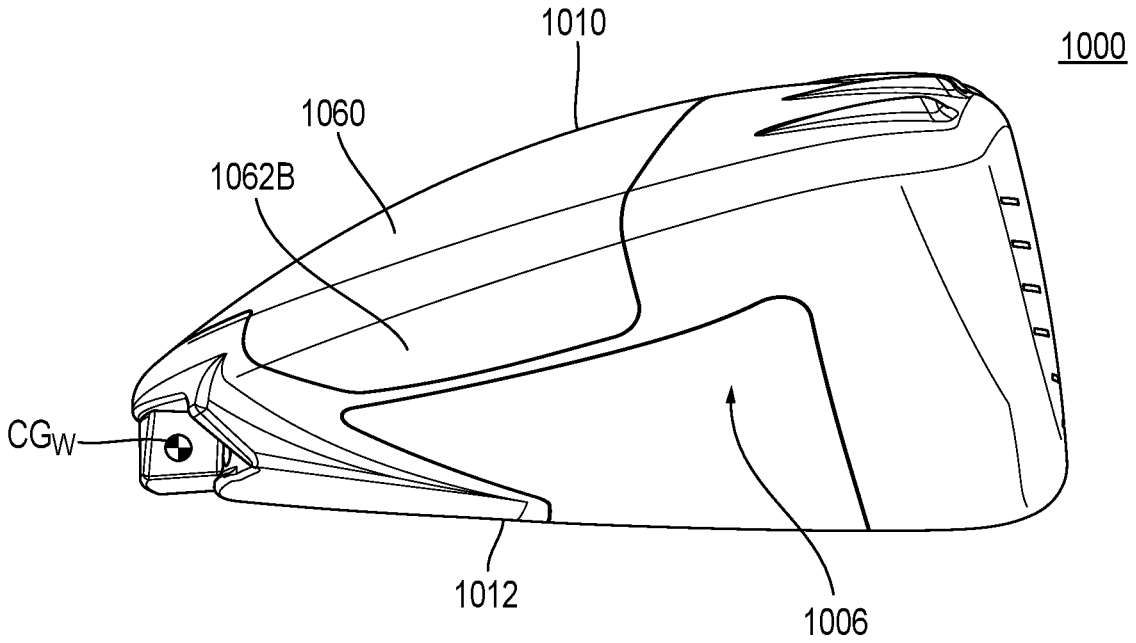
FIG. 15 illustrates a toe-side elevation view of the golf club head of FIG. 12.
Figure 16:
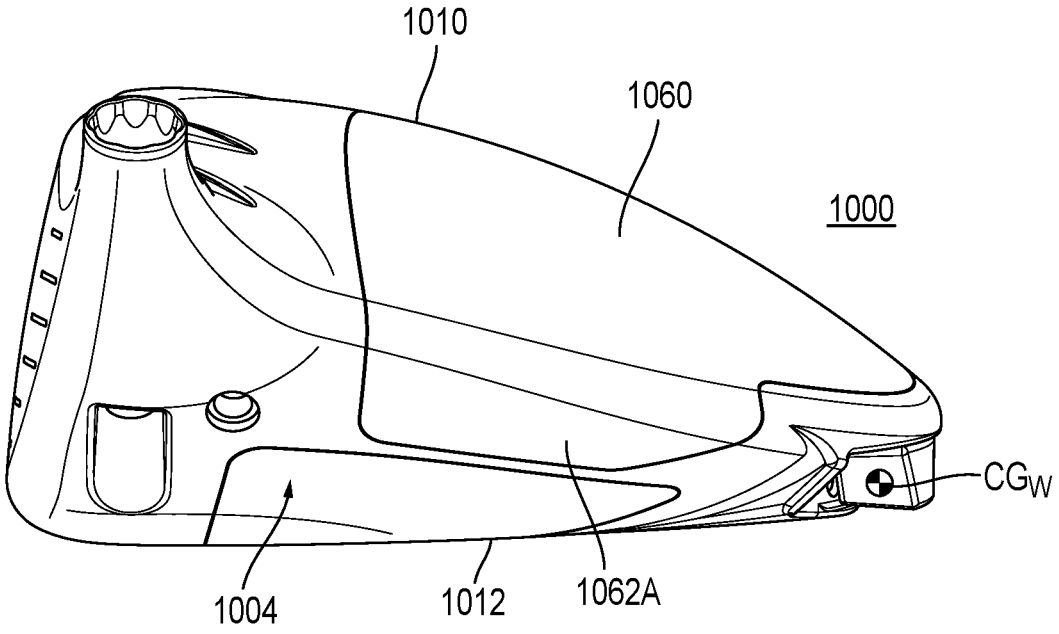
FIG. 16 illustrates a heel-side elevation view of the golf club head of FIG. 12.

Referring to FIGS. 14-16, the crown insert 1060 wraps around the heel end 1004 and the toe end 1006 and forms a portion of the sole 1012. Therefore, the crown insert 1060 forms a portion of the body perimeter in the heel end 1004 and the toe end 1006. The crown insert 1060 comprises a crown insert heel wrap 1062A, and a crown insert toe wrap 1062B. The crown insert heel wrap 1062A forms at least a portion of the sole 1012 near the heel end 1004, and the crown insert toe wrap 1062B forms at least a portion of the sole 1012 near the toe end 1006. The crown insert 1060 reduces the mass within the heel end 1004, the toe end 1006, and the sole 1012 by replacing the generally denser frame material with a lightweight material. The mass saved from the crown insert 1060 can be redistributed to maximize $I_{YY}$, provide an $I_{XX}/I_{YY}$ ratio close to 1, and/or to provide a club head CG position at or near the loft-normal axis 35. In particular, wrapping the crown insert 1060 over the body perimeter in the toe and heel portions removes perimeter mass that provides a significant contribution to $I_{YY}$. The resulting discretionary mass can therefore be reintroduced to locations that provide an $I_{XX}/I_{YY}$ ratio close to 1, such as a centrally located mass pad or a weight member 1091.

The wrap-around design of the crown insert 1060 can help increase the mass within the central mass zone (CMZ), providing a higher $I_{XX}/I_{YY}$ ratio. In many embodiments, the crown insert heel wrap 1062A, and the crown insert toe wrap 1062B form portions of the body perimeter and portions of the sole 1012 that are located near the body perimeter, both of which are outside of the central mass zone (CMZ). The present configuration of the crown insert 1060 removes mass from portions of the sole 1012 that are outside of the central mass zone (CMZ). The discretionary mass created by removing mass from the body perimeter and sole 1012 via the wrap-around design of the crown insert 1060 can be redistributed within the central mass zone (CMZ) to provide an $I_{XX}/I_{YY}$ ratio close to 1.

In some embodiments, the crown insert 1060 does not wrap over the rear edge of the body 1001. As illustrated in FIG. 13, the crown insert rear edge 1064D is bounded within the perimeter of the crown 1010 and does not extend over the rear end 1011 or onto the sole 1012. In many embodiments, as illustrated in FIG. 13, the crown insert rear edge 1064D can be located substantially near the rear end 1011. In other embodiments, the crown insert rear edge 1064D can be spaced a substantial distance from the rear end 1011. This configuration spaces the rearward connection between the crown insert 1060 and the rearward frame 1050 away from the rear end 1011. In many cases, doing so can provide both manufacturing and durability benefits by providing plenty of space between the composite crown insert 1060 and a weight member 1091 located proximate the rear end 1011. Manufacturers often require significant clearance between such a weight member 1091 and a composite component to enable the geometry of the weight housing structure 1092 to be cast.

The amount of non-metallic material forming the body 1001 can be characterized by the percentage of the crown surface area that is formed by the crown insert 1060 and/or the percentage of the sole surface area that is formed by the sole insert 1070. The crown insert 1060 removes a significant amount of mass from the crown 1010. The crown insert 1060 defines between 50% and 85% of the crown surface area. In some embodiments, the crown insert 1060 defines between 50% and 55%, 55% and 60%, 60% and 65, 65% and 70%, 70% and 75%, 75% and 80%, or between 80% and 85% of the crown surface area. Covering a large portion of the crown 110 with a lightweight material reduces the structural mass of the body 101 near the crown. This reduction of structural mass mitigates the adverse effects that providing a cube-like body shape has on the club head CG position.

Due to the crown insert heel wrap 1062A and crown insert toe wrap 1062B, the crown insert 1060 also removes a significant amount of mass from the sole 1012. The crown insert 1060 defines between 3% and 25% of the sole surface area. In some embodiments, the crown insert 1060 defines between 3% and 7%, 5% and 11%, 7% and 13%, 9% and 15%, 11% and 20%, or between 13% and 25% of the sole surface area. Additionally, the crown insert 1060 forms between 25% and 75% of the body perimeter. In some embodiments, the crown insert 1060 defines between 25% and 40%, 35% and 50%, 45% and 60%, 50% and 70%, or between 65% and 75% of the body perimeter. The crown insert coverage is selected to remove a significant amount of mass from the crown 1010. The higher the percentage of the body 1001 that is formed by a non-metal material, the more discretionary mass is available to strategically distribute to provide an $I_{XX}/I_{YY}$ ratio close to 1.

The crown insert 1060 defines a crown insert thickness measured between the inner surface and the outer surface of the crown insert 1060. In some embodiments, the crown insert thickness can be uniform throughout the crown insert 1060. In other embodiments, the crown insert thickness can vary throughout the crown insert 1060. The crown insert thickness is between 0.010 inch and 0.040 inch. In some embodiments, the crown insert thickness is between 0.010 inch and 0.020 inch, 0.015 inch and 0.030 inch, 0.025 inch and 0.035 inch, or between 0.030 inch and 0.040 inch. In some embodiments, the crown insert thickness can be less than 0.040 inch, 0.035 inch, 0.030 inch, 0.025 inch, 0.020 inch, or less than 0.015 inch. The crown insert thickness is large enough to provide a durable crown insert 1060 without significantly increasing the structural mass of the crown insert 1060.

The crown insert 1060 comprises a substantially low mass, despite forming a significant portion of the body 1001. The crown insert 1060 comprises a crown insert mass between 5 grams and 20 grams. In some embodiments, the crown insert mass is between 5 grams and 12 grams, 10 grams and 15 grams, 12 grams and 18 grams, or between 15 grams and 20 grams. In some embodiments, the crown insert mass can be less than 20 grams, 19 grams, 18 grams, 17 grams, 16 grams, 15 grams, 14 grams, 13 grams, 12 grams, 11 grams, 10 grams, 9 grams, 8 grams, 7 grams, or less than 6 grams. The crown insert mass is selected to provide a lightweight crown insert 1060 that reduces the structural mass of the body 1001.

The lightweight sole insert 1070 reduces the mass within the sole 1012 and therefore increases discretionary mass to be redistributed to other portions of the golf club head 1000. Although the sole insert 1070 removes mass low in the body 1001, the discretionary mass can be redistributed to other low portions, such as a rear weight member located in an extreme soleward position, or a mass pad located on the sole, which lowers the position of the club head CG better distributing mass to provide an $I_{XX}/I_{YY}$ ratio close to 1.

The sole insert 1070 comprises an inner surface oriented to the hollow interior cavity 1007 and an outer surface opposite the inner surface. The forward sole return 1042 forms a forward portion of the sole 1012 proximate the strike face 1002, the rearward sole return 1052 forms a portion of the sole 1012 proximate the rear end 1011, and the sole insert outer surface can form the remainder of the sole 1012. In the illustrated embodiment, the sole insert 1070 is retained within the sole 1012 such that it does not extend upwards past the body perimeter. However, in other embodiments, the sole insert 1070 may wrap around the body perimeter to form a portion of the crown 1010. In the embodiment illustrated in FIGS. 12-19, the sole insert 1070 does not form a portion of the weight housing structure 1092. In other embodiments, the sole insert 1070 can define a portion of the weight housing structure 1092.

The sole insert 1070 comprises a sole insert perimeter 1074 that traces an outline of the sole insert 1070. Referring to FIG. 14, the sole insert perimeter 1074 comprises a sole insert forward edge 1074A, a sole insert toe edge 1074B, a sole insert heel edge 1074C, and a sole insert rear edge 1074D. The sole insert 1070 is bonded to the frame 1030 near the sole insert 1070 perimeter.

The sole insert 1070 forms a significant portion of the sole 1012 to increase discretionary mass. The sole insert 1070 defines between 25% and 75% of the sole surface area. In some embodiments, the sole insert 1070 defines between 25% and 50%, 40% and 60%, 50% and 75%, or between 60% and 75% of the sole surface area. The sole insert coverage is selected to remove a significant amount of mass from the sole 1012. The higher the percentage of the body 1001 that is formed by a non-metal material, the more discretionary mass is available to strategically distribute to provide an $I_{XX}/I_{YY}$ ratio close to 1.

FIGS. 15 and 16 illustrate a toe-side elevation view and a heel-side elevation view of the golf club head 1000, respectively. As shown, portions of the sole insert 1070 extend upwards from the lowest portion of the sole 1012 towards the body perimeter near the heel end 1004 and the toe end 1006. The sole insert 1070 extends upward a significant portion of the body height ($H_B$) due to the curvature of the sole 1012. In many embodiments, a portion of the sole insert 1070 crosses into the upper hemisphere (UH). In these embodiments, the sole insert 1070 reduces mass within the upper hemisphere (UH) and allows the discretionary mass to be reallocated to the lower hemisphere (LH). The size of the sole insert 1070 can be characterized by a percentage of the sole insert surface area that is located within the upper hemisphere (UH). In many embodiments, between 5% and 30% of the sole insert surface area is located within the upper hemisphere (UH). In some embodiments, between 5% and 10%, 10% and 15%, 15% and 20%, 20% and 25%, or between 25% and 30% of the sole insert surface area is located within the upper hemisphere (UH).

The sole insert 1070 removes mass from the sole 1012, which is typically considered a more desirable location to include mass to help lower the club head CG and increase club head MOI. However, the mass saved by the sole insert 1070 can be reallocated to portions of the body 1001 that are even more efficient for lowering the club head CG and providing an $I_{XX}/I_{YY}$ ratio close to 1. In many embodiments, the mass saved by the sole insert can be reallocated to a weight member 1091, which, in many cases, is more effective at lowering the club head CG. In many embodiments, a portion of the sole insert 1070 extends up the heel end 1004 and the toe end 1006 to an elevation located above the elevation of the weight member $CG_W$ (discussed below). The effectiveness of the sole insert 1070 in lowering the club head CG and providing an $I_{XX}/I_{YY}$ ratio close to 1 can be characterized by a percentage of the sole insert that is located above the weight member $CG_W$. In many embodiments, between 15% and 50% of the sole insert area is located above the weight member $CG_W$. In some embodiments, between 15% and 25%, 20% and 40%, 25% and 35%, 30% and 45%, or between 35% and 50% of the sole insert is located above the weight member $CG_W$. Reallocating mass to a weight member 1091 located in an extreme soleward position, or an internal mass feature located on the sole 1012 keeps the club head CG low but also provides a better mass distribution for the $I_{XX}/I_{YY}$ ratio.

The sole insert 1070 defines a sole insert thickness measured between the inner surface and the outer surface. In some embodiments, the sole insert thickness can be uniform throughout the sole insert 1070. In other embodiments, the sole insert thickness can vary throughout the sole insert 1070. The sole insert thickness is between 0.010 inch and 0.040 inch. In some embodiments, the sole insert thickness is between 0.010 inch and 0.020 inch, 0.015 inch and 0.030 inch, 0.025 inch and 0.035 inch, or between 0.030 inch and 0.040 inch. In some embodiments, the sole insert thickness can be less than 0.040 inch, 0.035 inch, 0.030 inch, 0.025 inch, 0.020 inch, or less than 0.015 inch. The sole insert thickness is large enough to provide a durable sole insert 1070 without significantly increasing the structural mass of the sole insert 1070.

The sole insert 1070 comprises a substantially low mass, despite forming a significant portion of the body 1001. The sole insert 1070 comprises a sole insert mass between 4 grams and 20 grams. In some embodiments, the crown insert mass can be between 4 grams and 12 grams, 10 grams and 15 grams, 12 grams and 18 grams, or between 15 grams and 20 grams. In some embodiments, the sole insert mass can be less than 20 grams, 19 grams, 18 grams, 17 grams, 16 grams, 15 grams, 14 grams, 13 grams, 12 grams, 11 grams, 10 grams, 9 grams, 8 grams, 7 grams, or less than 6 grams. The sole insert mass is selected to provide a lightweight sole insert 1070 that reduces the structural mass of the body 1001.

Despite forming a majority of the body 1001, the one or more discrete inserts can define a small percentage of the total club head mass. In many embodiments, the combined mass of the one or more discrete inserts defines between 3% and 20% of the total club head mass. In some embodiments, the combined mass of the one or more discrete inserts defines between 3% and 10%, 5% and 15%, 7% and 16%, 10% and 15%, 12% and 20%, or between 15% and 20% of the total club head mass. As such, a large amount of discretionary mass is created by the one or more discrete inserts that can be redistributed throughout the club head to maximize $I_{YY}$, provide an $I_{XX}/I_{YY}$ ratio close to 1, and/or to provide a club head CG position at or near the loft-normal axis.

The body shape of the golf club head generally affects the sound and feel response. The body shapes described herein may, in some cases, introduce dominant vibrations at impact that lead to a harsh sound or feel at impact. The golf club head 1000 can further comprise various internal reinforcement structures that reduce vibrations in specific areas of the body 1001. The internal reinforcement structures can be provided to damp vibrations and provide a more desirable, muted sound and feel response.

The location of the internal reinforcement structures can improve structural rigidity and/or acoustic/vibrational response. The internal reinforcement structures can be located on the frame 1030, the crown insert 1060, and/or the sole insert 1070. In some embodiments, the frame 1030 can comprise one or more internal bridges that span across one or more of the openings to further reinforce each opening. In some embodiments, the frame 1030 can comprise one or more frame ribs that extend along internal surfaces of the frame 1030 to provide reinforcement to various locations that experience high vibrations at impact. In some embodiments, the crown insert 1060 and/or the sole insert 1070 can comprise one or more insert ribs that extend along internal surfaces of the inserts. The golf club head 1000 can comprise any combination of the internal reinforcement structures described below.

The golf club head 1000 can comprise one or more internal bridges to structurally reinforce the crown opening 1031 and/or the sole opening 1033. The internal bridges contact an interior surface of the one or more of the discrete inserts, thereby increasing the available surface area for bonding between the insert and the frame 1030. The internal bridges also reduce vibrations present in the frame 1030. The internal bridges can be located along any desired portion of the frame 1030 that improves structural rigidity and/or acoustic/vibrational response.

The internal bridges are offset inwardly from the exterior surface of the frame 1030 and concealed beneath one or more of the discrete inserts. The internal bridges are concealed by the insert such that the internal bridges are not visible from the exterior of the golf club head 1000. Like the external bridges 1045A, 1045B, the internal bridges are formed integrally with the frame 1030 and span across an opening to connect various portions of the frame 1030. The internal bridges are different from the external bridges 1045A, 1045B because they do not define the openings. Rather, the internal bridges are located within the openings and extend across at least a portion of a respective opening. The internal bridges can be located near the crown 1010, the sole 1012, and/or the body perimeter. Various examples of internal bridges are illustrated in FIGS. 20A-22C. The golf club head 1000 can comprise any combination of the internal bridges described herein.

Figure 20A:
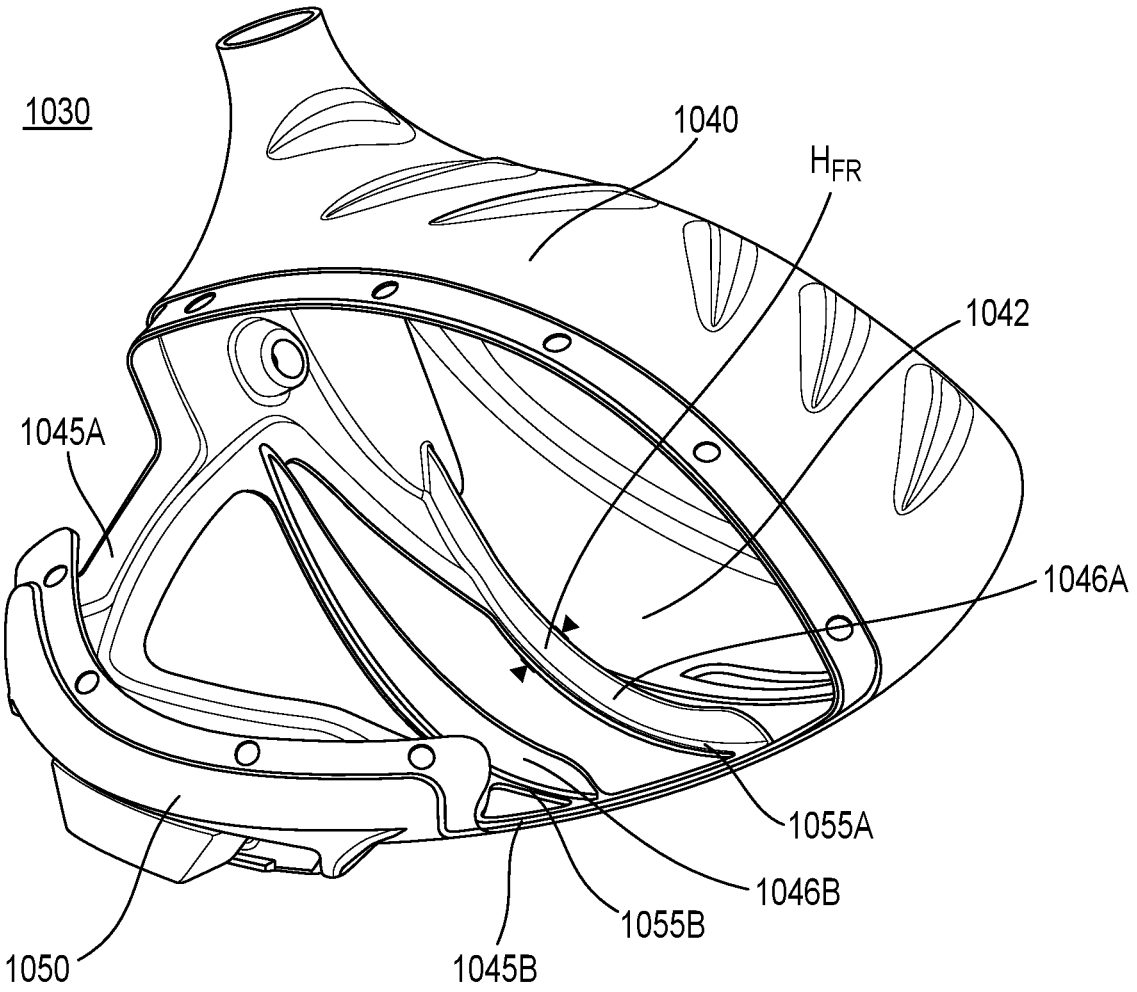
FIG. 20A illustrates a rear-perspective view of a golf club head according to the present invention, with portions removed to better show a frame with internal reinforcing features.
Figure 20B:
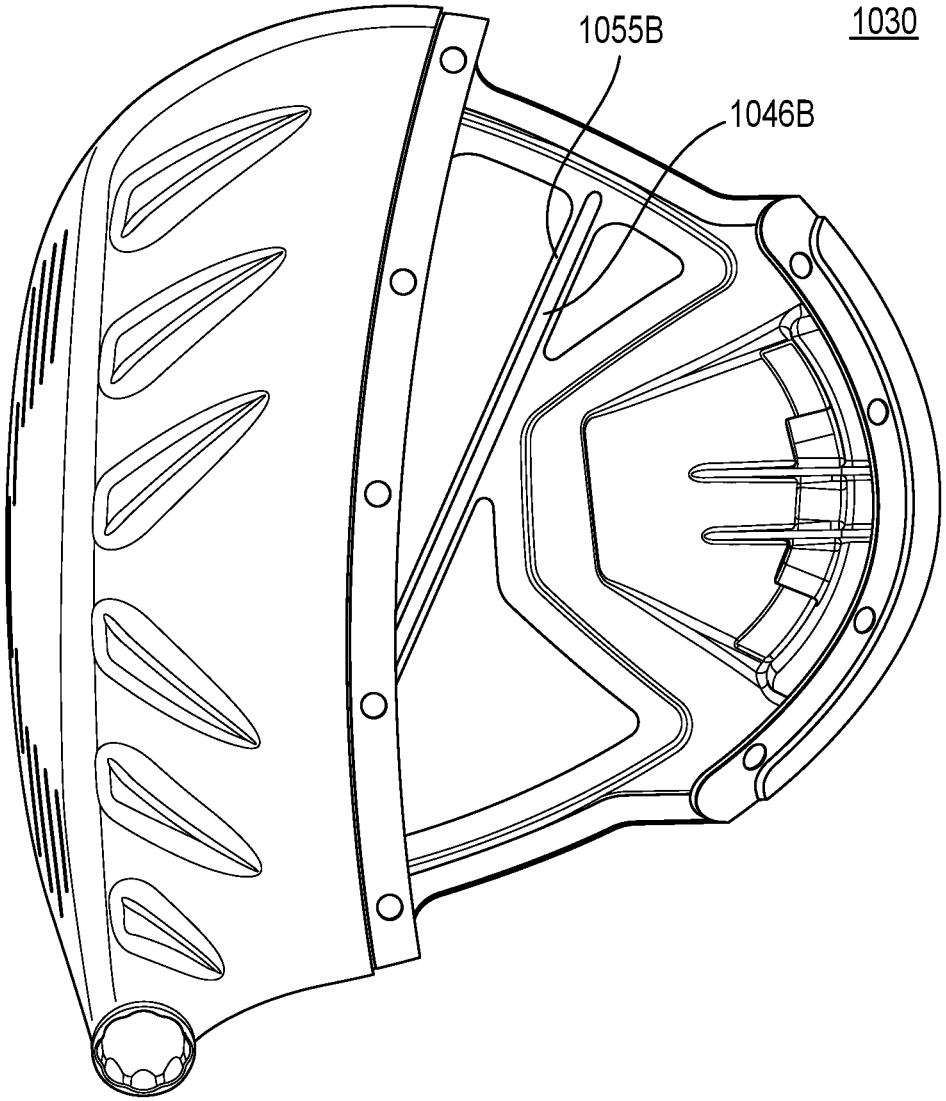
FIG. 20B illustrates a top plan view of the golf club head of FIG. 20A, with portions removed to better show the frame and reinforcing features.
Figure 20C:
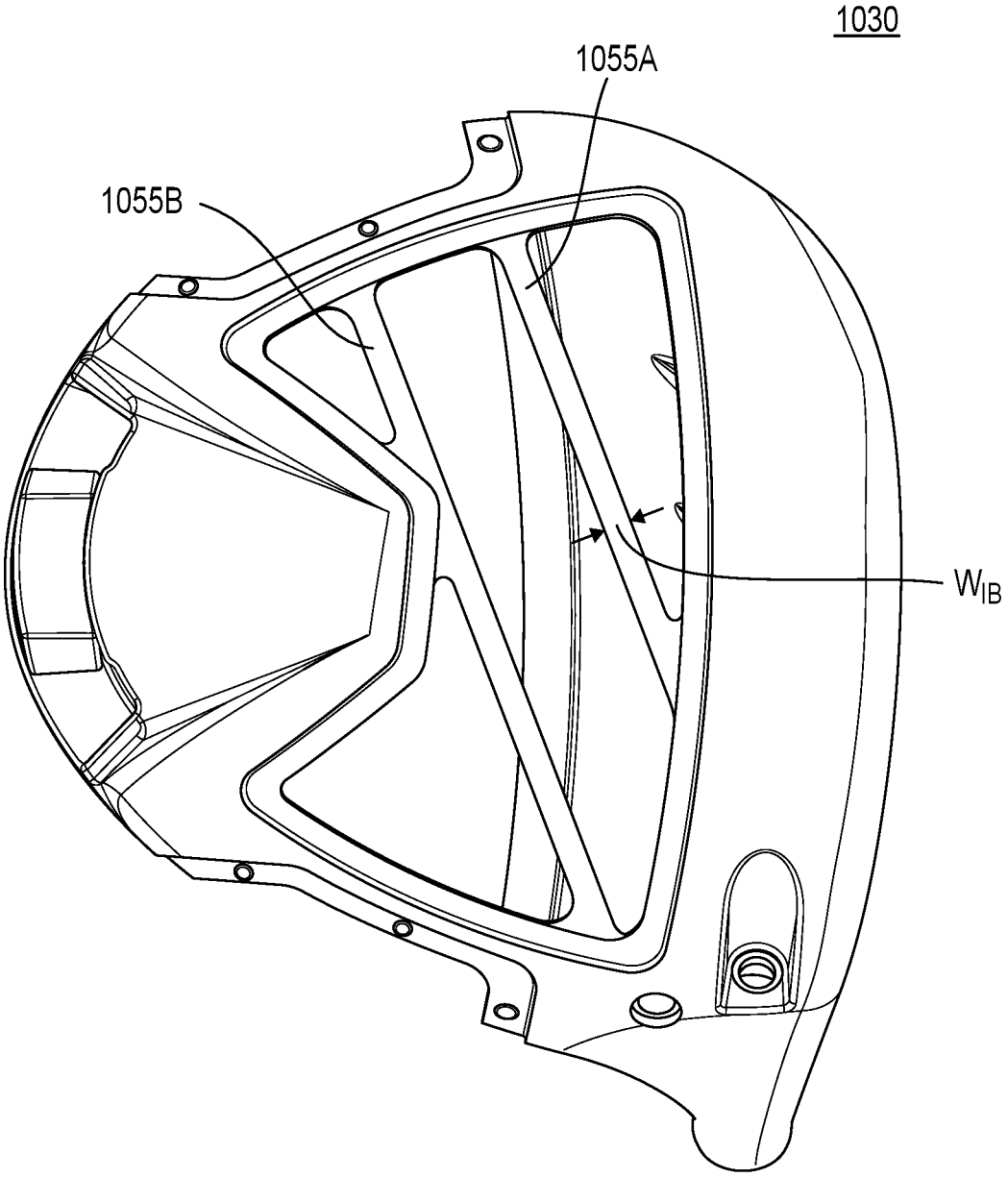
FIG. 20C illustrates a bottom plan view of the golf club head of FIG. 20A, with portions removed to better show the frame and reinforcing features.

FIGS. 20A-20C illustrate a frame 1030 comprising two external bridges 1045A, 1045B, two internal bridges 1055A, 1055B, and two frame ribs 1046A, 1046B. The forward internal bridge 1055A and the rearward internal bridge 1055B extend diagonally across the sole opening 1033 between the toe-side external bridge 1045B and the forward sole return 1042. The forward frame rib 1046A and the rearward frame rib 1046B extend upward from the forward internal bridge 1055A and the rearward internal bridge 1055B, respectively (discussed in more detail below).

Figure 21A:
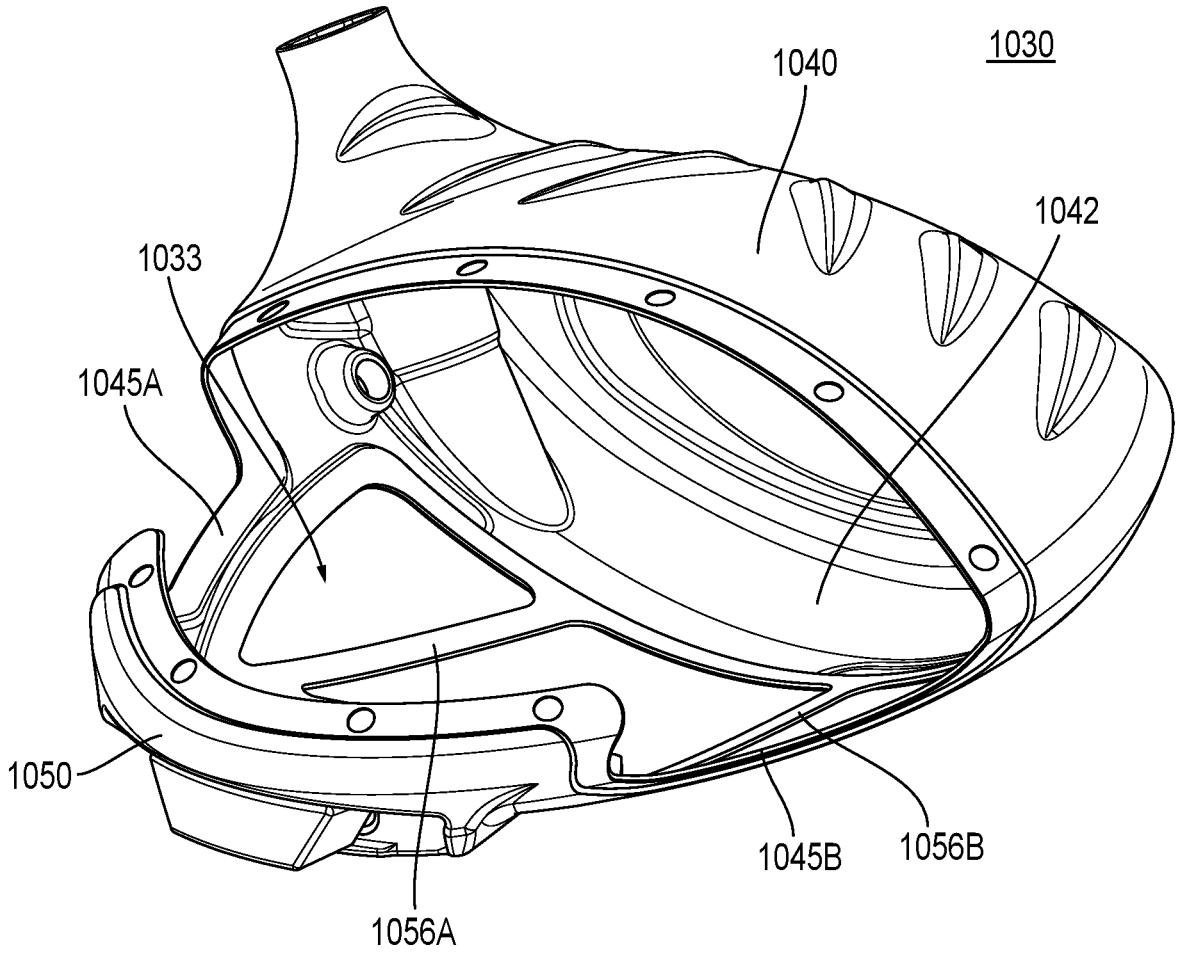
FIG. 21A illustrates a rear perspective view of a golf club head according to the present invention, with portions removed to better show a frame with internal reinforcing features.
Figure 21B:
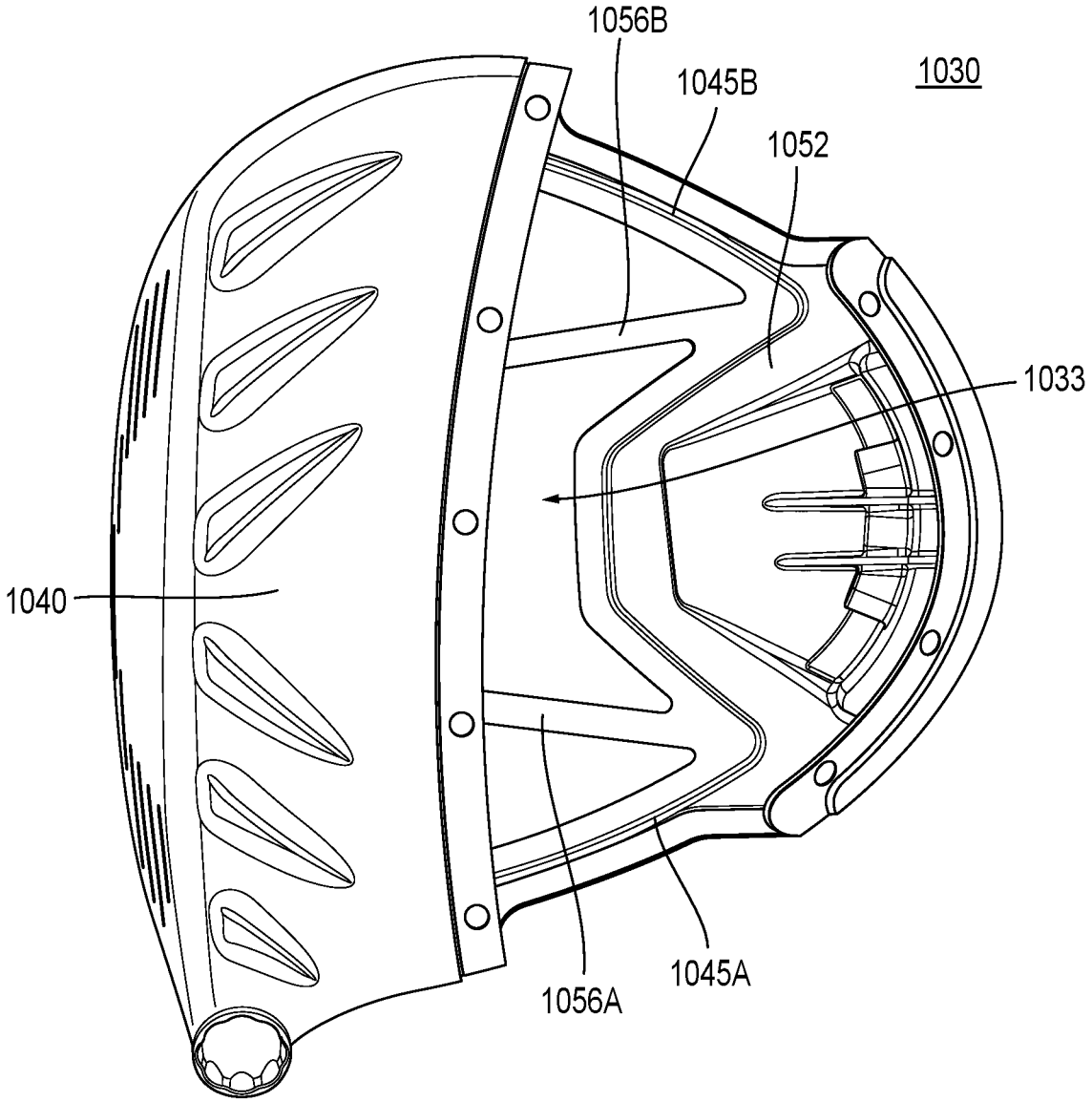
FIG. 21B illustrates a top plan view of the golf club head of FIG. 21A, with portions removed to better show the frame and reinforcing features.
Figure 21C:
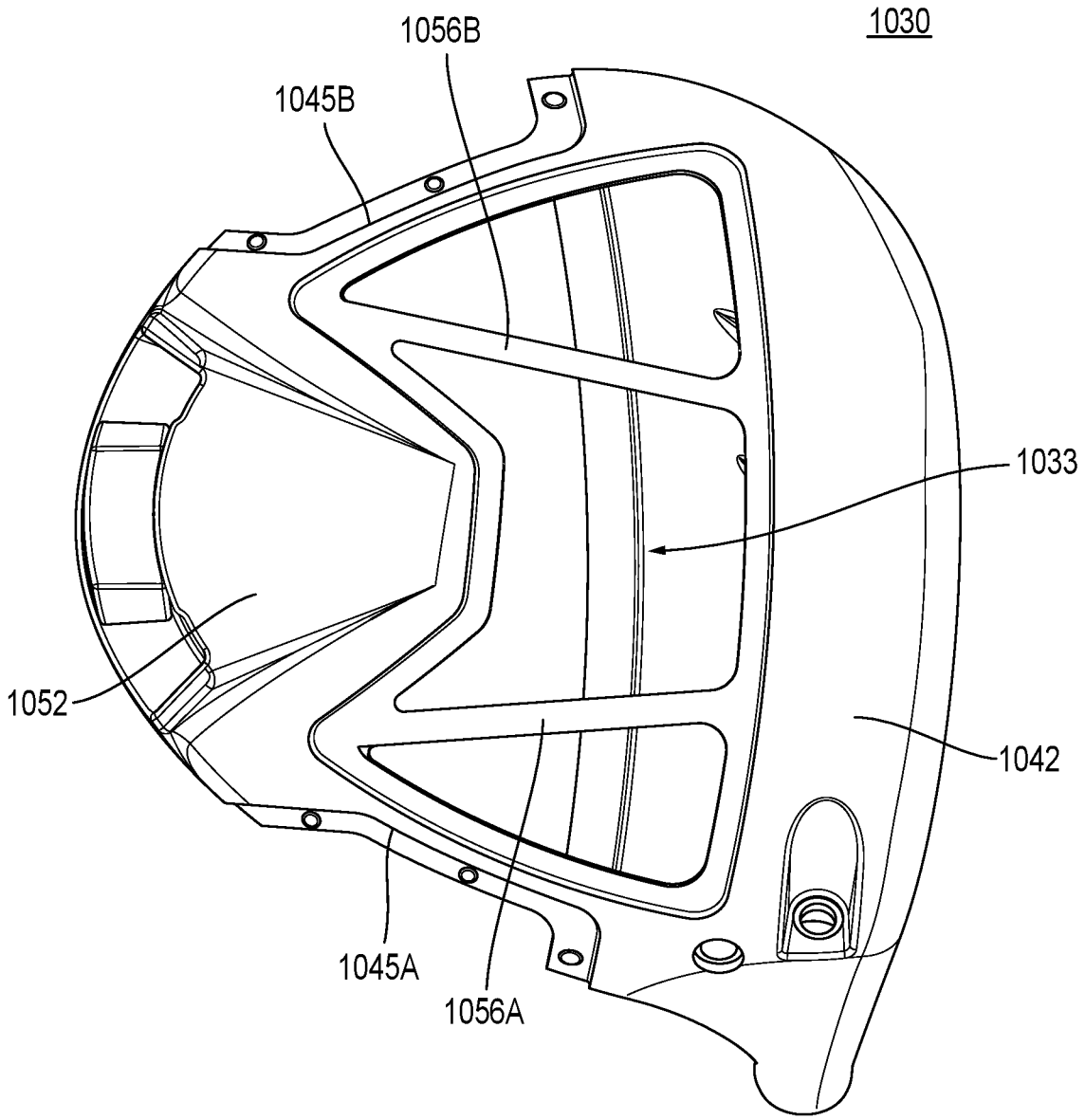
FIG. 21C illustrates a bottom plan view of the golf club head of FIG. 21A, with portions removed to better show the frame and reinforcing features.

FIGS. 21A-21C illustrate a frame 1030 comprising two external bridges 1045A, 1045B, and two internal sole bridges 1056A, 1056B. The heel-side sole bridge 1056A and the toe-side sole bridge 1056B extend in a front-to-rear direction across the sole opening 1033 between the forward sole return 1042 and the rearward sole return 1052.

Figure 22A:
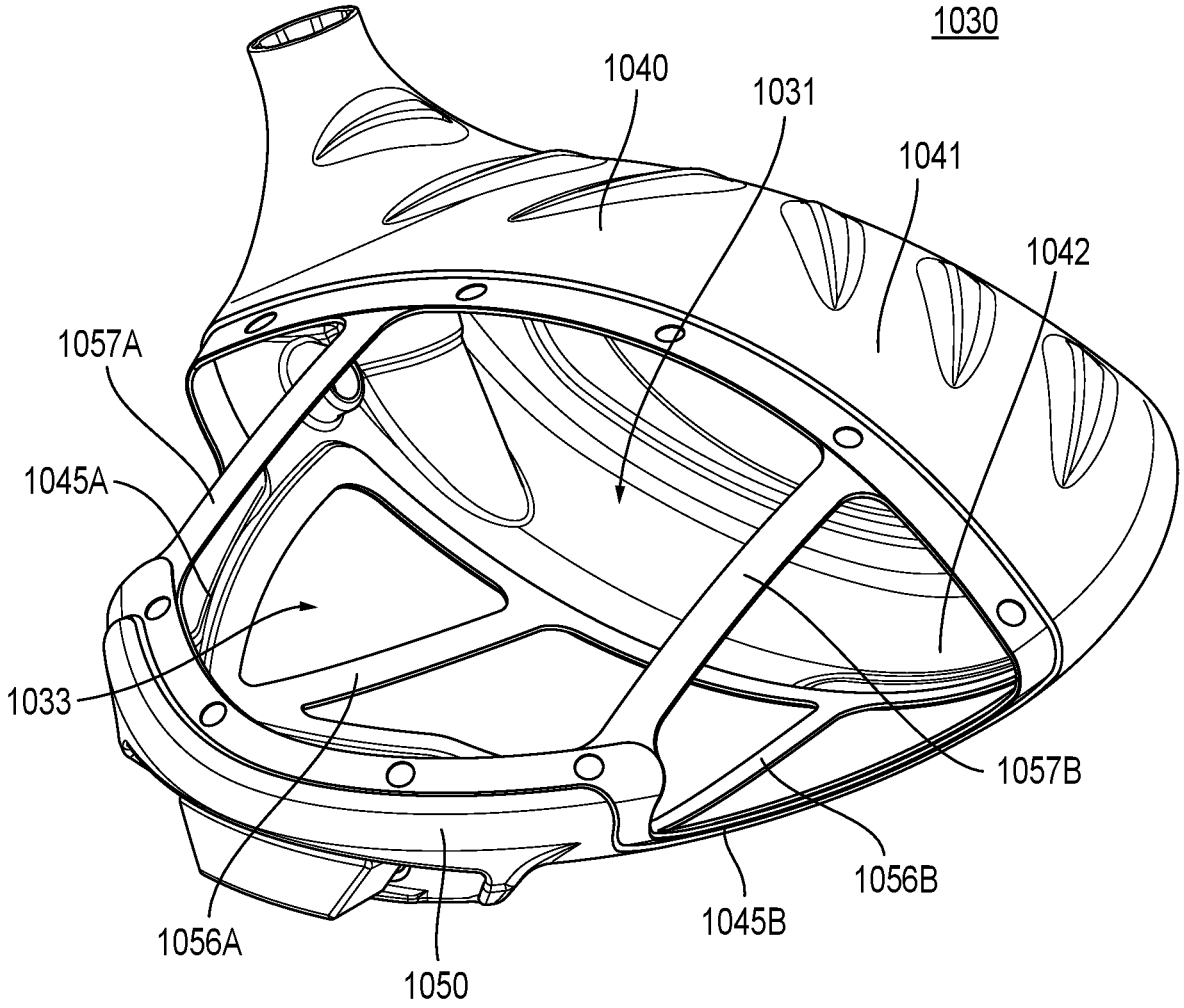
FIG. 22A illustrates a rear perspective view of a golf club head according to the present invention, with portions removed to better show a frame with internal reinforcing features.
Figure 22B:
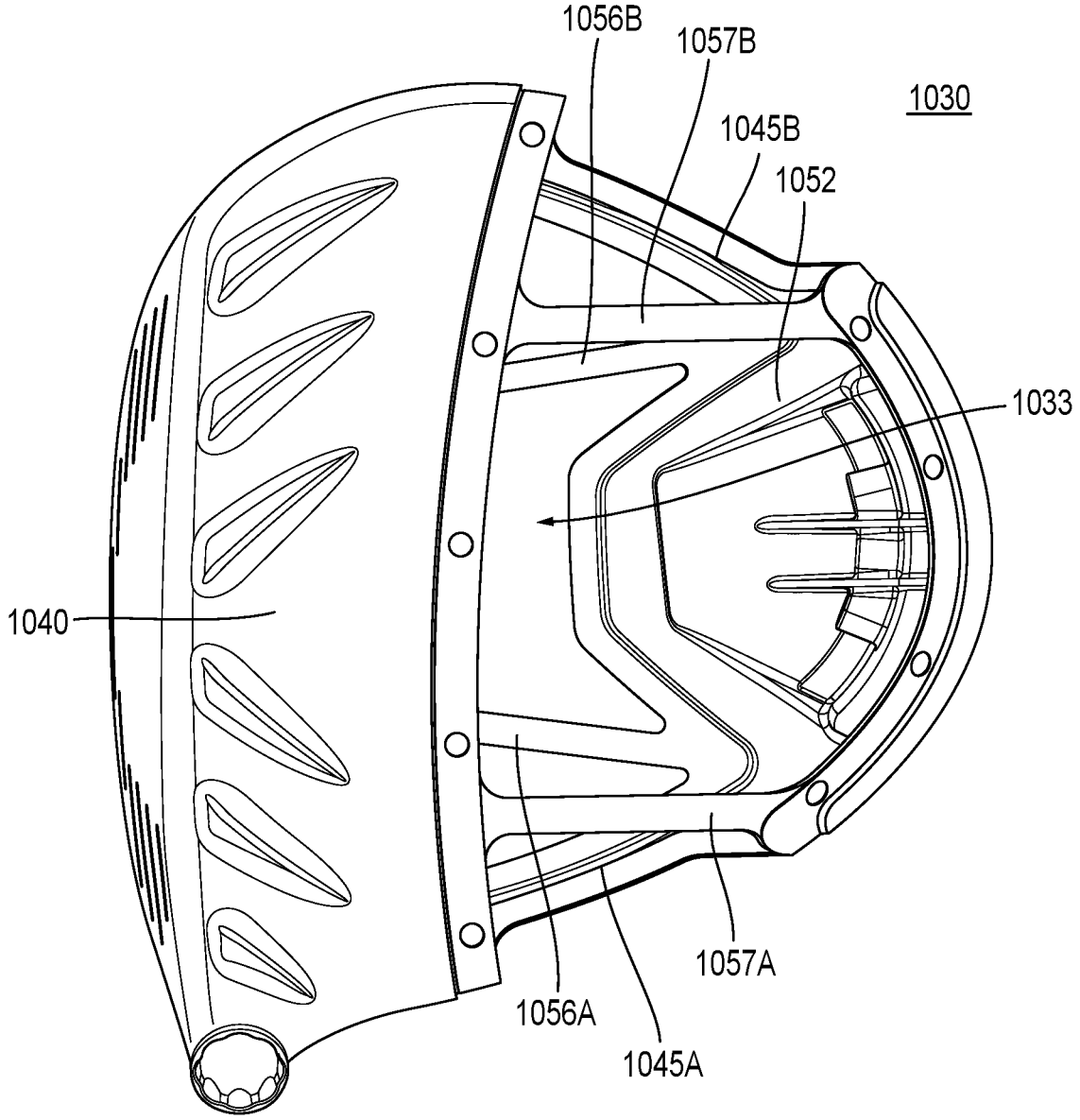
FIG. 22B illustrates a top plan view of the golf club head of FIG. 22A, with portions removed to better show the frame and reinforcing features.
Figure 22C:
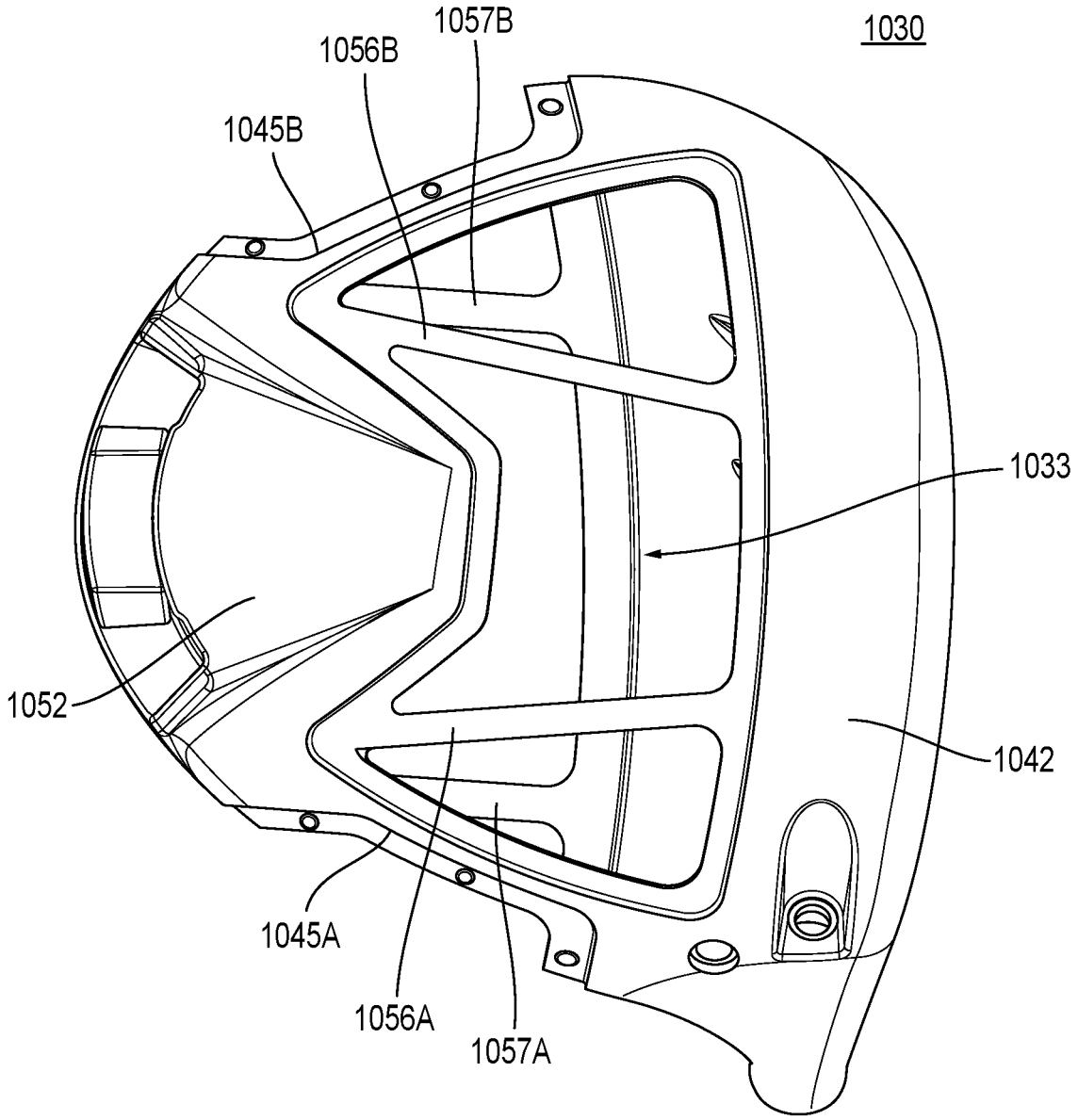
FIG. 22C illustrates a bottom plan view of the golf club head of FIG. 22A, with portions removed to better show the frame and reinforcing features.

FIGS. 22A-22C illustrate a frame 1030 comprising two external bridges 1045A, 1045B, two internal sole bridges 1056A, 1056B, and two internal crown bridges 1057A, 1057B. The heel-side sole bridge 1056A and the toe-side sole bridge 1056B extend in a front-to-rear direction across the sole opening 1033 between the forward sole return 1042 and the rearward sole return 1052. The heel-side crown bridge 1057A and the toe-side crown bridge 1057B extend in a front-to-rear direction across the crown opening 1031 between the forward crown return 1041 and the rearward crown return 1051.

As discussed above, the internal bridges can connect any two portions of the frame 1030. The internal bridges can comprise any shape and can extend in any direction between adjacent portions of an opening. For example, the internal bridges can extend in a front-to-rear direction, a heel-to-toe direction, or in a diagonal direction. The internal bridges can be parallel to the strike face 1002, perpendicular to the strike face 1002, or at an angle relative to the strike face 1002. In some embodiments, the internal bridges can be angled between approximately 5 degrees and 45 degrees relative to the strike face 1002. For embodiments including multiple internal bridges, the internal bridges can be substantially parallel to one another, or the internal bridges can be orientated at an angle relative to one another. In some embodiments, the internal bridges can intersect with one another. While the illustrated embodiments each comprise either two or four internal bridges, the frame 1030 can comprise any number of internal bridges. For example, frame 1030 can comprise one internal bridge, two internal bridges, three internal bridges, four internal bridges, five internal bridges, six internal bridges, or any suitable number of internal bridges.

The one or more internal bridges comprise various dimensions including an internal bridge width ($W_{IB}$) and an internal bridge thickness. Each dimension is sized to provide sufficient structural support to the frame 1030. While the internal bridge 1055A used to illustrate certain dimensions is located near the sole 1012, the following dimensions can be applied to any internal bridge located anywhere on the frame 1030.

Referring to FIG. 20C, each internal bridge defines an internal bridge width ($W_{IB}$) measured across the surface of the internal bridge. In some embodiments, the internal bridge width ($W_{IB}$) can remain constant throughout the entire internal bridge. In other embodiments, the internal bridge width ($W_{IB}$) can vary in any direction throughout internal bridge. The internal bridge width ($W_{IB}$) is between 0.10 inch and 1.50 inch. For example, the internal bridge width ($W_{IB}$) can be between 0.10 inch and 0.25 inch, 0.10 inch and 0.35 inch, 0.15 inch and 0.20 inch, 0.15 inch and 0.25 inch, 0.20 inch and 0.35 inch, 0.20 inch and 0.40 inch, 0.25 inch and 0.50 inch, 0.30 inch and 0.80 inch, 0.50 inch and 0.75 inch, 0.60 inch and 0.90 inch, 0.75 inch and 1.00 inch, 0.90 inch and 1.20 inches, 1.00 inch and 1.30 inches, 1.25 inches and 1.40 inches, or between 1.30 inches and 1.50 inches. The internal bridge width ($W_{IB}$) is large enough to provide sufficient structural support to the frame 1030 without significantly increasing the structural mass of the frame 1030.

Each internal bridge defines an internal bridge thickness measured between the outer surface and the inner surface of the internal bridge. In some embodiments, the internal bridge thickness can remain constant throughout the entire internal bridge. In other embodiments, the internal bridge thickness can vary in any direction throughout internal bridge. The internal bridge thickness can be between 0.015 inch and 0.050 inch. For example, the internal bridge thickness can be between 0.015 inch and 0.020 inch, 0.015 inch and 0.025 inch, 0.020 inch and 0.025 inch, 0.020 inch and 0.035 inch, 0.025 inch and 0.030 inch, 0.035 inch and 0.045 inch, or between 0.035 inch and 0.050 inch. The internal bridge thickness is large enough to provide sufficient structural support to the frame 1030 without significantly increasing the structural mass of the frame 1030.

In some embodiments, the internal bridges can be integrally cast with the frame 1030 such that they are formed from the same material as the frame 1030. In other embodiments, the internal bridges can be separately formed and attached to the frame 1030. In embodiments with separately formed internal bridges, the internal bridges can be formed from any suitable material such as a metallic material, a composite material, or any other suitable material. Further, the separately formed internal bridges can be attached to the frame 1030 using any suitable attachment mechanism such as adhesives, welding, over molding, or any other suitable attachment mechanism.

The frame 1030 can further comprise one or more frame ribs to structurally reinforce portions of the frame 1030. The frame ribs improve acoustics by reducing vibrations in specific areas of the frame 1030. The frame ribs can be located along any desired portion of the forward frame 1040 and/or rearward frame 1050 that improves structural rigidity and/or acoustic/vibrational response.

The frame ribs extend along an interior surface of the frame 1030. Like the internal bridges, the frame ribs can be formed integrally with the frame 1030. Alternatively, the frame ribs can be formed separately and attached to the frame 1030 via a coupling mechanism. The frame ribs can be located near the crown 1010, the sole 1012, and/or the body perimeter. Various examples of frame ribs are illustrated in FIGS. 18 and 20A-20C. The frame 1030 can comprise any combination of the frame ribs described herein.

Referring to FIG. 18, the frame 1030 can comprise a pair of frame ribs 1053A, 1053B located proximate the rear end 1011 and extending in a substantially front-to-rear direction. The frame ribs 1053A, 1053B can be particularly useful in embodiments comprising a weight member 1091 coupled to a low and rearward portion of the body 1001. In such embodiments, the frame ribs 1053A, 1053B are effective in damping vibrations that are caused by providing a weight member 1091 with a large mass in a rearward portion of the club head.

In some embodiments, the frame ribs can be formed integrally with one or more internal bridges. In these embodiments, the internal bridges form a platform, and the frame ribs extend upwards from the internal bridges into the hollow interior cavity 1007. FIGS. 20A-20C illustrate a frame 1030 comprising a forward frame rib 1046A and a rearward frame rib 1046B that extend upward from a forward internal bridge 1055A and a rearward internal bridge 1055B, respectively. The internal bridges 1055A, 1055B and the frame ribs 1046A, 1046B extend diagonally across the sole opening between the toe-side external bridge 1045B and the forward sole return 1042.

As discussed above, the frame ribs can extend along any portion of the frame 1030. The frame ribs can comprise any shape and can extend in any direction along an inner surface of the frame 1030. For example, the frame ribs can extend in a front-to-rear direction, a heel-to-toe direction, or in a diagonal direction. The frame ribs can be parallel to the strike face 1002, perpendicular to the strike face 1002, or at an angle relative to the strike face 1002. In some embodiments, the frame ribs can be angled between approximately 5 degrees and 45 degrees relative to the strike face 1002. For embodiments including multiple frame ribs, the frame ribs can be substantially parallel to one another, or the frame ribs can be orientated at an angle relative to one another. In some embodiments, the frame ribs can intersect with one another. The frame 1030 can comprise any number of frame ribs. For example, the frame 1030 can comprise one frame rib, two frame ribs, three frame ribs, four frame ribs, five frame ribs, six frame ribs, or any suitable number of frame ribs.

The one or more frame ribs comprise various dimensions including a frame rib height ($H_{FR}$) and a frame rib length. Each dimension is sized to provide sufficient structural support to the frame 1030. While the frame rib 1046A used to illustrate certain dimensions is located near the sole 1012, the following dimensions can be applied to any frame rib located anywhere on the frame 1030.

Referring to FIG. 20A, each frame rib defines a frame rib height ($H_{FR}$) measured across the surface of the frame rib in a direction perpendicular to the outer surface of the frame 1030. In some embodiments, the frame rib height ($H_{FR}$) can remain constant throughout the entire frame rib. In other embodiments, the frame rib height ($H_{FR}$) can vary in any direction throughout an individual frame rib. Additionally, in some embodiments, the frame rib height ($H_{FR}$) can remain constant between adjacent frame ribs, while in other embodiments, the frame rib height ($H_{FR}$) can vary across different frame ribs. The frame rib height ($H_{FR}$) is between 0.01 inch and 0.90 inch. For example, the frame rib height ($H_{FR}$) can be between 0.01 inch and 0.15 inch, 0.10 inch and 0.25 inch, 0.20 inch and 0.50 inch, 0.40 inch and 0.75 inch, 0.50 inch and 0.80 inch, or between 0.75 inch and 0.90 inch. The frame rib height ($H_{FR}$) is large enough to provide sufficient structural support to the frame 1030 without significantly increasing the structural mass of the frame 1030.

Each frame rib further defines a frame rib length measured along the path the frame rib between the furthest end points of the frame rib. The frame rib length can be measured in a front-to-rear direction, a heel-to-toe direction, or in a diagonal direction, depending on the directionality of the frame rib. In some embodiments, the frame rib length can remain constant between adjacent frame ribs, while in other embodiments, the frame rib length can vary between different frame ribs. In many embodiments, the frame rib length is between 1.00 inch and 5.00 inches. In some embodiments, the frame rib length is between 1.00 inch and 1.50 inches, 1.25 inches and 2.75 inches, 2.40 inches and 3.60 inches, 2.50 inches and 2.80 inches, 2.75 inches and 4.00 inches, 3.25 inches and 4.50 inches, 3.40 inches and 4.70 inches, 3.50 inches and 4.90 inches, or between 4.25 inches and 5.00 inches. In many embodiments, the frame rib length can be between 25% and 90% of the body width ($W_B$). In some embodiments, the frame rib length is between 25% and 45%, 40% and 60%, 45% and 70%, 55% and 75%, 60% and 80%, or between 75% and 90% of the body width ($W_B$). The frame rib length is large enough to provide sufficient structural support to the frame 1030 without significantly increasing the structural mass of the frame 1030.

In some embodiments, the frame ribs can be integrally cast with the frame 1030 such that they are formed from the same material as the frame 1030. In other embodiments, the frame ribs can be separately formed and attached to the frame 1030. In embodiments with separately formed frame ribs, the frame ribs can be formed from any suitable material such as a metallic material, a composite material, or any other suitable material. Further, the separately formed frame ribs can be attached to the frame 1030 using any suitable attachment mechanism such as adhesives, welding, over molding, or any other suitable attachment mechanism.

In some embodiments, the one or more composite inserts can comprise one or more insert ribs. Similar to the frame ribs, the insert ribs can damp vibrations to provide a more desirable, muted sound and feel response. The insert ribs can be located along any desired portion of the one or more inserts that improves structural rigidity or acoustic/vibrational response. The insert ribs can be located on the crown insert 1060, on the sole insert 1070, or a combination thereof.

The insert ribs extend along an interior surface of the one or more inserts. The insert ribs can be formed integrally with the one or more inserts, or they can be formed separately and attached to the one or more inserts via a coupling mechanism. The insert ribs can be located near the crown 1010, the sole 1012, and/or the body perimeter. Various examples of insert ribs are illustrated in FIGS. 23A-28C. The crown insert 1060 and/or the sole insert 1070 can comprise any combination of the insert ribs described herein.

Figure 23A:
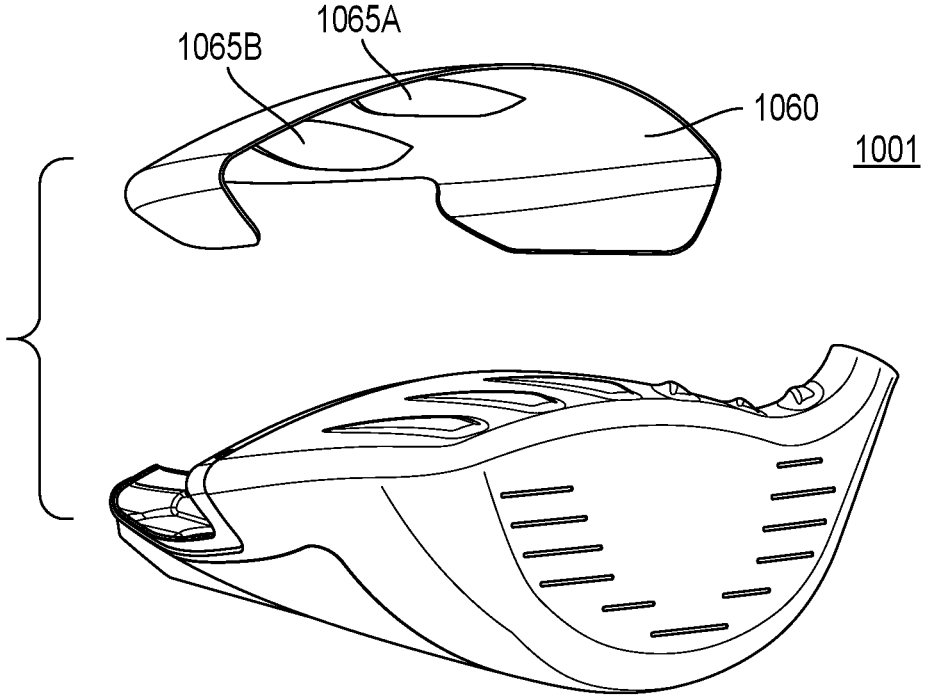
FIG. 23A illustrates an exploded front perspective view of a golf club head according to the present invention, comprising a crown insert with reinforcing features.
Figure 23B:
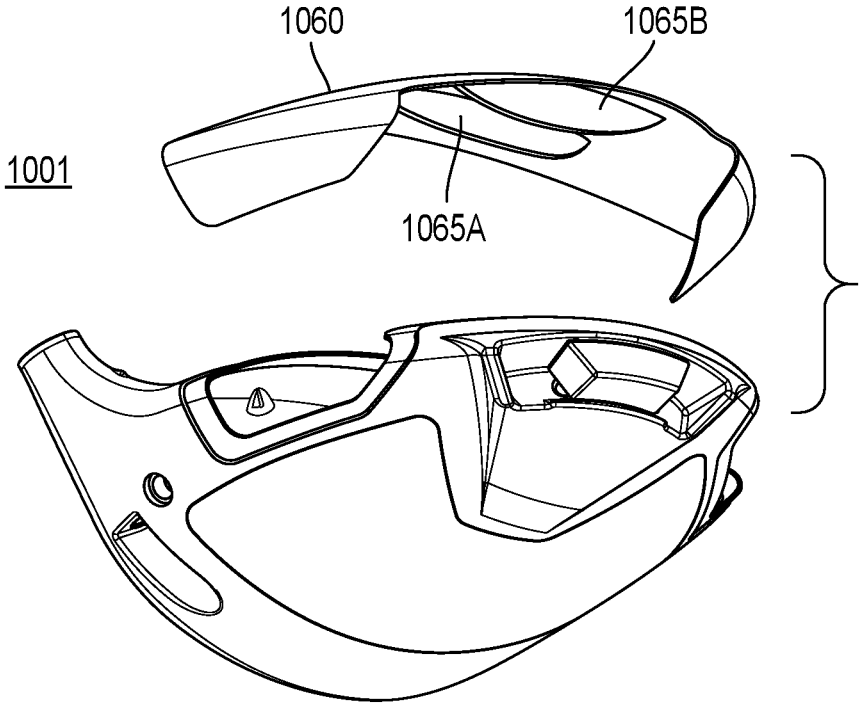
FIG. 23B illustrates an exploded rear view of the golf club head of FIG. 23A.

FIGS. 23A and 23B illustrate a crown insert 1060 comprising two insert ribs 1065A, 1065B that each extend in a heel-to-toe direction across the crown insert 1060. The forward insert rib 1065A is located closer to the front end 1008, and the rear insert rib 1065B is located closer to the rear end 1011.

Figure 24A:
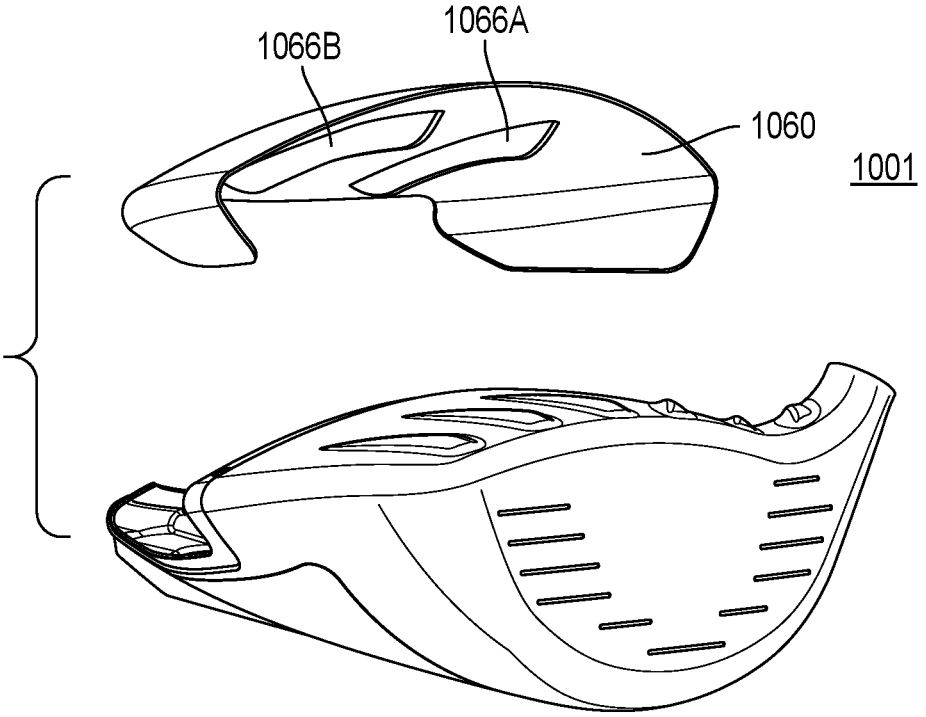
FIG. 24A illustrates an exploded front perspective view of a golf club head according to the present invention, comprising a crown insert with reinforcing features.
Figure 24B:
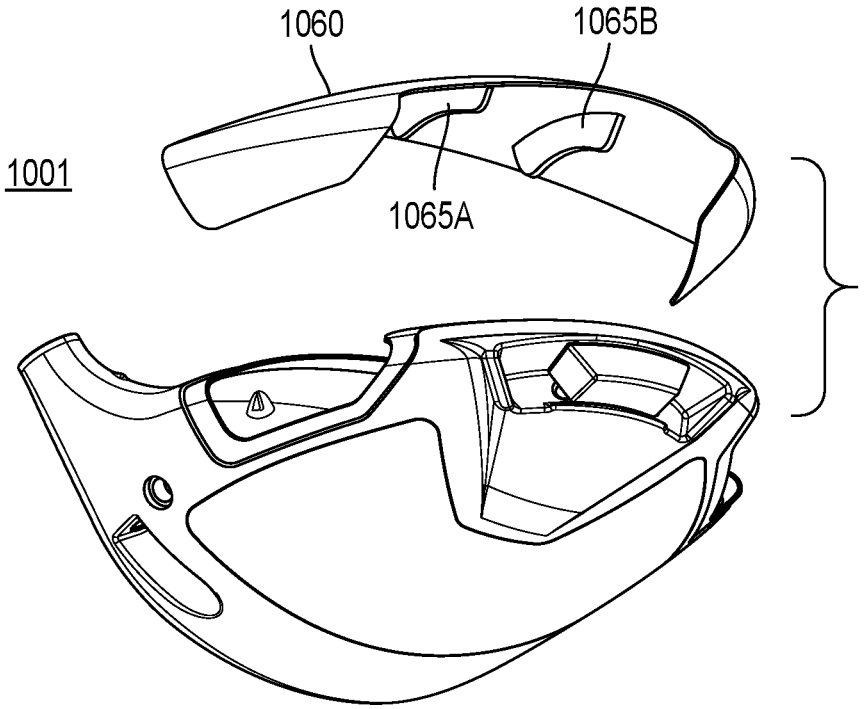
FIG. 24B illustrates an exploded rear view of the golf club head of FIG. 23A.

FIGS. 24A and 24B illustrate a crown insert 1060 comprising two insert ribs 1066A, 1066B that extend in a front-to-rear direction across the crown insert 1060. The heel-side insert rib 1066A is located closer to the heel end 1004, and the toe-side insert rib is located closer to the toe end 1006.

Figure 25A:
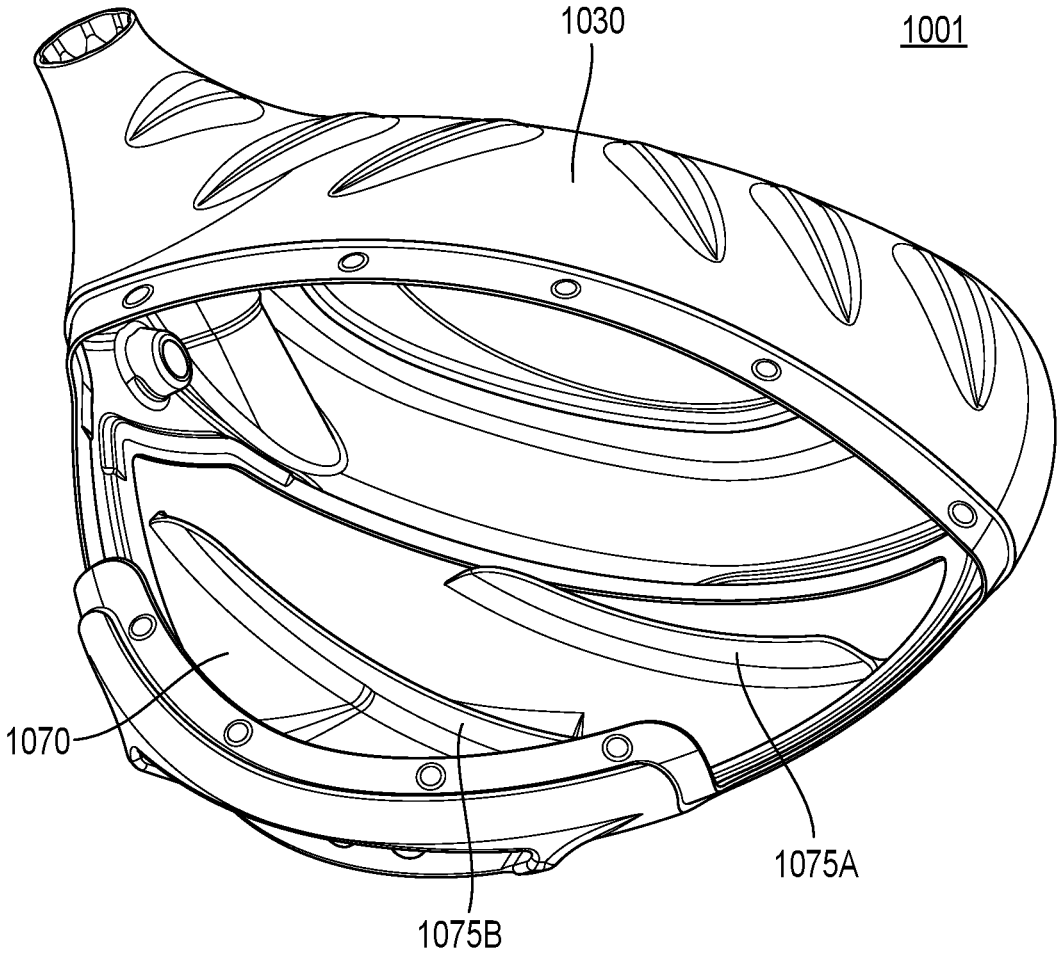
FIG. 25A illustrates a rear perspective view of a golf club head, with portions removed to better show a sole insert with reinforcing features.
Figure 25B:
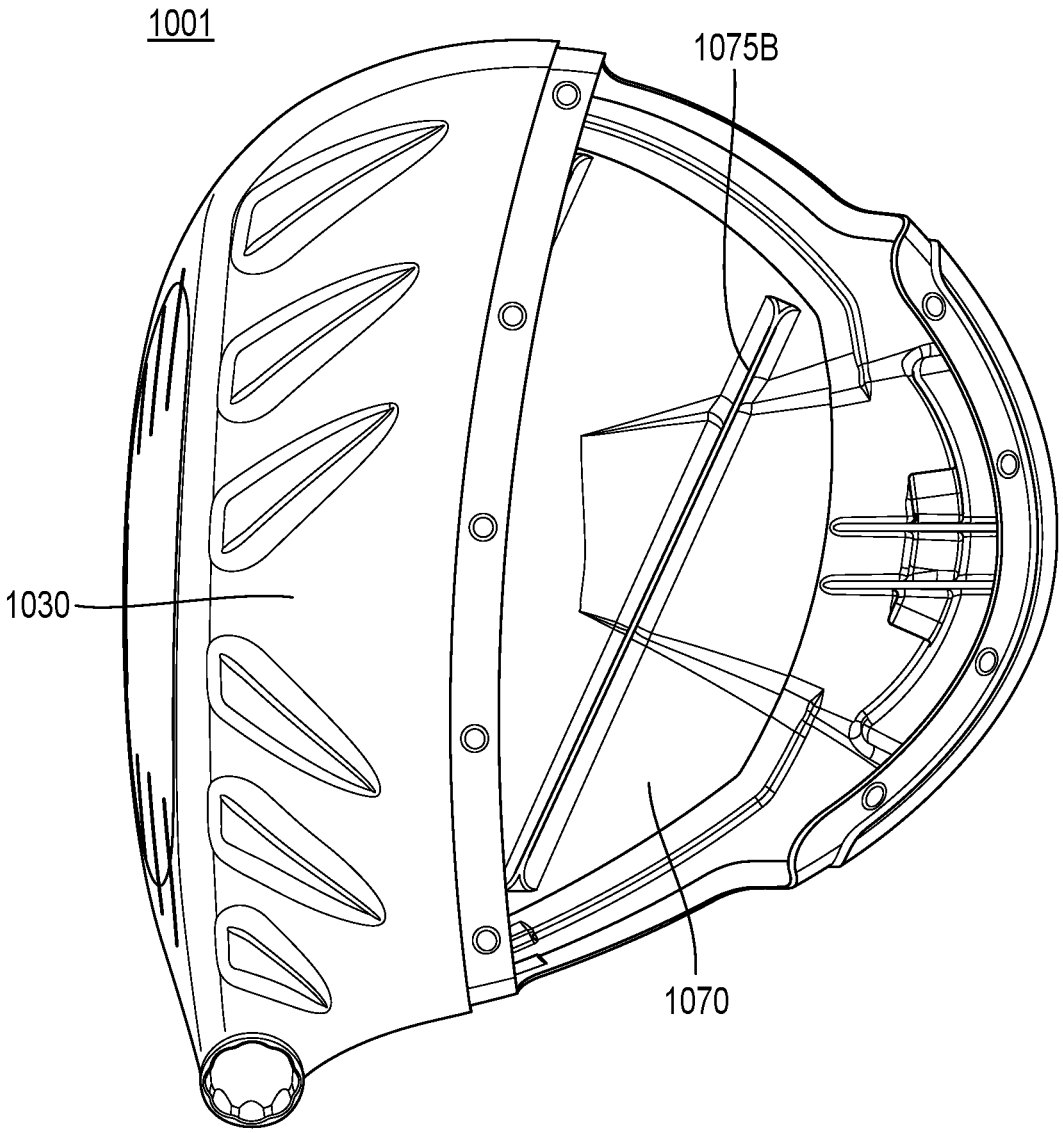
FIG. 25B illustrates a top plan view of the golf club head of FIG. 25A, with portions removed to better show the sole insert with reinforcing features.

FIGS. 25A and 25B illustrate a sole insert 1070 comprising two insert ribs 1075A, 1075B that extend diagonally across the sole insert 1070 between the toe-side external bridge 1045B and the forward sole return 1042.

As discussed above, the insert ribs can extend along any portion of the one or more composite inserts. The insert ribs can comprise any shape and can extend in any direction along an inner surface of the one or more composite inserts. For example, the insert ribs can extend in a front-to-rear direction, a heel-to-toe direction, or in a diagonal direction. The insert ribs can be parallel to the strike face 1002, perpendicular to the strike face 1002, or at an angle relative to the strike face 1002. In some embodiments, the insert ribs can be angled between approximately 5 degrees and 45 degrees relative to the strike face 1002. For embodiments including multiple insert ribs, the insert ribs can be substantially parallel to one another, or the insert ribs can be orientated at an angle relative to one another. In some embodiments, the insert ribs can intersect with one another. Each insert can comprise any number of insert ribs. For example, each insert can comprise one insert rib, two insert ribs, three insert ribs, four insert ribs, five insert ribs, six insert ribs, or any suitable number of insert ribs.

The one or more insert ribs comprise various dimensions including an insert rib length ($L_{IR}$), an insert rib height ($H_{IR}$), and an insert rib offset ($O_{IR}$). Each dimension is sized to provide sufficient structural support to the respective composite insert. While the insert ribs used to illustrate these dimensions are located on the crown insert 1060, the following dimensions can be applied to any insert rib located on the crown insert 1060, the sole insert 1070, and/or a central insert (discussed in more detail below).

Figure 26A:
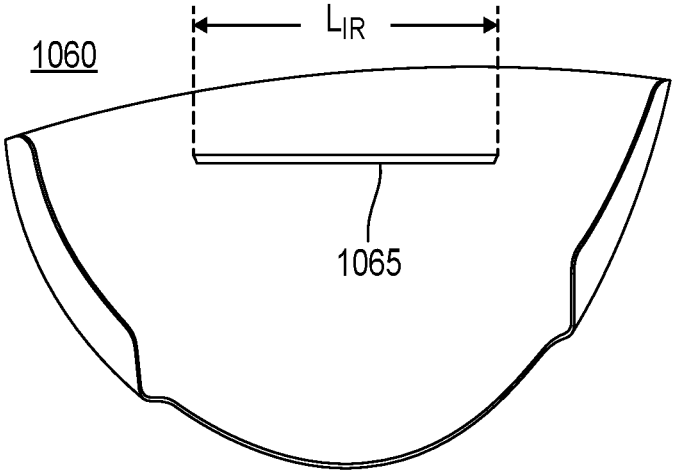
FIG. 26A illustrates a bottom plan view of a golf club head, with portions removed to better show a crown insert with reinforcing features.
Figure 27A:
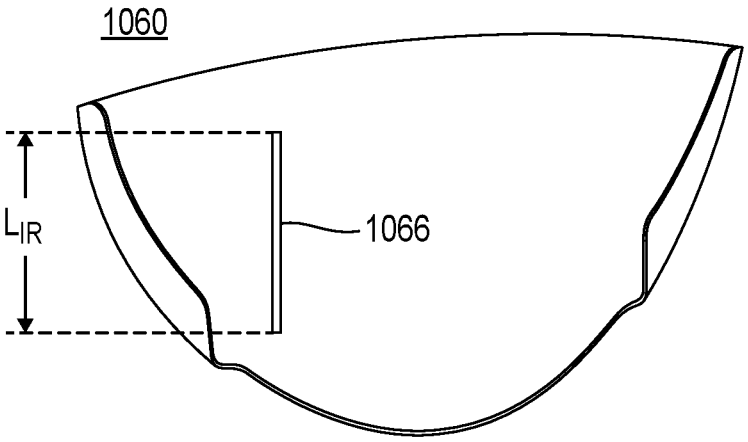
FIG. 27A illustrates a bottom plan view of a golf club head, with portions removed to better show a crown insert with reinforcing features.

Referring to FIGS. 26A and 27A, each insert rib defines an insert rib length ($L_{IR}$) measured across the surface of the insert rib between the end points of the insert rib. The insert rib length ($L_{IR}$) can be measured in a front-to-rear direction, a heel-to-toe direction, or in a diagonal direction, depending on the directionality of the insert rib. In some embodiments, the insert rib length ($L_{IR}$) can remain constant between adjacent ribs, while in other embodiments, the insert rib length ($L_{IR}$) can vary between different insert ribs. In many embodiments, the insert rib length ($L_{IR}$) is between 1.00 inch and 5.00 inches. In some embodiments, the insert rib length ($L_{IR}$) is between 1.00 inch and 1.50 inches, 1.25 inches and 2.75 inches, 2.40 inches and 3.60 inches, 2.50 inches and 2.80 inches, 2.75 inches and 4.00 inches, 3.25 inches and 4.50 inches, 3.40 inches and 4.70 inches, 3.50 inches and 4.90 inches, or between 4.25 inches and 5.00 inches.

Referring to FIG. 26A, in some embodiments including an insert rib 1065 that extends in a heel-to-toe direction, the insert rib length ($L_{IR}$) can be described in terms of the body width ($W_B$). In some embodiments, the insert rib length ($L_{IR}$) can be between 25% and 90% of the body width ($W_B$). In some embodiments, the insert rib length ($L_{IR}$) is between 25% and 45%, 40% and 60%, 45% and 70%, 55% and 75%, 60% and 80%, or between 75% and 90% of the body width ($W_B$). Referring to FIG. 27A, in some embodiments including an insert rib 1066 that extends in a front-to-rear direction, the insert rib length ($L_{IR}$) can be described in terms of the body depth ($D_B$). In some embodiments, the insert rib length ($L_{IR}$) can be between 25% and 90% of the body depth ($D_B$). In some embodiments, the insert rib length ($L_{IR}$) is between 25% and 45%, 40% and 60%, 45% and 70%, 55% and 75%, 60% and 80%, or between 75% and 90% of the body depth ($D_B$). The insert rib length ($L_{IR}$) is large enough to provide sufficient structural support to the respective composite insert without significantly increasing the structural mass of the composite insert.

Figure 28A:
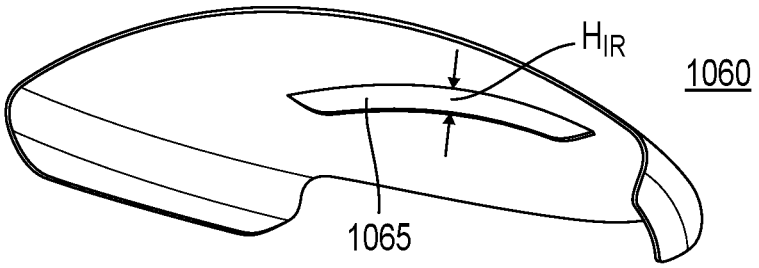
FIG. 28A illustrates a front perspective view of a golf club head, with portions removed to better show a crown insert with reinforcing features.
Figure 28B:
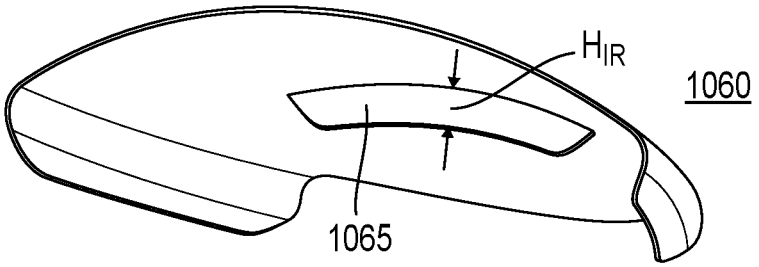
FIG. 28B illustrates a front perspective view of a golf club head, with portions removed to better show a crown insert with reinforcing features.
Figure 28C:
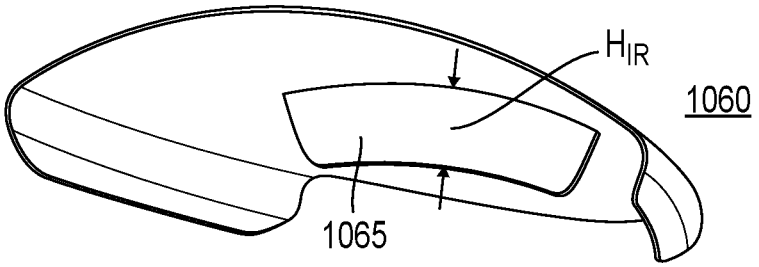
FIG. 28C illustrates a front perspective view of a golf club head, with portions removed to better show a crown insert with reinforcing features.

Referring to FIGS. 28A-28C, each insert rib 1065 defines an insert rib height ($H_{IR}$) measured across the surface of the insert rib 1065 in a direction perpendicular to the outer surface of the frame 1030. In some embodiments, the insert rib height ($H_{IR}$) can remain constant throughout the entire insert rib 1065. In other embodiments, the insert rib height ($H_{IR}$) can vary in any direction throughout an individual insert rib 1065. Additionally, in some embodiments, the insert rib height ($H_{IR}$) can remain constant between adjacent ribs, while in other embodiments, the insert rib height ($H_{IR}$) can vary between different insert ribs. The insert rib height ($H_{IR}$) is between 0.01 inch and 0.90 inch. For example, the insert rib height ($H_{IR}$) can be between 0.01 inch and 0.15 inch, 0.10 inch and 0.25 inch, 0.20 inch and 0.50 inch, 0.40 inch and 0.75 inch, 0.50 inch and 0.80 inch, or between 0.75 inch and 0.90 inch. Various examples of insert rib offsets ($O_{IR}$) are illustrated in FIGS. 28A-28C, where the insert rib height ($H_{IR}$) increases from the insert rib 1065 illustrated in FIG. 28A to the insert rib 1065 illustrated in FIG. 28C. The insert rib height ($H_{IR}$) is large enough to provide sufficient structural support to the respective composite insert without significantly increasing the structural mass of the composite insert.

Figure 26B:
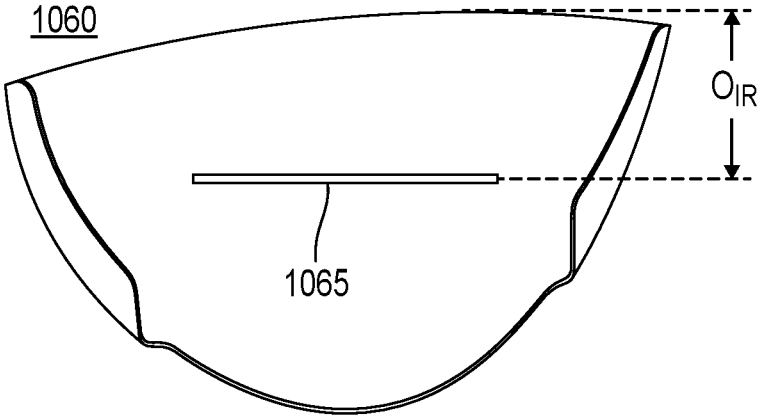
FIG. 26B illustrates a bottom plan view of a golf club head, with portions removed to better show a crown insert with reinforcing features.
Figure 26C:
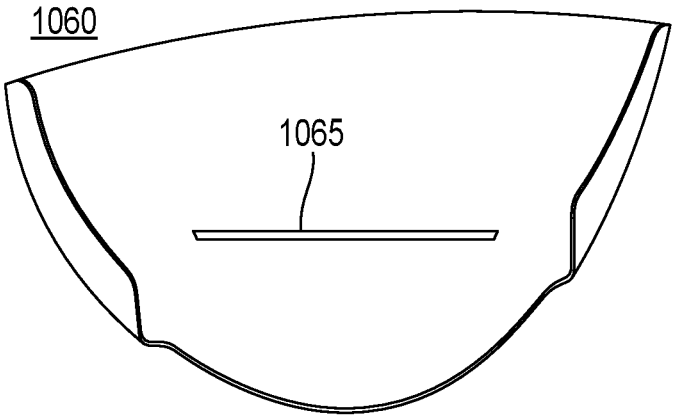
FIG. 26C illustrates a bottom plan view of a golf club head, with portions removed to better show a crown insert with reinforcing features.
Figure 27B:
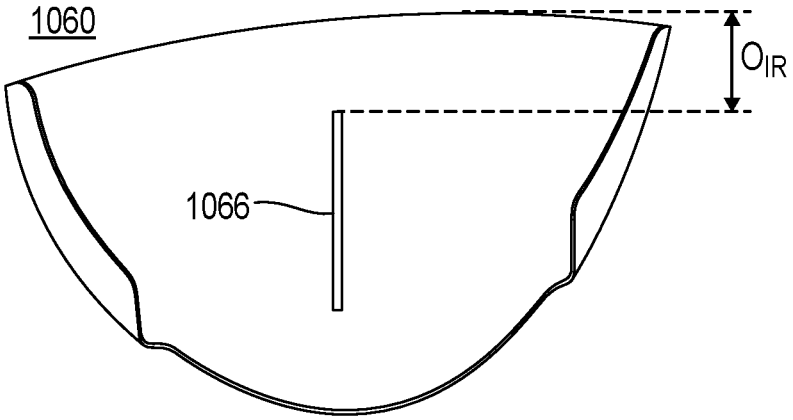
FIG. 27B illustrates a bottom plan view of a golf club head, with portions removed to better show a crown insert with reinforcing features.
Figure 27C:
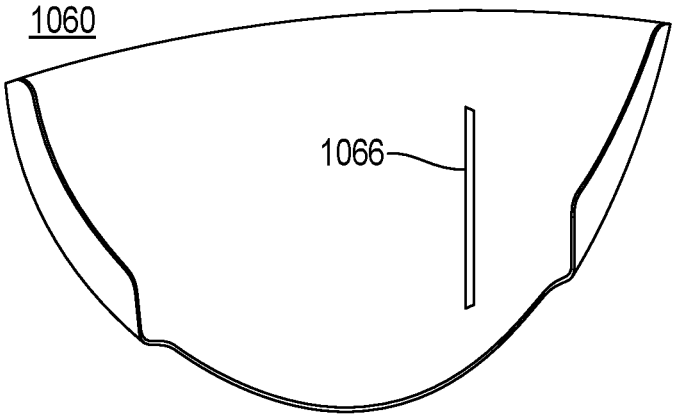
FIG. 27C illustrates a bottom plan view of a golf club head, with portions removed to better show a crown insert with reinforcing features.

Referring to FIGS. 26B and 27B, each insert rib defines an insert rib offset ($O_{IR}$) measured between a forwardmost point on the crown insert 1060 and the forwardmost point of each insert rib. In some embodiments, the insert rib offset ($O_{IR}$) can remain constant between adjacent ribs, while in other embodiments, the insert rib offset ($O_{IR}$) can vary across different insert ribs. The insert rib offset ($O_{IR}$) is between 0.10 inch and 3.50 inches. In some embodiments, the insert rib offset ($O_{IR}$) is between 0.10 inch and 0.50 inch, 0.25 inch and 0.75 inch, 0.50 inch and 0.75 inch, 0.60 inch and 0.90 inch, 0.75 inch and 1.00 inch, 0.80 inch and 1.10 inch, 1.00 inch and 1.50 inches, 1.25 inches and 1.75 inches, 1.40 inches and 2.60 inches, 1.50 inches and 2.80 inches, 1.75 inches and 2.50 inches, 2.25 inches and 3.50 inches, 2.40 inches and 3.30 inches, 2.50 inches and 2.90 inches, or between 2.57 inches and 3.50 inches. Various examples of insert rib offsets ($O_{IR}$) are illustrated in FIGS. 26A-27C.

FIGS. 26A-26C illustrate various embodiments of a crown insert 1060 comprising an insert rib 1065 that extends in the heel-to-toe direction. The insert rib 1065 illustrated in FIG. 26A is located near a forward portion of the crown insert 1060, the insert rib 1065 illustrated in FIG. 26B is located near a central portion of the crown insert 1060 and insert rib 1065 illustrated in FIG. 26C is located near a rearward portion of the crown insert 1060. As such, insert rib 1065 illustrated in FIG. 26A comprises the smallest insert rib offset ($O_{IR}$), and the insert rib 1065 illustrated in FIG. 26C comprises the largest insert rib offset ($O_{IR}$).

In some embodiments, the insert ribs can be integrally formed with the one or more inserts such that they are formed from the same material as the one or more inserts. In other embodiments, the insert ribs can be separately formed and attached to the one or more inserts. In embodiments with separately formed insert ribs, the insert ribs can be formed from any suitable material such as a metallic material, a composite material, or any other suitable material. Further, the separately formed insert ribs can be attached to the one or more inserts using any suitable attachment mechanism such as adhesives, welding, over molding, or any other suitable attachment mechanism.

High vibration areas of the golf club head can be reinforced to control vibration response. As discussed above, the internal reinforcement structures control vibrations to compensate for any dominant vibrations associated with the unique body shape and mass distribution of the golf club heads described herein. Therefore, the body 1001 can include any combination of the aforementioned external bridges, internal bridges, frame ribs, and/or insert ribs. Each of the internal reinforcement structures discussed above comprises a small percentage of mass relative to the body 1001. As such, the internal reinforcement structures discussed above support the respective portion of the body 1001, without significantly increasing the structural mass. The internal reinforcement structures allow for a club head that achieves a high $I_{YY}$, a high $I_{XX}/I_{YY}$ ratio, and a club head CG position at or near the loft-normal axis 35, all while also providing a desirable sound and feel response.

In addition to the internal reinforcement structures described above, the frame 1030 can further comprise one or more mass pads, to optimize CG placement and/or mass distribution to achieve a high $I_{XX}/I_{YY}$ ratio. The mass pads are internal weighting structures that comprise a concentration of mass specifically placed to control the club head MOI and CG position. The frame 1030 can comprise one or more mass pads located along a desired portion of the frame 1030 in order to provide optimal CG placement and/or mass distribution. In many embodiments, discretionary mass created by the lightweight composite inserts, lightweight shaft-receiving structure, small-arced weight member housing structure, or any of the other mass-saving structures disclosed herein can be distributed to the one or more mass pads.

The one or more mass pads can be located on interior surfaces of the frame 1030 near a central portion of the crown 1010, a central portion of the sole 1012, and/or any combination of these locations. In some embodiments, the one or more mass pads can be formed integrally with the frame 1030. In other embodiments, the one or more mass pads can be formed separately and attached to the frame 1030 via a coupling mechanism such as welding, brazing, mechanical coupling, adhesive coupling, or any other suitable means. In many embodiments, the one or more mass pads can contact a portion of the one or more composite inserts. In these embodiments, the one or more mass pads can increase the bonding surface area between the frame 1030 and the one or more composite inserts. The frame 1030 can comprise any combination of the mass pads described herein.

In many embodiments, the one or more mass pads can be located at or near the Y'-axis 80, such that all or a majority of the one or more mass pads fits within the central mass zone (CMZ). As such, the one or more mass pads increase $I_{XX}$ with little impact on $I_{YY}$, thereby providing an $I_{XX}/I_{YY}$ ratio close to 1. In many embodiments, one or more mass pads can be intersected by the Y'-axis 80. The proximity of any of the one or more mass pads to the Y'-axis 80 may be characterized by the size of a central mass zone (CMZ) (as described above) that bounds the entirety of the one or more mass pads. For example, in some embodiments, the one or more mass pads can be entirely bounded within a central mass zone (CMZ) having a central mass zone radius ($R_{CMZ}$) less than 2.00 inches, 1.75 inches, 1.50 inches, 1.25 inches, 1.00 inch, 0.75 inch, 0.50 inch, or less than 0.25 inch. The smaller the central mass zone radius ($R_{CMZ}$) that bounds the entirety of the one or more mass pads, the more effective each mass pad is at providing an $I_{XX}/I_{YY}$ ratio close to 1. A mass pad bounded within a small central mass zone (CMZ) increases $I_{XX}$ more than $I_{YY}$, as compared to a similar mass pad of the same mass that does not fit within said central mass zone (CMZ). For example, a 20 gram mass pad that fits entirely within a central mass zone (CMZ) having a central mass zone radius ($R_{CMZ}$) of 0.75 inch provides a lesser $I_{YY}$ contribution (and therefore a higher $I_{XX}/I_{YY}$ ratio) than a 20 gram mass pad that only partially fits within a central mass zone (CMZ) having a central mass zone radius ($R_{CMZ}$) of 0.75 inch.

The one or more mass pads can optimize mass distribution to achieve a high $I_{XX}/I_{YY}$ ratio by positioning mass proximate the central mass zone (CMZ). Further, a measurement of the percentage of volume of the one or more mass pads located within the central mass zone (CMZ) can characterize how effectively mass pad mass is positioned within the central mass zone (CMZ). For embodiments where the central mass zone radius ($R_{CMZ}$) is 1 inch, the percentage of volume of the one or more mass pads residing within the central mass zone (CMZ) can be between 50% and 60%, 60% and 70%, 70% and 80%, 80% and 90%, or between 90% and 100%. For other embodiments where the central mass zone radius ($R_{CMZ}$) is 1 inch, the percentage of volume of the one or more mass pads residing within the central mass zone (CMZ) can be greater than 50%, 60%, 70%, 80%, 90% or greater than 100%. A high percentage of mass pad volume being located within the central mass zone (CMZ) is indicative of a high concentration of club head mass within the central mass zone (CMZ). As discussed above, a high concentration of club head mass within the central mass zone (CMZ) is beneficial for increasing the club head $I_{XX}/I_{YY}$ ratio.

The one or more mass pads can be located proximate the Y'-axis 80 to ensure that mass pad mass is contained within the central mass zone (CMZ). A straight-line distance between the center of gravity of the one or more mass pads and the Y'-axis 80 can characterize how effectively mass is positioned within the central mass zone (CMZ). Mass pads with effective mass placement within the central mass zone (CMZ) will have a straight-line distance between the mass pad center of gravity and the Y'-axis 80 of 0.4 inch or less. In some embodiments, the mass pad center of gravity comprises a straight-line distance to the Y'-axis 80 of less than 0.4 inch. In other embodiments, the mass pad center of gravity comprises a straight-line distance to the Y'-axis 80 between 0.0 inch and 0.1 inch, 0.1 inch and 0.2 inch, 0.2 inch and 0.3 inch, or between 0.3 inch and 0.4 inch. As described above, the central mass zone radius ($R_{CMZ}$) is 0.5 inch or greater. Thereby, mass pads with a center of gravity positioned substantially close (within 0.4 inch) to the Y'-axis 80 concentrate mass within the central mass zone (CMZ), thereby increasing $I_{XX}$ without significantly increasing $I_{YY}$.

The one or more mass pads can be centrally located on the crown 1010 and/or the sole 1012. In many embodiments, at least a portion of the one or more mass pads can be intersected by the YZ plane (a vertical plane aligning with both the Y-axis 50 and the Z-axis 60). In many embodiments, the one or more mass pads can be located entirely within the club head midsection, as defined above. In some embodiments, the one or more mass pads can be located entirely within the middle 50% of the body depth ($D_B$). In some embodiments, the one or more mass pads can be located entirely within the middle 45% of the body depth ($D_B$), 40%, 35%, 30%, 25%, or entirely within the middle 20% of the body depth ($D_B$). In some embodiments, the one or more mass pads can be located entirely within the middle 50% of the body width ($W_B$). In some embodiments, the one or more mass pads can be located entirely within the middle 45% of the body width ($W_B$), 40%, 35%, 30%, 25%, or entirely within the middle 20% of the $W_B$. In many embodiments a forwardmost point of the one or more mass pads can be spaced rearward of the leading edge 1003 by a significant percentage of the body depth ($D_B$). In some embodiments, the forwardmost point of the one or more mass pads can be spaced rearward of the leading edge 1003 by a distance greater than or equal to 10%, 15%, 20%, 25% of the body depth ($D_B$).

Figure 29A:
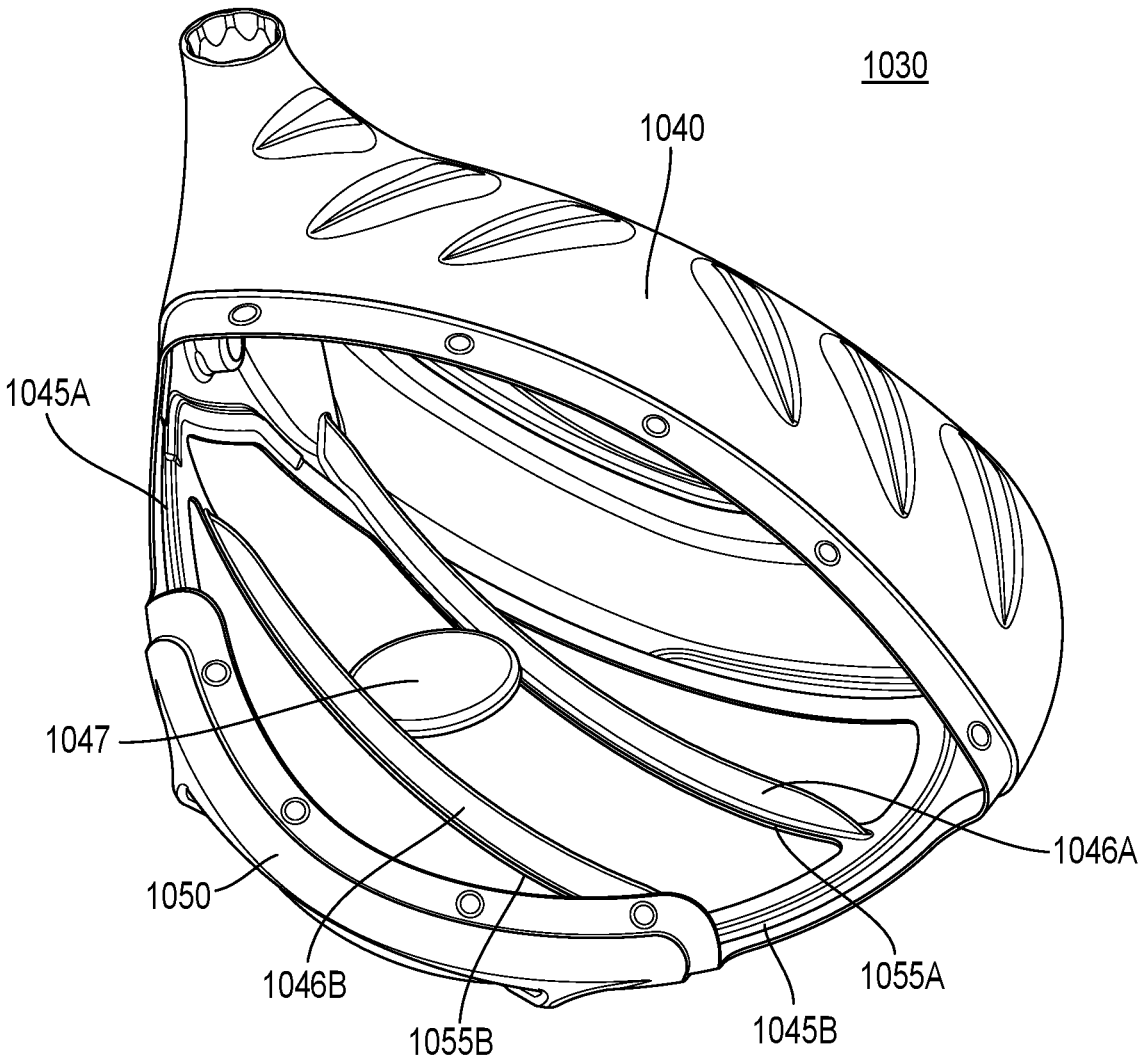
FIG. 29A illustrates a rear perspective view of a golf club head, with portions removed to better show a frame with internal mass features.
Figure 29B:
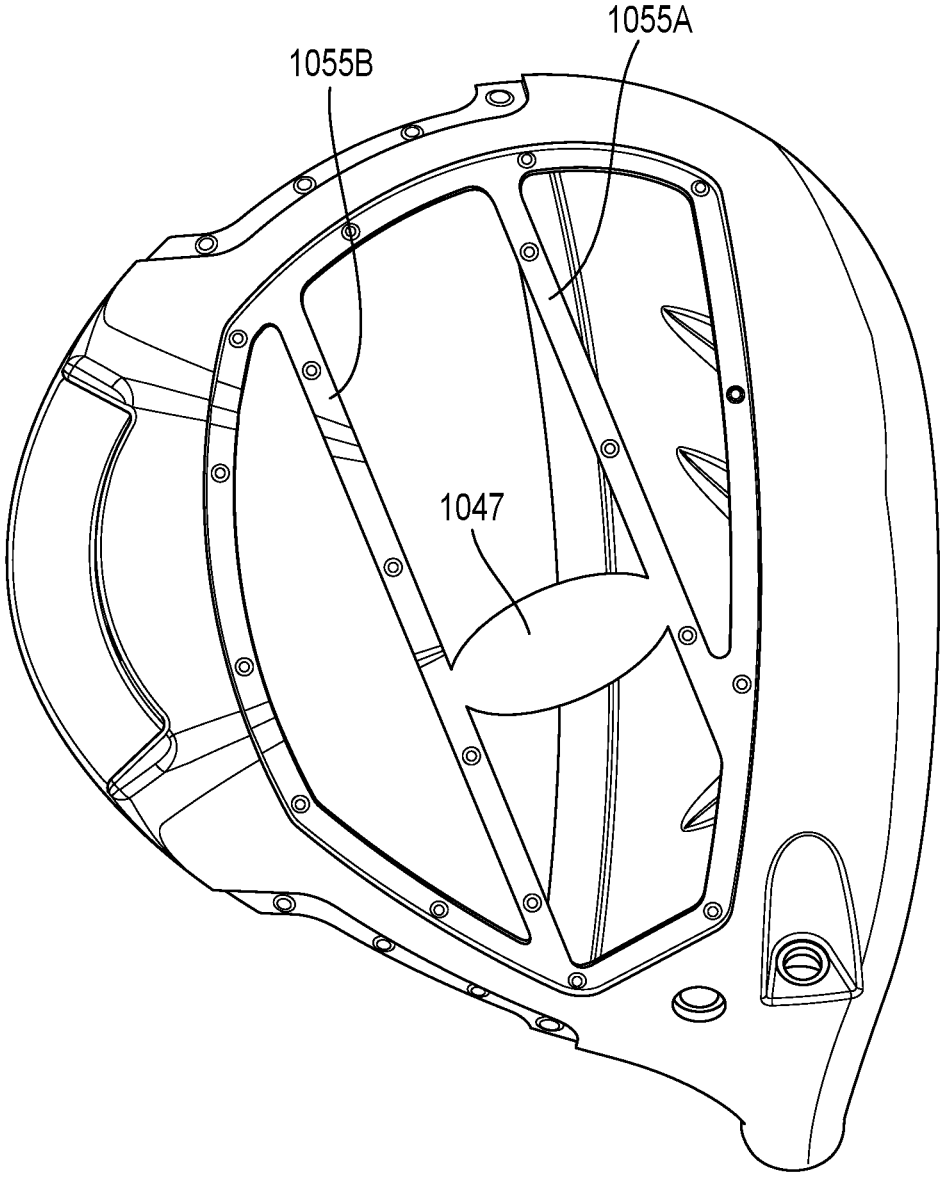
FIG. 29B illustrates a bottom plan view of the golf club head of FIG. 29A, with portions removed to better show the frame with internal mass features.

FIGS. 29A and 29B illustrate an embodiment of a frame 1030 comprising a mass pad 1047 suspended between two internal bridges 1055A, 1055B and two frame ribs 1046A, 1046B. While the illustrated embodiment comprises a single mass pad 1047, the frame 1030 can comprise any number of mass pads. For example, frame 1030 can comprise one mass pad, two mass pads, three mass pads, four mass pads, five mass pads, six mass pads, or any other suitable number of mass pads. The one or more mass pads can comprise any shape such as circular, ovular, rectangular, or any other suitable shape.

In many embodiments, the one or more mass pads can comprise a mass between 10 and 60 grams. In some embodiments, the one or more mass pads can comprise a mass between 10 grams and 15 grams, 15 grams and 20 grams, 20 grams and 25 grams, 25 grams and 30 grams, 30 grams and 35 grams, 35 grams and 40 grams, 40 grams and 45 grams, 45 grams and 50 grams, 50 grams and 55 grams, or between 55 grams and 60 grams. In some embodiments, the one or more mass pads can comprise a mass greater than 5 grams, 10 grams, 15 grams, 20 grams, 25 grams, 30 grams, 35 grams, 40 grams, 45 grams, 50 grams, 55 grams, or greater than 60 grams.

The one or more mass pads can be integrally cast with the frame 1030 such that they are formed from the same material as the frame 1030. Alternatively, the one or more mass pads can be separately formed and attached to the frame 1030. In these embodiments, the one or more mass pads can be formed from any suitable material such as a metallic material, a composite material, or any other suitable material.

In addition to the internal reinforcement structures and the mass pads described above, the composite inserts can further define one or more indentations to provide a desired club head shape. The one or more indentations remove volume from certain portions of the body 1001 such that volume can be added to other more desirable locations. The one or more indentations define a portion of the club head that is recessed away from the outer surface of the body 1001 towards the hollow interior cavity 1007. The one or more indentations are recessed toward the hollow interior cavity 1007 via one or more walls 1076. Each indentation can be fully or partially enclosed by the one or more walls 1076. Each indentation further defines a floor 1078 that forms a lower base of said indentation. The one or more indentations can be incorporated along with the internal reinforcement structures and/or the mass pads.

The one or more indentations can occupy any volume on the exterior surface of the club head. The body 1001 can define one or more indentations located along any desired portion of the body 1001 in order to provide optimal mass reallocation. The one or more indentations can be located along any desired portion of the frame 1030, the crown insert 1060, and/or the sole insert 1070. The one or more indentations can be located on the exterior surface of the golf club head 1000 on the crown 1010 or the sole 1012 and can be located near the front end 1008, the rear end 1011, the heel end 1004, the toe end 1006, and/or at any combination of these locations. The one or more indentations can be integrally formed with the frame 1030, crown insert 1060, sole insert 1070, and/or any combination thereof. The one or more indentations disclosed herein can define any percentage of the exterior surface area of the golf club head 1000.

Figure 30:
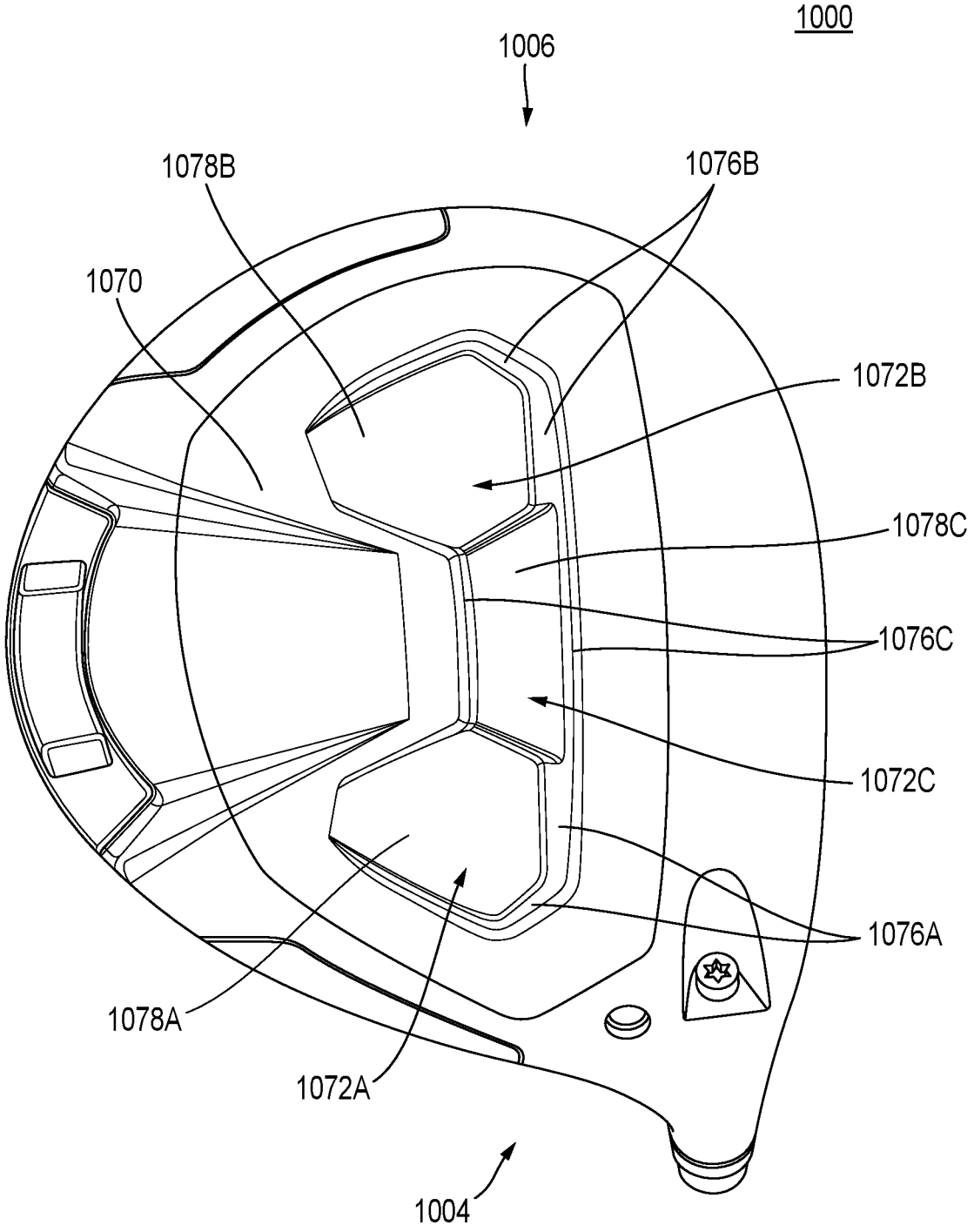
FIG. 30 illustrates a bottom plan view of a golf club head according to the present invention, comprising a sole insert with indentations.
Figure 31:
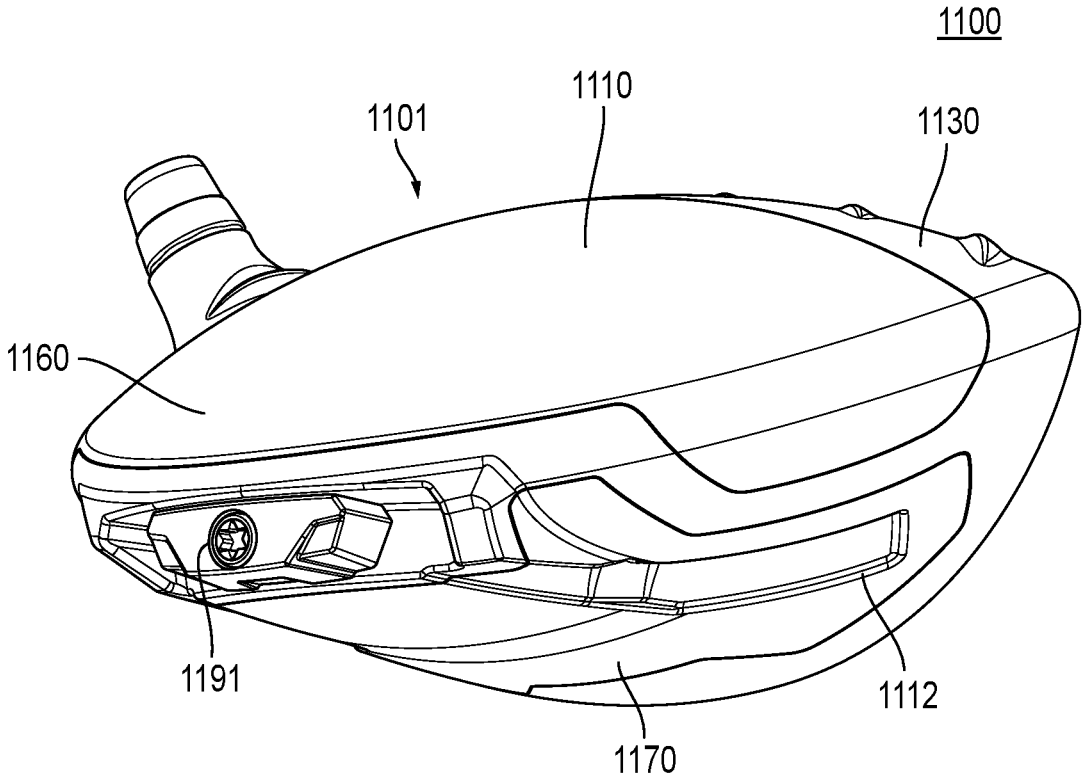
FIG. 31 illustrates a rear perspective view of a golf club head according to the present invention.
Figure 32:
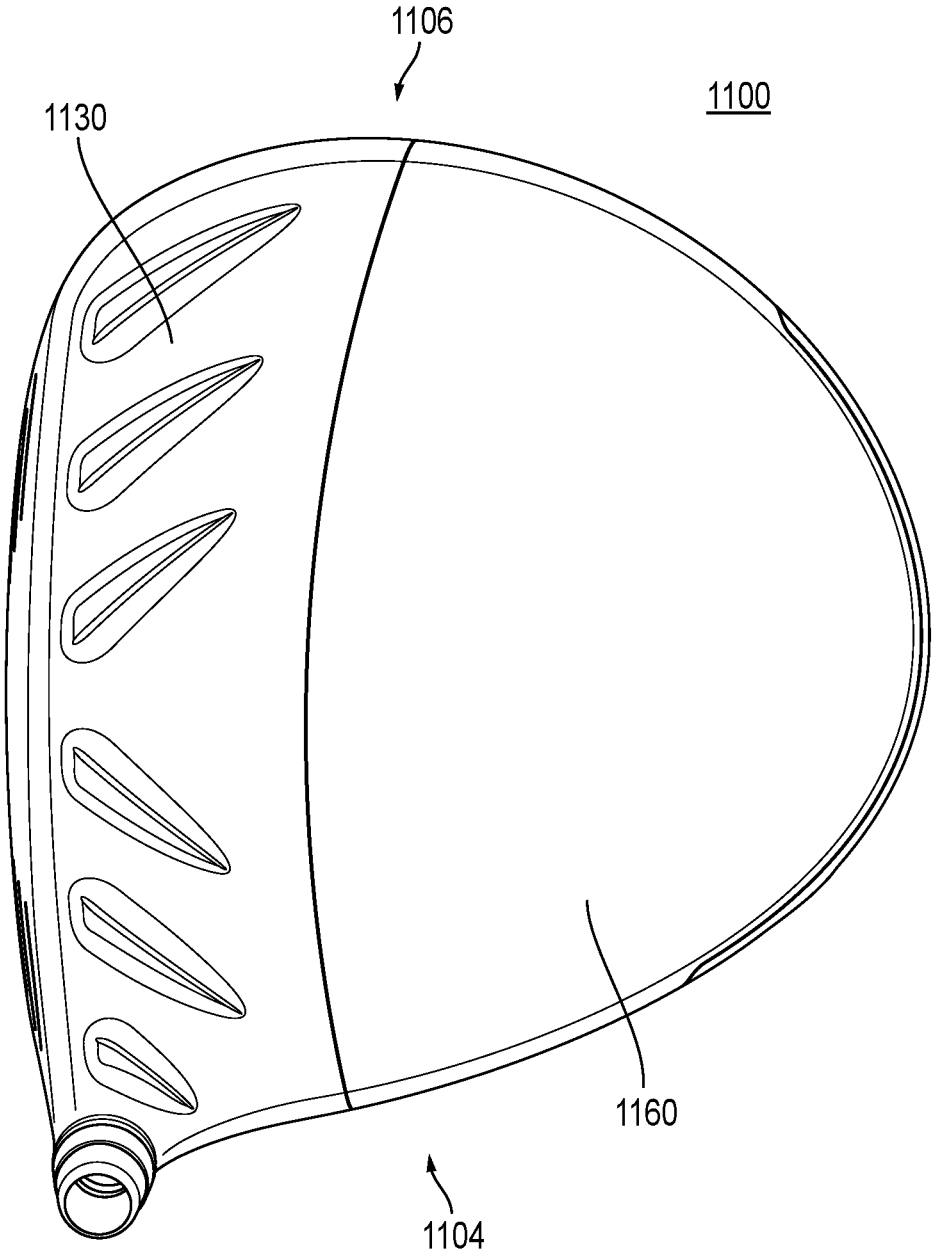
FIG. 32 illustrates a top plan view of the golf club head of FIG. 31.

FIG. 30 illustrates a sole insert 1070 which defines a first indentation 1072A, a second indentation 1072B, and a third indentation 1072C. The first indentation 1072A is defined by a first wall 1076A which extends around the perimeter of first floor 1078A. The second indentation 1072B is defined by a second wall 1076B which extends around the perimeter of second floor 1078B. The third indentation 1072B is defined by a third wall 1076B which extends around the perimeter of third floor 1078B. The one or more walls 1076 which fully or partially define each indentation can have a varying height. For example, the walls 1076A, 1076B, and 1076C of FIG. 30 vary in height. In particular, walls 1076A, 1076B, and 1076C generally decrease in height in a strike face 1002 to rear end 1011 direction.

Each indentation can define an indentation volume measured based on the native outer surface of the body. The indentations can define a combined indentation volume between 1 $cm^3$ and 12 $cm^3$. In some embodiments, the combined indentation volume can be between 1 $cm^3$ and 5 $cm^3$, 4 $cm^3$ and 8 $cm^3$, 5 $cm^3$ and 10 $cm^3$, or between 6 $cm^3$ and 12 $cm^3$. In some embodiments, each indentation can define an individual indentation volume of approximately 1 $cm^3$, 2 $cm^3$, 3 $cm^3$, 4 $cm^3$, 5 $cm^3$, 6 $cm^3$, 7 $cm^3$, 8 $cm^3$, 9 $cm^3$, 10 $cm^3$, 11 $cm^3$, or approximately 12 $cm^3$.

While the illustrated embodiment defines three indentations 1072A, 1072B, 1072C, the body 1001 can define any suitable number of indentations. In some embodiments, the golf club head 1000 may define one indentation, two indentations, three indentations, four indentations, five indentations, six indentations, seven indentations, eight indentations, nine indentations, or more than 10 indentations. The one or more indentations may be formed in any shape including circular, ovular, rectangular, triangular, polygonal, hexagonal, or any other suitable shape.

The one or more indentations may be integrally formed with the outer surface of the body 1001 such that they are formed from the same materials as the body 1001. In the illustrated embodiment, the indentations are defined in the sole insert 1070 and are integrally formed from the same material as the sole insert 1070. In other embodiments, the one or more indentations can be formed from the same material as the frame 1030, the crown insert 1060, and/or the sole insert 1070. Still in other embodiments, the one or more indentations can be partially formed from the same material as the frame 1030 and partially formed from the same material as the crown insert 1060, and/or the sole insert 1070.

B. Discrete Crown Insert and Sole Insert with Rear Extensions

FIGS. 31-40B illustrate another embodiment of a golf club head 1100 comprising one or more discrete composite inserts. The golf club head 1100 comprises similar dimensions and relationships to the golf club head 1000, as discussed above. Specifically, the golf club head 1100 comprises similar dimensions and/or dimensional parameters related to midsection coverage, perimeter coverage, upper hemisphere (UH) coverage, lower hemisphere (LH) coverage, or any combination thereof. The golf club head 1100 can comprise any combination of the internal reinforcement structures, mass pads, and/or indentations described above. The golf club head 1100 is similar to the golf club head 1000 and like reference numbers are used to describe the golf club head 1100 (for example, the golf club head 1100 comprises a crown 1110, a sole 1112, a heel end 1104, a toe end 1106, etc.).

Figure 34:
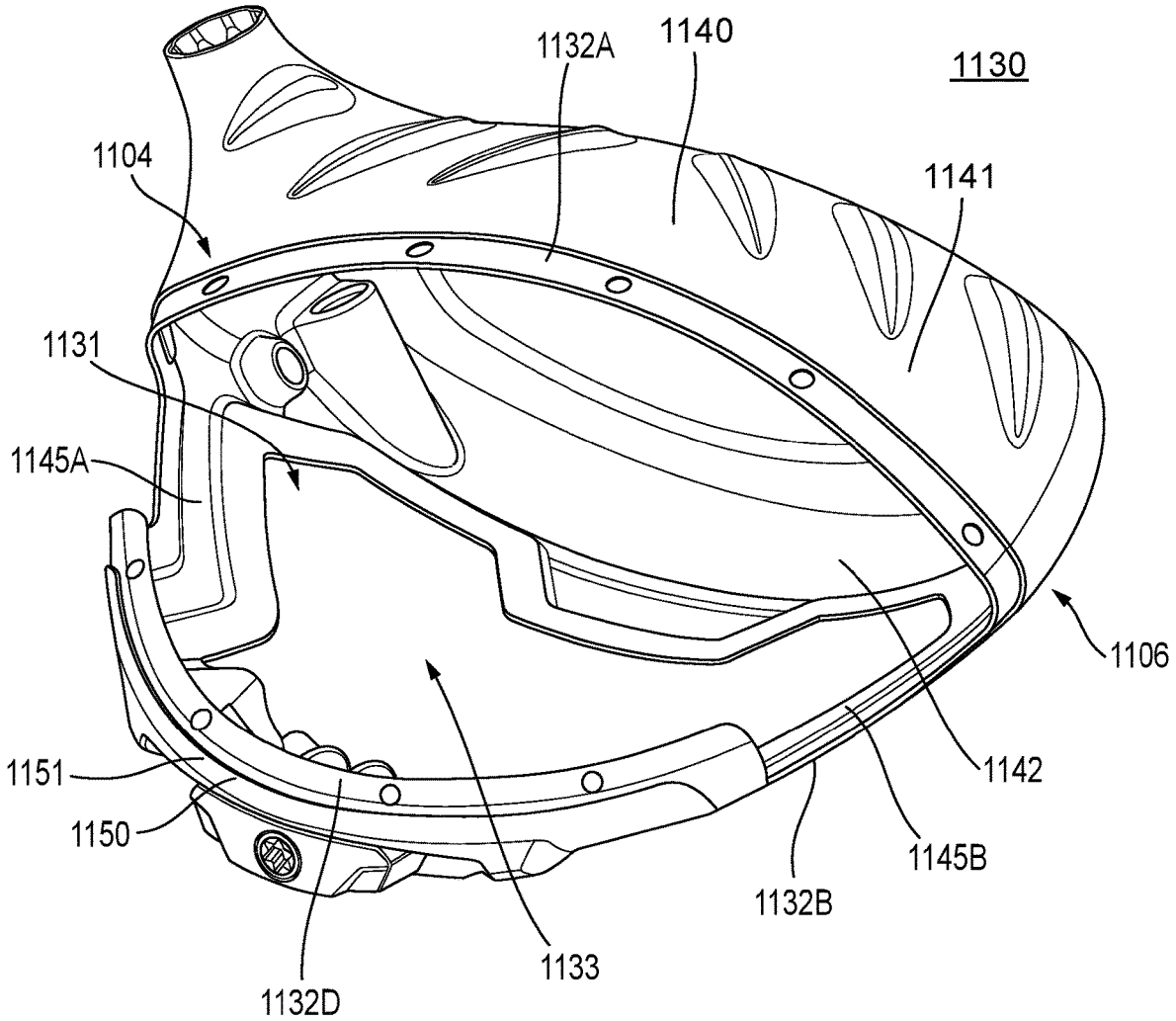
FIG. 34 illustrates a rear perspective view of the golf club head of FIG. 31, with portions removed to better show a frame.
Figure 35:
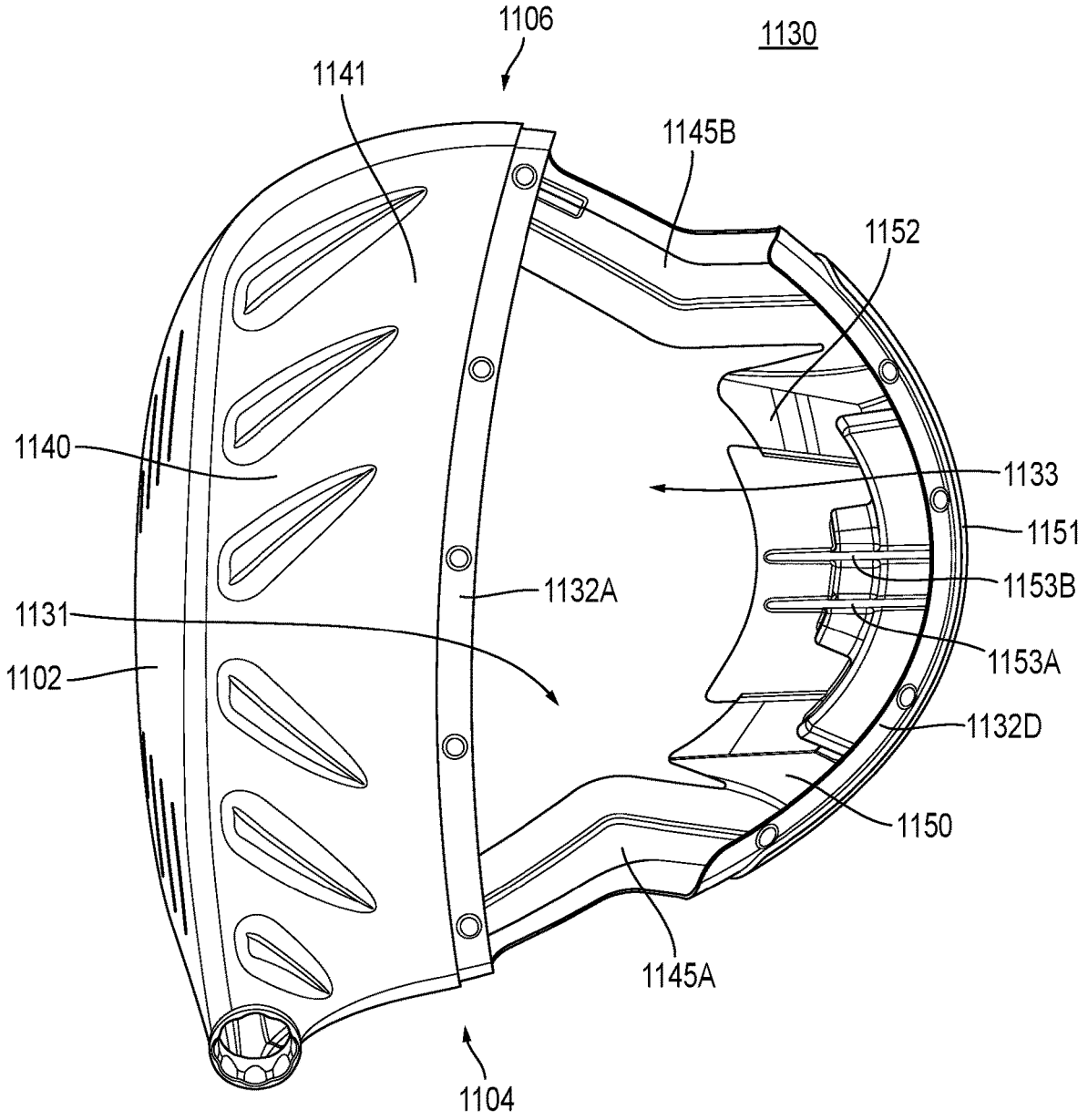
FIG. 35 illustrates a top plan view of the golf club head of FIG. 31, with portions removed to better show the frame.
Figure 36:
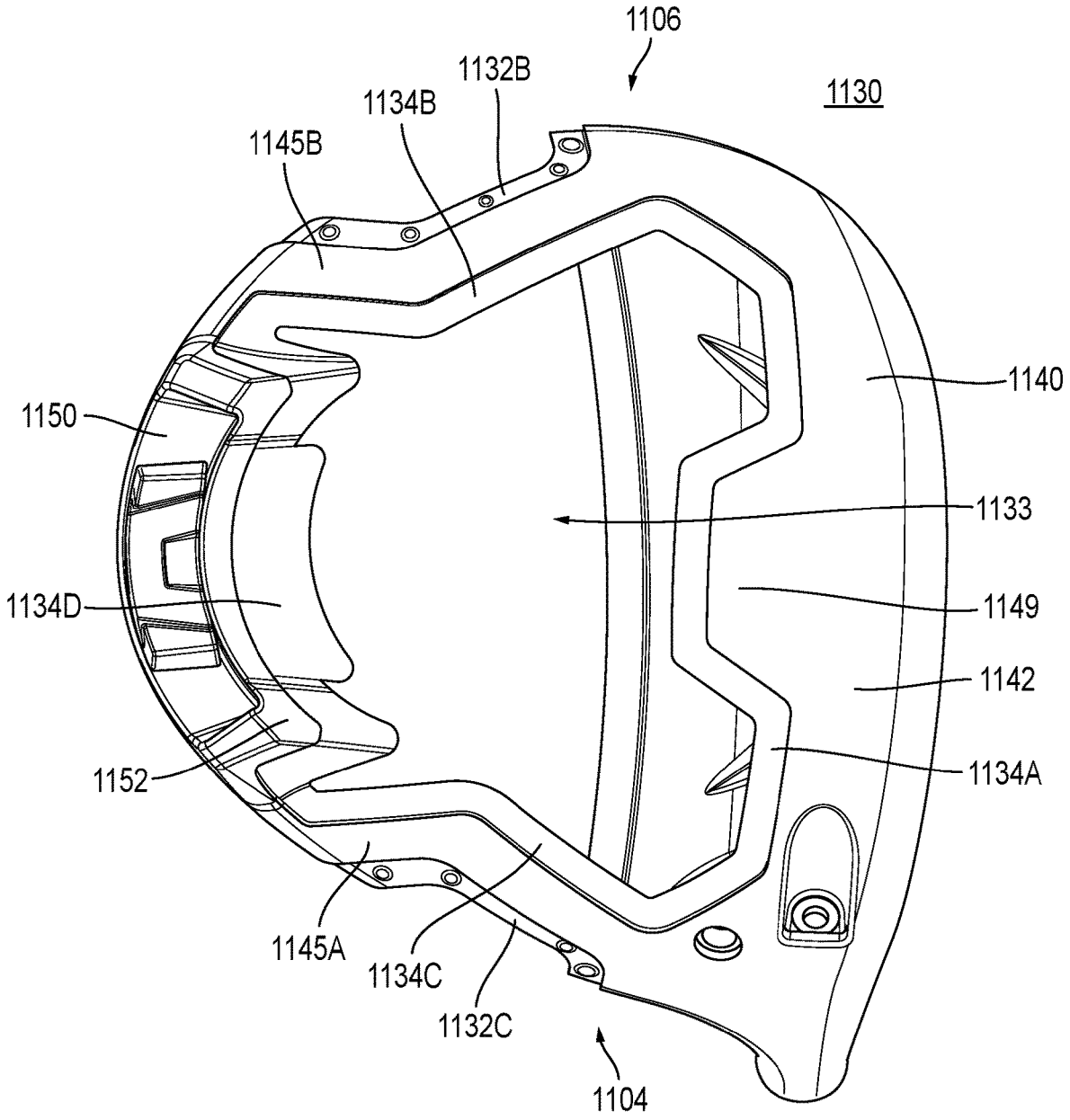
FIG. 36 illustrates a bottom plan view of the golf club head of FIG. 36, with portions removed to better show the frame.

Referring to FIGS. 34-36, the golf club head 1100 comprises a frame 1130 that provides a structure for receiving a crown insert 1160 and a sole insert 1170. The frame 1130 comprises a forward frame 1140 and a rearward frame 1150 that are connected via a heel-side external bridge 1145A and a toe-side external bridge 1145B. The forward frame 1140 comprises a forward crown return 1141 that forms a forward portion of the crown 1110, and a forward sole return 1142 that forms a forward portion of the sole 1112. The rearward frame 1150 comprises a rearward crown return 1151 that forms a rearward portion of the crown 1110, and a rearward sole return 1152 that forms a rearward portion of the sole 1112.

The frame 1130 comprises a series of ledges 1132A, 1132B, 1132C, 1132D that collectively form a crown ledge and define a crown opening 1131. The crown ledge of the golf club head 1100 is similar to the crown ledge of the golf club head 1000 discussed above. Specifically, the crown ledge comprises a forward crown ledge 1132A, a toeward crown ledge 1132B located on the sole proximate to the toe portion, a heelward crown ledge 1132C located on the sole proximate to the heel portion, and a rearward crown ledge 1132D located on the crown 1210 in the rear of the club head. Further, the crown ledge comprises similar a crown ledge width ($W_{CL}$) and crown ledge thickness to the crown ledge of the golf club head 1000. The crown insert 1160 is similar to the crown insert 1060 of the golf club head 1000 discussed above. Specifically, the crown insert 1160 comprises a crown insert heel wrap 1162A, and a crown insert toe wrap 1162B that wrap around the heel end 1104 and the toe end 1106, respectively, to form a portion of the sole 1112. The crown insert 1160 comprises a similar crown surface are coverage, sole surface area coverage, perimeter coverage, thickness, and mass to the crown insert 1060. The golf club head 1100 is relatively similar to the golf club head 1000, but for the difference in the shape of the sole opening 1133 and the sole insert 1170.

Figure 33:
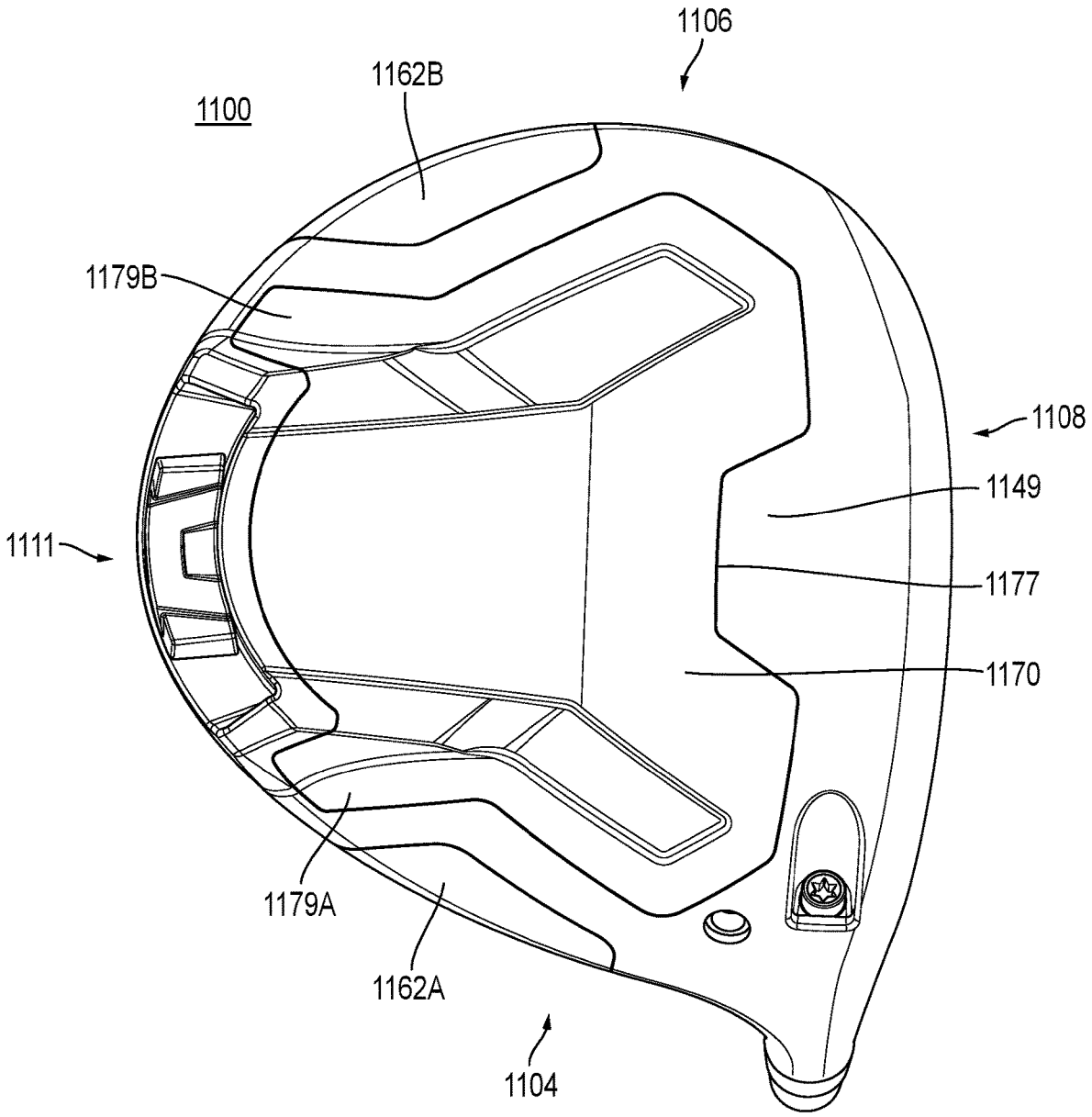
FIG. 33 illustrates a bottom plan view of the golf club head of FIG. 31.

Referring to FIG. 33, the sole insert 1170 comprises a heel-side extension 1179A near the heel end 1104, and a toe-side extension 1179B near the toe end 1106. The heel and toe side extensions 1179A, 1179B are located near the rear end 1111 of the golf club head 1100. The heel and toe side extensions 1179A, 1179B. The sole insert 1170 defines a cutout 1177 near the front end 1108 of the golf club head 1100. The cutout 1177 corresponds to a projection 1149 located on the frame 1130. The sole insert 1170 is received within the sole opening 1133 to enclose a hollow interior cavity. Despite the difference in the shape, the sole insert 1170 comprises a similar sole surface area coverage, thickness, and mass to the sole insert 1070.

The frame 1130 comprises a sole ledge that defines a sole opening 1133. The sole ledge comprises a forward sole ledge 1134A, a toeward sole ledge 1134B, a heelward sole ledge 1134C, and a rearward sole ledge 1134D. In comparison to the sole ledge of the golf club head 1000, the forward sole return 1142 comprises a projection 1149 that extends towards the center of the frame 1130, as illustrated in FIG. 33. The projection 1149 is also defined where the forward sole ledge 1134A projects inwards towards the center of the frame 1130. Further, the rearward sole ledge 1134D extends closer to the rear end 1111 of the golf club head 1100 than the sole ledge of the golf club head 1000. Despite the changes in shape, the sole ledge comprises similar a sole ledge width ($W_{SL}$) and sole ledge thickness to the sole ledge of the golf club head 1000. The sole ledges allow an outer surface of the sole insert 1170 to sit flush with the adjacent surface of the frame 1130.

The rear extensions 1179A, 1179B of the sole insert 1170 allow more lightweight material to cover portions of the sole 1112 that do not experience high stress upon impact with a golf ball. The rear extensions 1179A, 1179B allows the sole insert 1170 to extend further upward along the body height ($H_B$), thereby providing a greater portion of the sole insert 1170 in the upper hemisphere (UH) and/or above the weight member $CG_W$. Further, the introduction of the projection 1149 to the forward frame allows a large central mass pad (described below) to be located within the central mass zone (CMZ), thereby allocating mass to improve the $I_{XX}/I_{YY}$ ratio.

The golf club head 1100 can further comprise any combination of the internal reinforcement structures, mass pads, and/or indentations discussed above. The golf club head 1100 can comprise any combination of internal reinforcement structures discussed above to reduce vibrations in specific areas of the body 1101. Said reinforcement structures can include internal bridges, frame ribs, and/or insert ribs. The golf club head 1100 can comprise any combination of internal reinforcement structures located on the frame 1130, the crown insert 1160, and/or the sole insert 1170. The internal reinforcement structures of the golf club head 1100 can comprise similar directionality, height, width, and/or thickness dimensions to the internal reinforcement structures of the golf club head 1000.

The golf club head can comprise any combination of the mass pads discussed above to improve club head CG placement to achieve a high $I_{XX}/I_{YY}$ ratio. The golf club head 1100 can comprise any combination of mass pads located on interior surfaces of the frame 1130 near the crown 1110, the sole 1112, the front end 1108, the rear end 1111, the heel end 1104, and/or the toe end 1106. The mass pads of the golf club head 1200 can comprise similar positioning, sizing, and/or mass to the mass pads of the golf club head 1000. FIGS. 37A-40B illustrate various examples of internal reinforcement structures within the golf club head 1100. Additionally, FIGS. 20A-29B illustrate various examples of internal reinforcement structures within other embodiments of the golf club heads described herein. The internal reinforcing features illustrated on these embodiments can be adapted for use in the golf club head 1100.

Referring to FIG. 35, the frame 1130 can comprise a pair of frame ribs 1153A, 1153B located proximate the rear end 1111 and extending in a substantially front-to-rear direction. The frame ribs 1153A, 1153B can be particularly useful in embodiments comprising a weight member 1191 coupled to a low and rearward portion of the body 1101. In such embodiments, the frame ribs 1153A, 1153B are effective in damping vibrations that are caused by providing a weight member 1191 with a large mass in a rearward portion of the club head.

Figure 37A:
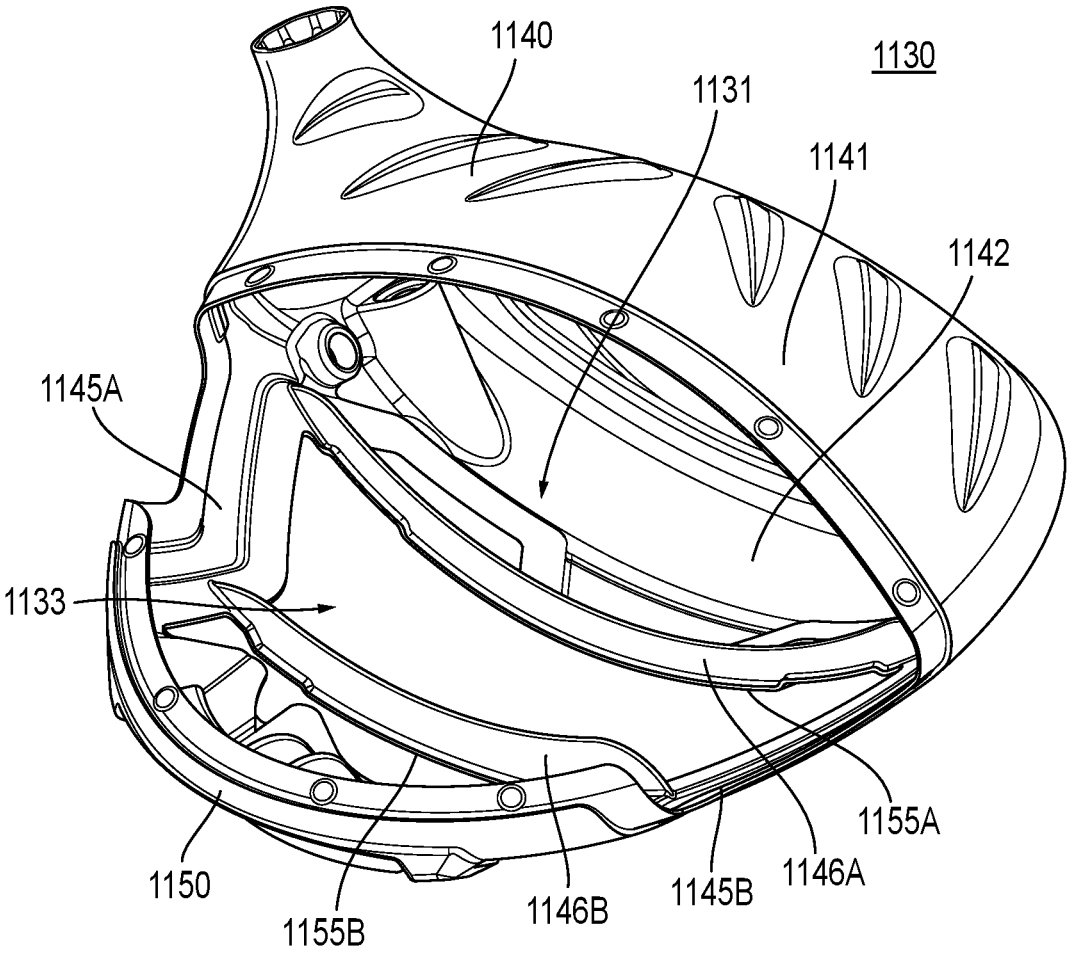
FIG. 37A illustrates a rear perspective view of a golf club head according to the present invention, with portions removed to better show a frame with internal reinforcing features.
Figure 37B:
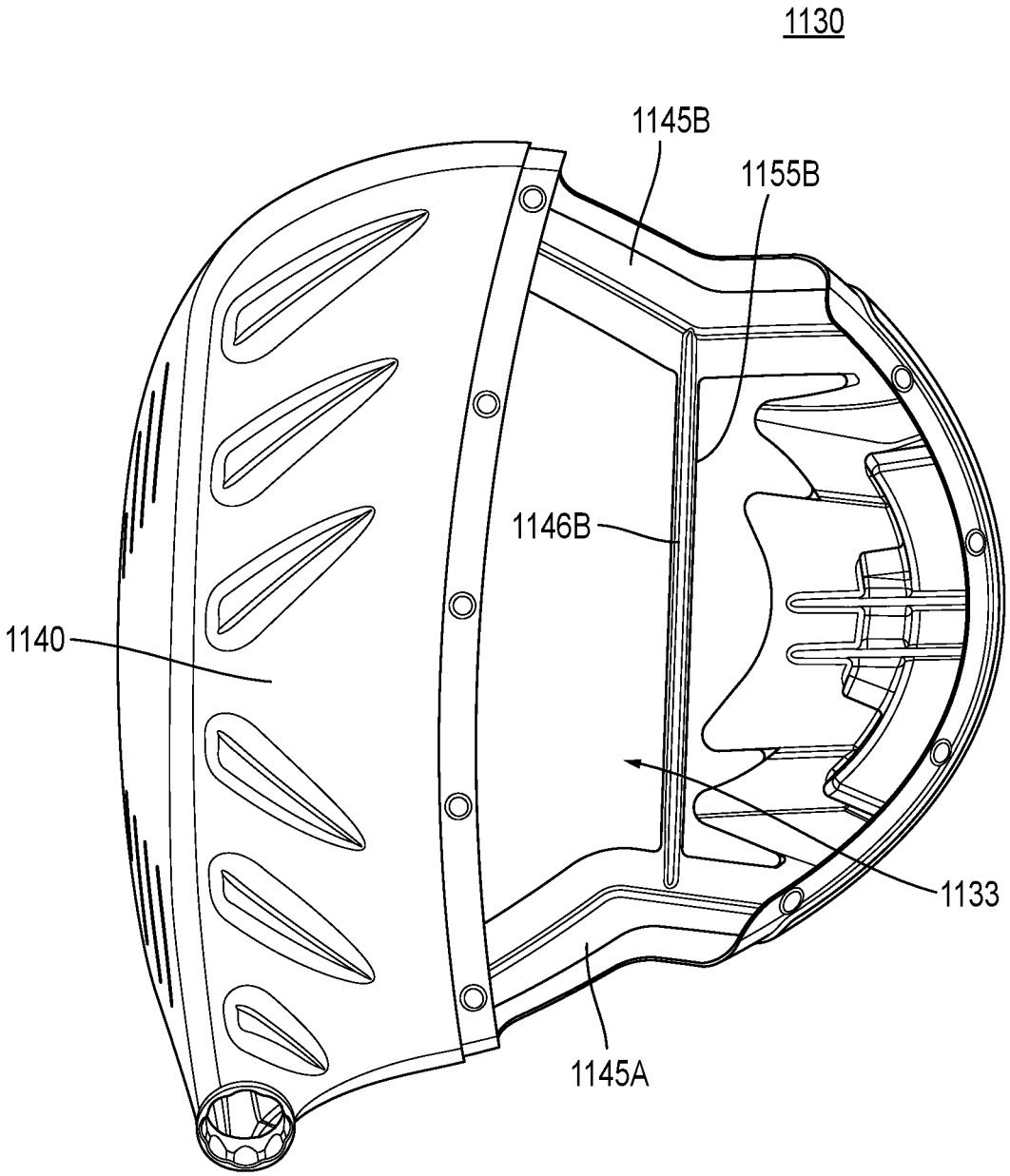
FIG. 37B illustrates a top plan view of the golf club head of FIG. 37A, with portions removed to better show the frame with internal reinforcing features.
Figure 37C:
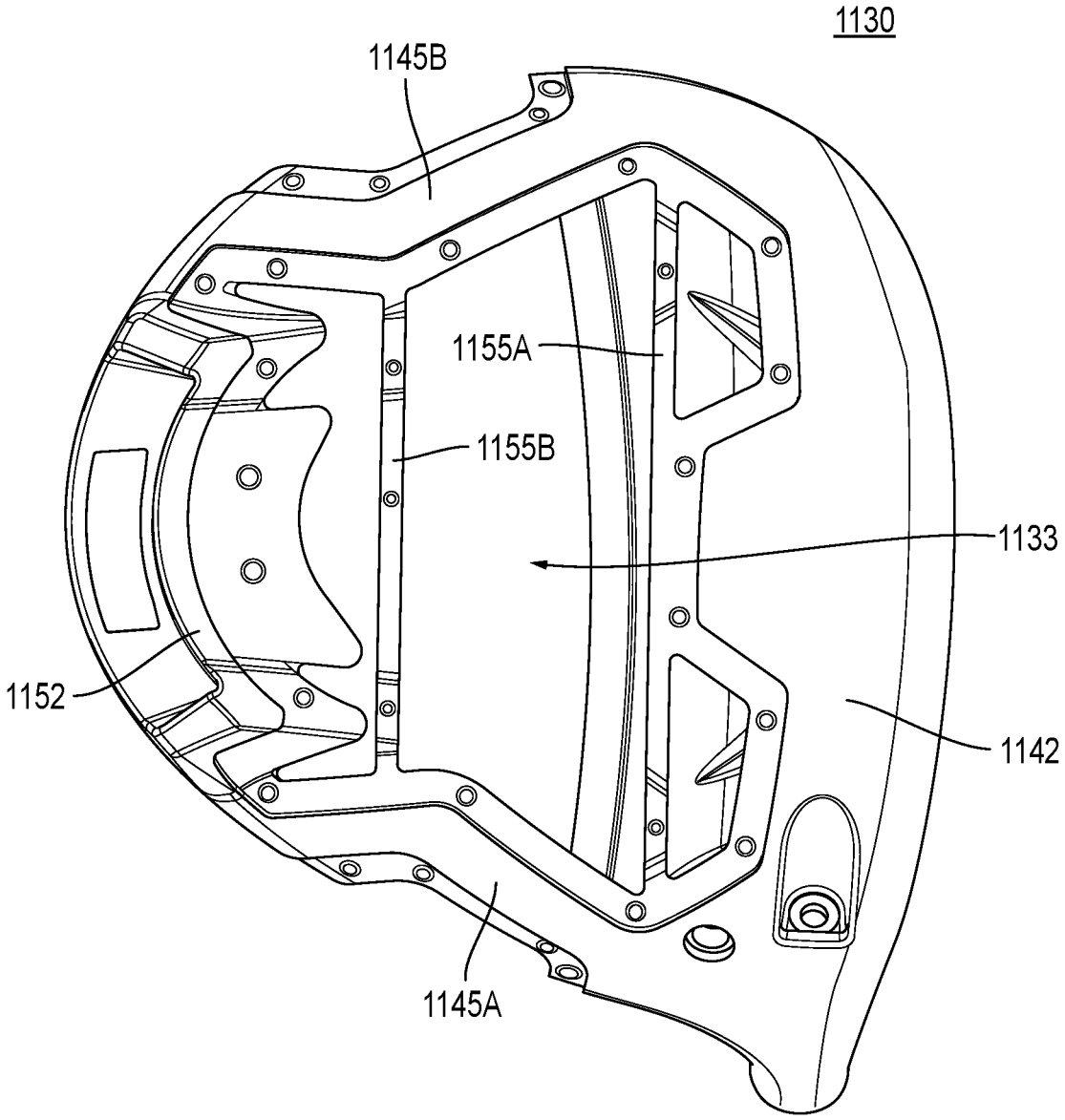
FIG. 37C illustrates a bottom plan view of the golf club head of FIG. 37A, with portions removed to better show the frame with internal reinforcing features.

FIGS. 37A-37C illustrate a frame 1130 comprising two external bridges 1145A, 1145B, two internal bridges 1155A, 1155B, and two frame ribs 1146A, 1146B. The forward internal bridge 1155A and the rearward internal bridge 1155B extend in a heel-to-toe direction across the sole opening 1133 between portions of the forward sole return 1142. The forward frame rib 1146A and the rearward frame rib 1146B are located above the forward internal bridge 1155A and the rearward internal bridge 1155B, respectively.

Figure 38A:
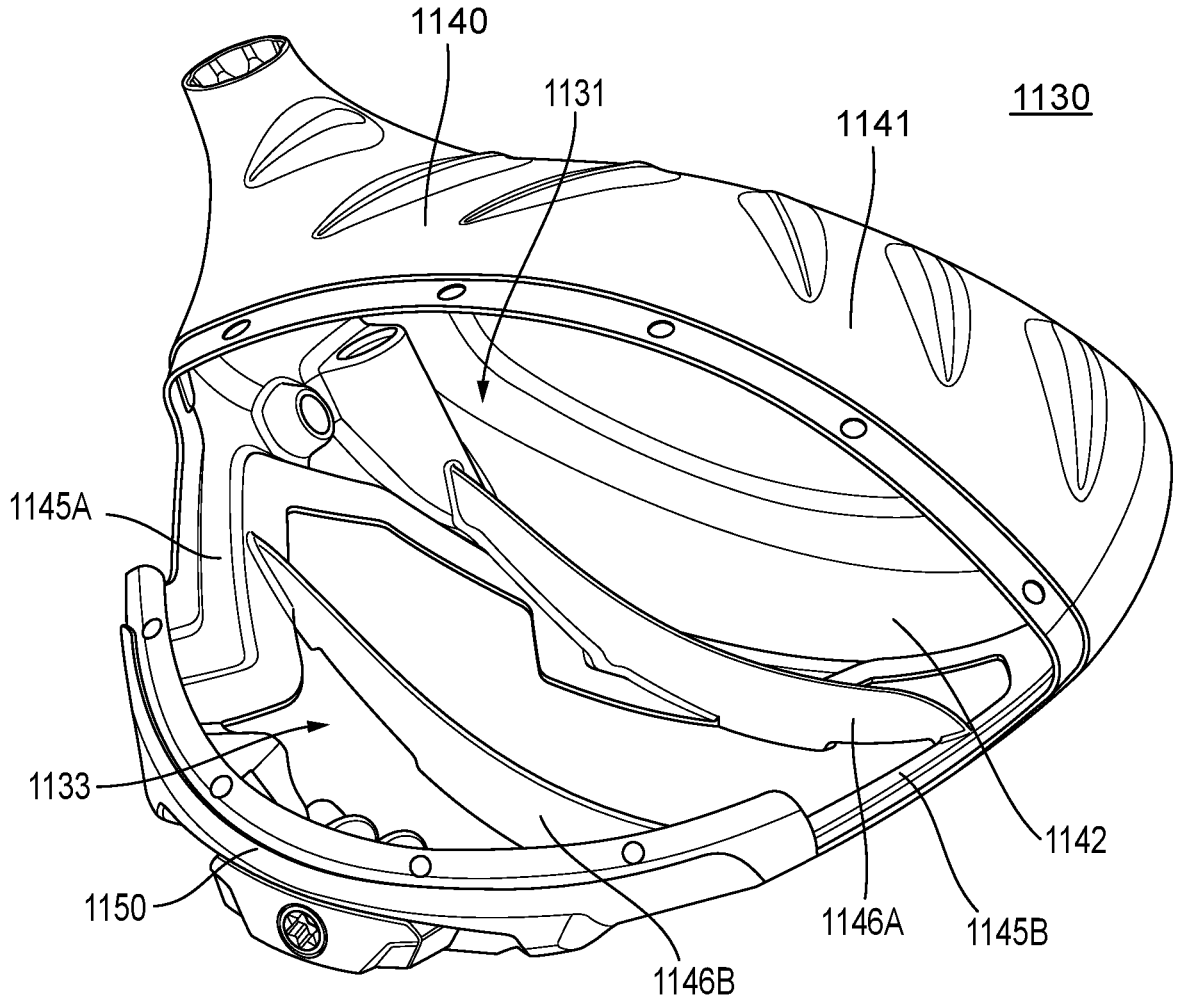
FIG. 38A illustrates a rear perspective view of a golf club head according to the present invention, with portions removed to better show a frame with internal reinforcing features.
Figure 38B:
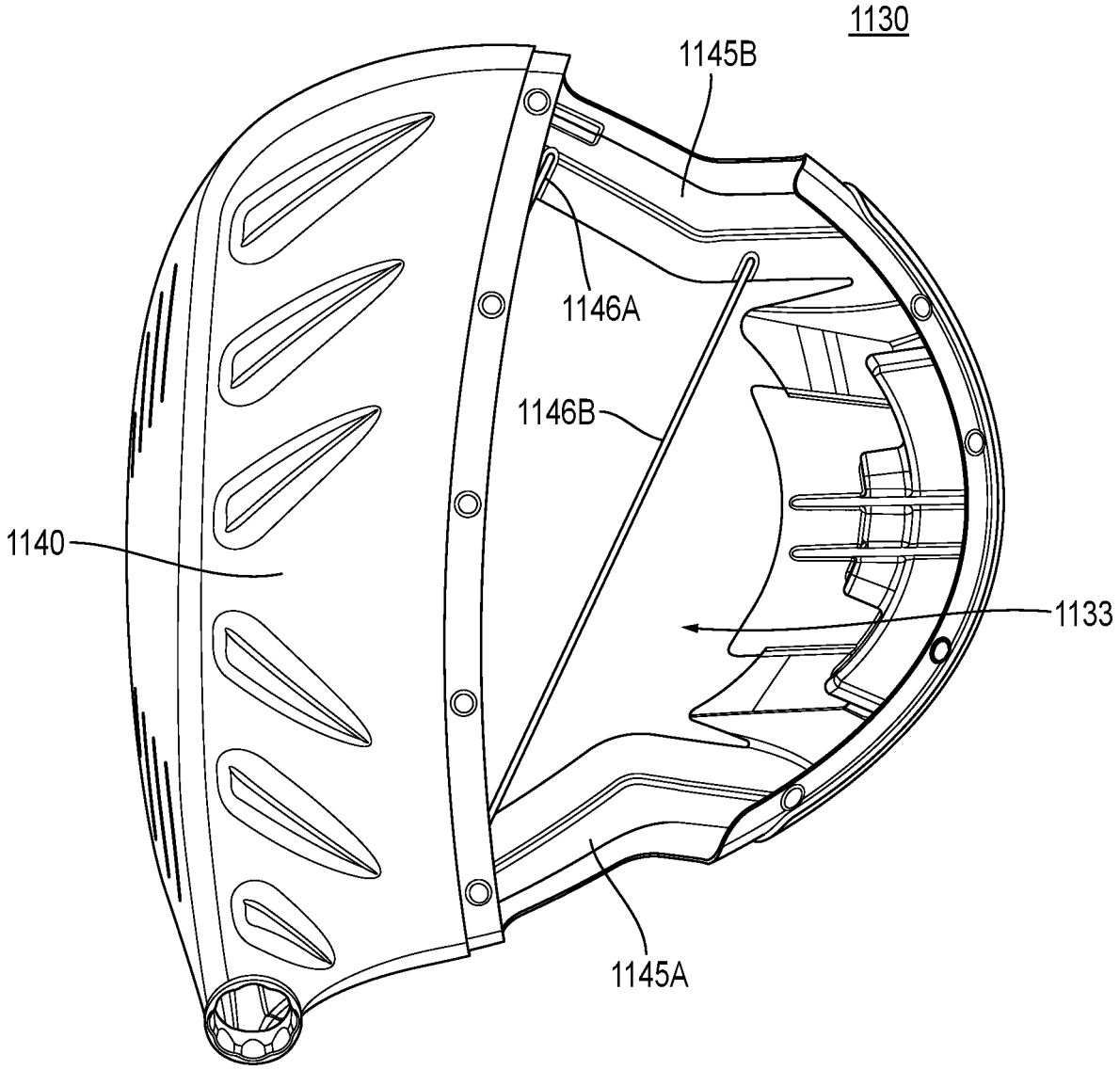
FIG. 38B illustrates a top plan view of the golf club head of FIG. 38A, with portions removed to better show the frame with internal reinforcing features.
Figure 38C:
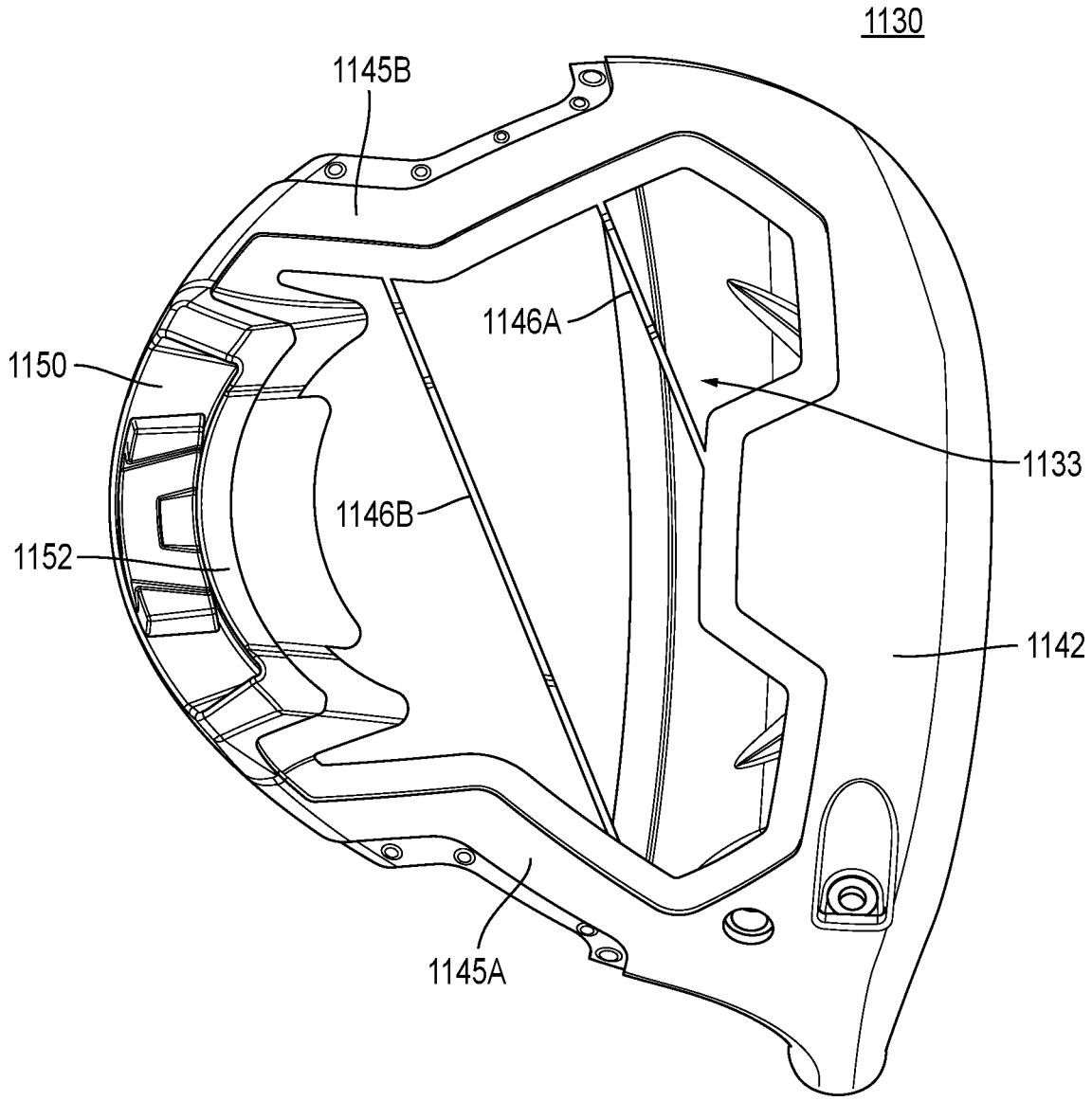
FIG. 38C illustrates a bottom plan view of the golf club head of FIG. 38A, with portions removed to better show the frame with internal reinforcing features.

FIGS. 38A-38C illustrate a frame 1130 comprising two external bridges 1145A, 1145B and two frame ribs 1146A, 1146B. The forward frame rib 1146A and the rearward frame rib 1146B extend diagonally across the sole opening 1133. The forward frame rib 1146A extends between the toe-side external bridge 1145B and the forward sole return 1142. The rearward frame rib 1146B extends between the heel-side external bridge 1145A and the toe-side external bridge 1145B. The embodiment illustrated in FIGS. 38A-38C is devoid of internal bridges.

Figure 39A:
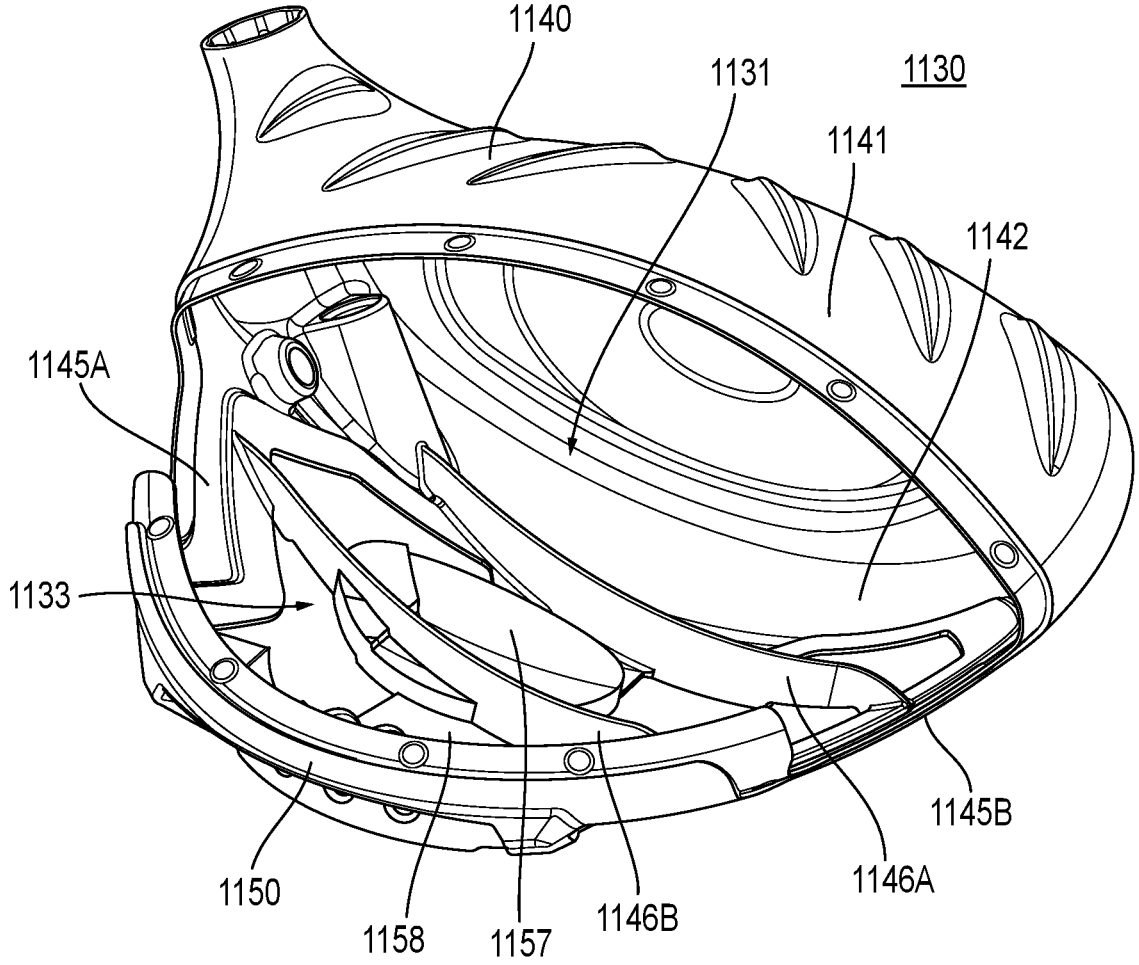
FIG. 39A illustrates a rear perspective view of a golf club head according to the present invention, with portions removed to better show a frame with internal reinforcing features.
Figure 39B:
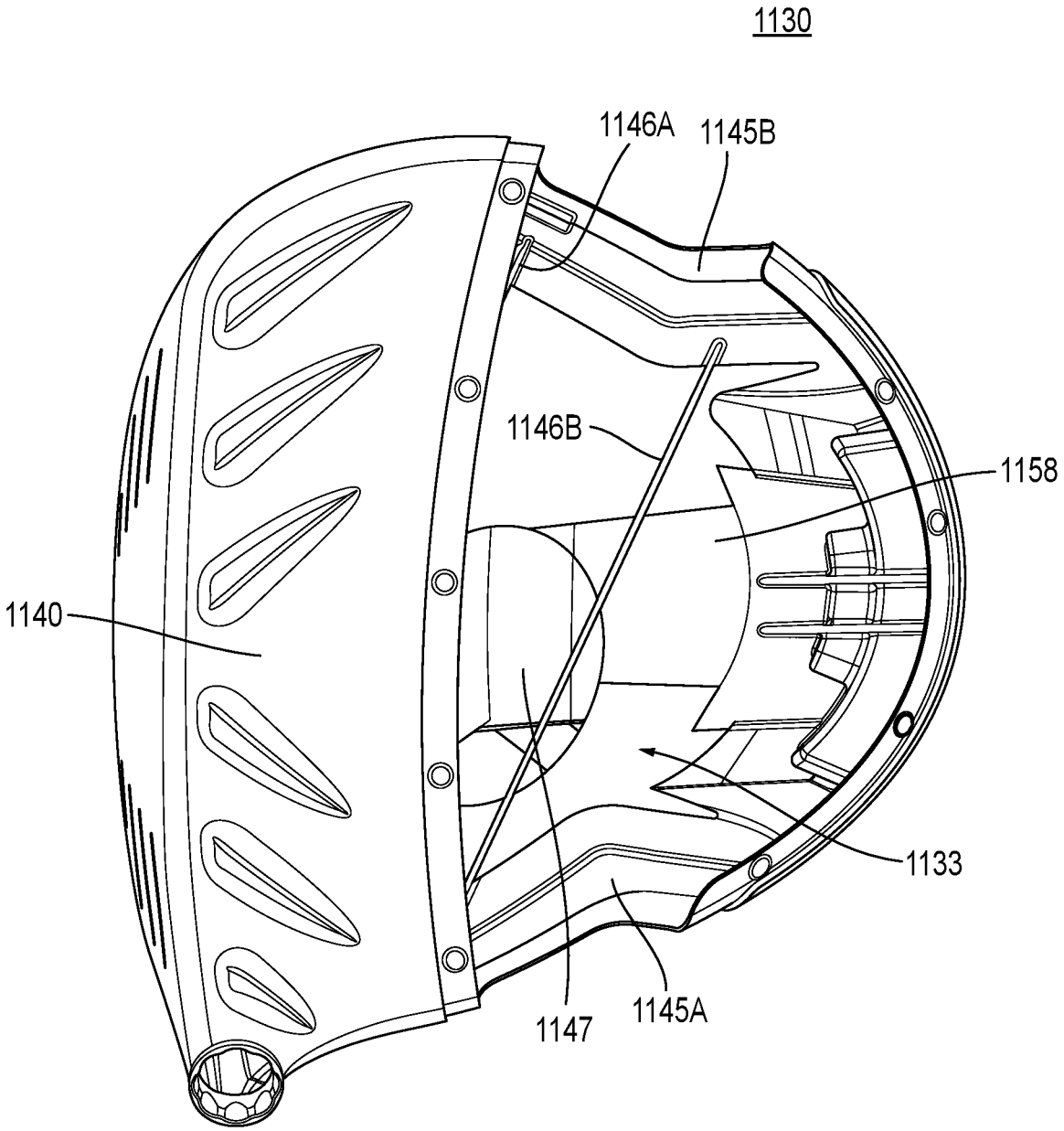
FIG. 39B illustrates a top plan view of the golf club head of FIG. 39A, with portions removed to better show the frame with internal reinforcing features.
Figure 39C:
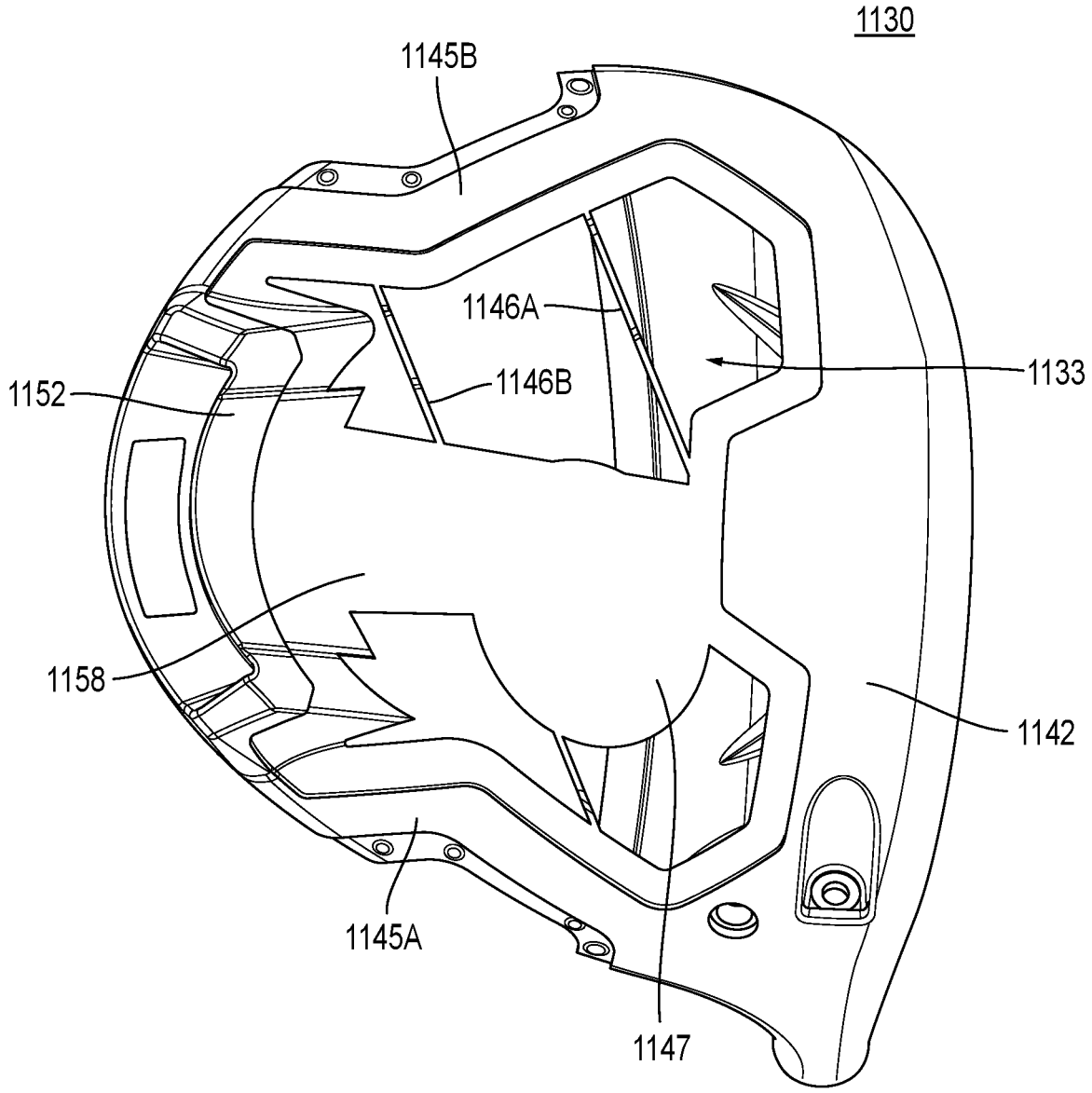
FIG. 39C illustrates a bottom plan view of the golf club head of FIG. 39A, with portions removed to better show the frame with internal reinforcing features.

FIGS. 39A-39C illustrate a frame 1130 comprising an internal bridge 1158, two frame ribs 1146A, 1146B, and a mass pad 1157. The internal bridge 1158 extends in a front-to-rear direction across the sole opening 1133 between the forward sole return 1142 and the rearward sole return 1152. The mass pad 1157 is positioned above the internal bridge 1158. The frame ribs 1146A, 1146B extend diagonally across the sole opening 1133 and are located above the internal bridge 1158. The forward frame rib 1146A extends between the toe-side external bridge 1145B and the forward sole return 1142. The rearward frame rib 1146B extends between the heel-side external bridge 1145A and the toe-side external bridge 1145B. The rearward frame rib 1146B intersects the mass pad 1157. The internal bridge 1158 comprises an internal bridge width ($W_{IB}$) that is large enough to support the mass pad 1157.

Figure 40A:
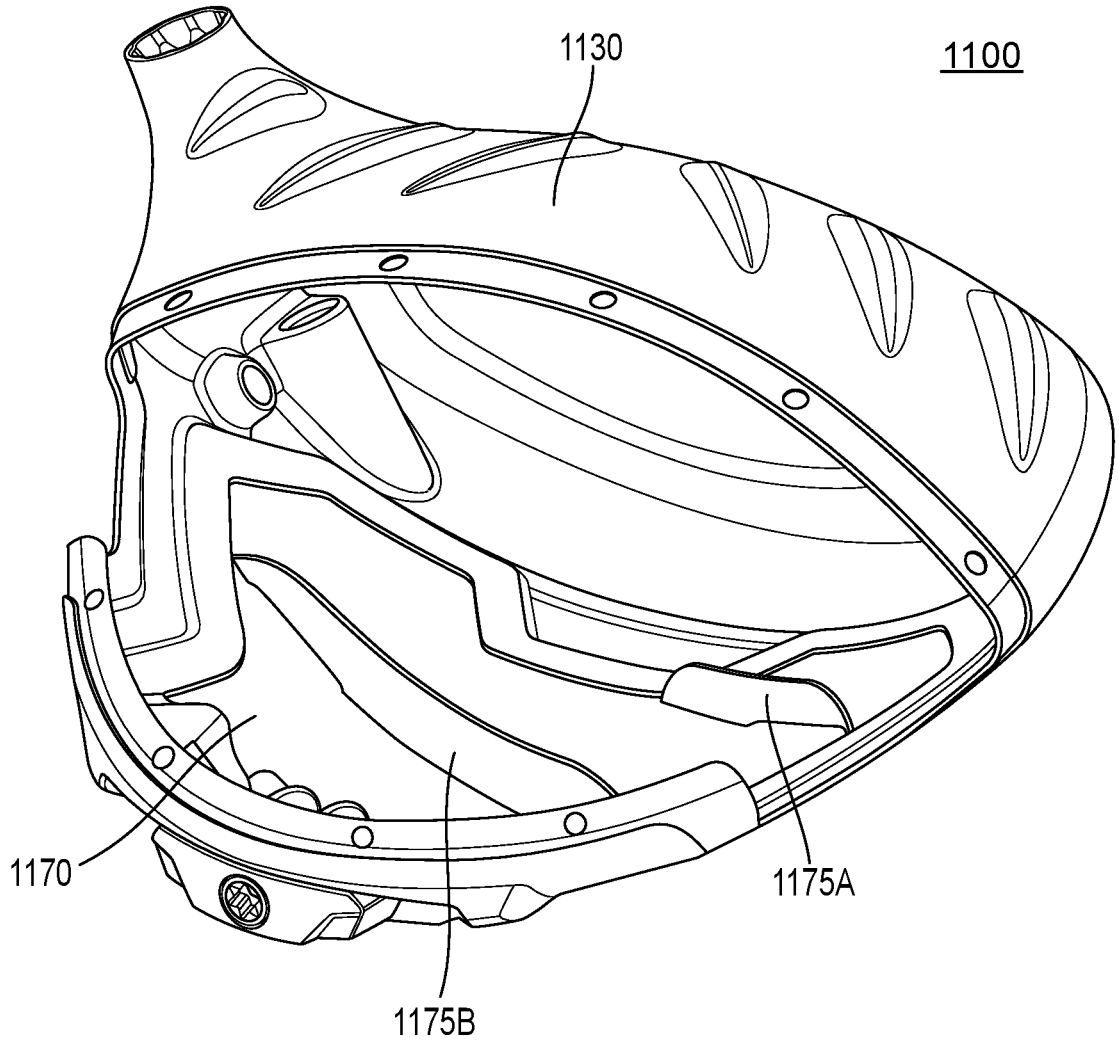
FIG. 40A illustrates a rear-perspective view of a golf club head according to the present invention, with portions removed to better show a sole insert with reinforcing features.
Figure 40B:
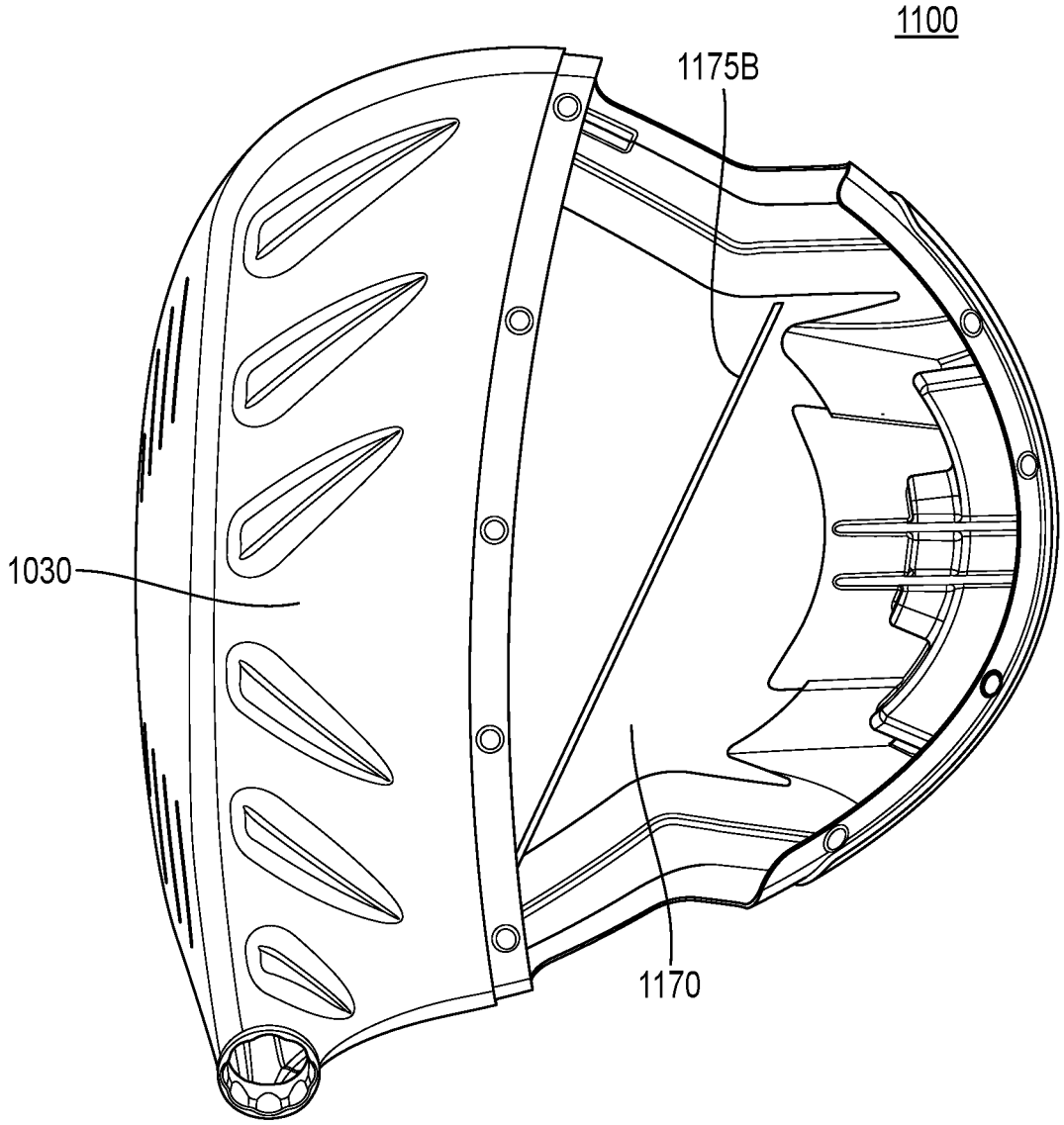
FIG. 40B illustrates a top plan view of the golf club head of FIG. 40A, with portions removed to better show the sole insert with internal reinforcing features.

FIGS. 40A and 40B illustrate a sole insert 1170 comprising two insert ribs 1175A, 1175B that extend diagonally across the sole insert 1170. The forward insert rib 1175A extends across the sole insert 1170 between the toe-side external bridge 1145B and the forward sole return 1142. The rearward insert rib 1175B extends across the sole insert 1170 between the heel-side external bridge 1145A and the toe-side external bridge 1145B.

The golf club head 1100 can comprise any combination of the indentations discussed above to provide a desired club head shape. The golf club head 1100 can comprise any combination of indentations located on the frame 1130, the crown insert 1160, and/or the sole insert 1170. The indentations of the golf club head 1100 can comprise similar shapes and/or dimensions to the Indentations of the golf club head 1000.

C. Discrete Crown Insert and Multiple Sole Inserts

Figure 41:
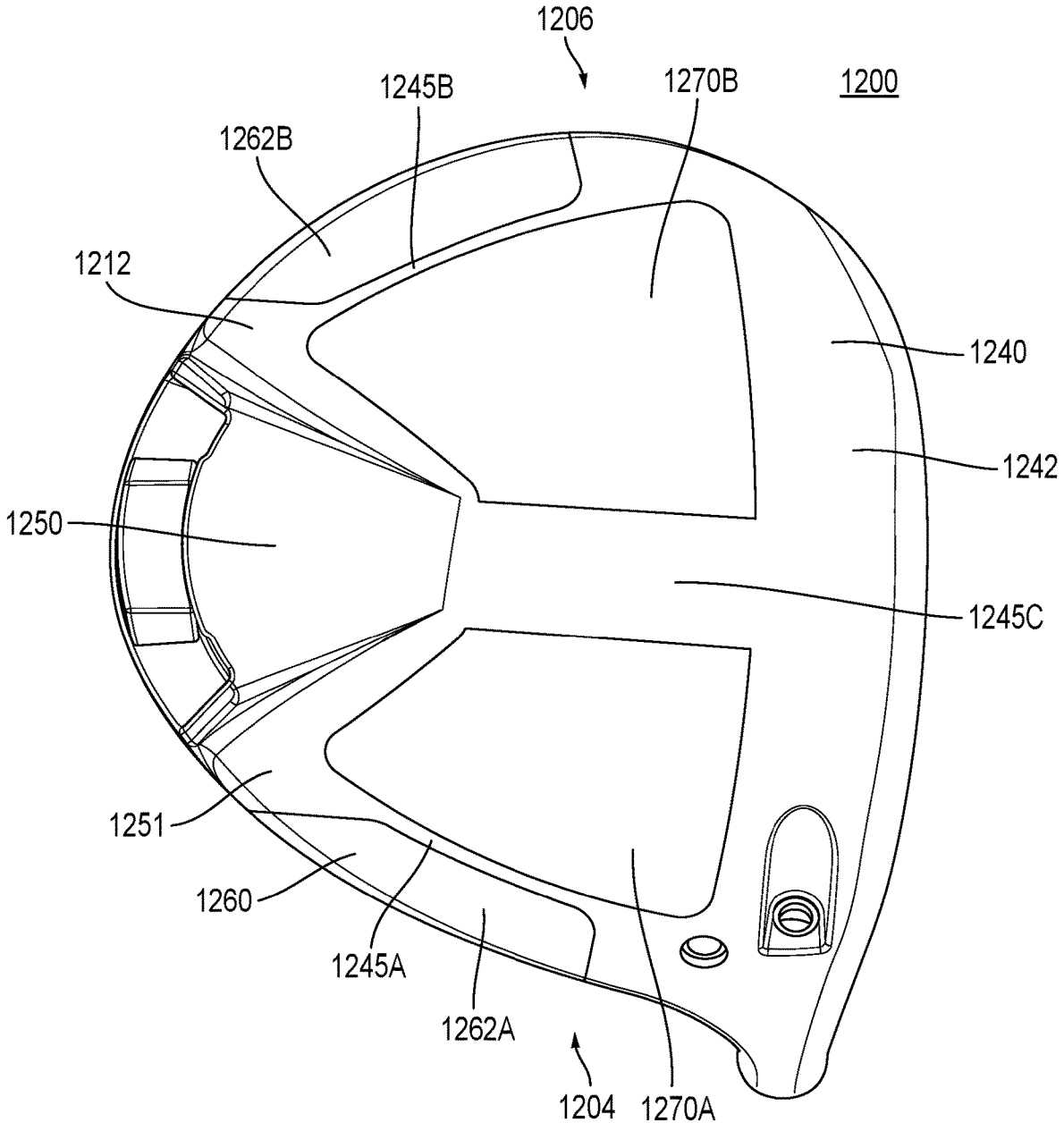
FIG. 41 illustrates a bottom plan view of a golf club head according to the present invention.
Figure 42:
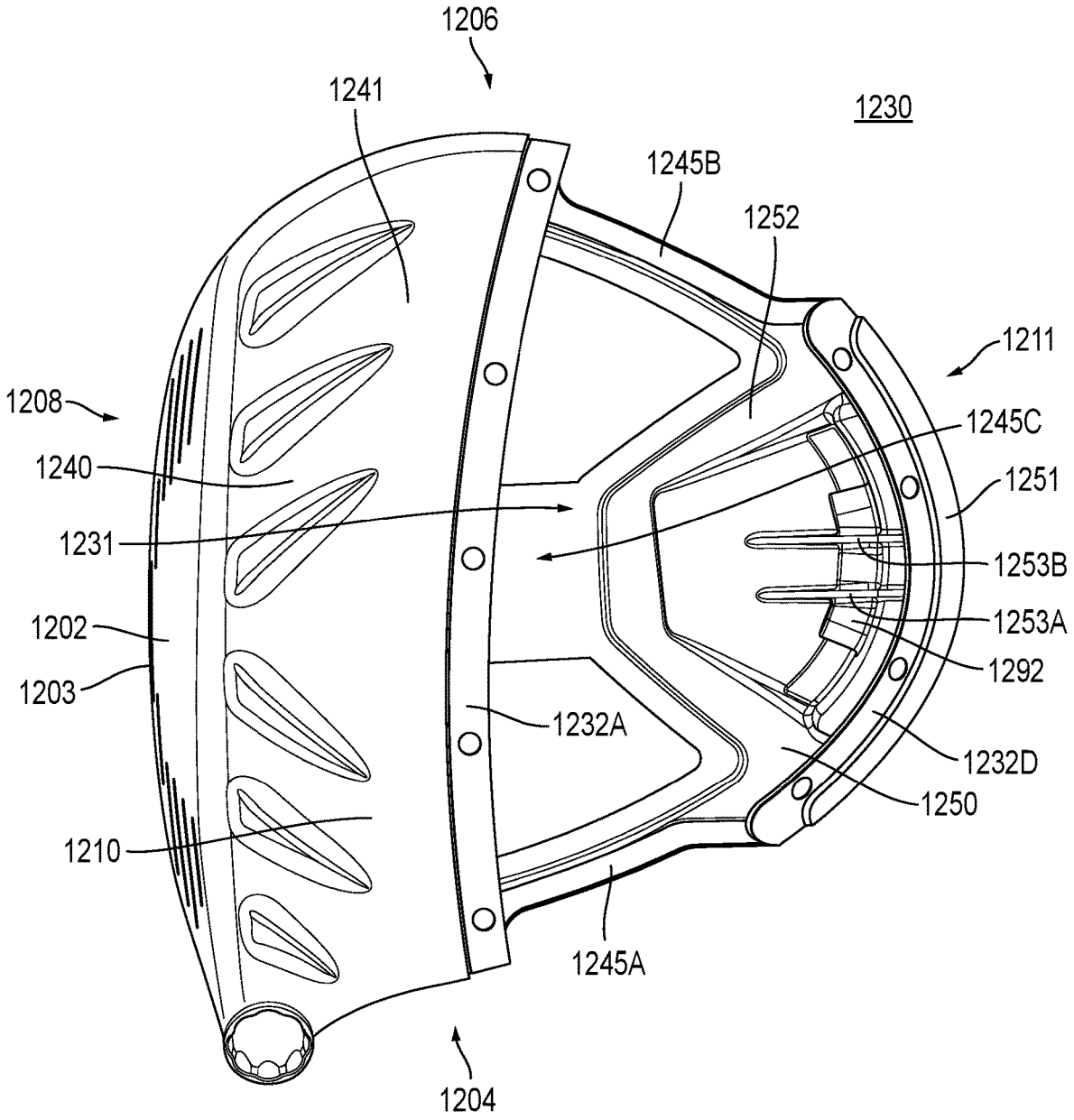
FIG. 42 illustrates a top plan view of the golf club head of FIG. 41, with portions removed to better show the frame.
Figure 43:
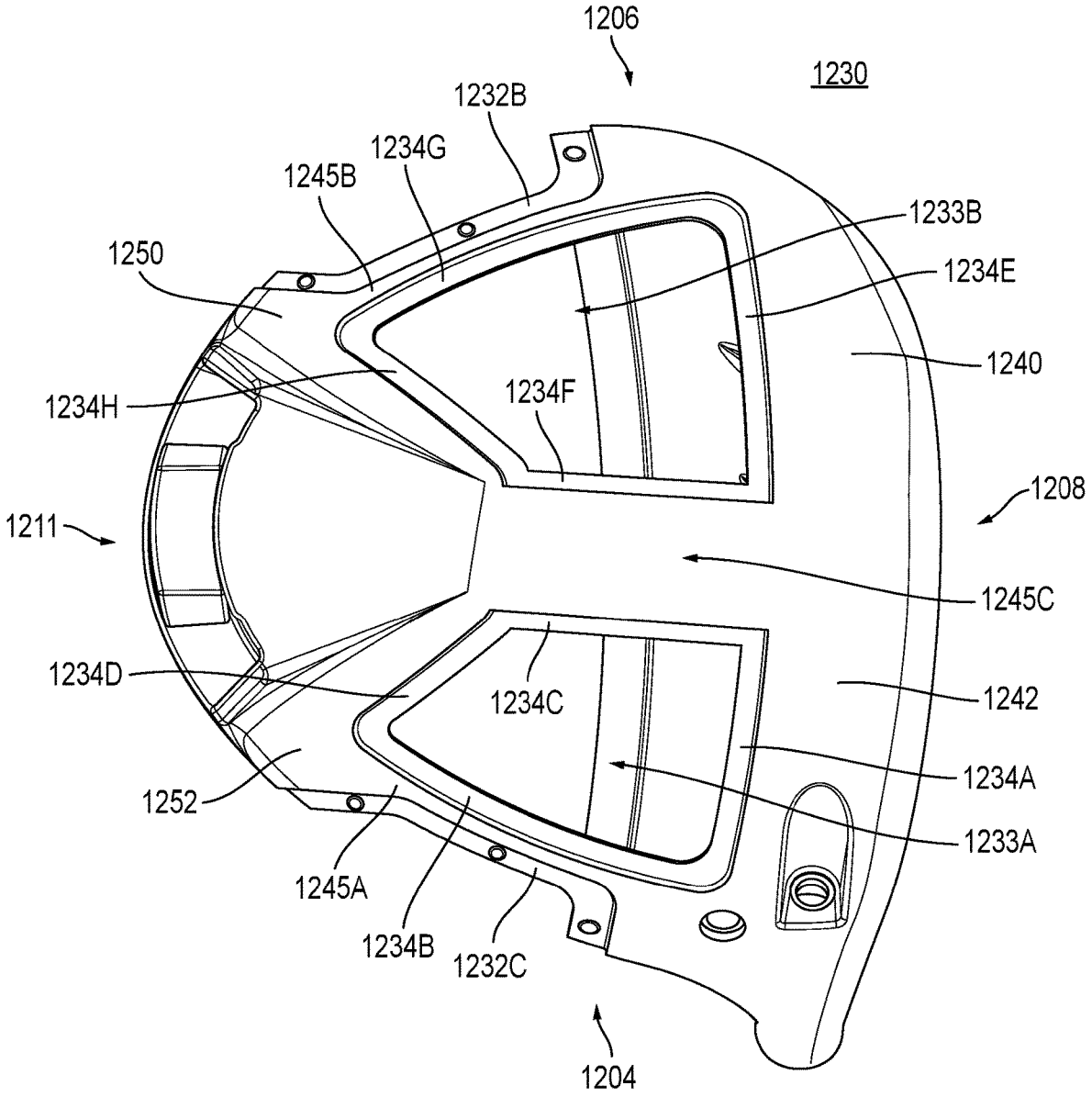
FIG. 43 illustrates a bottom plan view of the golf club head of FIG. 41, with portions removed to better show the frame.

FIGS. 41-43 illustrate another embodiment of a golf club head 1200 comprising one or more discrete composite inserts. The golf club head 1200 comprises similar dimensions and relationships to the golf club head 1000, as discussed above. Specifically, the golf club head 1200 comprises similar dimensions and/or dimensional parameters related to midsection coverage, perimeter coverage, upper hemisphere (UH) coverage, lower hemisphere (LH) coverage, or any combination thereof. The golf club head 1200 can comprise any combination of the internal reinforcement structures, mass pads, and/or indentations described above. The golf club head 1200 is similar to golf club head 1000, and like reference numbers are used to describe the golf club head 1200 (for example, the golf club head 1200 comprises a crown 1210, a sole 1212, a heel end 1204, a toe end 1206, etc.).

Referring to FIGS. 42 and 43, the golf club head 1200 comprises a frame 1230 that provides a structure for receiving a crown insert 1260, a heel-side sole insert 1270A, and a toe-side sole insert 1270B. The frame 1230 comprises a forward frame 1240 and a rearward frame 1250 that are connected via a heel-side external bridge 1245A, a toe-side external bridge 1245B, and a central external bridge 1245C. The forward frame 1240 comprises a forward crown return 1241 that forms a forward portion of the crown 1210, and a forward sole return 1242 that forms a forward portion of the sole 1212. The rearward frame 1250 comprises a rearward crown return 1251 that forms a rearward portion of the crown 1210, and a rearward sole return 1252 that forms a rearward portion of the sole 1212.

The frame 1230 comprises a series of ledges 1232A, 1232B, 1232C, 1232D that collectively form a crown ledge and define a crown opening 1231. The crown ledge of the golf club head 1200 is similar to the crown ledge of the golf club head 1000 discussed above. Specifically, the crown ledge comprises a forward crown ledge 1232A, a toeward crown ledge 1232B located on the sole proximate to the toe portion, a heelward crown ledge 1232C located on the sole proximate to the heel portion, and a rearward crown ledge 1232D located on the crown 1210 in the rear of the club head. Further, the crown ledge comprises a crown ledge width ($W_{CL}$) and crown ledge thickness similar to the crown ledge of the golf club head 1000. The crown insert 1260 is similar to the crown insert 1060 of the golf club head 1000 discussed above. Specifically, the crown insert 1260 comprises a crown insert heel wrap 1262A, and a crown insert toe wrap 1262B that wrap around the heel end 1204 and the toe end 1206, respectively, to form a portion of the sole 1212. The crown insert 1260 comprises a similar crown surface are coverage, sole surface area coverage, perimeter coverage, thickness, and mass to the crown insert 1060. The golf club head 1200 is relatively similar to the golf club head 1000, but for the addition of the central external bridge 1245C to the frame 1230.

The central external bridge 1245C extends in a front-to-rear direction between the forward sole return 1242 and the rearward sole return 1252. As discussed above, the external bridges help to define the one or more openings and provide separation between the one or more inserts. Referring to FIG. 41, the central external bridge 1245C partitions the sole opening into a heel-side sole opening 1233A and a toe-side sole opening 1233B. The golf club head 1200 comprises a heel-side sole insert 1270A that is received within the heel-side sole opening 1233A, and a toe-side sole insert 1270B that is received within the toe-side sole opening 1233B to enclose a hollow interior cavity. Despite the difference in shape, the sole inserts 1270A, 1270B can comprise a similar sole surface area coverage, thickness, and mass to the sole insert 1070.

The frame 1230 comprises sole ledges to accommodate the heel-side sole insert 1270A and the toe-side sole insert 1270B. Referring to FIG. 43, the heel-side sole opening 1233A comprises sole ledges 1234A, 1234B, 1234C, 1234D configured to receive the heel-side sole insert 1270A. The toe-side sole opening 1233B comprises sole ledges 1234E, 1234F, 1234G, 1234H configured to receive the toe-side sole insert 1270B. Despite the changes in shape, the sole ledge comprises similar a sole ledge width ($W_{SL}$) and sole ledge thickness to the sole ledge of the golf club head 1000. The sole ledges allow an outer surface of the sole inserts 1270A, 1270B to sit flush with the adjacent surface of the frame 1230.

While the illustrated embodiment demonstrates a golf club head 1200 comprising two discrete sole inserts 1270A, 1270B, the golf club head can comprise any number of discrete sole inserts. For example, frame 1030 can comprise two sole inserts, three sole inserts, four sole inserts, five sole inserts, six sole inserts, or any suitable number of sole inserts. The introduction of multiple discrete sole inserts allows the geometries of the sole inserts to be more customizable for a specific mass distribution. Providing multiple discrete sole inserts can also improve manufacturability by allowing smaller, simpler sole insert geometries to be formed rather than requiring a single insert to be formed with a complicated geometry. Further, the introduction of the central external bridge 1245C can support a large central mass pad (described below) located within the central mass zone (CMZ), thereby allocating mass to improve the $I_{XX}/I_{YY}$ ratio.

The golf club head 1200 can further comprise any combination of the internal reinforcement structures, mass pads, and/or indentations discussed above. The golf club head 1200 can comprise any combination of internal reinforcement structures discussed above to reduce vibrations in specific areas of the body 1201. Said reinforcement structures can include internal bridges, frame ribs, and/or insert ribs. The golf club head 1200 can comprise any combination of internal reinforcement structures located on the frame 1230, the crown insert 1260, the heel-side sole insert 1270A, and/or the toe-side sole insert 1270B. The internal reinforcement structures of the golf club head 1200 can comprise similar directionality, height, width, and/or thickness dimensions to the internal reinforcement structures of the golf club head 1000.

Various examples of internal bridges are illustrated in FIGS. 20A-20C, 29A, and 29B, 37A-37C, and 39A-39C. Various examples of frame ribs are illustrated in FIGS. 20A-22C, 29A, and 29B, and 37A-39C. Various examples of insert ribs are illustrated in FIGS. 23A-28C, 40A, and 40B. The internal reinforcing features illustrated on the golf club heads 1000, 1100 can be adapted for use in the golf club head 1200. For example, these internal reinforcement structures can extend across the entirety of the sole 1212 such that one or more internal reinforcement structures can extend over the heel-side sole opening 1233A, the toe-side sole opening 1233B, and the central external bridge 1245C. Alternatively, these internal reinforcement structures can extend across the heel-side sole opening 1233A and/or the toe-side sole opening 1233B.

Referring to FIG. 41, the frame 1230 can comprise a pair of frame ribs 1253A, 1253B located proximate the rear end 1211 and extending in a substantially front-to-rear direction. The frame ribs 1253A, 1253B can be particularly useful in embodiments comprising a weight member 1291 coupled to a low and rearward portion of the body 1201. In such embodiments, the frame ribs 1253A, 1253B are effective in damping vibrations that are caused by providing a weight member 1291 with a large mass in a rearward portion of the club head.

The golf club head can comprise any combination of the mass pads discussed above to improve club head CG placement to achieve a high $I_{XX}/I_{YY}$ ratio. The golf club head 1200 can comprise any combination of mass pads located on interior surfaces of the frame 1230 near the crown 1210, the sole 1212, the front end 1208, the rear end 1211, the heel end 1204, and/or the toe end 1206. The mass pads of the golf club head 1200 can comprise similar positioning, sizing, and/or mass to the mass pads of the golf club head 1000.

Various examples of mass pads are illustrated in FIGS. 29A, 29B, and 39A-39C. The mass pads illustrated on the golf club heads 1000, 1100 can be adapted for use in the golf club head 1200. For example, the mass pads can be formed integrally with the central external bridge 1245C. Alternatively, these mass pads can be suspended within the heel-side sole opening 1233A and/or the toe-side sole opening 1233B by one or more internal bridges and/or other portions of the frame 1230.

The golf club head can comprise any combination of the indentations discussed above to provide a desired club head shape. The golf club head 1200 can comprise any combination of indentations located on the frame 1230, the heel-side sole insert 1270A, and/or the toe-side sole insert 1270B. The indentations of the golf club head 1200 can comprise similar shapes and/or dimensions to the Indentations of the golf club head 1000.

FIG. 30 illustrates an example of a golf club head 1000 comprising indentations 1072A, 1072B, 1072C. The indentations illustrated on the golf club head 1000 can be adapted for use in the golf club head 1200. For example, the indentations can extend across portions of the central external bridge 1245C and/or the sole inserts 1270A, 1270B. Alternatively, the indentations can be located within only the central external bridge 1245C the heel-side sole insert 1270A, and/or the toe-side sole insert 1270B.

iii. Central Insert Embodiments

FIGS. 44-60 illustrate various embodiments of a golf club head comprising a continuous, central insert (referred to as a "central insert"). The central insert is secured to the frame to define the body. The central insert wraps continuously around the body and forms at least a portion of the crown, at least a portion of the sole, and at least a portion of the body perimeter near both the heel end and the toe end. The central insert can be a single component, or multiple components. The central insert is received within a central opening located on the frame. As discussed above, the frame is formed from a metallic material to provide a sturdy structure for receiving the inserts, and the central insert is formed from a lightweight composite material, which creates discretionary mass that can be redistributed throughout the club head to maximize $I_{YY}$, provide an $I_{XX}/I_{YY}$ ratio close to 1, and/or to provide a club head CG position at or near the loft-normal axis.

The central insert strategically forms a large portion of the body midsection (MS) to remove mass from near the club head CG, thereby increasing discretionary mass to be redistributed around the periphery of the golf club head to increase MOI. As discussed above, the midsection (MS) of the body typically experiences relatively low stress during impact, which allows large amounts of composite or otherwise lightweight material to be placed near the midsection (MS) without compromising the durability of the golf club head. The central insert is spaced rearward of the strike face to allow the strike face to bend at impact without any interference from the central insert. Providing a club head with a central insert provides a balance between increasing discretionary mass and preserving durability.

The golf club head 2000 is used to illustrate various features of golf club heads comprising a central insert. For example, the golf club head 2000 is used to illustrate various internal reinforcement structures, mass pads, and/or indentations. These structures, however, are not limited to the golf club head 2000. The various club head embodiments comprising a central insert described herein can comprise any combination of said structures including, but not limited to, internal reinforcement structures, mass pads, and/or indentations.

A. Single-Member Central Insert

Figure 44:
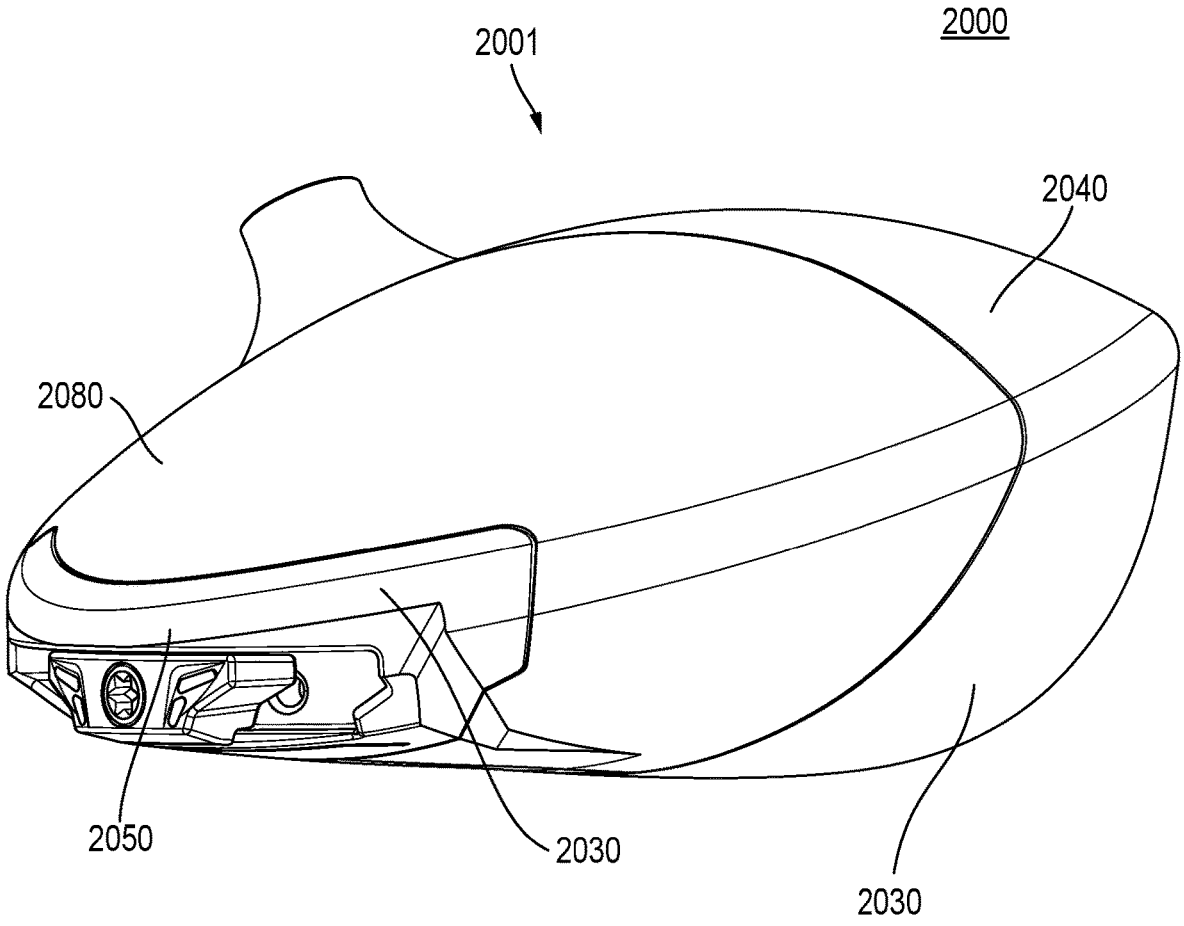
FIG. 44 illustrates a rear-perspective view of a golf club head according to the present invention, comprising a central insert.
Figure 49:
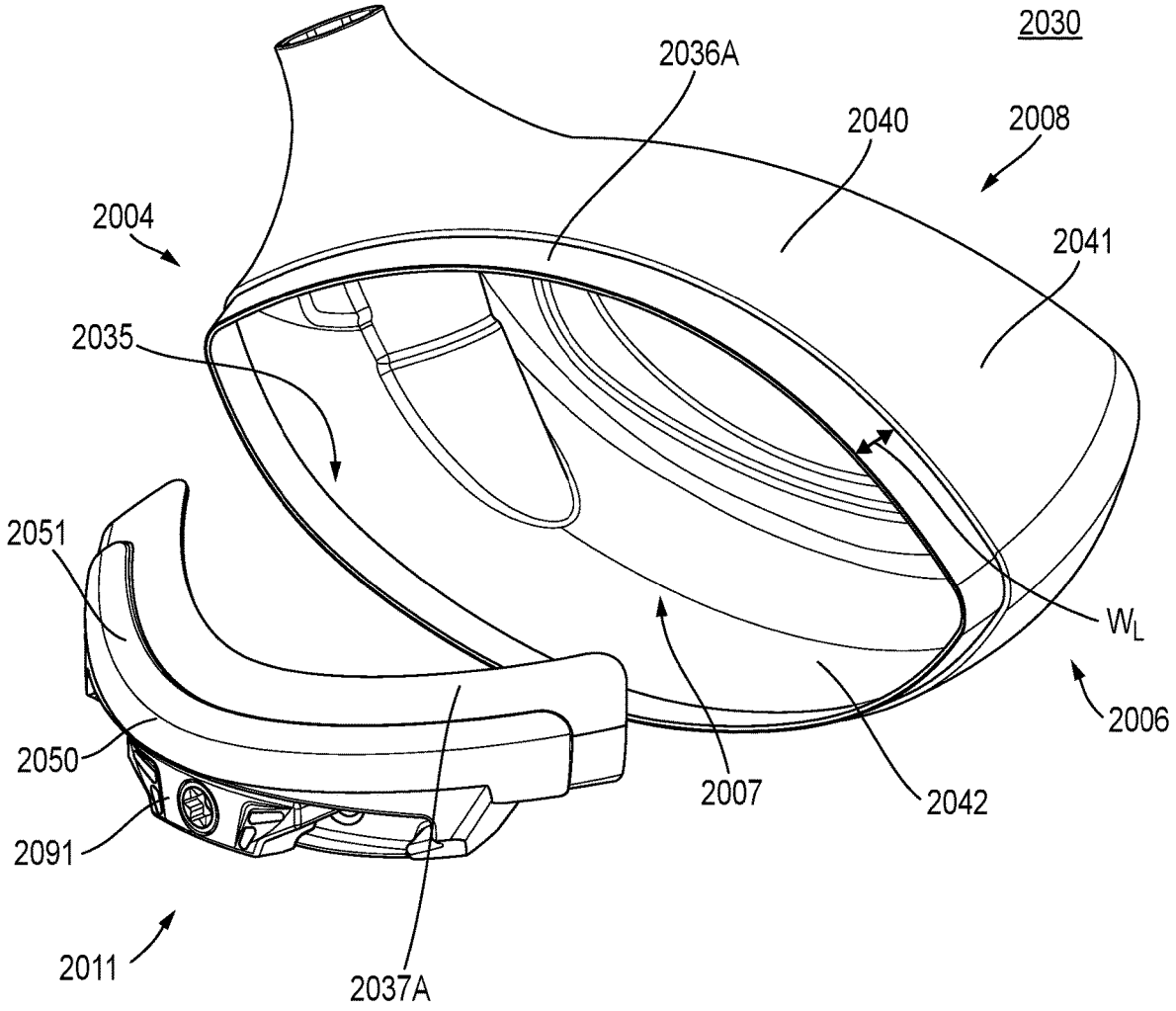
FIG. 49 illustrates a rear perspective view of the golf club head of FIG. 44, with portions removed to better show a frame.
Figure 50:
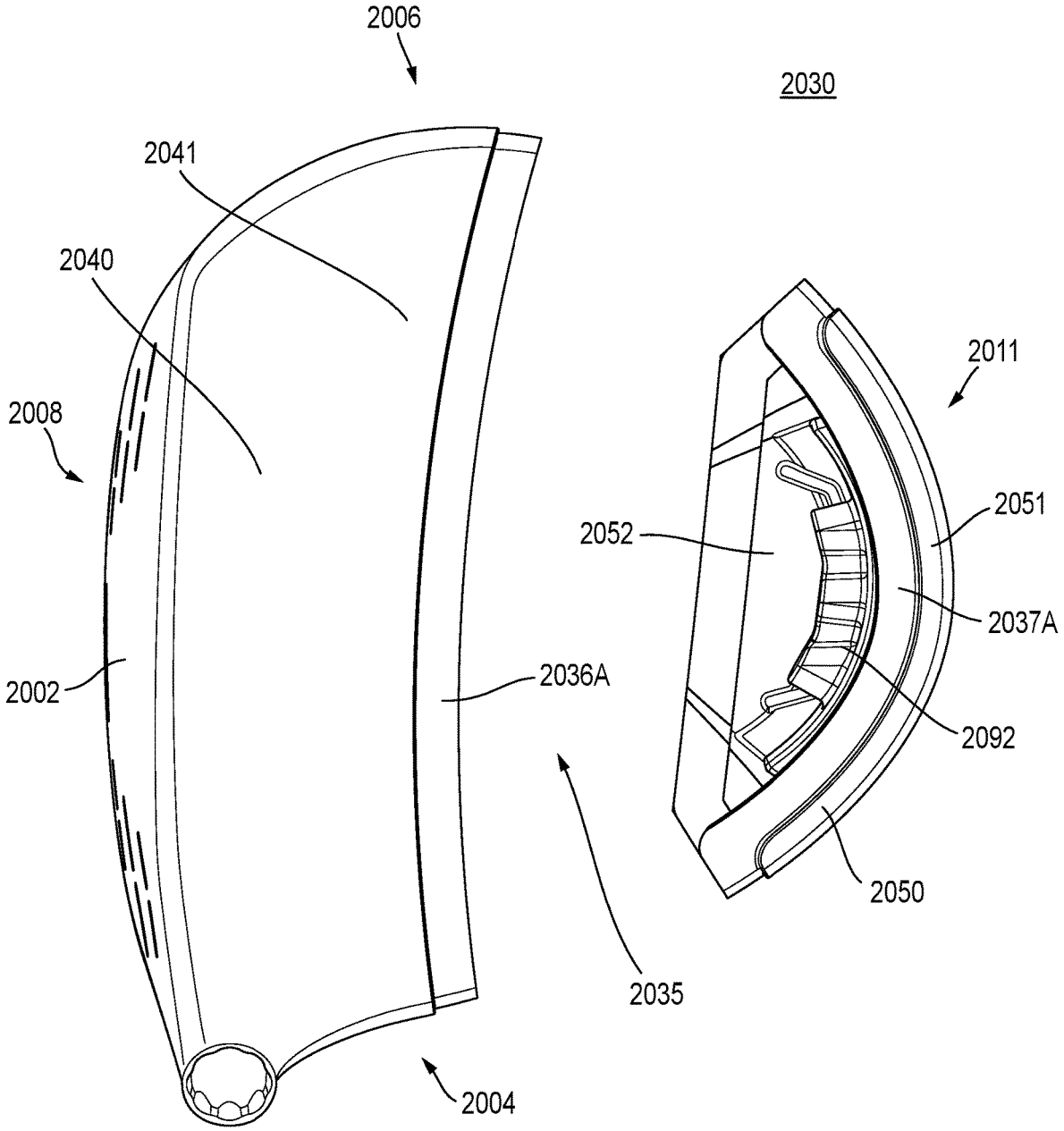
FIG. 50 illustrates a top plan view of the golf club head of FIG. 44, with portions removed to better show the frame.
Figure 51:
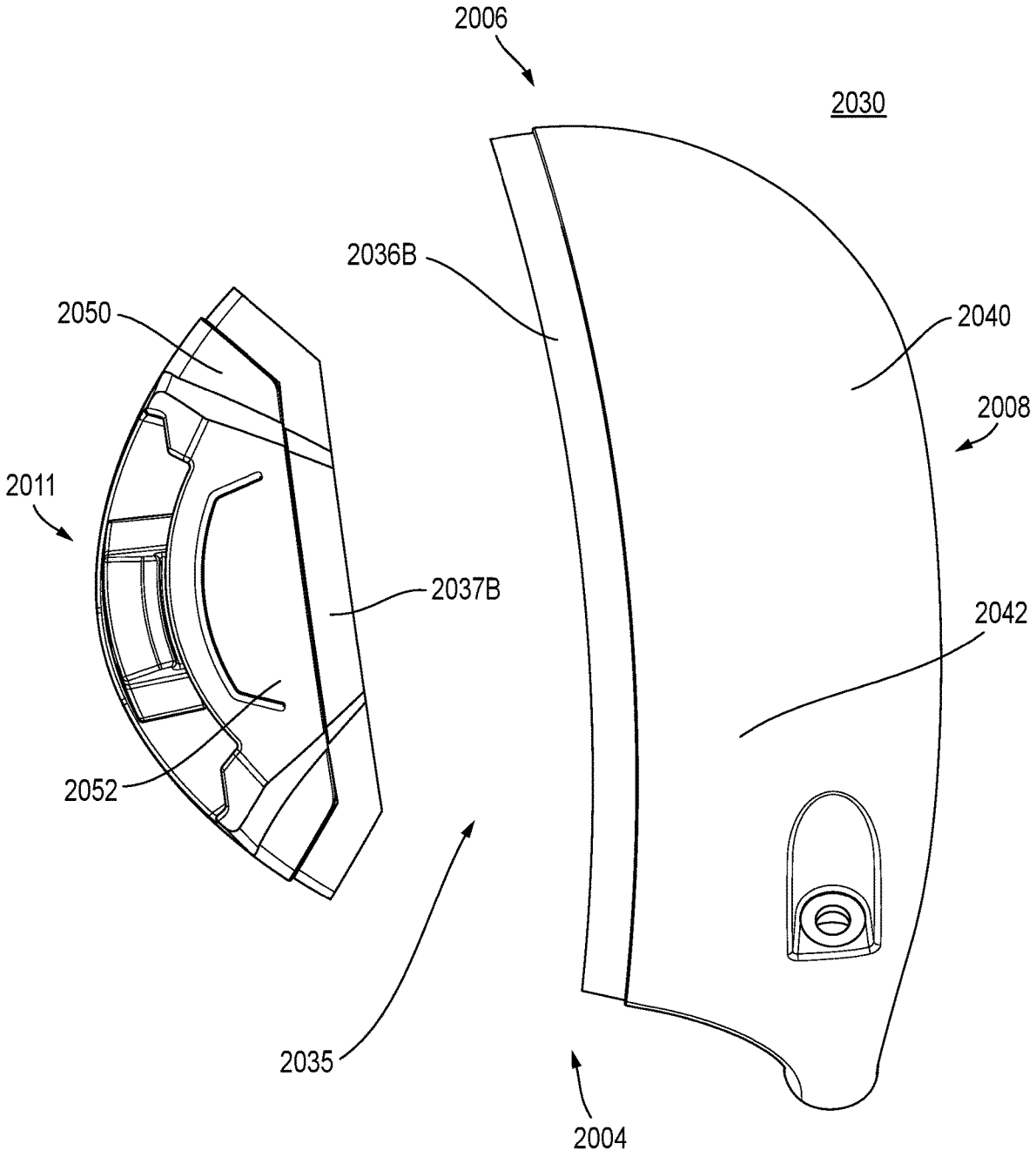
FIG. 51 illustrates a bottom plan view of the golf club head of FIG. 44, with portions removed to better show the frame.

FIGS. 44-52C illustrate one embodiment of a golf club head 2000 comprising a central insert 2080 formed from a single component. Referring to FIG. 44, the golf club head 2000 comprises a body 2001 having a frame 2030. The frame 2030 provides a structure for receiving the central insert 2080. Referring to FIGS. 49-51, the frame 2030 comprises a forward frame 2040 near a front end 2008 of the golf club head 2000, and a rearward frame 2050 near a rear end 2011 of the golf club head 2000. In some embodiments, the forward frame 2040 and the rearward frame 2050 are connected via one or more internal bridges. In other embodiments, the forward frame 2040 and the rearward frame 2050 are separate components that are not connected to one another. In these embodiments, the forward frame 2040 and the rearward frame 2050 are separated by the central insert 2080.

The forward frame 2040 is positioned near a front end 2008 of the golf club head 2000 and forms a forward portion of the frame 2030. Referring to FIGS. 49-51, the forward frame 2040 comprises a forward crown return 2041 that forms a forward portion of the crown 2010, and a forward sole return 2042 that forms a forward portion of the sole 2012. The forward frame 2040 includes a strike face 1002 and further forms the hosel 1005.

The forward crown return 2041 and the forward sole return 2042 are configured to withstand and dissipate the impact stresses associated with the golf club head 2000 striking a golf ball. Stress from a ball impact is largely or completely dissipated within the rearward extent of the forward crown return 2041 and the forward sole return 2042. The midsection (MS), which is rearward of the forward crown return 2041 and the forward sole return 2042, does not bear a significant portion of the ball striking impact stress. Therefore, the return portions 2041, 2042 allow for a large portion of the midsection (MS) to be formed from one or more composite inserts. Mass removed from the midsection (MS) can be allocated elsewhere in the golf club head 2000, such as into a weight member. The forward crown return 2041 and the forward sole return 2042 can extend rearwardly from the strike face 2002 a distance between 0.25 inch and 1.5 inches. In some embodiments, this distance can be between 0.25 inch and 0.75 inch, 0.50 inch and 1.00 inch, 0.75 inch and 1.25 inches, 1.00 inch and 1.25 inches, or between 1.10 inches and 1.50 inches.

The rearward frame 2050 is positioned near a rear end 2011 of the golf club head 2000 and forms a rearward portion of the frame 2030. Referring to FIGS. 49-51, the rearward frame 2050 comprises a rearward crown return 2051 that forms a portion of the crown 2010, and a rearward sole return 2052 that forms a rearward portion of the sole 2012. The rearward frame 2050 further comprises a weight housing structure 2092 for receiving a fixed or adjustable weight member 2091.

The central insert 2080 is received within a corresponding opening located on the frame 2030. Referring to FIG. 49, a central opening 2035 is defined between the forward frame 2040 and the rearward frame 2050. The central opening 2035 is configured with a ledge to create a bonding surface for the central insert 2080. The ledge is recessed into the frame 2030 away from the exterior surface of the frame 2030.

Referring to FIGS. 49 and 50, the forward frame 2040 comprises a forward ledge having a forward crown ledge 2036A and a forward sole ledge 2036B. Referring to FIGS. 49 and 51, the rearward frame 2050 comprises a rearward ledge having a rearward crown ledge 2037A and a rearward sole ledge 2037B. The forward crown ledge 2036A is formed by a portion of the forward crown return 2041, and the rearward crown ledge 2037A is formed by a portion of the rearward crown return 2051. The forward ledge and the rearward ledge are recessed from an outer surface of the body 1001 to accommodate for the combined thickness of the overlap between the central insert 2080, the ledges, and any adhesives used to secure these two components together. Therefore, the ledges allow an outer surface of the central insert 2080 to sit flush with the adjacent surface of the frame 1030.

In the illustrated embodiment, the forward and rearward ledges extend continuously from the crown 2010 to the sole 2012. In other embodiments, forward ledge and/or the rearward ledge can extend only around portions of the crown 2010 and the sole 2012. The central insert 2080 comprises complementary geometry to the central opening 2035 such that the central insert 2080 completely covers and seals the central opening 2035 and abuts the forward and rearward ledges.

Referring to FIGS. 49-51, the ledges define a ledge width (WL) measured across the surface of each ledge between the beginning of the recessed portion and the edge of the central opening 2035. In some embodiments, the ledge width (WL) can remain constant throughout the entire ledge. Alternatively, in other embodiments, the ledge width (WL) can vary throughout the forward crown ledge 2036A, the forward sole ledge 2036B, the rearward crown ledge 2037A, and the rearward sole ledge 2037B. The ledge width (WL) can be between 0.10 inch and 0.80 inch. For example, the ledge width (WL) can be between 0.10 inch and 0.15 inch, 0.10 inch and 0.25 inch, 0.15 inch and 0.20 inch, 0.15 inch and 0.25 inch, 0.20 inch and 0.25 inch, 0.20 inch and 0.30 inch, 0.25 inch and 0.50 inch, 0.40 inch and 0.60 inch, 0.50 inch and 0.75 inch, or between 0.60 inch and 0.80 inch.

The ledge width (WL) is large enough to provide sufficient bonding area for the central insert 2080 without significantly increasing the structural mass of the frame 2030. The ledges comprise an inner surface oriented to the hollow interior cavity 2007 and an outer surface opposite the inner surface. The ledges define a ledge thickness measured between the outer surface and the inner surface of the ledges. In some embodiments, the ledge thickness can remain constant throughout the ledges. Alternatively, in other embodiments, the ledge thickness can vary throughout the forward crown ledge 2036A, the forward sole ledge 2036B, the rearward crown ledge 2037A, and the rearward sole ledge 2037B. The ledge thickness can be between 0.015 inch and 0.035 inch. For example, the crown ledge thickness can be between 0.015 inch and 0.020 inch, 0.015 inch and 0.025 inch, 0.020 inch and 0.025 inch, 0.020 inch and 0.035 inch, 0.025 inch and 0.030 inch, or between 0.030 inch and 0.035 inch. In some embodiments, the rearward ledge is thicker than other portions of the forward ledge 2036 to withstand stresses imposed on the rearward ledge due to a weight member located within the rearward frame 2050. In these embodiments, the ledge thickness can be greater than 0.020 inch near the rearward ledge. The ledge thickness is large enough to provide structural support to the central insert 2080 without significantly increasing the structural mass of the frame 2030.

As discussed above, the frame 2030 provides a sturdy structure for receiving the central insert 2080. The central insert 2080 provides a high-performing club head which has a high $I_{YY}$ and balances other performance characteristics such as the $I_{XX}/I_{YY}$ ratio, force transfer, aerodynamics, and CG adjustability as described above. Referring to FIG. 44, the central insert 2080 is received within the central opening 2035 to enclose a hollow interior cavity 2007. The central insert 2080 provides a lightweight structure that reduces the mass of the body 2001, particularly in the midsection (MS), and allows for additional discretionary mass to be redistributed to other portions of the golf club head 2000. In particular, removing mass from the crown 2010, the sole 2112, and the body perimeter via the central insert 2080 is effective in lowering the club head CG toward the loft-normal axis 35.

The central insert 2080 comprises an outer surface and an inner surface. The forward crown return 2041 forms a forward portion of the crown 2010 proximate the strike face 2002, the rearward crown return 2051 forms a portion of the crown 2010 proximate the rear end 2011, and the central insert outer surface can form the remainder of the crown 2010. In many embodiments, the central insert outer surface forms a majority of the surface of the crown 2010. The forward sole return 2042 forms a forward portion of the sole 2012 proximate the strike face 2002, the rearward sole return 2052 forms a portion of the sole 2012 proximate the rear end 2011, and the central insert 2080 can form the remainder of the sole 2012. In many embodiments, the central insert outer surface forms a majority of the surface of the sole 2012.

Figure 45:
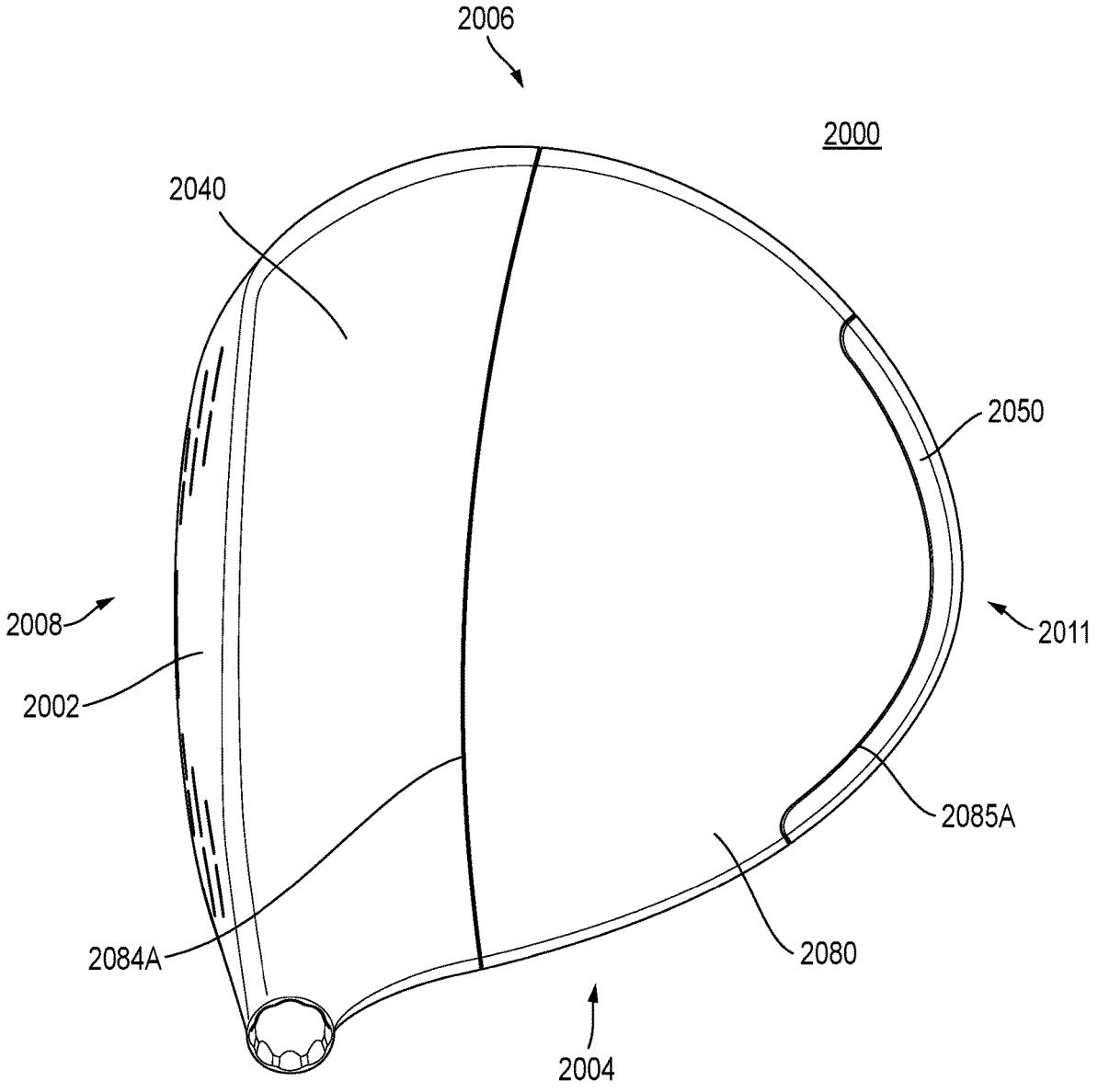
FIG. 45 illustrates a top plan view of the golf club head of FIG. 44.
Figure 46:
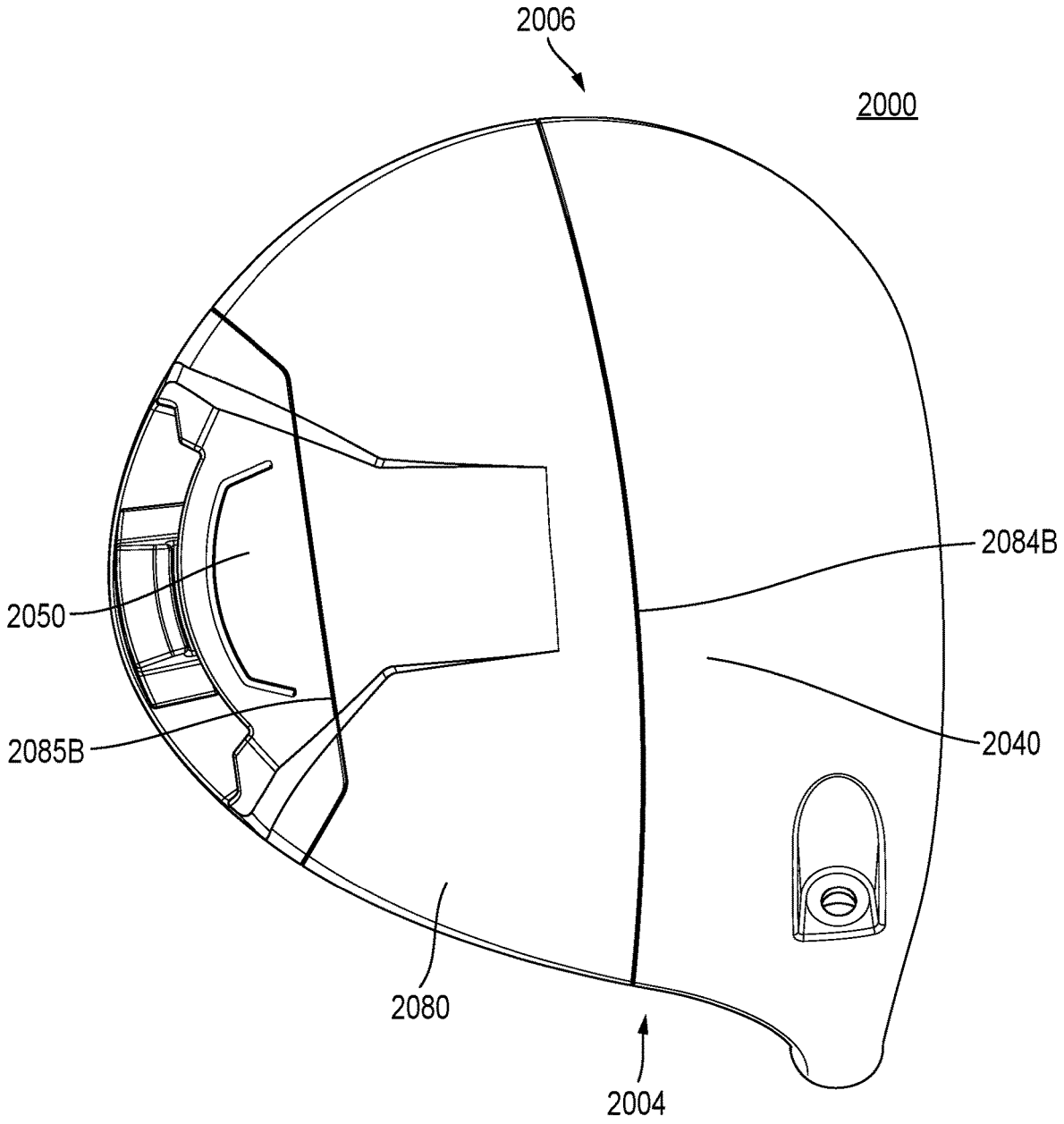
FIG. 46 illustrates a bottom plan view of the golf club head of FIG. 44.
Figure 47:
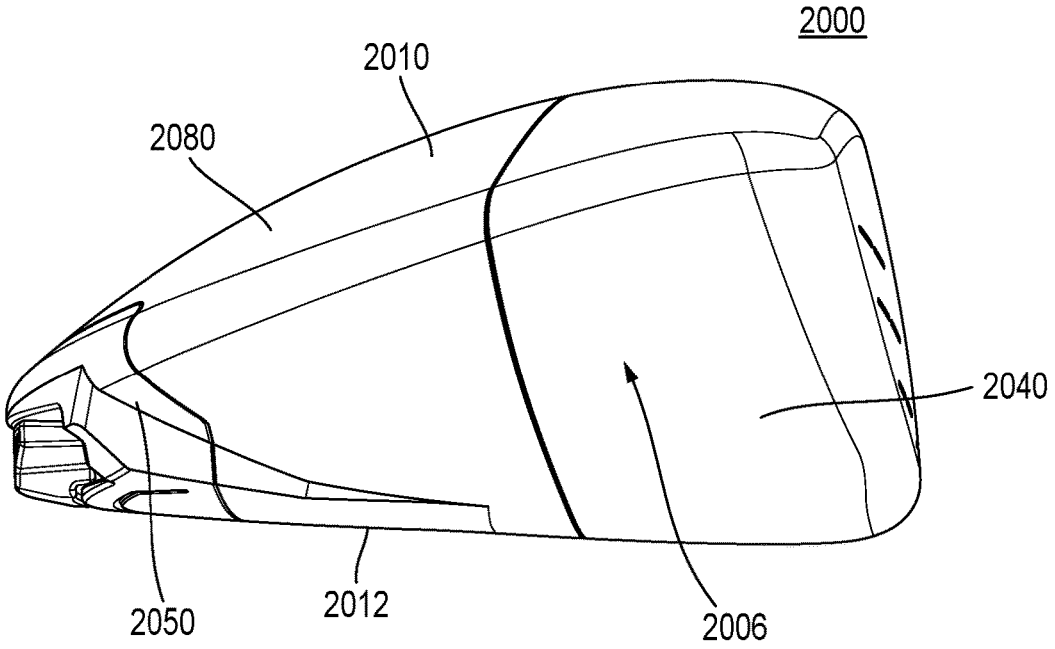
FIG. 47 illustrates a toe-side elevation view of the golf club head of FIG. 44.
Figure 48:
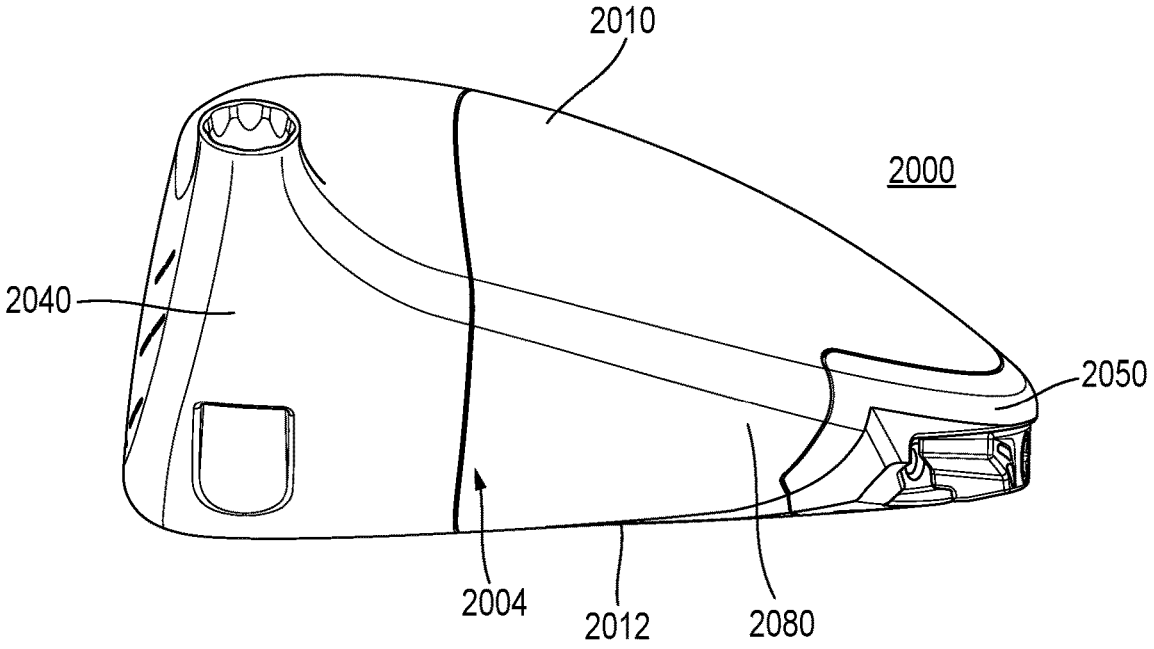
FIG. 48 illustrates a heel-side elevation view of the golf club head of FIG. 44.

The central insert 2080 comprises a perimeter including a forward perimeter 2084 and a rearward perimeter 2085 that trace an outline of the central insert 2080. Referring to FIGS. 45 and 46, the forward perimeter 2084 comprises a forward crown edge 2084A and a forward sole edge 2084B. The rearward perimeter 2085 comprises a rearward crown edge 2085A and a rearward sole edge 2085B. The central insert 2080 is bonded to the forward frame 2040 near the forward perimeter 2084 and bonded to the rearward frame 2050 near the rearward perimeter 2085.

FIGS. 44-46, the central insert 2080 wraps continuously from the crown 2010 around the body perimeter near the heel end 2004 and the toe end 2006 and to the sole 2012. Therefore, the central insert 2080 forms a portion of the body perimeter near the heel end 2004 and the toe end 2006. The central insert 2080 reduces the mass within the heel end 2004, the toe end 2006, the crown 2010 and the sole 2012 by replacing the generally denser frame material with a lightweight material. The mass saved from the central insert 2080 can be redistributed to improve $I_{YY}$, the $I_{XX}/I_{YY}$ ratio, and/or to position a club head CG at or near the loft-normal axis 35. In particular, wrapping the central insert 2080 over the body perimeter in the toe and heel portions removes perimeter mass that provides a significant contribution to $I_{YY}$. The resulting discretionary mass can therefore be reintroduced to locations that provide an $I_{XX}/I_{YY}$ ratio close to 1, such as a centrally located mass pad or a weight member 2091.

In some embodiments, the central insert 2080 does not wrap over the rear edge of the body 2001. As illustrated in FIG. 45, the rearward crown edge 2085A is bounded within the perimeter of the crown 2010 and does not extend over the rear end 2011 or onto the sole 2012. In many embodiments, as illustrated in FIG. 45, the rearward crown edge 2085A can be located substantially near the rear end 2011. In other embodiments, the rearward crown edge 2085A can be spaced a substantial distance from the rear end 2011. This configuration spaces the rearward connection between the central insert 2080 and the rearward frame 2050 away from the rear end 2011. In many cases, doing so can provide both manufacturing and durability benefits by providing plenty of space between the composite central insert 2080 and a weight member 2091 located proximate the rear end 2011. Manufacturers often require significant clearance between such rear weight members 2091 and a composite component to enable the geometry of the weight housing structure 2092 to be cast.

The central insert 2080 removes a significant amount of mass from the crown 2010, the sole 2012, and the body perimeter. The central insert 2080 defines between 50% and 85% of the crown surface area. In some embodiments, the central insert 2080 defines between 50% and 55%, 55% and 60%, 60% and 65, 65% and 70%, 70% and 75%, 75% and 80%, or between 80% and 85% of the crown surface area. The central insert 2080 defines between 25% and 75% of the sole surface area. In some embodiments, the central insert 2080 defines between 25% and 50%, 40% and 60%, 50% and 75%, or between 60% and 75% of the sole surface area. Additionally, the central insert 2080 forms between 25% and 75% of the body perimeter. In some embodiments, the central insert 2080 defines between 25% and 40%, 35% and 50%, 45% and 60%, 50% and 70%, or between 65% and 75% of the body perimeter. The central insert coverage is selected to remove a significant amount of mass from the crown 2010, the sole 2012, and the body perimeter.

The central insert 2080 defines a central insert thickness measured between the inner surface and the outer surface. In some embodiments, the central insert thickness can be uniform throughout the central insert 2080. In other embodiments, the central insert thickness can vary throughout the central insert 2080. The central insert thickness is between 0.010 inch and 0.040 inch. In some embodiments, the central insert thickness is between 0.010 inch and 0.020 inch, 0.015 inch and 0.030 inch, 0.025 inch and 0.035 inch, or between 0.030 inch and 0.040 inch. In some embodiments, the central insert thickness can be less than 0.040 inch, 0.035 inch, 0.030 inch, 0.025 inch, 0.020 inch, or less than 0.015 inch. The central insert thickness is large enough to provide a durable central insert 2080 without significantly increasing the structural mass of the central insert 2080.

The central insert 2080 comprises a substantially low mass, despite forming a significant portion of the body 2001. The central insert 2080 comprises a central insert mass between 5 grams and 30 grams. In some embodiments, the crown insert mass can be between 5 grams and 12 grams, 10 grams and 15 grams, 12 grams and 18 grams, 15 grams and 25 grams, 20 grams and 27 grams, or between 25 grams and 30 grams. In some embodiments, the sole insert mass can be less than 30 grams, 29 grams, 28 grams, 27 grams, 26 grams, 25 grams, 24 grams, 23 grams, 22 grams, 21 grams, 20 grams, 19 grams, 18 grams, 17 grams, 16 grams, 15 grams, 14 grams, 13 grams, 12 grams, 11 grams, 10 grams, 9 grams, 8 grams, 7 grams, or less than 6 grams. The central insert mass is selected to provide a lightweight central insert 2080 that reduces the structural mass of the body 2001.

Despite forming a majority of the body 2001, the central insert 2080 can define a small percentage of the total club head mass. In many embodiments, the mass of the central insert 2080 defines between 3% and 30% of the total club head mass. In some embodiments, the mass of the central insert 2080 defines between 3% and 15%, 5% and 15%, 7% and 16%, 10% and 15%, 12% and 20%, 15% and 23%, 20% and 25%, 23% and 27%, or between 25% and 30% of the total club head mass. As such, a large amount of discretionary mass is created by the central insert 2080 that can be redistributed throughout the club head to maximize $I_{YY}$, provide an $I_{XX}/I_{YY}$ ratio close to 1, and/or to provide a club head CG position at or near the loft-normal axis 35.

The body shape of the golf club head generally affects the sound and feel response. The body shapes described herein may, in some cases, introduce dominant vibrations at impact that lead to a harsh sound or feel at impact. The golf club head 2000 can further comprise various internal reinforcement structures that reduce vibrations in specific areas of the body 2001. The internal reinforcement structures can be provided to damp vibrations and provide a more desirable, muted sound and feel response.

The internal reinforcement structures can be located along any desired portion of the body 2001 that improves structural rigidity and/or an acoustic/vibrational response. The internal reinforcement structures can be located on the frame 2030, and/or the central insert 2080. In some embodiments, the frame 2030 can comprise one or more internal bridges that span across and reinforce the central opening 2035. In some embodiments, the frame 2030 can comprise one or more frame ribs that extend along internal surfaces of the frame 2030 to provide reinforcement to various locations that experience high vibrations at impact. In some embodiments, the central insert 2080 can comprise one or more insert ribs that extend along internal surfaces of the central insert 2080. The golf club head 2000 can comprise similar internal reinforcement structures to those in any of the embodiments described above.

The golf club head 2000 can comprise one or more internal bridges to structurally reinforce the central opening 2035. The internal bridges contact an interior surface of the central insert 2080, thereby providing additional bonding surface area between the central insert 2080 and the frame 2030. The internal bridges also reduce vibrations present in the frame 2030. The internal bridges can be located along any desired portion of the frame 2030 that improves structural rigidity and/or acoustic/vibrational response.

The internal bridges are offset inwardly from the exterior surface of the frame 2030 and hidden beneath the central insert 2080. The internal bridges are concealed by the central insert 2080 such that the internal bridges are not visible from the exterior of the golf club head 2000. The internal bridges are formed integrally with the frame 2030 and span across the central opening 2035 to connect the forward frame 2040 to the rearward frame 2050. The internal bridges can be located near the crown 2010, the sole 2012, and/or the body perimeter. The golf club head 2000 can comprise any combination of the internal bridges described herein.

Figure 52A:
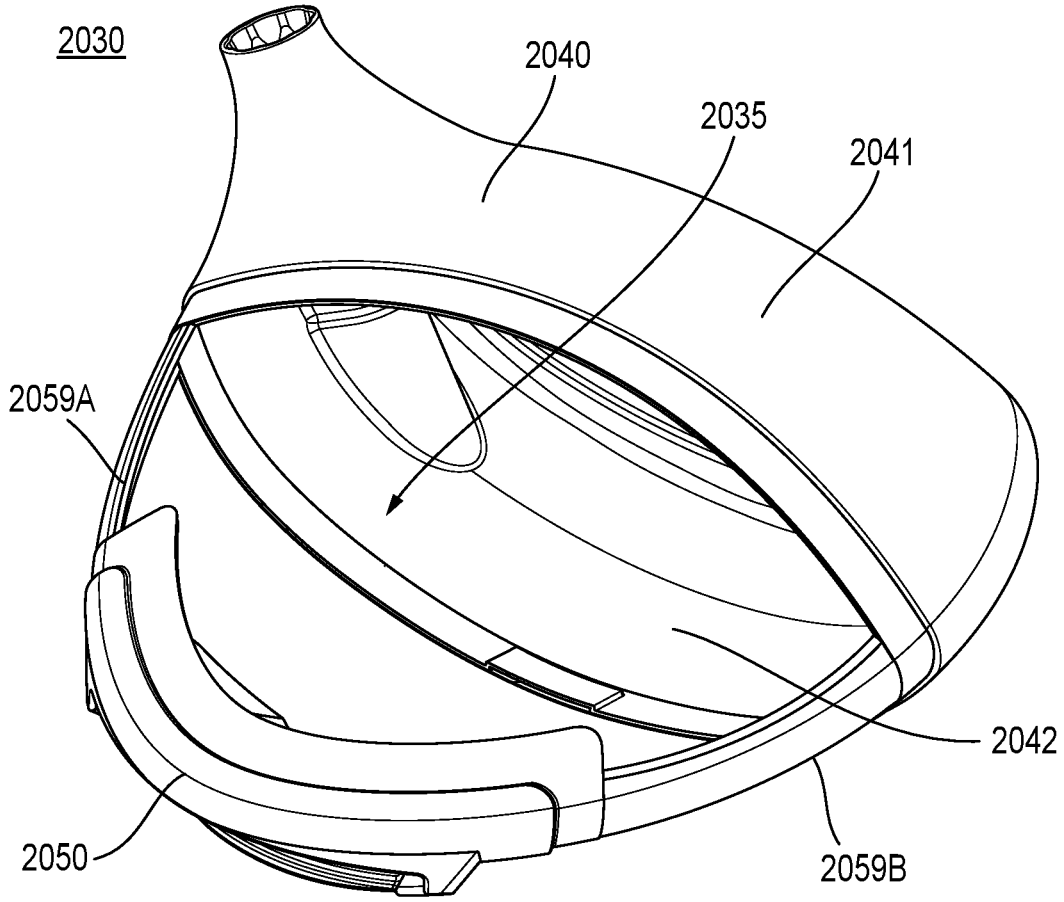
FIG. 52A illustrates a rear-perspective view of a golf club head according to the present invention, with portions removed to better show a frame with internal reinforcing features.
Figure 52B:
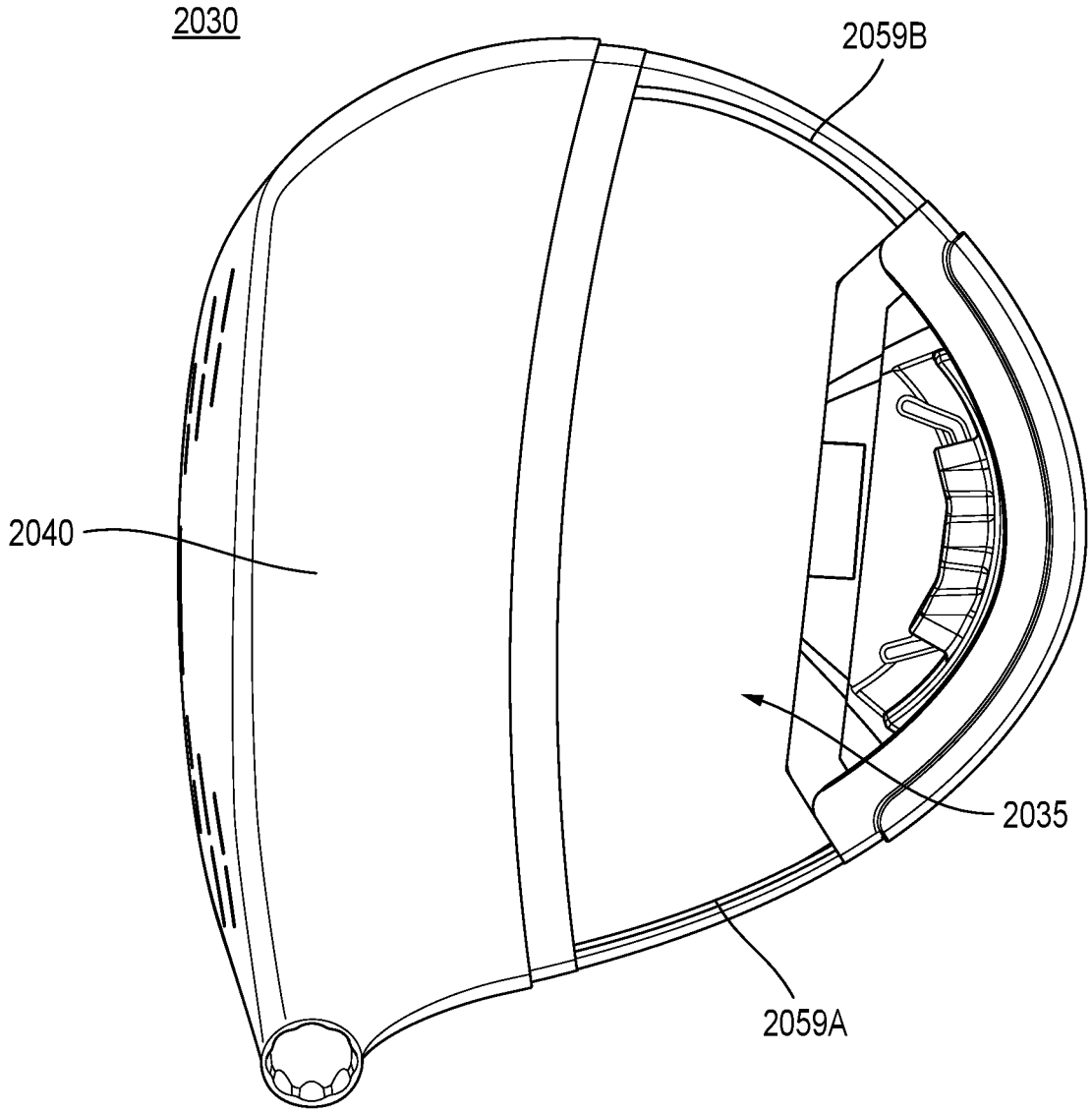
FIG. 52B illustrates a top view of the golf club head of FIG. 52A, with portions removed to better show the frame with internal reinforcing features.
Figure 52C:
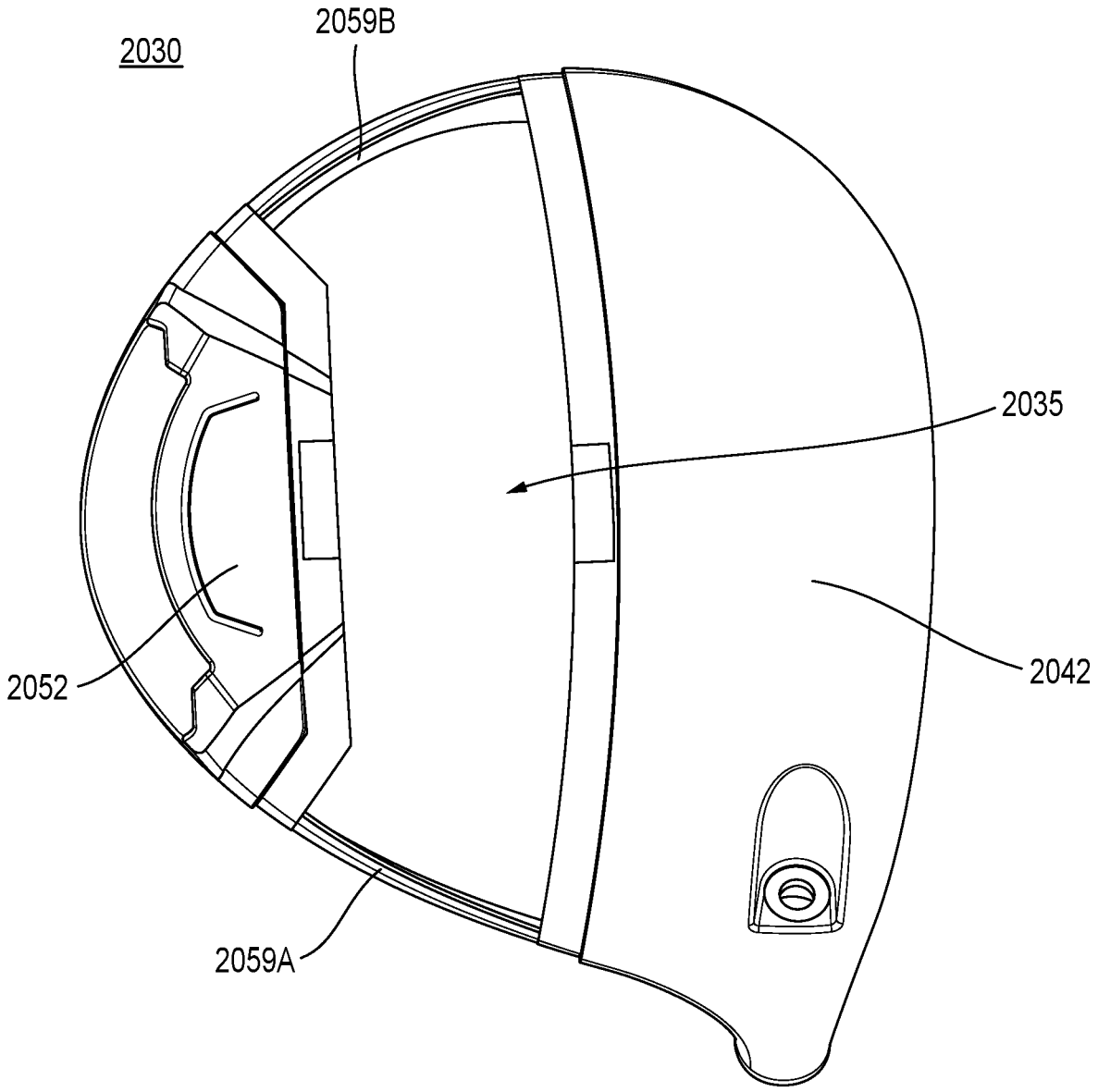
FIG. 52C illustrates a sole view of the golf club head of FIG. 52A, with portions removed to better show the frame with internal reinforcing features.
Figure 53:
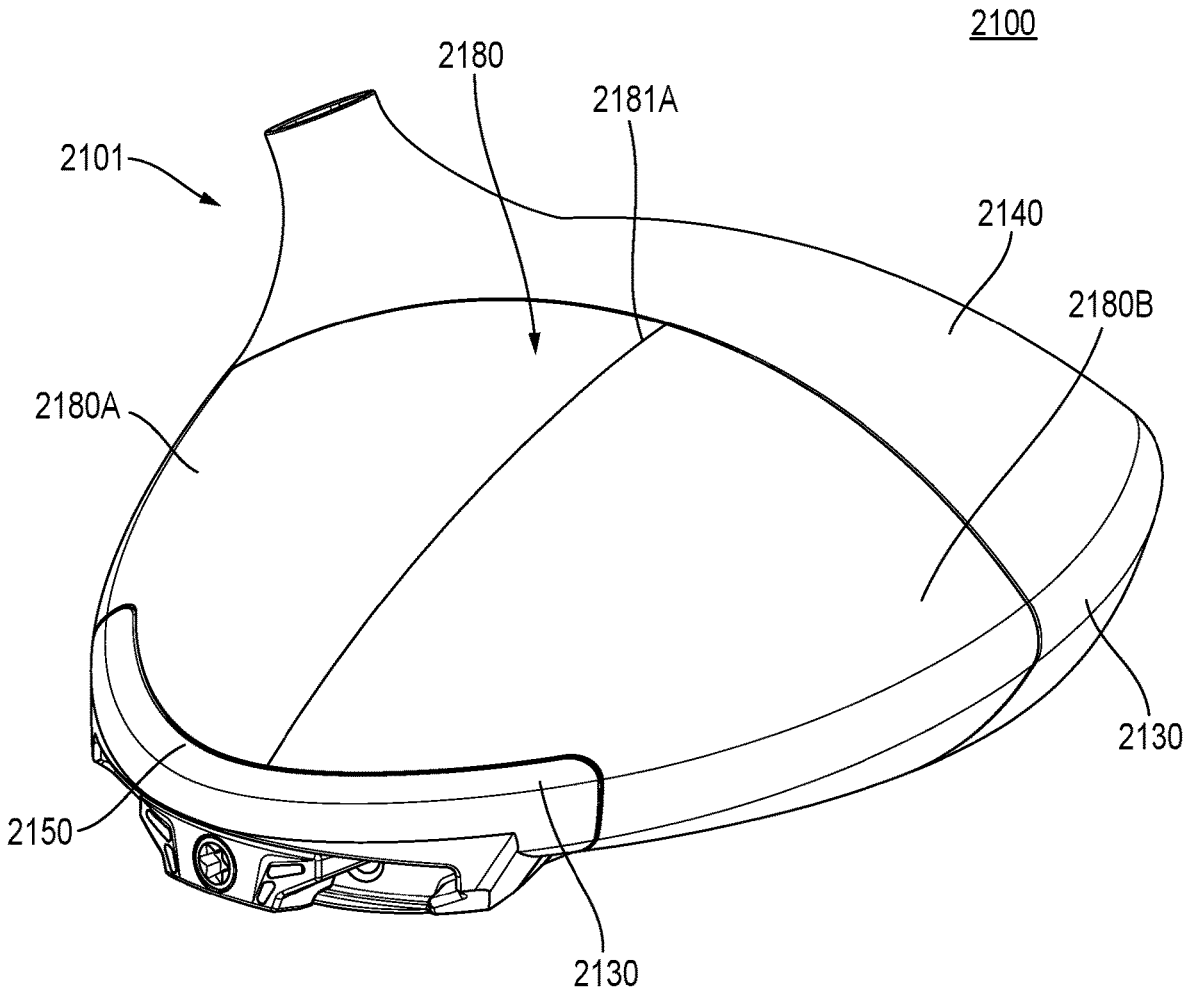
FIG. 53 illustrates a rear-perspective view of a golf club head according to the present invention, comprising a central insert.

FIGS. 52A-52C illustrate a frame 2030 comprising two internal bridges 2059A, 2059B. The heel-side internal bridge 2059A and the toe-side internal bridge 2059B extend across the central opening 2035 between the forward frame 2040 and the rearward frame 2050. The heel-side internal bridge 2059A and the toe-side internal bridge 2059B are located near the body perimeter by the heel end 2004 and the toe end 2006, respectively.

As discussed above, the internal bridges can connect the forward frame 2040 to the rearward frame 2050 at any location near the crown 2010, the sole 2012, the heel end 2004, the toe end 2006, and/or the body perimeter. The internal bridges can comprise any shape and can extend in any direction between adjacent portions of the central opening 2035. For example, the internal bridges can extend in a front-to-rear direction, or in a diagonal direction. The internal bridges can be perpendicular to the strike face 2002, or at an angle relative to the strike face 2002. In some embodiments, the internal bridges can be angled between approximately 5 degrees and 45 degrees relative to the strike face 2002. For embodiments including multiple internal bridges, the internal bridges can be substantially parallel to one another, or the internal bridges can be orientated at an angle relative to one another. In some embodiments, the internal bridges can intersect with one another. The frame 2030 can comprise any number of internal bridges. For example, frame 2030 can comprise one internal bridge, two internal bridges, three internal bridges, four internal bridges, five internal bridges, six internal bridges, or any suitable number of internal bridges.

The one or more internal bridges comprise various dimensions including an internal bridge width ($W_{IB}$) and an internal bridge thickness. These dimensions can be similar to those described above for the golf club head 1000. Each dimension is sized to provide sufficient structural support to the frame 1030. In some embodiments, the internal bridges can be integrally cast with the frame 2030 such that they are formed from the same material as the frame 2030. In other embodiments, the internal bridges can be separately formed and attached to the frame 2030. In embodiments with separately formed internal bridges, the internal bridges can be formed from any suitable material such as a metallic material, a composite material, or any other suitable material. Further, the separately formed internal bridges can be attached to the frame 2030 using any suitable attachment mechanism such as adhesives, welding, over molding, or any other suitable attachment mechanism.

The frame 2030 can further comprise one or more frame ribs to structurally reinforce portions of the frame 2030. The frame ribs also reduce vibrations in specific areas of the frame 2030. The frame ribs can be located along any desired portion of the forward frame 2040 and/or the rearward frame 2050 that improves structural rigidity and/or acoustic/vibrational response. The frame 2030 can comprise any combination of the frame ribs described herein.

The frame ribs extend along an interior surface of the frame 2030. Like the internal bridges, the frame ribs can be formed integrally with the frame 2030. Alternatively, the frame ribs can be formed separately and attached to the frame 2030 via a coupling mechanism. The frame ribs can be located near the crown 2010, the sole 2012, and/or the body perimeter. The frame ribs can comprise any shape and can extend in any direction along an inner surface of the frame 2030. For example, the frame ribs can extend in a front-to-rear direction, a heel-to-toe direction, or in a diagonal direction. The frame ribs can be parallel to the strike face 2002, perpendicular to the strike face 2002, or at an angle relative to the strike face 2002. In some embodiments, the frame ribs can be angled between approximately 5 degrees and 45 degrees relative to the strike face 2002. For embodiments including multiple frame ribs, the frame ribs can be substantially parallel to one another, or the frame ribs can be orientated at an angle relative to one another. In some embodiments, the frame ribs can intersect with one another. The frame 2030 can comprise any number of frame ribs. For example, the frame 2030 can comprise one frame rib, two frame ribs, three frame ribs, four frame ribs, five frame ribs, six frame ribs, or any suitable number of frame ribs.

The one or more frame ribs comprise various dimensions including a frame rib height ($H_{FR}$) and a frame rib length. These dimensions can be similar to those described above for the golf club head 1000. Each dimension is sized to provide sufficient structural support to the frame 2030. In some embodiments, the frame ribs can be integrally cast with the frame 2030 such that they are formed from the same material as the frame 2030. In other embodiments, the frame ribs can be separately formed and attached to the frame 2030. In embodiments with separately formed frame ribs, the frame ribs can be formed from any suitable material such as a metallic material, a composite material, or any other suitable material. Further, the separately formed frame ribs can be attached to the frame 2030 using any suitable attachment mechanism such as adhesives, welding, over molding, or any other suitable attachment mechanism.

In some embodiments, the central insert 2080 can comprise one or more insert ribs. Similar to the frame ribs, the insert ribs damp vibrations and provide a more desirable, muted sound and feel response. The insert ribs can be located along any desired portion of the central insert 2080 that improves structural rigidity or acoustic/vibrational response. The central insert 2080 can comprise any combination of the insert ribs described herein.

The insert ribs extend along an interior surface of the central insert 2080. The insert ribs can be formed integrally with the central insert 2080, or they can be formed separately and attached to the central insert 2080 via a coupling mechanism. The insert ribs can be located near the crown 2010, the sole 2012, and/or the body perimeter. The insert ribs can comprise any shape and can extend in any direction along an inner surface of the central insert 2080. For example, the insert ribs can extend in a front-to-rear direction, a heel-to-toe direction, or in a diagonal direction. The insert ribs can be parallel to the strike face 2002, perpendicular to the strike face 2002, or at an angle relative to the strike face 2002. In some embodiments, the insert ribs can be angled between approximately 5 degrees and 45 degrees relative to the strike face 2002. For embodiments including multiple insert ribs, the insert ribs can be substantially parallel to one another, or the insert ribs can be orientated at an angle relative to one another. In some embodiments, the insert ribs can intersect with one another. The central insert 2080 can comprise any number of insert ribs. For example, the central insert 2080 can comprise one insert rib, two insert ribs, three insert ribs, four insert ribs, five insert ribs, six insert ribs, or any suitable number of insert ribs.

The one or more insert ribs comprise various dimensions including an insert rib length ($L_{IR}$), an insert rib height ($H_{IR}$), and an insert rib offset ($O_{IR}$). These dimensions can be similar to those described above for the golf club head 1000. Each dimension is sized to provide sufficient structural support to the respective composite insert. In some embodiments, the insert ribs can be integrally formed with the central insert 2080 such that they are formed from the same material as the central insert 2080. In other embodiments, the insert ribs can be separately formed and attached to the central insert 2080. In embodiments with separately formed insert ribs, the insert ribs can be formed from any suitable material such as a metallic material, a composite material, or any other suitable material. Further, the separately formed insert ribs can be attached to the central insert 2080 using any suitable attachment mechanism such as adhesives, welding, over molding, or any other suitable attachment mechanism.

High vibration areas of the golf club head can be reinforced to control vibration response. As discussed above, the internal reinforcement structures control vibrations to compensate for any dominant vibrations associated with the unique body shape and mass distribution of the golf club heads described herein. Therefore, the body 2001 can include any combination of the aforementioned external bridges, internal bridges, frame ribs, and/or insert ribs. Each of the internal reinforcement structures discussed above comprises a small percentage of mass relative to the body 2001. As such, the internal reinforcement structures discussed above each provide sufficient support to the respective portion of the body 2001, without significantly increasing the structural mass. The internal reinforcement structures allow for a club head that achieves a high $I_{XX}/I_{YY}$ ratio while also providing a desirable sound and feel response.

Various examples of internal bridges are illustrated in FIGS. 20A-20C, 29A, and 29B, 37A-37C, and 39A-39C. Various examples of frame ribs are illustrated in FIGS. 20A-22C, 29A, and 29B, and 37A-39C. Various examples of insert ribs are illustrated in FIGS. 23A-28C, 40A, and 40B. The internal reinforcing features illustrated on the golf club heads 1000, 1100 can be adapted for use in the golf club head 2000. For example, one or more of the internal reinforcement structures illustrated in the figures listed above can extend across the central opening 2035 to connect the forward frame 2040 to the rearward frame 2050.

In addition to the internal reinforcement structures described above, the frame 2030 can further comprise one or more mass pads, to improve CG placement and/or mass distribution to achieve a high $I_{XX}/I_{YY}$ ratio. The mass pads are internal weighting structures that comprise a concentration of mass. The frame 2030 can comprise one or more mass pads located along a desired portion of the frame 2030 in order to provide optimal CG placement and/or mass distribution. In many embodiments, the discretionary mass created by the lightweight composite inserts, a lightweight shaft-receiving structure, a small-arced weight member housing structure, or any of the other mass-saving structures disclosed herein can be distributed to the one or more mass pads. The golf club head 2000 can comprise similar internal reinforcement structures to those in any of the embodiments described above.

The one or more mass pads can be located on the frame 2030 near a central portion of the crown 2010, a central portion of the sole 2012, and/or any combination thereof. The one or more mass pads can be located within the central opening 2035 between the forward frame 2040 and the rearward frame 2050. In these embodiments, the one or more mass pads can be suspended by one or more internal reinforcement features that extends across the central opening 2035. In some embodiments, the one or more mass pads can be formed integrally with the frame 2030 and/or one or more internal reinforcement features. In other embodiments, the one or more mass pads can be formed separately and attached to the frame 2030 and/or one or more internal reinforcement features via a coupling mechanism such as welding, brazing, mechanical coupling, adhesive coupling, or any other suitable means. In many embodiments, the one or more mass pads can contact a portion of the central insert 2080. In these embodiments, the one or more mass pads can increase the bonding surface area between the frame 2030 and the central insert 2080. The frame 2030 can comprise any combination of the mass pads described herein.

In many embodiments, the one or more mass pads can be located at or near the Y'-axis 80, such that all or a majority of the one or more mass pads fits within the central mass zone (CMZ). As such, the one or more mass pads provide a significant contribution to $I_{XX}$ with a negligible contribution to $I_{YY}$, thereby providing an $I_{XX}/I_{YY}$ ratio close to 1. In many embodiments, one or more mass pads can be intersected by the Y'-axis 80. The proximity of any of the one or more mass pads to the Y'-axis may be characterized by the size of a central mass zone (CMZ) (as described above) that bounds the entirety of the one or more mass pads. For example, in some embodiments, the one or more mass pads can be entirely bounded within a central mass zone (CMZ) having a central mass zone radius ($R_{CMZ}$) less than 2.00 inches, 1.75 inches, 1.50 inches, 1.25 inches, 1.00 inch, 0.75 inch, 0.50 inch, or less than 0.25 inch. The smaller the central mass zone radius ($R_{CMZ}$) that bounds the entirety of the one or more mass pads, the more efficient each mass pad is at providing an $I_{XX}/I_{YY}$ ratio close to 1. A mass pad bounded within a small central mass zone (CMZ) provides a greater contribution to $I_{XX}$ than to $I_{YY}$, as compared to a similar mass pad of the same mass that does not fit within said central mass zone (CMZ). For example, a 20 gram mass pad that fits entirely within a central mass zone (CMZ) having a central mass zone radius ($R_{CMZ}$) of 0.75 inch provides a lesser $I_{YY}$ contribution (and therefore a higher $I_{XX}/I_{YY}$ ratio) than a 20 gram mass pad that only partially fits within a central mass zone (CMZ) having a central mass zone radius ($R_{CMZ}$) of 0.75 inch.

The one or more mass pads can be centrally located on the crown 2010 and/or the sole 2012. In many embodiments, at least a portion of the one or more mass pads can be intersected by the YZ plane (a vertical plane aligning with both the Y-axis 50 and the Z-axis 60). In some embodiments, the one or more mass pads can be located entirely within the midsection (MS). In some embodiments, the one or more mass pads can be located entirely within the middle 50% of the body depth ($D_B$). In some embodiments, the one or more mass pads can be located entirely within the middle 45% of the body depth ($D_B$), 40%, 35%, 30%, 25%, or entirely within the middle 20% of the body depth ($D_B$). In some embodiments, the one or more mass pads can be located entirely within the middle 50% of the body width ($W_B$). In some embodiments, the one or more mass pads can be located entirely within the middle 45% of the body width ($W_B$), 40%, 35%, 30%, 25%, or entirely within the middle 20% of the body width ($W_B$). In many embodiments, a forwardmost point of the one or more mass pads can be spaced rearward of the leading edge 2003 by significant percentage of the body depth ($D_B$). In some embodiments, the forwardmost point of the one or more mass pads can be spaced rearward of the leading edge 2003 by a distance greater than or equal to 10%, 15%, 20%, 25% of the body depth ($D_B$).

Various examples of mass pads are illustrated in FIGS. 29A, 29B, and 39A-39C. The mass pads illustrated on the golf club heads 1000, 1100 can be adapted for use in the golf club head 2000. For example, the mass pads can be formed integrally with one or more external bridges, internal bridges, and/or frame ribs that extend across the central opening.

The frame 2030 can comprise any number of mass pads. For example, frame 2030 can comprise one mass pad, two mass pads, three mass pads, four mass pads, five mass pads, six mass pads, or any other suitable number of mass pads. The one or more mass pads can comprise any shape such as circular, ovular, rectangular, or any other suitable shape. The mass pads of the golf club head 2000 can comprise similar positioning, sizing, and/or mass to the mass pads of the golf club head 1000.

In many embodiments, the one or more mass pads can comprise a mass between 10 and 60 grams. In some embodiments, the one or more mass pads can comprise a mass between 10 grams and 15 grams, 15 grams and 20 grams, 20 grams and 25 grams, 25 grams and 30 grams, 30 grams and 35 grams, 35 grams and 40 grams, 40 grams and 45 grams, 45 grams and 50 grams, 50 grams and 55 grams, or between 55 grams and 60 grams. In some embodiments, the one or more mass pads can comprise a mass greater than 5 grams, 10 grams, 15 grams, 20 grams, 25 grams, 30 grams, 35 grams, 40 grams, 45 grams, 50 grams, 55 grams, or greater than 60 grams.

The one or more mass pads can be integrally cast with the frame 2030 such that they are formed from the same material as the frame 2030. Alternatively, the one or more mass pads can be separately formed and attached to the frame 2030. In these embodiments, the one or more mass pads can be formed from any suitable material such as a metallic material, a composite material, or any other suitable material. In some embodiments, the separately formed and attached mass pad can be formed from a material comprising a higher density than the material of the frame 2030.

In addition to the internal reinforcement structures and the mass pads described above, the central insert 2080 can further define one or more indentations to provide a more desirable club head shape. The one or more indentations remove volume from the body 2001 that can be reallocated to other more desirable locations. The central insert 2080 can comprise any configuration of the indentations described above in the golf club head 1000. The one or more indentations can be incorporated along with the internal reinforcement structures and the mass pads to further improve mass reallocation.

The one or more indentations can be located along any desired portion of the frame 2030, and/or the central insert 2080. The one or more indentations can be located on the exterior surface of the club head on the crown 2010 or the sole 2012 and can be located near the front end 2008, the rear end 2011, the heel end 2004, the toe end 2006, and/or at any combination of these locations. The one or more indentations can be integrally formed with the frame 2030, the central insert 2080, and/or any combination thereof. The one or more indentations disclosed herein can define any percentage of the exterior surface area of the golf club head 2000.

The body 2001 can define any suitable number of indentations. In some embodiments, the golf club head 2000 may define one indentation, two indentations, three indentations, four indentations, five indentations, six indentations, seven indentations, eight indentations, nine indentations, or more than ten indentations. The one or more indentations may be formed in any shape including circular, ovular, rectangular, triangular, polygonal, hexagonal, or any other suitable shape. The indentations of the golf club head 1200 can comprise similar shapes and/or dimensions to the indentations of the golf club head 1000.

Each indentation can define an indentation volume measured based on the native outer surface of the body 2001. The indentations can define a combined indentation volume between 1 $cm^3$ and 12 $cm^3$. In some embodiments, the combined indentation volume can be between 1 $cm^3$ and 5 $cm^3$, 4 $cm^3$ and 8 $cm^3$, 5 $cm^3$ and 10 $cm^3$, or between 6 $cm^3$ and 12 $cm^3$. In some embodiments, each indentation can define an individual indentation volume of approximately 1 $cm^3$, 2 $cm^3$, 3 $cm^3$, 4 $cm^3$, 5 $cm^3$, 6 $cm^3$, 7 $cm^3$, 8 $cm^3$, 9 $cm^3$, 10 $cm^3$, 11 $cm^3$, or approximately 12 $cm^3$.

FIG. 30 illustrates an example of a golf club head 1000 comprising indentations 1072A, 1072B, 1072C. The indentations illustrated on the golf club head 1000 can be adapted for use in the golf club head 2000. For example, the indentations can extend across portions of the frame 230, and/or the central insert 2080.

The one or more indentations may be integrally formed with the outer surface of the body 2001 such that they are formed from the same materials as the body 2001. In some embodiments, the indentations are defined in the central insert 2080 and are integrally formed from the same material as the central insert 2080. In other embodiments, the one or more indentations can be formed from the same material as the frame 2030, and/or the central insert 2080. Still in other embodiments, the one or more indentations can be partially formed from the same material as the frame 2030 and partially formed from the same material as the central insert 2080.

B. Multi-Member Central Insert

FIGS. 53-60 illustrate another embodiment of a golf club head 2100 comprising a central insert. The golf club head 2100 comprises similar dimensions and relationships to the golf club head 2000, as discussed above. Specifically, the golf club head 2100 comprises similar dimensions and/or dimensional parameters to the golf club head 2000, such as the dimensions and/or dimensional parameters related to midsection coverage, perimeter coverage, upper hemisphere (UH) coverage, lower hemisphere (LH) coverage, or any combination thereof. The golf club head 2100 can comprise any combination of the internal reinforcement structures, mass pads, and/or indentations described above. The golf club head 2100 is similar to the golf club head 2000 and like reference numbers are used to describe the golf club head 2100 (for example, the golf club head 2100 comprises a crown 2110, a sole 2112, a heel end 2104, a toe end 2106, etc.).

The golf club head 2100 is substantially similar to the golf club head 2000, but for a difference in the central inserts. The central insert 2180 of the golf club head 2100 comprises multiple insert components that are secured to one another to define the central insert 2180. In contrast, the central insert 2080 of the golf club head 2000 is formed from a single component. In the golf club head 2100, multiple insert components are coupled together to mimic a central insert that is formed from a single component. The golf club head 2100 can comprise a substantially similar frame 2130 to the frame 2030 of the golf club head 2000. The frame 2130 can comprise similar dimensions to the frame 2030, such as ledge width (WL) and ledge thickness. Further, the frame 2130 can comprise combination any of the internal bridges and/or frame ribs discussed above in the golf club head 2000.

As discussed above, the central insert 2180 comprises a multi-component construction. Specifically, the central insert 2180 comprises a heel-side insert 2180A near the heel end 2104 and a toe-side insert 2180B near the toe end 2106. The heel-side insert 2180A and the toe-side insert 2180B are coupled to one another to define a single central insert 2180. Although the central insert 2180 comprises multiple components, the central insert 2180 is considered to comprise a singular central insert 2180 because the central insert 2180 wraps continuously around the body 2101 and forms at least a portion of the crown 2110, at least a portion of the sole 2112, and at least a portion of the body perimeter near both the heel end 2104 and the toe end 2106.

Figure 54:
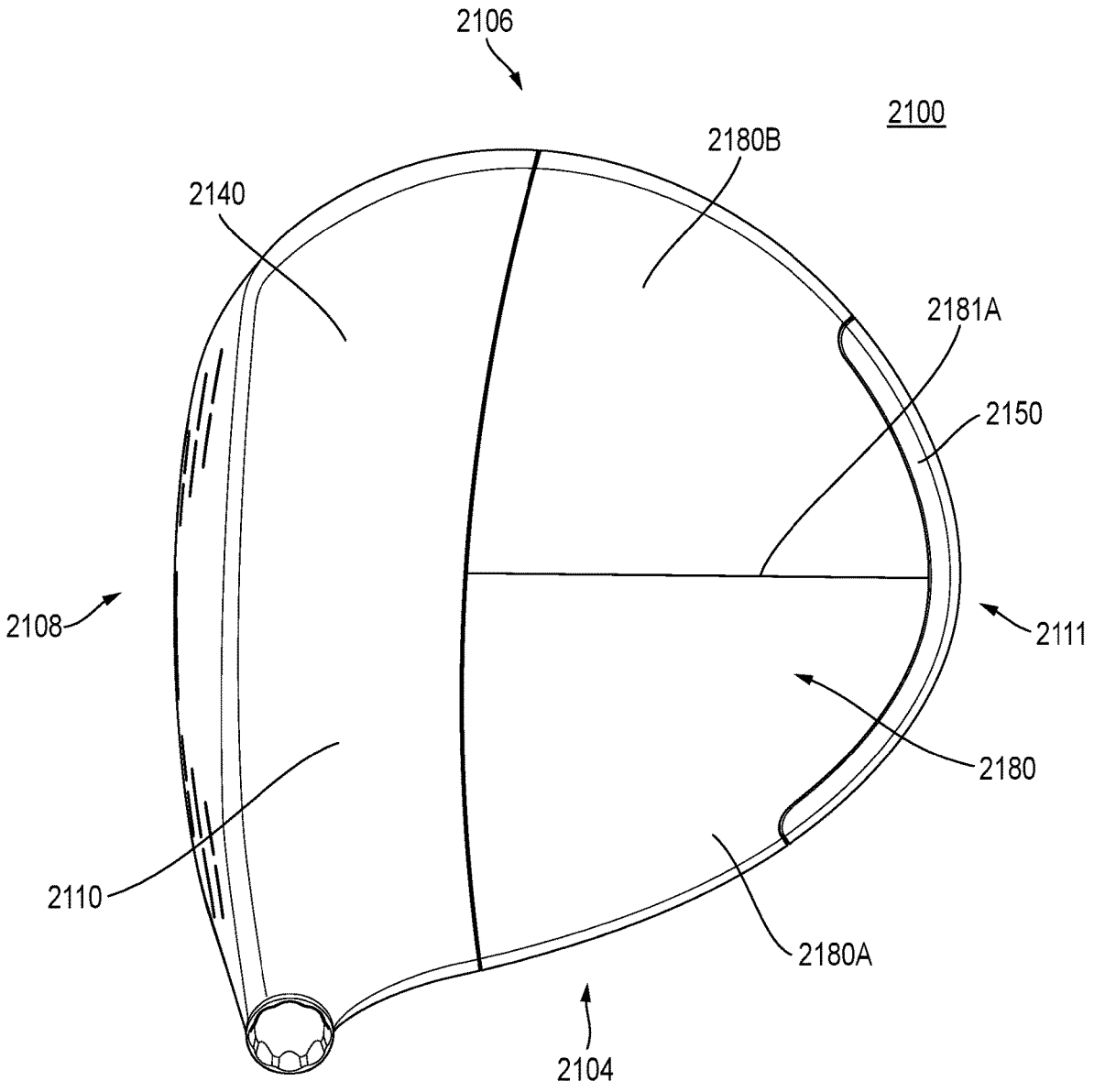
FIG. 54 illustrates a top plan view of the golf club head of FIG. 53.
Figure 55:
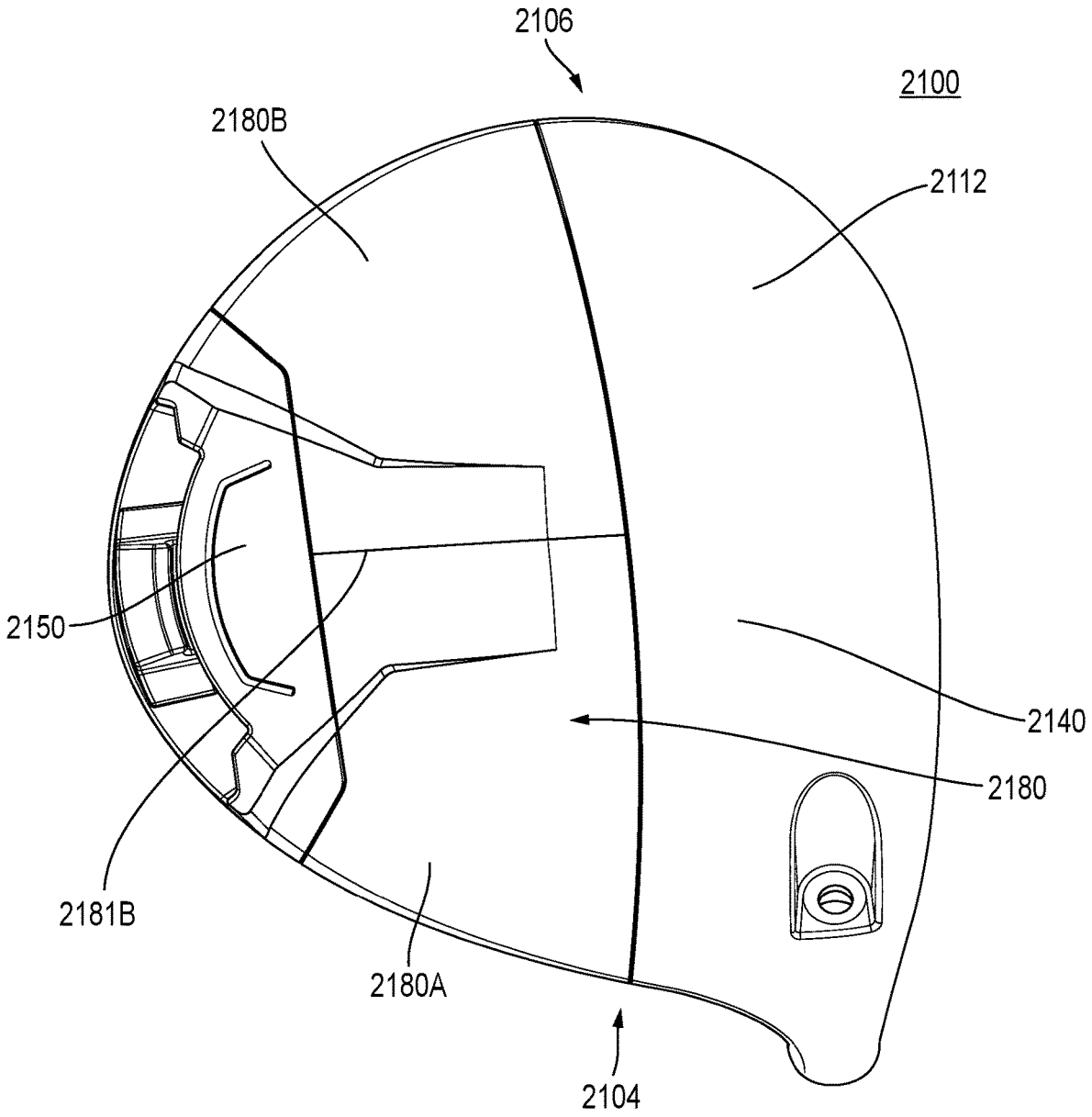
FIG. 55 illustrates a bottom plan view of the golf club head of FIG. 53.
Figure 56:
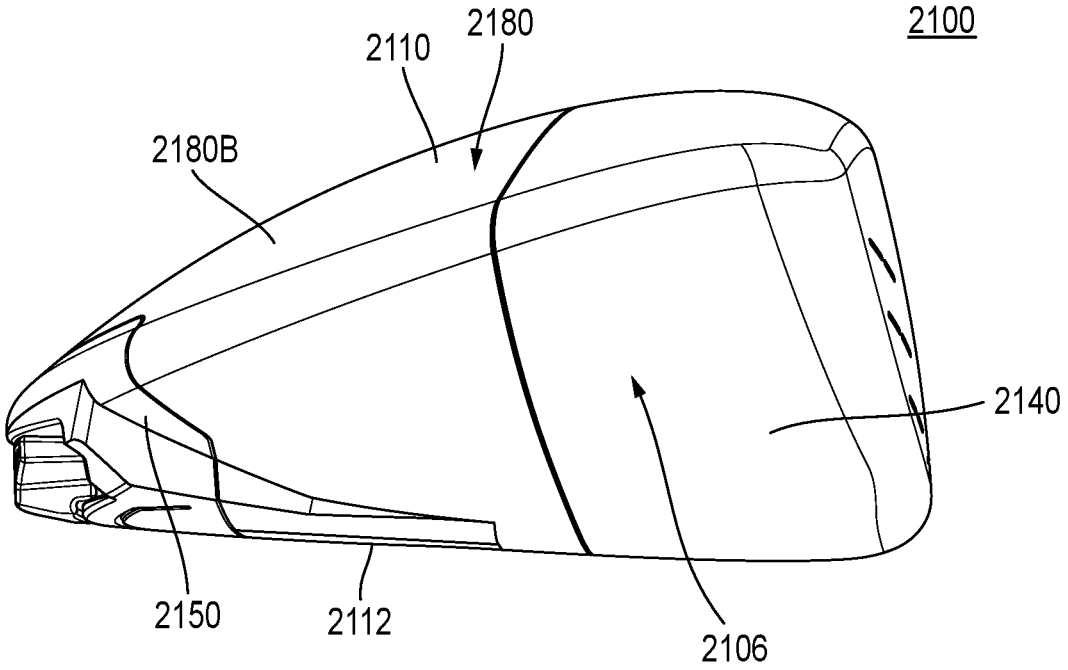
FIG. 56 illustrates a toe-side elevation view of the golf club head of FIG. 53.
Figure 57:
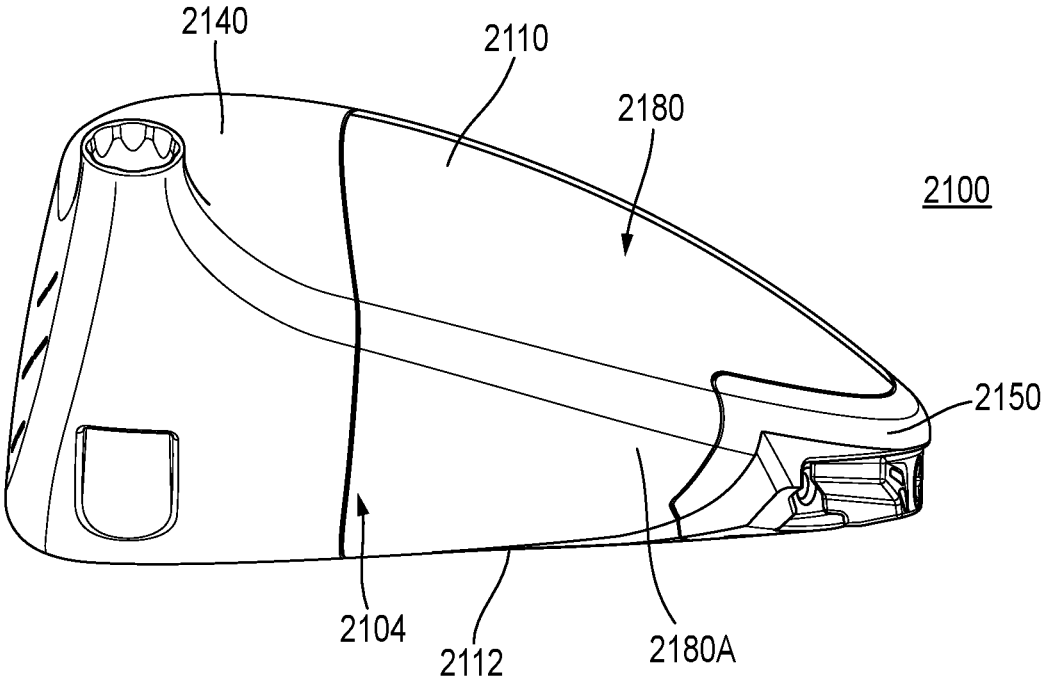
FIG. 57 illustrates a heel-side elevation view of the golf club head of FIG. 53.
Figure 58:
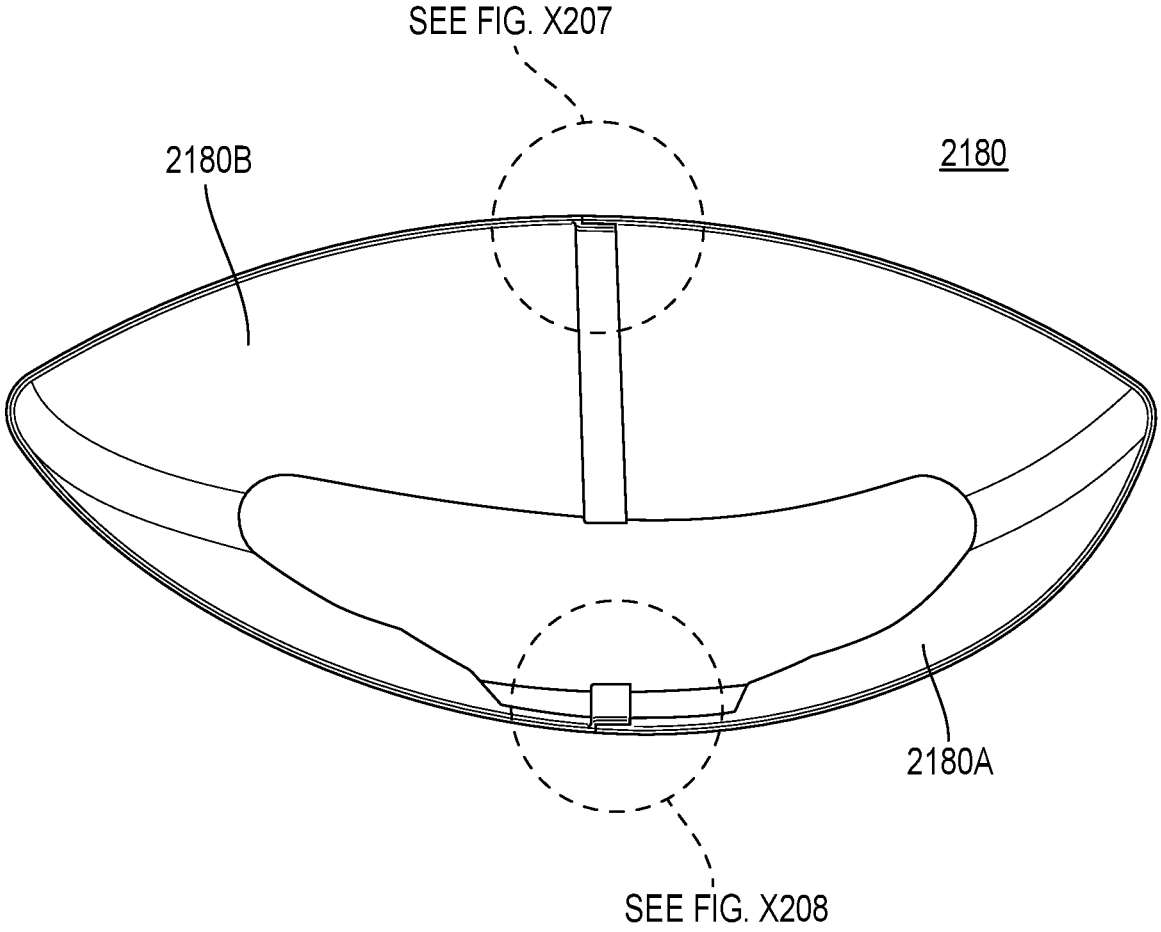
FIG. 58 illustrates a front elevation view of the central insert of the golf club head of FIG. 53.

Each multi-component central insert defines a connection where the insert components are coupled to one another. Each connection is formed by the interface between a mating edge located on one member and an insert ledge located on the other member. Referring to FIG. 54, the central insert 2180 defines an upper connection 2181A where the heel-side insert 2180A and the toe-side insert 2180B are coupled to one another near the crown 2110. Referring to FIG. 55, the central insert 2180 defines a lower connection 2181B where the heel-side insert 2180A and the toe-side insert 2180B are coupled to one another near the sole 2112.

Figure 59:
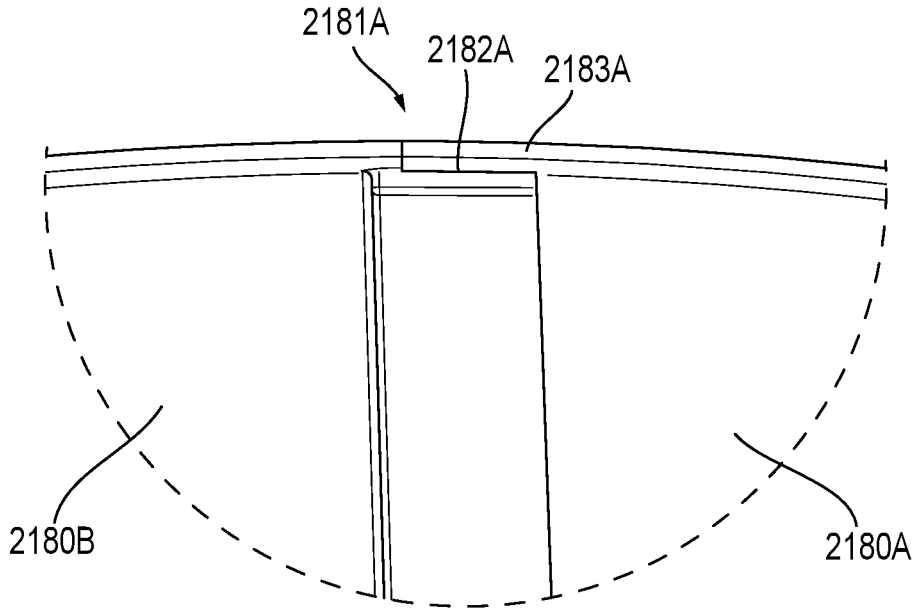
FIG. 59 illustrates a close up view of the central insert of FIG. 53.
Figure 60:
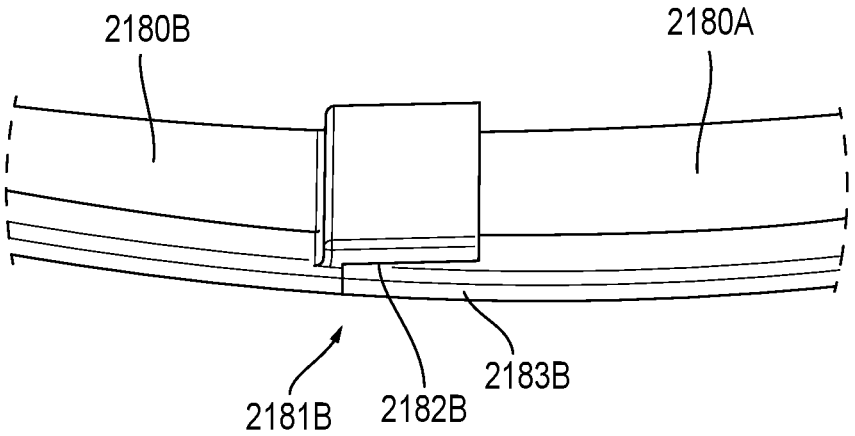
FIG. 60 illustrates a close up view of the central insert of FIG. 53.

The toe-side insert 2180B is configured with insert ledges to receive the heel-side insert 2180A. Referring to FIGS. 59 and 60, the toe-side insert 2180B comprises an insert ledge that is recessed with respect to an exterior surface of the central insert 2180. The insert ledge comprises an upper insert ledge 2182A located near the crown 2110 and a lower insert ledge 2182B located near the sole 2112.

The heel-side insert 2180A comprises a mating edge configured to be received by the insert ledge. The mating edge comprises an upper mating edge 2183A located near the crown 2110 and a lower mating edge 2183B located near the sole 2112. The upper mating edge 2183A overlaps the upper insert ledge 2182A to define the upper connection 2181A, and the lower mating edge 2183B overlaps the lower insert ledge 2182B to define the lower connection 2181B. The overlap between the mating edges and the insert ledges forms each connection to couple the toe-side insert 2180B and the heel-side insert 2180A together.

In the illustrated embodiment, the toe-side insert 2180B is configured to receive the heel-side insert 2180A. In other embodiments, the heel-side insert 2180A can be configured to receive the toe-side insert 2180B. In many embodiments, the toe-side insert 2180B and the heel-side insert 2180A are secured to one another by epoxy or another suitable adhesive means. In some embodiments, the toe-side insert 2180B and the heel-side insert 2180A can be secured by a mechanical fastening means in addition to or in replacement of the adhesive means.

The illustrated embodiment depicts a multi-component central insert 2180 comprising two components: a heel-side insert 2180A and a toe-side insert 2180B. However, in other embodiments, the multi-component central insert can comprise more than two components. For example, the multi-component central insert can comprise three components, four components, five components, six components, seven components, eight components, nine components, or any suitable number of components. Additionally, the different components need not be located near only the heel end and toe end. In other embodiments, the different components may be located near the crown, sole, heel end, toe end, and/or any combination of these locations. Providing multiple inserts components can improve manufacturability by allowing smaller, simpler insert geometries to be formed rather than requiring a single central insert to be formed with a complicated geometry.

As discussed above, each multi-component central insert defines a connection where the different components are coupled to one another. In the illustrated embodiment, the central insert 2180 defines two connections: an upper connection 2181A near the crown 2110, and a lower connection 2181B near the sole 2112. In other embodiments, the multi-component central insert can define more than two connections. For example, the multi-component central insert can comprise three connections, four connections, five connections, six connections, seven connections, eight connections, nine connections, or any suitable number of connections to accommodate the number of inserts. Additionally, the different connections need not be located near only the crown and the sole. In other embodiments, the different connections may be located near the crown, sole, heel end, toe end, and/or any combination of these locations. In many embodiments, each connection of the multi-component central insert can be finished or constructed such that each connection is not visibly discernible, giving the multi-component central insert the appearance of a single component central insert.

As discussed above, each connection is formed by the interface between a mating edge located on one member and an insert ledge located on the other member. In the illustrated embodiment, the heel-side insert 2180A defines both of the insert ledges 2182A, 2182B, and the toe-side insert 2180B defines both of the mating edges 2183A, 2183B. In other embodiments, each component can comprise an insert ledge and a mating edge.

As discussed above, the central insert 2180 is substantially similar to the central insert 2080. The central insert is received within a central opening 2135, and the external shape of the central insert 2180 is similar to the central insert 2080. Despite the difference in construction, the central insert 2180 comprises a similar crown coverage, perimeter coverage, central insert thickness, and central insert mass to the central insert 2080.

The golf club head 2100 can further comprise any combination of the internal reinforcement structures, mass pads, and/or indentations discussed above. The golf club head 2100 can comprise any combination of internal reinforcement structures discussed above to reduce vibrations in specific areas of the body 2101. Said reinforcement structures can include internal bridges, frame ribs, and/or insert ribs. The golf club head 2100 can comprise any combination of internal reinforcement structures located on the frame 2130, the toe-side insert 2180B, and/or the heel-side insert 2180A. The internal reinforcement structures of the golf club head 2100 can comprise similar height, width, and/or thickness dimensions to the internal reinforcement structures of the golf club head 1000.

Various examples of internal bridges are illustrated in FIGS. 20A-20C, 29A, and 29B, 37A-37C, 39A-39C, and 52A-52C. Various examples of frame ribs are illustrated in FIGS. 20A-22C, 29A, and 29B, and 37A-39C. Various examples of insert ribs are illustrated in FIGS. 23A-28C, 40A, and 40B. The internal reinforcing features illustrated on the golf club heads 1000, 1100, 2000 can be adapted for use in the golf club head 2100. For example, these internal reinforcement structures can extend across the central opening 2135 to connect the forward frame 2140 to the rearward frame 2150.

The golf club head 2100 can comprise any combination of the internal weighting structures (also referred to as "mass pads") discussed above to improve CG placement to achieve a high $I_{XX}/I_{YY}$ ratio. The golf club head 2100 can comprise any combination of mass pads located on the frame 2130 near a central portion of the crown 2110, a central portion of the sole 2112, and/or any combination of these locations. Various examples of mass pads are illustrated in FIGS. 29A, 29B, and 39A-39C. The mass pads illustrated on the golf club heads 1000, 1100 can be adapted for use in the golf club head 2000. For example, the mass pads can be formed integrally with one or more external bridges, internal bridges, and/or frame ribs that extend across the central opening 2135.

The golf club head 2100 can comprise any combination of the indentations discussed above to provide a desired club head shape. The golf club head 2100 can comprise any combination of indentations located on the frame 2130, the heel-side insert 2180A, and/or the toe-side insert 2180B. The indentations of the golf club head 2100 can comprise similar shapes and/or dimensions to the indentations of the golf club head 2000. FIG. 30 illustrates an example of a golf club head 1000 comprising indentations 1072A, 1072B, 1072C. The indentations illustrated on the golf club head 1000 can be adapted for use in the golf club head 2100. For example, the indentations can extend across portions of the frame 2130, the heel-side insert 2180A, and/or the toe-side insert 2180B.

c. Weight Members i. Adjustable Weighting Systems

The various embodiments of golf club heads described herein may further comprise an adjustable weighting system. The adjustable weighting system disclosed below allows the user to adjust the club head CG position for a desired performance characteristic, such as shot-bend correction. The adjustable weighting system disclosed herein is capable of adjusting $CG_X$ by between 0.03 inch and 0.10 inch, thereby providing between 3 and 10 yards of shot bend correction, in either direction (i.e., left or right) for a driver impact having a ball speed of 150 mph. The adjustable weighting system disclosed herein comprises a heavy weight member (i.e., between 10 grams and 50 grams), within a short-arced housing structure (i.e., comprising a slot length less than 2 inches). A heavy weight member in a short-arced housing structure achieves a desired amount of $CG_X$ adjustment while reducing the amount of structural mass required for the housing structure. The adjustable weighting system disclosed herein also helps position the club head CG in line with the loft-normal axis 35 to increase ball speed. Driver-type club heads are typically constructed with a majority of the club head volume residing above the loft-normal axis 35, causing the club head CG to reside above the loft-normal axis 35. The heavy weight member is provided in an extreme rearward and soleward position to lower the club head CG nearer the loft-normal axis and position the weight member $CG_W$ below the loft-normal axis 35. A heavy weight member located in an extreme rearward and soleward portion of the golf club head drives the club head CG toward the loft-normal axis 35 to increase ball speed while improving the club head $I_{XX}/I_{YY}$ ratio.

Figure 61:
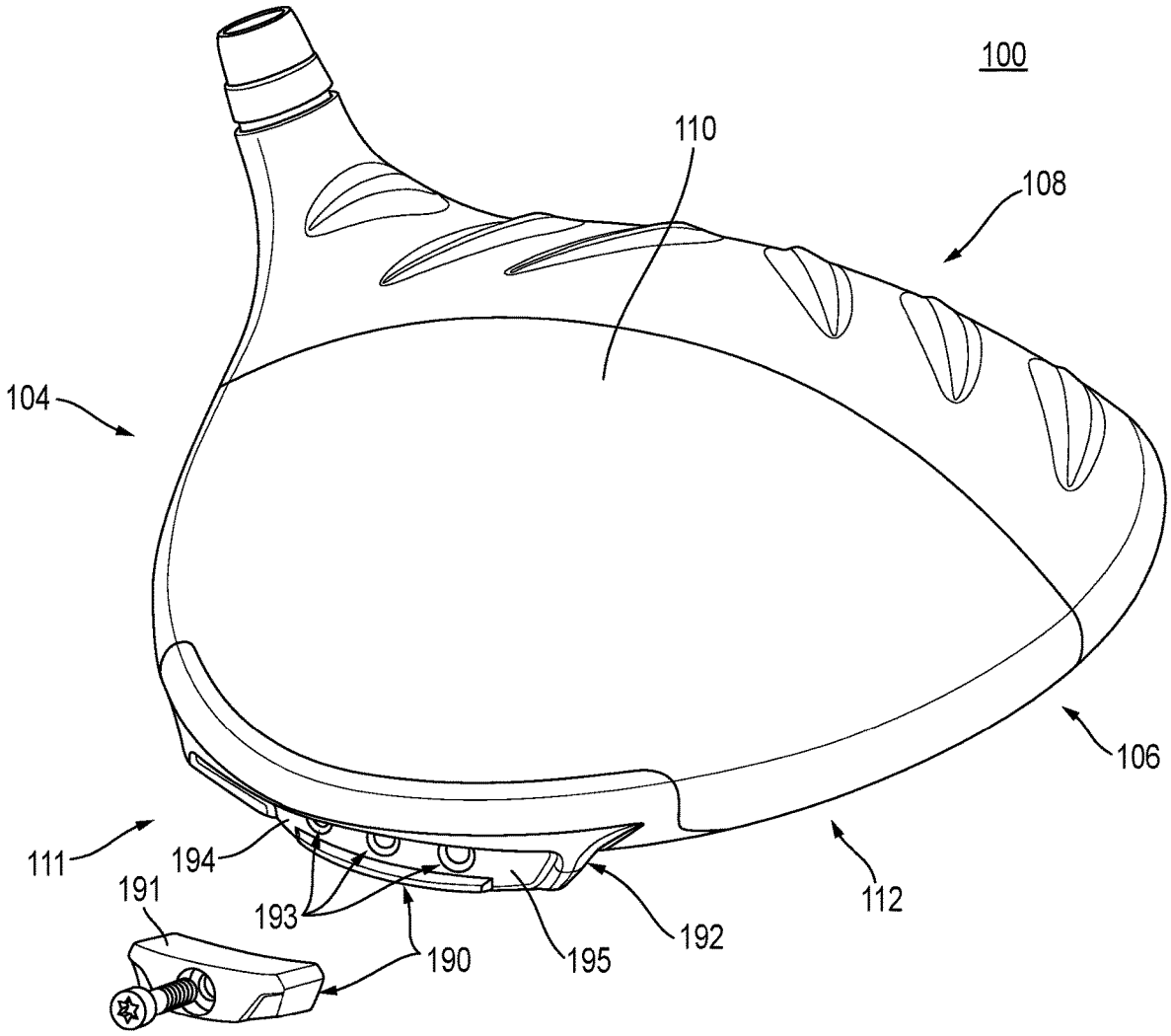
FIG. 61 illustrates an exploded rear perspective view of a golf club head according to the present invention, comprising an adjustable weighting system.
Figure 62:
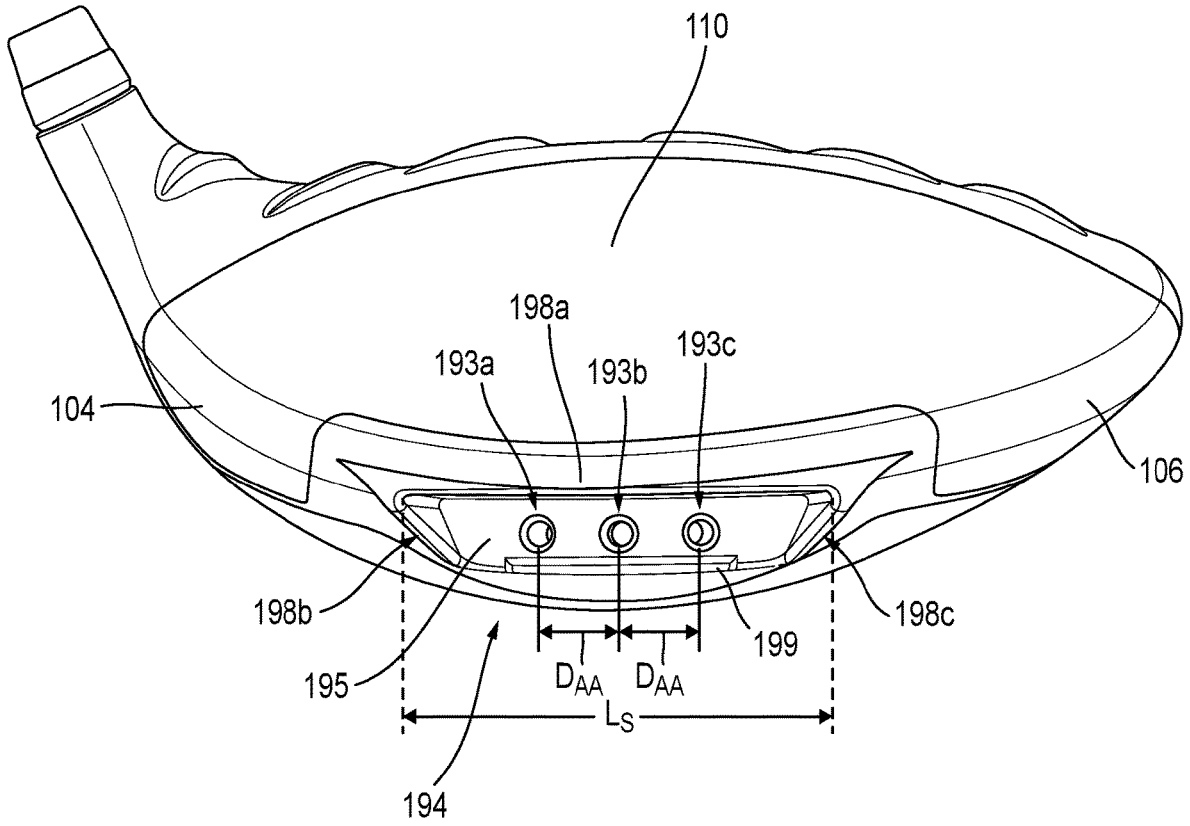
FIG. 62 illustrates a rear view of the golf club head of FIG. 61, with portions removed to better show the slot.

The adjustable weighting systems discussed herein can be substantially similar to those found in U.S. patent application Ser. No. 17/249,525, filed Mar. 4, 2021, and U.S. patent application Ser. No. 16/185,923, filed Nov. 9, 2018, now U.S. Pat. No. 10,556,161, both of which are incorporated herein in their entirety. In particular, as illustrated in FIGS. 61 and 62, the adjustable weighting system 190 comprises a weight member 191 within a weight housing structure 192, wherein the weight member 191 is adjustable between a plurality of discrete attachment points 193. The weight housing structure 192 forms a slot 194 configured to receive and accommodate the weight member 191 in any of the plurality of discrete positions (described in further detail below). The weight housing structure 192 can comprise one or more walls 198 and or partial ledges 199 which at least partially surround the weight member 191 and at least partially enclose a slot interior surface 195. For example, the weight housing structure 192 can comprise an upper wall 198*a*, a heel-side wall 198*b*, and a toe-side wall 198*c*, as well as a partial ledge 199 which surround the slot 194 and house the weight member 191 when secured within the slot 194.

The adjustable weighting system 190 comprises a plurality of discrete attachment points 193 configured to receive the weight member 191. The adjustable weighting systems disclosed in U.S. patent application Ser. No. 17/249,525 filed Mar. 4, 2021, and U.S. patent application Ser. No. 16/185,923, filed Nov. 9, 2018, contemplate a plurality of discrete attachment point 193 locations, including up to six discrete attachment points 193. Although the golf club head 100 according to the present invention can comprise any number of discrete attachment points 193, the present disclosure focuses primarily on adjustable weighing systems that include three discrete attachment points 193. In particular, the FIG. 62 illustrates a heel-side discrete attachment point 193*a*, a neutral discrete attachment point 193*b*, and a toe-side discrete attachment point 193*c*, unless otherwise noted. All measurements and descriptions of adjustable weighting systems 190 disclosed herein are understood to refer to embodiments wherein the weight member 191 is attached to the neutral discrete attachment point 193*b*, unless otherwise noted.

The adjustable weighting system 190 disclosed herein comprises a heavy weight member 191 which, as described above, efficiently allows $CG_X$ adjustment along a small-arced housing structure 192 and concentrates mass in low and rearward portions of the golf club head 100. Thus, the heavy weight member 191 permits $CG_X$ adjustment while improving both $I_{XX}$ and $I_{YY}$, as well as bringing the club head CG in line with the loft-normal axis 35. The mass of the heavy weight member 191 is increased due to the discretionary mass created by the lightweight composite inserts, the lightweight shaft-receiving structure, and/or the other mass-saving structures disclosed herein.

In some embodiments, the mass of the weight member 191 ranges between 30 grams and 50 grams. In some embodiments, the mass of the weight member 191 can be greater than 30 grams. In one embodiment, the mass of the weight member 191 can be 38 grams. In some embodiments, the mass of the weight member can be between 28 and 38 grams, 30 and 35 grams, 30 and 40 grams, 35 and 45 grams, or between 40 and 50 grams. The mass of the weight member 191 can be 30 grams, 31 grams, 32 grams, 33 grams, 34 grams, 35 grams, 36 grams, 37 grams, 38 grams, 39 grams, 40 grams, 41 grams, 42 grams, 43 grams, 44 grams, 45 grams, 46 grams, 47 grams, 48 grams, 49 grams or 50 grams. The mass of the weight member 191 can be greater than 30 grams, 31 grams, 32 grams, 33 grams, 34 grams, 35 grams, 36 grams, 37 grams, 38 grams, 39 grams, 40 grams, 41 grams, 42 grams, 43 grams, 44 grams, 45 grams, 46 grams, 47 grams, 48 grams, 49 grams, or greater than 50 grams. A weight member 191 with a mass between 30 grams and 50 grams is generally sufficient to move the club head CG in line with the loft-normal axis 35 and creates desired $CG_X$ adjustability within a small-arced housing structure 192. However, heavier golf club heads may require a weight member 191 with a larger mass to achieve equivalent club head CG adjustability.

The discretionary mass created by the mass saving structures described herein enable the weight member 191 to comprise a significant percentage of the total club head mass. In particular, the weight member 191 can comprise between 15% and 50% of the total club head mass. In some embodiments, the weight member 191 can comprise approximately 18.4% of the total club head mass. In other embodiments, the weight member 191 can comprise between 15% and 20%, 20% and 25%, 25% and 30%, 30% and 35%, 35% and 40%, 40% and 45%, or between 45% and 50% of the total club head mass. In other embodiments, the weight member 191 can comprise greater than 15%, 20%, 25%, 30%, 35%, 40%, 45%, or greater than 50% of the total club head mass. A weight member 191 that comprises between 15% and 50% of the club head mass comprises a large enough percentage of the overall club head mass to significantly affect the club head CG position.

A weight member 191 which comprises a significant percentage of the club head mass, as described herein, significantly alters the club head CG location. As discussed above, aligning the club head CG with the loft-normal axis 35 is beneficial, particularly for increasing ball speed. An extreme rearward and soleward positioning of the weight member 191 can align the club head CG with the loft-normal axis 35, thereby increasing ball speeds. There are additional benefits of positioning a heavy weight member 191 in both a rearward and soleward position, including MOI benefits. Specifically, the rearward positioning of the weight member 191 provides a more rearward club head CG position, nearer to the perimetrical centroid (PC), thereby enabling an increased $I_{XX}/I_{YY}$ ratio.

The weight member 191 comprises a weight member center of gravity (hereafter referred to as the "weight member $CG_W$"). The weight member $CG_W$ is the point at which mass is centered within the weight member 191. The weight member 191 is configured such that the weight member $CG_W$ resides within the weight member body. The location of the weight member $CG_W$ can be described relative to the club head primary coordinate system. Specifically, the weight member $CG_W$ is located at a distance ($CG_{WX}$), measured along the X-axis 40, a distance ($CG_{WY}$), measured along the Y-axis 50, and a distance ($CG_{WZ}$) measured along the Z-axis 60. The distances $CG_{WX}$, $CG_{WY}$, and $CG_{WZ}$ are measured with the weight member 191 attached to the neutral discrete attachment point 193*b* (i.e., in a configuration designed to provide a straight ball flight), unless otherwise specified.

Figure 63:
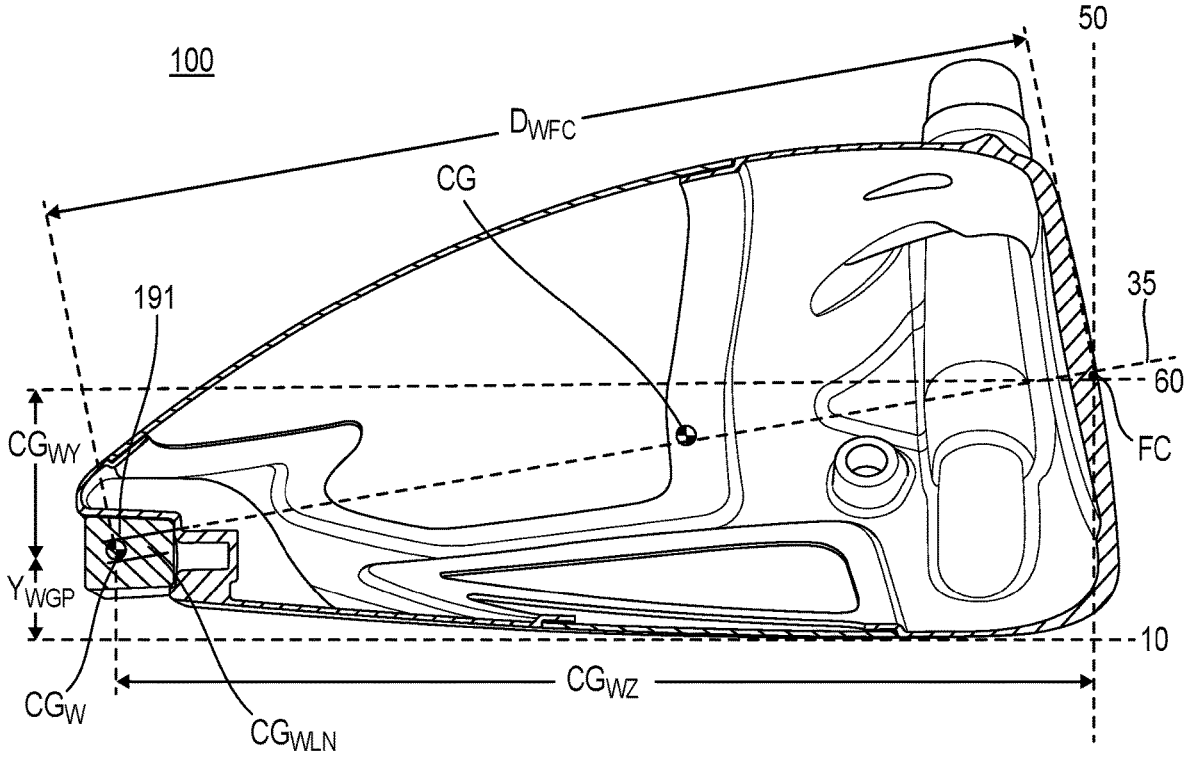
FIG. 63 illustrates a cross sectional view of the golf club head of FIG. 61.

Referring to FIG. 63, the extreme soleward position of the weight member $CG_W$ can further be characterized by a distance between the weight member $CG_W$ and the face center (FC) measured parallel to the Y-axis 50, which can be referred to as distance ($CG_{WY}$). A weight member $CG_W$ located below face center (FC) will yield a negative $CG_{WY}$ value. In many embodiments, the distance ($CG_{WY}$) can be between −0.40 inch and −1.20 inches. In some embodiments, the distance ($CG_{WY}$) is between −0.40 inch and −0.45 inch, −0.45 inch and −0.50 inch, −0.50 inch and −0.55 inch, −0.55 inch and −0.60 inch, −0.60 inch and −0.65 inch, −0.65 inch and −0.70 inch, −0.70 inch and −0.75 inch, −0.75 inch and −0.80 inch, −0.80 inch and −0.85 inch, −0.85 inch and −0.90 inch, −0.90 inch and −0.95 inch, −0.95 inch and −1.00 inch, −1.00 inch and −1.05 inches, −1.05 and −1.10 inches, −1.10 inches and −1.15 inches, or between −1.15 inches and −1.20 inches. In some embodiments, the distance ($CG_{WY}$) can be less than −0.40 inch, −0.45 inch, −0.50 inch, −0.55 inch, −0.60 inch, −0.65 inch, −0.70 inch, −0.75 inch, −0.80 inch, −0.85 inch, −0.90 inch, −0.95 inch, −1.00 inch, −1.05 inches, −1.10 inches, −1.15 inches, or less than −1.20 inches. A distance ($CG_{WY}$) which is between −0.40 inch and −1.20 inches or less than −1.20 inches is sufficient to lower the club head CG and bring the club head CG in line with loft-normal axis 35.

Referring to FIG. 63, the weight member 191 can define a distance ($CG_{WZ}$) greater than 90% of the body depth ($D_B$) to increase the club head MOI and increase forgiveness. In some embodiments, the distance ($CG_{WZ}$) can be approximately 95% of the body depth ($D_B$), 96%, 97%, 98%, 99%, or approximately 100% of the body depth ($D_B$). In other embodiments, the distance ($CG_{WZ}$) can be between 94% and 96%, 96% and 98%, or between 98% and 100% of the body depth ($D_B$). A distance ($CG_{WZ}$) greater than or equal to 95% of the body depth ($D_B$) is sufficient to ensure the weight member 191 significantly increases the club head MOI.

The distance ($CG_{WZ}$) can be measured to gauge the effectiveness of weight member 191 placement. A distance ($CG_{WZ}$) which is positive corresponds to a weight member 191 located rearward of the strike face 102. In some embodiments, the distance ($CG_{WZ}$) can be greater than 4.4 inches. In one embodiment, the distance ($CG_{WZ}$) can be 4.62 inches.

In some embodiments, the distance ($CG_{WZ}$) can be between 4.4 inches and 4.5 inches, 4.5 inches and 4.6 inches, 4.6 inches and 4.7 inches, 4.7 inches and 4.8 inches, 4.8 inches and 4.9 inches, or between 4.9 inches and 5.0 inches. In some embodiments, the distance ($CG_{WZ}$) can be greater than 4.4 inches, 4.5 inches, 4.6 inches, 4.7 inches, 4.8 inches, or greater than 4.9 inches. A sufficiently large distance ($CG_{WZ}$) indicates efficient weight member 191 placement along the Z-axis 60.

As detailed above, driver-type club heads typically have a club head CG residing above the loft-normal axis 35. To lower the club head CG along the Y-axis 50, and to bring the club head CG in line with the loft-normal axis 35, the weight member $CG_W$ can be located in an extreme soleward position. Referring to FIG. 63, the distance between the weight member $CG_W$ and the ground plane 10 along the Y-axis 50 can be referred to as the distance ($Y_{WGP}$). In many embodiments, the distance ($Y_{WGP}$) can be between 0.005 and 0.50 inch. In some embodiments, the distance ($Y_{WGP}$) can be between 0.005 inch and 0.10 inch, 0.10 inch and 0.15 inch, 0.15 inch and 0.20 inch, 0.20 inch and 0.25 inch, 0.25 inch and 0.30 inch, 0.30 inch and 0.35 inch, 0.35 inch and 0.40 inch, 0.40 inch and 0.45 inch, or between 0.45 inch and 0.50 inch. In many embodiments, the distance ($Y_{WGP}$) can be less than 0.50 inch. In some embodiments, the distance ($Y_{WGP}$) can be less than 0.50 inch, 0.45 inch, 0.40 inch, 0.35 inch, 0.30 inch, 0.25 inch, 0.20 inch, 0.15 inch, or less than 0.10 inch. A distance ($Y_{WGP}$) between 0.005 inch and 0.50 inch, or less than 0.10 inch sufficiently lowers the weight member $CG_W$ to bring the club head CG in line with loft-normal axis 35.

Referring to FIG. 63, the extreme soleward and rearward position of the weight member 191 can further be characterized by a straight-line distance ($D_{WFC}$) measured between the weight member $CG_W$ and the face center (FC). In many embodiments, the distance ($D_{WFC}$) is between 4.4 inches and 5.0 inches. In some embodiments, the distance ($D_{WFC}$) is between 4.4 inches and 4.6 inches, 4.6 inches and 4.8 inches, 4.8 inches and 5.0 inches, 5.0 inches and 5.2 inches, or between 5.2 inches and 5.4 inches. In other embodiments, the distance ($D_{WFC}$) can be greater than 4.4 inches, 4.6 inches, or greater than 4.8 inches. A distance ($D_{WFC}$) being greater than 4.4 inches or between 4.4 inches and 5.0 inches is sufficient to increase the club head MOI and bring the club head CG in line with the loft-normal axis 35.

Figure 64:
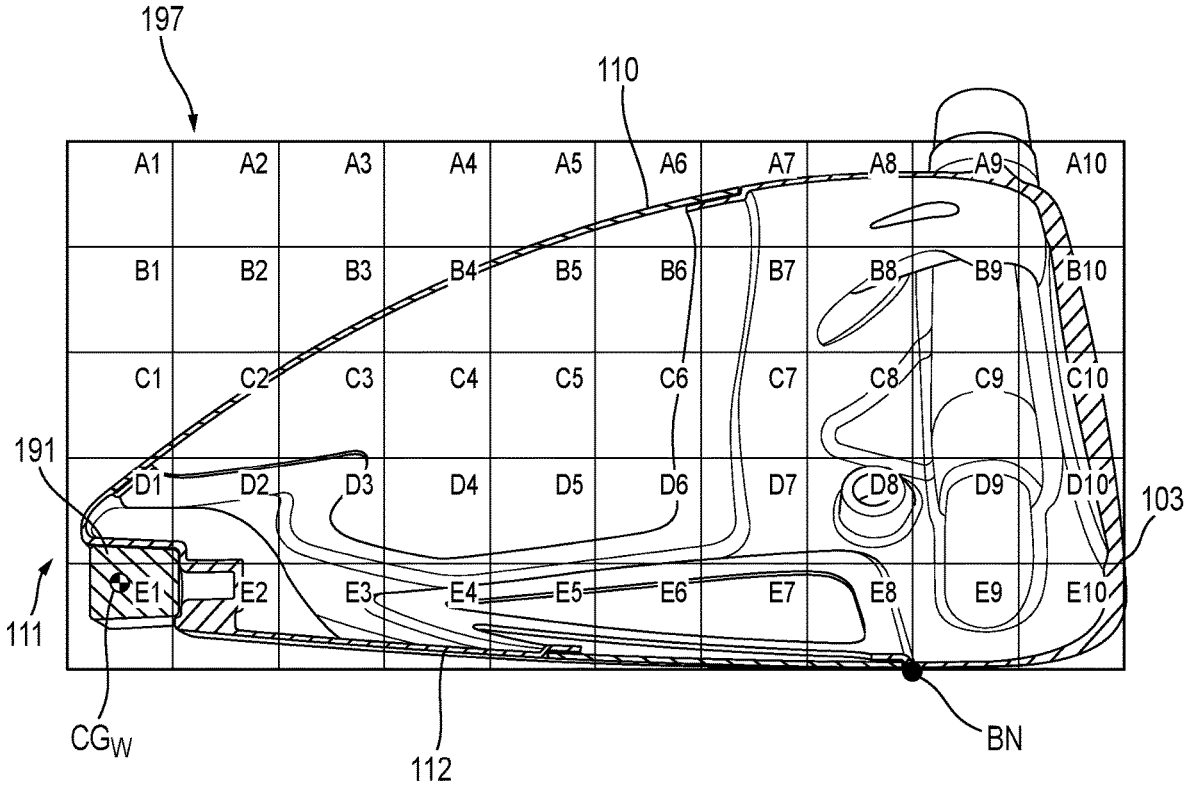
FIG. 64 illustrates a cross sectional view of the golf club head of FIG. 61, overlaid with a positional grid.

A cross-sectional grid 197 of the golf club head 100 can be used to characterize a position of the weight member $CG_W$. As shown in FIG. 64, the cross-sectional grid 197 is parallel to the YZ plane and intersects the weight member $CG_W$. The forwardmost boundary of the grid contacts the leading edge 103 and extends parallel to the Y-axis 50. The bottom boundary of the grid contacts the body nadir (BN) and extends parallel to the Z-axis 60. The cross-sectional grid 197 is divided into five rows of equal width (wherein the width of each row is measured along the front-to-rear direction of the golf club head 100) spanning a total of 5 inches in length, and ten columns of equal height (wherein the height of each row is measured along the crown-to-sole direction of the golf club head 100) spanning a total 2.5 inches in height. Thereby, the cross-sectional grid of FIG. 64 comprises 50 boxes, wherein each box is a 0.5 inch by 0.5 inch square. The rows are numbered in a crown-to-sole direction, with the row closest to the crown 110 labeled row A and the solewardmost row labeled row E. The columns are numbered 1 through 10, with the column closest to the rear end 111 labeled column 1 and the column closest to the leading edge 103 labeled row 10. As shown in FIG. 64, the weight member $CG_W$ is located in the solewardmost and rearwardmost box, E1. Locating the weight member $CG_W$ in the most soleward and rearward box, E1, of the grid indicates an extreme rearward and soleward placement of the weight member 191.

As discussed above, locating the weight member $CG_W$ at or near the loft-normal axis 35 will lower the club head CG. A weight member $CG_W$ below the loft-normal axis 35 ensures that the weight member 191 substantially lowers the club head CG toward the loft-normal axis 35, even as the club head CG moves rearward. This is true regardless of the mass of the weight member 191, and therefore there are no tradeoffs between providing a heavy weight member 191 and providing a club head CG at or near the loft-normal axis 35.

Referring to FIG. 63, a minimum perpendicular distance between the loft-normal axis 35 and the weight member $CG_W$, hereafter referred to as the distance ($CG_{WLN}$), can characterize how effectively the weight member 191 positions mass below the loft-normal axis 35. A negative distance ($CG_{WLN}$) value corresponds to a weight member $CG_W$ located below the loft-normal axis 35 and a positive distance ($CG_{WLN}$) value corresponds to a weight member $CG_W$ location above the loft-normal axis 35. In many embodiments, the distance ($CG_{WLN}$) has a negative value. In some embodiments, the distance ($CG_{WLN}$) is between −0.05 inch and −0.60 inch. In some embodiments, the distance ($CG_{WLN}$) is between −0.05 inch and −0.10 inch, −0.10 inch and −0.15 inch, −0.15 inch and −0.20 inch, −0.20 inch and −0.25 inch, −0.25 inch and −0.30 inch, −0.30 inch and −0.35 inch, −0.35 inch and −0.40 inch, −0.45 inch and −0.50 inch, −0.50 inch and −0.55 inch, or between −0.55 inch and −0.60 inch. In other embodiments, the distance ($CG_{WLN}$) can be less than −0.05 inch, −0.10 inch, −0.15 inch, −0.20 inch, −0.25 inch, −0.30 inch, −0.35 inch, −0.40 inch, −0.50 inch, or less than −0.55 inch. A distance ($CG_{WLN}$) with a negative value lowers the club head CG and brings the club head CG more in line with the loft-normal axis 35, thereby increasing ball speed. The $CG_{WLN}$ values disclosed above can be apply to any loft-normal axis 35 orientation defined above, including a loft-normal axis 35 that is perfectly normal to the loft plane 15 or a loft-normal axis 35 that is substantially normal to the loft plane 15.

The adjustable weight system 190 described herein comprises a slot 194 for receiving the weight member 191 rearward and soleward along the body 101. As discussed above, the slot 194 can be confined to a relatively small arc on the rear end 111 of the golf club head 100 to reduce the amount of discretionary weight used by the weight housing structure 192.

Referring to FIG. 62, the slot interior surface 195 spans a slot length (Ls) measured parallel to the X-axis 40. The slot length (Ls) can be between 1.6 inches and 2.0 inches. The slot length (Ls) can be between 1.6 inches and 1.7 inches, 1.7 inches and 1.8 inches, 1.8 inches and 1.9 inches, or between 1.9 and 2.0 inches. In some embodiments, the slot length (Ls) can be less than 2.0 inches, 1.9 inches, 1.8 inches, or less than 1.7 inches. A slot length (Ls) which can be less than 2.0 inches can ensure that the weight housing structure 192 does not become excessively large and comprise too much of the club head discretionary mass. A sufficiently small slot length (Ls) further ensures that discretionary mass can be incorporated into the weight member 191 and/or central mass zone (CMZ), thereby placing mass in more advantageous locations which allow for a higher club head $I_{XX}/I_{YY}$ ratio.

Referring to FIG. 62, the distance between adjacent discrete attachment points (hereafter "distance ($D_{AA}$)") can be measured along the X-axis 40. In many embodiments, the distance ($D_{AA}$) can be between 0.25 inch and 0.60 inch. In some embodiments, the distance ($D_{AA}$) can be between 0.25 inch and 0.30 inch, 0.30 inch and 0.35 inch, 0.35 inch and 0.40 inch, 0.40 inch and 0.45 inch, 0.45 inch and 0.50 inch, 0.50 inch and 0.55 inch, or between 0.55 inch and 0.60 inch. In some embodiments, the distance ($D_{AA}$) can be less than 0.60 inch, 0.50 inch, 0.40 inch, or less than 0.30 inch. A distance ($D_{AA}$) being less than 0.60 inch, or between 0.25 and 0.60 inch ensures that the weight member 191 position is sufficiently adjustable to allow for shot-bend correction. A distance ($D_{AA}$) of 0.60 inch or less correlates to discrete attachment points 193 which are substantially close together, ensuring that the weight housing structure 192 is not excessively large and does not utilize a significant portion of the available discretionary mass.

Typical adjustable weighting systems 190 have weight members 191 with less mass, and therefore require a slot length (Ls) greater than 2 inches (hereafter "large-arced" housing structures) to get the desired amount of club head $CG_X$ adjustment for shot-bend correction. As discussed above, a small-arced housing structure 192 is advantageous, as less discretionary mass is utilized by the weight housing structure 192. Weight savings can be added to the weight member 191, which has a more advantageous position for aligning the club head CG with the loft-normal axis 35 and increasing club head MOI. As a result of a significant percentage of mass being incorporated into the weight member 191, the adjustable weighting system described herein requires less distance between discrete attachment points 193 to yield the same club head $CG_X$ adjustment when compared to a traditional, lower mass weight member 191 in a large-arced housing structure. For example, the weight member 191 described herein can shift the club head $CG_X$ between 0.5 inch and 0.9 inch when the discrete attachment points 193 are separated by a distance ($D_{AA}$) disclosed above. In one embodiment, a distance ($D_{AA}$) of 0.35 inches causes a 0.73 inch shift in $CG_X$ when the weight member 191 is moved between adjacent discrete attachment points 193. In other embodiments, moving the weight member 191 between adjacent discrete attachment points 193 can shift the $CG_X$ between 0.50 inch and 0.55 inch, 0.55 inch and 0.60 inch, 0.60 inch and 0.65 inch, 0.65 inch and 0.70 inch, 0.70 inch and 0.75 inch, 0.75 inch and 0.80 inch, 0.80 inch and 0.85 inch, or between 0.85 inch and 0.90 inch. A significant shift of the $CG_X$ with a relatively small distance ($D_{AA}$) indicates that the small-arced housing structure 192 achieves high levels of shot-bend correction without requiring a large amount of mass to form the housing structure 192.

The small-arced housing structure 192 further can be confined to the extreme rear end 111 of the golf club head 100. Housing structures 192 which follow the contours of the rear end 111 will extend closer to the strike face 102 at their heel-side wall 198*b* and toe-side wall 198*c* than they do at their neutral discrete attachment point 193*b*. Accordingly, at heel-side discrete attachment point 193*a* and toe-side discrete attachment point 193*c*, large-arced housing structures position mass closer to the strike face 102 and further from the rear end 111. The larger the housing structure arc, the further forward the weight member is positioned when in the heel-side or toe-side position. Therefore, such large-arced housing structures require club head CG depth to be significantly reduced to achieve a desirable $CG_X$ shift. These large-arced housing structures are therefore less advantageous for MOI and aligning the club head CG with the loft-normal axis 35.

One way of quantifying the advantages of a small-arced housing structure 192 is by measuring the difference in club head CG depth (as defined above, club head CG depth is the club head CG location along the Z-axis 60) between various configurations of the weight member 191. Due to the curved nature of driver-type club head shapes, when housing structures 192 are confined to extreme heelward and soleward portions of the golf club head 100, weight members positioned more heelward and toeward will also be positioned closer to the strike face 102. The club head CG depth of the weight member configuration in which the weight member 191 is attached at the neutral discrete attachment point 193*b* can be compared to the weight member 191 configurations in which the weight member 191 is attached to the heel-side discrete attachment point 193*a* or the toe-side discrete attachment point 193*c* (which are both closer to the strike face than the neutral discrete attachment point 193*b*). As discussed above, for $I_{XX}$ and $I_{YY}$, it is advantageous for the weight member 191 to be as far rearward and soleward as possible. Thereby, a small difference in club head CG depth between the between the neutral weight member configuration, and the heel-side and toe-side weight member configurations is desirable to retain $I_{XX}$ and $I_{YY}$ and the club head CG position for all weight member configurations.

In some embodiments, the difference in club head CG depth between the neutral weight member configuration, and either the heel-side weight member configuration or the toe-side weight member configuration can be approximately 0 to 0.5 inches. In one embodiment, the difference in club head CG depth between the neutral weight member configuration, and either the heel-side weight member configuration or the toe-side weight member configuration can be 0.021 inches. In other embodiments, the difference in club head CG depth between the neutral weight member configuration, and either the heel-side weight member configuration or the toe-side weight member configuration can be between 0 inch and 0.1 inch, 0.1 inch and 0.2 inch, 0.2 inch and 0.3 inch, 0.3 inch and 0.4 inch, or between 0.4 inch and 0.5 inch. In other embodiments, the difference in club head CG depth between the neutral weight member configuration, and either the heel-side weight member configuration or the toe-side weight member configuration can be less than 0.5 inch, 0.4 inch, 0.3 inch, or less than 0.2 inch. Retaining club head CG depth between the neutral weight member configuration, the heel-side weight member configuration and the toe-side weight member configuration ensures that $I_{XX}$ and $I_{YY}$ are maintained at all weight member configurations. A small-arced housing structure 192 with a heavy weight member 191 ensures a desirable club head $CG_X$ shift (in some embodiments, between 0.5 and 0.9 inch) can be achieved with a decrease of less than 0.5 inch of club head CG depth.

Another way of quantifying the advantages of a small-arced housing structure 192 is by comparing the difference in $I_{XX}$ and $I_{YY}$ between the neutral weight member configuration, and either the heel-side weight member configuration or the toe-side weight member configuration. A small-arced housing structure 192 will have less $I_{XX}$ and $I_{YY}$ drop-off between discrete attachment points 193 when compared to a large-arced housing structure. In many embodiments, the difference in $I_{XX}$ between the neutral weight member configuration, and either the heel-side weight member configuration or the toe-side weight member configuration, can be less than 200 g-cm$^2$. In other embodiments, the difference in $I_{XX}$ between the neutral weight member configuration, and either the heel-side weight member configuration or the toe-side weight member configuration, can be less than 200 g-cm$^2$, 175 g-cm$^2$, 150 g-cm$^2$, 100 g-cm$^2$, or less than 50 g-cm$^2$. In many embodiments, the difference in $I_{YY}$ between the neutral weight member configuration, and either the heel-side weight member configuration or the toe-side weight member configuration, can be less than 200 g-cm$^2$. In other embodiments, the difference in $I_{YY}$ between the neutral weight member configuration, and either the heel-side weight member configuration or the toe-side weight member configuration, can be less than 200 g-cm$^2$, 175 g-cm$^2$, 150 g-cm$^2$, 100 g-cm$^2$, or less than 50 g-cm$^2$. Limiting the $I_{YY}$ and $I_{XX}$ drop-off between the neutral weight member configuration, and either the heel-side weight member configuration or the toe-side weight member configuration, ensures that forgiveness of the driver is retained at all discrete attachment point 193 positions.

Structural elements, such as the frame ribs 1053A and 1053B disclosed above and illustrated in FIG. 18, can support the adjustable weighting system 190. As discussed above, the adjustable weighting system 190 places a significant portion of the club head mass rearward and soleward. Without the internal reinforcing features disclosed herein, this extreme perimeter weighting could lead to durability issues with the golf club head 100. It is important that any internal reinforcing features included to support the adjustable weighting system 190 do not utilize too much discretionary mass which could be implemented into the weight member 191. For this reason, the lightweight composite ribs disclosed herein are advantageous for preserving club head $I_{XX}$, $I_{YY}$, and CG positioning while providing necessary structural rigidity to support the extreme rearward mass introduced by the weight member 191.

ii. Fixed Weight Members

While the present disclosure and figures illustrate embodiments of the adjustable weighting system wherein a weight member is removably attached to one of a plurality of discrete attachment points, in other embodiments, the weight member can be permanently fixed or removably attached to a single location within the housing structure. Attaching the weight member to a single location reduces the size of the housing structure. For embodiments with a single weight configuration the slot length (Ls) can be substantially short, such that it is designed to accommodate only the single weight member configuration. In such embodiments, the slot length (Ls) can be between 0.5 inch and 2 inches. The slot length (Ls) can be between 0.5 inch and 0.75 inch, 0.75 inch and 1.00 inch, 1.00 inch and 1.25 inches, 1.25 inches and 1.5 inches, 1.5 inches and 1.75 inches, or between 1.75 inches and 2.00 inches. In some embodiments, the slot length (Ls) can be less than 2.0 inches, 1.75 inches, 1.5 inches, 1.25 inches, 1.00 inches, 0.75 inches, or less than 0.50 inches. As discussed above, a sufficiently small slot length (Ls) ensures that discretionary mass can be incorporated into the weight member, thereby placing mass in more advantageous locations, allowing for a higher club head MOI and a club head CG position at or near the loft-normal axis 35.

d. Lightweight Shaft-Receiving Structure

Figure 65A:
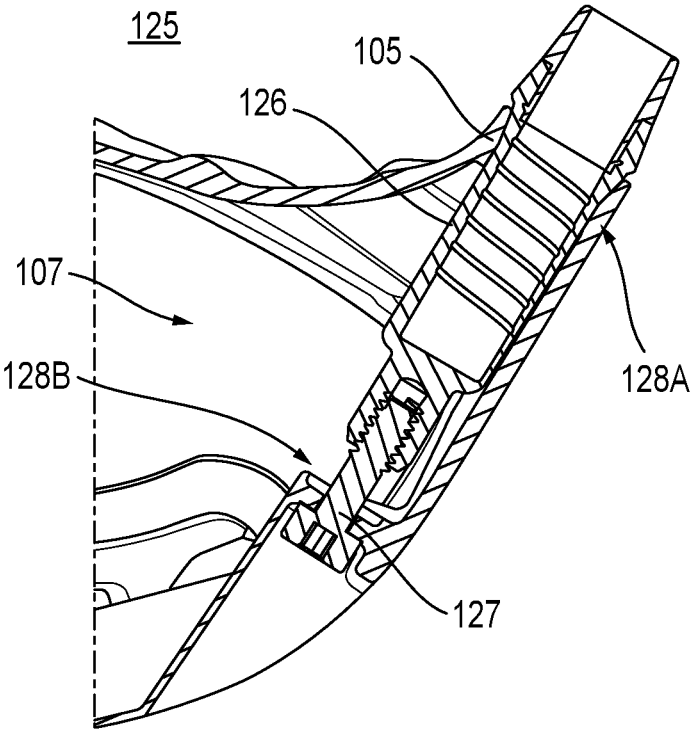
FIG. 65A illustrates a detailed, cross-sectional view of the golf club head of FIG. 1, highlighting a lightweight shaft-receiving structure.
Figure 65B:
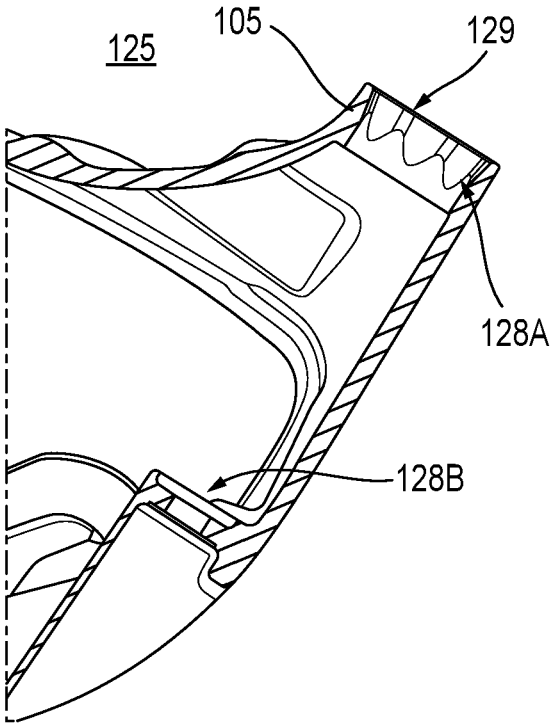
FIG. 65B illustrates a detailed, cross-sectional view of the golf club head of FIG. 1, with portions removed to better show the lightweight shaft-receiving structure.
Figure 66:
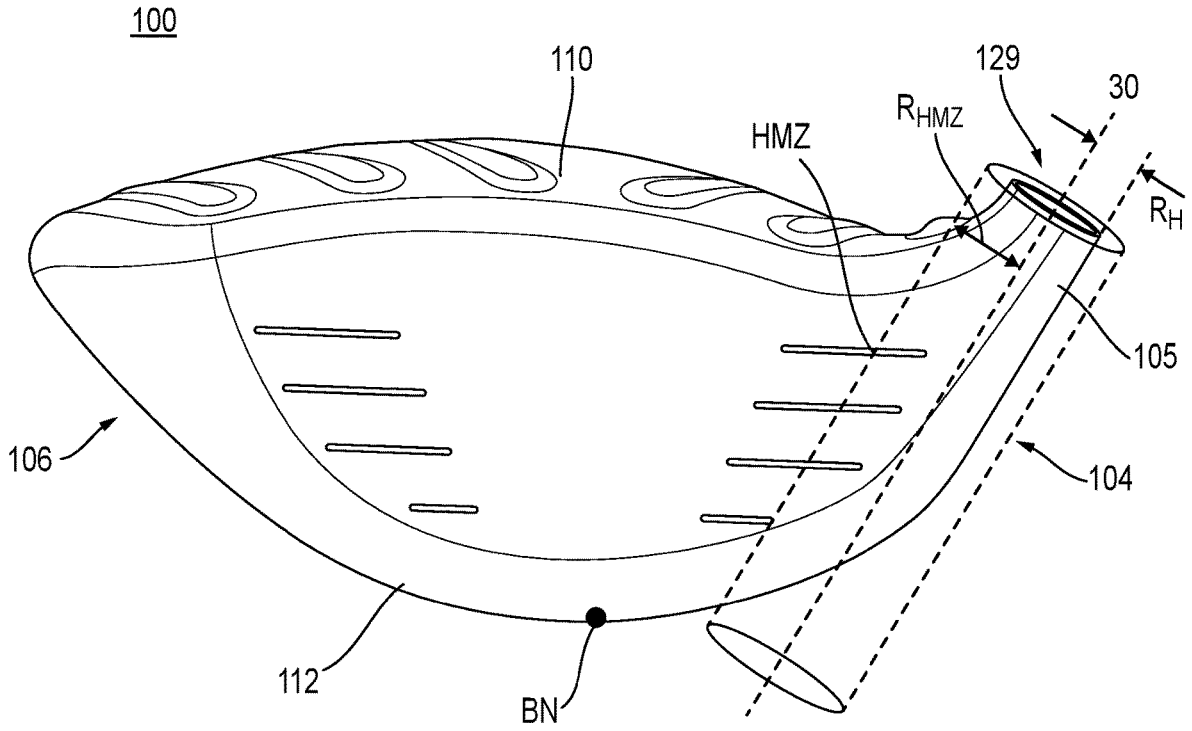
FIG. 66 illustrates a detailed front side elevation view of the golf club head of FIG. 1, highlighting a hosel mass zone.

In some embodiments, referring to FIGS. 65A-66, the golf club head 100 can comprise a lightweight shaft-receiving structure 125 which creates discretionary mass. The discretionary mass can be allocated to other portions of the golf club head 100 that provide an $I_{XX}/I_{YY}$ ratio close to 1. Providing the lightweight shaft-receiving structure 125 can allow extra mass to be placed within the central mass zone (CMZ) or used to increase the mass of any of the mass pads or weight members described in detail above.

Referring to FIG. 65A, in some embodiments, the golf club head 100 can comprise an adjustable shaft-receiving mechanism. The adjustable shaft-receiving mechanism may be used to adjust the loft angle and/or lie angle for a particular player. The adjustable shaft-receiving mechanism can be similar to those described in U.S. patent application Ser. No. 15/003,494, filed on Jan. 21, 2016, now U.S. Pat. No. 9,868,035, granted on Jan. 16, 2018; and U.S. patent application Ser. No. 17/304,836, filed on Jan. 25, 2021, now U.S. Pat. No. 11,607,590, granted on Mar. 21, 2023; which are both incorporated fully herein by reference.

The adjustable shaft-receiving mechanism comprises a shaft sleeve 126 configured to receive a golf club shaft and retained within the hosel 105 by a fastener 127. The shaft sleeve 126 and the hosel 105 comprise corresponding geometries that allow the shaft sleeve 126 to be removably rotated into a plurality of different configurations. Rotating the shaft sleeve 126 between different configurations can provide loft angle 20 and/or lie angle 25 adjustability to the golf club head 100. Referring to FIG. 65A, the lightweight shaft-receiving structure 125 houses the shaft sleeve 126 with a minimal amount of structural mass. At least a portion of the shaft sleeve 126 is exposed to the interior cavity 107. In the present embodiment, rather than being retained by an internal structure such as an interior hosel tube or hosel wall, the shaft sleeve 126 is retained and supported in the golf club head 100 by structures that also form at least a portion of the exterior of the body 101. In many embodiments, the lightweight shaft-receiving structure 125 comprises an upper end 128A and a lower end 128B. In the present embodiment, the shaft sleeve 126 is secured only at the upper end 128A and the lower end 128B. The shaft sleeve 126 is inserted through a hosel bore opening 129 and retained at the upper end by the hosel 105. The shaft sleeve 126 can be secured to the golf club head 100 by use of a fastener 127.

As discussed above, the hosel 105 is in an extreme heelward position, located a significant distance from the Y'-axis 80. To increase the golf club head 100 $I_{XX}/I_{YY}$ ratio, it is desirable to decrease the mass of structures located at the extreme heel end 104, such as the hosel 105, and to reallocate this mass to the central mass zone (CMZ) and/or by incorporating any mass savings into structures such as the mass pads or weight member of the adjustable weighting system described herein.

To quantify the effectiveness of the lightweight shaft-receiving structure 125 in creating discretionary mass, a hosel mass zone (HMZ) can be formed about the hosel axis 30, as shown in FIG. 66. In particular, the hosel mass zone (HMZ) can be formed as an imaginary cylinder centered about the hosel axis 30 and extending from the hosel bore opening 129 toward ground plane 10, past the body nadir (BN). The hosel mass zone (HMZ) may have a hosel mass zone radius $R_{HMZ}$. The radius $R_{HMZ}$ can have a value of 2 times the outer radius (RH) of the hosel 105.

The lightweight shaft-receiving structure 125 may comprise a hosel mass zone (HMZ) containing a small amount of the total club head mass. In other embodiments, the club head mass within the hosel mass zone (HMZ) can be between 5 grams and 35 grams. In some embodiments, the club head mass within the hosel mass zone (HMZ) can be less than 35 grams, 30 grams, 25 grams, 20 grams, 15 grams, or less than 10 grams. A hosel mass zone (HMZ) containing a small amount of the club head mass is indicative of a lightweight shaft-receiving structure 125 which effectively removes mass from the heel end 104 of the golf club head 100. These mass savings can then be incorporated into the central mass zone (CMZ) to provide an $I_{XX}/I_{YY}$ ratio close to 1.

The club head mass within the hosel mass zone (HMZ) can be described relative to the total club head mass. In many embodiments, the club head mass within the hosel mass zone (HMZ) can be between 1% and 15% of the total club head mass. In some embodiments, the club head mass within the hosel mass zone (HMZ) can be less than 15%, 14%, 13%, 12%, 11%, 10%, 9%, 8%, 7%, 6%, 5%, 4%, 3%, 2%, or less than 1% of the total club head mass. A hosel mass zone (HMZ) containing a small percentage of the club head mass is indicative of a lightweight shaft-receiving structure 125 which effectively removes mass from the extreme heel end 104 of the golf club head 100. These mass savings can then be incorporated into the central mass zone (CMZ) to provide an $I_{XX}/I_{YY}$ ratio close to 1.

The lightweight shaft-receiving structure 125 can create between 3 grams and 12 grams of discretionary mass in comparison to a prior-art shaft-receiving structure wherein the shaft sleeve is concealed from the interior cavity by a supporting structure such as a hosel tube or an interior hosel wall. In some embodiments, the lightweight shaft-receiving structure 125 can create between 3 grams and 5 grams, 4 grams and 6 grams, 5 grams and 7 grams, 6 grams and 8 grams, 7 grams and 9 grams, 8 grams and 10 grams, 9 grams and 11 grams, or between 10 grams and 12 grams of discretionary mass in comparison to a prior-art shaft receiving structure. In some embodiments, the lightweight shaft-receiving structure 125 can create greater than 3 grams, 4 grams, 5 grams, 6 grams, 7 grams, 8 grams, 9 grams, or greater than 10 grams of discretionary mass in comparison to a prior-art shaft receiving structure. Reducing the mass of the shaft-receiving structure 125 by eliminating redundant supporting structures frees up discretionary mass to be re-allocated to other areas of the golf club head 100 to maximize $I_{YY}$, provide an $I_{XX}/I_{YY}$ ratio close to 1, and/or provide a club head CG position at or near the loft-normal axis 35. In particular, because the shaft-receiving structure 125 is located proximate the heel end 104, the mass forming the shaft-receiving structure 125 is typically located outside of the central mass zone (CMZ). Reducing the mass of the shaft-receiving structure 125 by eliminating redundant supporting structures is particularly effective in increasing $I_{XX}/I_{YY}$, because doing so removes mass that is located outside of the central mass zone (CMZ) and allows the mass to be redistributed within the central mass zone (CMZ).

e. Bulge and Roll Optimization

As described above, the golf club head 100 can further comprise a bulge curvature and roll curvature specifically tailored to the club head properties to provide increased performance and forgiveness. Accordingly, the club head can satisfy one or more bulge radius or roll radius relations dependent on factors such as club head CG position, MOI, or any combination thereof. In many embodiments, as evidenced in the examples below, optimized bulge and roll curvatures can increase forgiveness in comparison to standard bulge and roll curvatures (i.e., bulge and roll curvatures that are not optimized in view of the club head characteristics).

In many embodiments, the optimal bulge and roll radii can be determined by computer simulations that factor in ranges or values for club head MOI (both $I_{XX}$ and $I_{YY}$) and CG position. In many embodiments, the computer simulations can be performed over a variety of swing speeds, face delivery angles, and/or impact locations on the strike face 102. In many embodiments, an $I_{XX}$ range and $I_{YY}$ range can be selected, and the optimal bulge and roll radii can be calculated as a function of the club head CG position within the $I_{XX}$ and $I_{YY}$ ranges.

The simulation determines an optimal bulge radius ($B_O$) and an optimal roll radius ($R_O$). In some embodiments, the optimal bulge radius and/or optimal roll radius can be uniform across the strike face 102. In other embodiments, the golf club head 100 can define multiple optimal bulge radii and/or optimal roll radii. In many embodiments, the golf club head 100 can define an upper roll radius above the face center (FC) and a lower roll radius below the face center (FC). Although in many embodiments the transition between the upper roll radius and the lower roll radius occurs at the face center (FC), in other embodiments, the transition between the upper roll radius and the lower roll radius can occur any height along the strike face 102 between the crown 110 and the sole 112. In some embodiments, the simulation determine an optimal upper roll radius ($R_{OU}$) and an optimal lower roll radius ($R_{OU}$). In many embodiments, the bulge curvature satisfies relation 1 below.

$$13.91-2.12*CG_Z+CG_Y<B_O<15.91-2.07*CG_Z+CG_Y \quad \text{Relation 1}$$

In many embodiments, the upper roll curvature satisfies relation 2 below.

$$2.04+3.94*CG_Z+CG_Y<R_{OU}<4.04-3.99*CG_Z+CG_Y \quad \text{Relation 2}$$

In many embodiments, the upper roll curvature satisfies relation 3 below.

$$11.97-2.65*CG_Z+CG_Y<R_{OL}<13.97-2.60*CG_Z+CG_Y \quad \text{Relation 3}$$

Relations 1, 2, and 3 represent the optimal bulge and roll curvatures for a golf club head comprising the MOI and CG properties described herein. For example, in many embodiments, the golf club head 100 satisfies relations 1, 2, and/or 3 and comprises an $I_{YY}$ greater than 5700 g*cm$^2$, an $I_{XX}/I_{YY}$ ratio between 0.77 and 1, a CG loft-normal distance less than 0.150 inch, a perimetrical centroid distance ($D_{PC}$) less than 0.50 inch, or any combination thereof.

In many embodiments, the bulge radius can be between 10 inches and 13 inches. In some embodiments the bulge radius can be between 10 inches and 11 inches, 11 inches and 12 inches, or between 12 inches and 13 inches.

In many embodiments, the upper roll radius can be between 10 inches and 13 inches. In some embodiments the upper roll radius can be between 10 inches and 11 inches, 11 inches and 12 inches, or between 12 inches and 13 inches.

In many embodiments, the lower roll radius can be between 7 inches and 10 inches. In some embodiments, the lower roll radius can be between 7 and 8 inches, 8 and 9 inches, or between 9 and 10 inches.

In many embodiments an average roll radius is defined as the average of the upper roll radius and the lower roll radius. In many embodiments, the average roll radius can be between 8.5 inches and 11.5 inches. In some embodiments, the average roll radius can be between 8.5 and 9 inches, 9.0 and 9.5 inches, 9.5 and 10.0 inches, 10.0 and 10.5 inches, 10.5 and 11.0 inches, or between 11.0 and 11.5 inches.

In many embodiments, the lower roll radius is tighter than the upper roll radius. Players tend to add excessive loft to the golf club head at impact, particularly on low strikes, which causes shots that launch high and balloon into the air. A tighter lower roll radius improves forgiveness on soleward mis-hits by effectively delofting the lower portion of the strike face 102, thereby providing a lower launch angle and retaining distance. In many embodiments, the golf club head 100 comprises a roll radius ratio defined as the lower roll radius divided by the upper roll radius, wherein the roll radius ratio can be between 0.50 and 1.0. In some embodiments the roll radius ratio can be between 0.50 and 0.55, 0.55 and 0.60, 0.60 and 0.65, 0.65 and 0.70, 0.75 and 0.80, 0.80 and 0.85, 0.85 and 0.90, 0.90 and 0.95, or between 0.95 and 1.00.

The optimized bulge and roll curvatures can be applied to the strike face 102 of a golf club head 100 comprising any one or combination of the features above. In particular, in many embodiments, the optimized bulge and roll curvatures are applied to a golf club head 100 comprising a balance of the physical properties and performance characteristics described herein (i.e., a high $I_{YY}$, an $I_{XX}/I_{YY}$ ratio near 1, a club head CG position at or near the loft-normal axis 35, a shallow strike face, desirable aerodynamic characteristics, club head CG adjustability, etc.). Providing optimized bulge and roll curvatures in a golf club head that achieves balanced physical properties and/or performance characteristics further enhances the performance of an already high-performing golf club head, without sacrificing performance with respect to any of the other performance characteristics.

EXAMPLES

I. Example 1: Exemplary Golf Club Heads with Balanced Properties and Characteristics Described herein is a comparison of the mass properties between a pair of exemplary club heads with balanced physical properties and/or performance characteristics according to the present disclosure and a pair of control club heads. The Example illustrates that the various designs and structures of the club heads described herein produce a club head with high MOI and improved mass properties. Primarily, the exemplary club head designs prioritized an $I_{YY}$ at or near the allowable limit, an $I_{XX}/I_{YY}$ ratio near 1, and a club head CG position that is centered relative to the club head perimeter and located at or near the loft-normal axis 35. Secondarily, the exemplary club head designs prioritized providing a shallow (short and thin) strike face without sacrificing the club head CG and MOI characteristics. Finally, the exemplary club heads provided CG, loft angle, and lie angle adjustability without sacrificing club head CG and MOI characteristics.

A first exemplary club head included a multi-material construction comprising a crown insert that forms a large portion of the crown and wraps around the body perimeter to form a portion of the sole near the heel end and the toe end. The multi-material construction further comprised a sole insert bounded within the sole. The crown insert formed 57.9% of the crown surface area and 5.7% of the sole surface area. The sole insert formed 48.9% of the sole surface area. The first exemplary club head further includes a lightweight adjustable shaft-receiving structure comprising a shaft sleeve exposed to the interior cavity, wherein the lightweight shaft-receiving structure comprised a mass of 25.2 grams located within the hosel mass zone (HMZ).

The discretionary mass of the first exemplary club head was primarily concentrated in an adjustable weight member located in an extreme rearward and soleward location. The weight member comprised a mass of 38.3 grams and was located within a short-arced weight member housing structure comprising a neutral discrete attachment point, a heel-side discrete attachment point, and a toe-side discrete attachment point. The adjustable weighting system comprised discrete attachment points separated by a distance ($D_{AA}$) of 0.35 inch.

The first exemplary club head comprised a body shape conducive to balancing all relevant physical properties and performance characteristics. The first exemplary club head comprised a large volume and body dimensions, a substantially shallow face with a high face center height ($H_{FC}$) and a reduced face thickness, and a steep crown angle ($\alpha_C$). The specific dimensions of the body shape are presented below in Table 1. The first exemplary club head further comprised a plurality of turbulators on the crown.

A second exemplary club head was substantially similar to the first exemplary club head. The second exemplary club head comprised a similar construction as the first exemplary club head, including a similar crown insert, a sole insert, adjustable shaft-receiving structure, adjustable weighting system, body shape, and turbulators. The second exemplary club head distributed discretionary mass into both the adjustable weight member and a central mass pad located on sole. The central mass pad comprised a mass of 16 grams. Approximately 76.2% of the central mass pad was located within a central mass zone (CMZ) having a central mass zone radius ($R_{CMZ}$) of 1 inch, and the distance between the central mass pad CG and the Y'-axis was 0.16 inch.

The first control club head included a multi-material construction comprising a crown insert substantially similar to that of the exemplary club heads, forming a large portion of the crown, and wrapping around the body perimeter to form a portion of the sole near the heel end and the toe end. The crown insert formed 58.5% of the crown surface area and 14.3% of the sole surface area. The first control club head was devoid of a sole insert. Instead, the sole was formed from the same material as the remaining portions of the frame. The first control club head was further devoid of a lightweight adjustable shaft-receiving structure. Instead, the first control club head comprised a prior-art adjustable shaft-receiving structure comprising a hosel tube that sealed the shaft sleeve within the hosel bore, such that the shaft sleeve was not exposed to the interior cavity. The shaft-receiving structure comprised a mass of 29.6 grams.

The discretionary mass of the first control club head was primarily concentrated in a fixed weight member located near the rear end and sole in a singular weight configuration. The non-adjustable weight member comprised a mass of 28.1 grams. The body shape of the first control club head was similar to that of the exemplary club heads, but for the differences in strike face dimensions exhibited in Table 1 below. The first control club head further comprised a plurality of turbulators on the crown.

The second control club head was devoid of any lightweight composite inserts. Instead, the second control club head included a single-material construction. The second control club head was further devoid of a lightweight adjustable shaft-receiving structure. Instead, the second control club head comprised a prior-art adjustable shaft-receiving structure comprising a hosel tube that sealed the shaft sleeve within the hosel bore, such that the shaft sleeve was not exposed to the interior cavity. The shaft-receiving structure comprised a mass of 31.4 grams.

The discretionary mass of the second control club head was primarily concentrated in an adjustable weight member located near the rear end and sole. The adjustable weight member comprised a mass of 14.7 grams and was located within a long-arced weight member housing structure comprising a neutral discrete attachment point, a heel-side discrete attachment point, and a toe-side discrete attachment point. The adjustable weighting system comprised discrete attachment points separated by a distance ($D_{AA}$) of 1.41 inch.

The second control club head was shaped similarly to the exemplary club heads and the first control club head, but for small differences in body dimensions. The second control club head comprised a taller, thicker strike face than both the exemplary club heads and the first control club head. The second control club head further comprised a plurality of turbulators on the crown.

Table 1 provides a summary of the dimensions described above, as well as a comparison of the mass distribution characteristics and mass properties of the first exemplary club head, the second exemplary club head, the first control club head, and the second control club head. The values below assume a loft-normal axis 35 that is perfectly normal (as defined above) relative to the loft plane 10.

TABLE 1

Physical Properties and Performance Characteristics

| | Exemplary Club Head 1 | Exemplary Club Head 2 | Control Club Head 1 | Control Club Head 2 |
|---|---|---|---|---|
| Body Height (in.) | 2.462 | 2.462 | 2.453 | 2.556 |
| Body Width (in.) | 4.925 | 4.925 | 4.931 | 4.822 |
| Body Depth (in.) | 4.851 | 4.851 | 4.859 | 4.684 |
| Strike face height (in.) | 1.680 | 1.680 | 1.739 | 1.805 |
| Face nadir height (in.) | 0.417 | 0.417 | 0.396 | 0.405 |
| Face center height (in.) | 1.253 | 1.253 | 1.260 | 1.300 |
| Average face thickness (in.) | 0.097 | 0.097 | 0.098 | 0.105 |
| % Mass within midsection | 39.21% | 40.73% | 42.67% | 50.39% |
| % Mass within rearward section | 26.33% | 26.01% | 21.03% | 12.96% |
| % Mass within CMZ | 6.49% | 10.30% | 9.36% | 8.32% |
| Volume in lower hemisphere (g) | 162.1 | 162.1 | 164.0 | 166.2 |
| Mass in lower hemisphere (g) | 115.5 | 117.4 | 105.9 | 94.6 |
| Mass within HMZ (g) | 25.2 | 25.2 | 29.6 | 31.4 |
| Weight member mass (g) | 38.3 | 38.3 | 28.1 | 14.7 |
| $CG_{WZ}$ | 4.62 | 4.62 | 4.55 | 4.34 |
| $CG_{WLN}$ (in.) | −0.106 | −0.106 | −0.062 | 0.002 |
| $D_{AA}$ (in.) | 0.35 | 0.35 | — | 1.41 |
| $\Delta CG_X$ (in.) | 0.073 | 0.073 | — | 0.111 |
| $\Delta CG_Z$ (in.) | 0.021 | 0.021 | — | 0.103 |
| $\Delta I_{XX}$ (g*cm$^2$) | −126.0 | −125.6 | — | −571.2 |
| $\Delta I_{YY}$ (g*cm$^2$) | −131.9 | −133.2 | — | −382.2 |
| Crown angle (°) | 69.5 | 69.5 | 71.6 | 70.9 |
| $D_{CP}$ (in.) | 0.378 | 0.358 | 0.583 | 0.578 |
| $I_{XX}$ (g*cm$^2$) | 4694.5 | 4591.5 | 4344.9 | 3661.7 |
| $I_{YY}$ (g*cm$^2$) | 6016.8 | 5766.1 | 5728.4 | 5373.3 |
| $I_{XX}/I_{YY}$ | 0.780 | 0.796 | 0.758 | 0.681 |
| $CG_{LN}$ (in.) | 0.026 | −0.009 | 0.053 | 0.101 |

As evidenced by Table 1, the exemplary club heads each comprised improved mass properties over the control club heads. The lightweight crown and sole inserts of the exemplary club heads created extra discretionary mass over the first control club head, which included only a lightweight crown insert, and the second control club head, which lacked both a lightweight crown insert and sole insert. The lightweight shaft-receiving structures of the first and second exemplary club heads reduced the mass within the hosel mass zone (HMZ), further creating discretionary mass. The mass-saving structures reduced the mass of the midsection (MS).

The first and second exemplary club heads both utilized the extra discretionary mass to increase the mass of the weight member, thereby increasing the mass percentage within the rearward section (RS) and reducing the parametrical centroid distance ($D_{PC}$). The second exemplary club head further utilized the extra discretionary mass to provide the central mass pad, thereby increasing the mass of the central mass zone (CMZ) despite the overall midsection (MS) being less massive than the first and second control club heads.

The first and second exemplary club heads increased $I_{YY}$ and provided an $I_{XX}/I_{YY}$ ratio closer to 1, relative to both of the control club heads. Relative to the first control club head, the first exemplary club head increased $I_{YY}$ by 5% and increased the $I_{XX}/I_{YY}$ ratio by 2.9%. This increase in both $I_{YY}$ and the $I_{XX}/I_{YY}$ ratio demonstrates the effectiveness of including a lightweight composite sole insert in addition to a lightweight crown insert. Although the second exemplary club head modestly increased $I_{YY}$ relative to the first control club head (a 0.66% increase), the second exemplary club head significantly increased the $I_{XX}/I_{YY}$ ratio over the first control club head (a 5.0% increase). This increase in the $I_{XX}/I_{YY}$ ratio demonstrates the effectiveness of including a lightweight composite sole insert in addition to a lightweight crown insert and further including a central mass pad. Relative to the second control club head, the first and second exemplary club heads increased $I_{YY}$ by 12% and 7%, respectively. Relative to the second control club head, the first and second exemplary club heads increased the $I_{XX}/I_{YY}$ ratio by 14.5% and 16.9%, respectively. This increase in both $I_{YY}$ and the $I_{XX}/I_{YY}$ ratio demonstrates the effectiveness of including lightweight composite crown and sole inserts over a single material club head.

Discretionary mass creation also allowed the exemplary club heads to achieve a more desirable club head CG position. The weight members of both exemplary club heads and the central mass pad of the second exemplary club head placed more mass low in the club head than the control club heads. The weight members of the first and second exemplary clubs were located further rearward (see $CG_{WZ}$), further below the loft-normal axis 35 (see $CG_{WLN}$) and were heavier than the weight members of the control club heads. The weight members and/or central mass pad of the exemplary club heads significantly increased the mass in the lower hemispheres despite the lower hemispheres comprising slightly less volume than the control club heads.

This utilization of discretionary mass significantly decreased the CG loft normal distance ($CG_{LN}$) in the exemplary club heads. Relative to the first control club head, the first and second exemplary club heads reduced the absolute value of the CG loft normal distance ($CG_{LN}$) by 50.9% and 83.0%, respectively. Relative to the second control club head, the first and second exemplary club heads reduced the absolute value of the CG loft normal distance ($CG_{LN}$) by 74.3% and 91.1%, respectively.

The exemplary club heads improved CG and MOI while also improving strike face properties. The exemplary club heads each reduced strike face height ($H_{SF}$) and thickness yet raised the face nadir height ($H_{FN}$), thereby maintaining a similar face center height ($H_{FC}$) to the control club heads. As such, the exemplary strike faces were shallower and more flexible and the loft-normal axis 35 was not significantly lowered, thereby allowing the exemplary club head CG loft normal distance $CG_{LN}$ to be reduced (as described above).

As discussed above, the first exemplary club head, the second exemplary club head, and the second control club head each comprised an adjustable weighting system. The exemplary weighting systems comprised short arcs and were identical to one another, while the second exemplary club head comprised a much larger arc, as evidenced by the increased distance between discrete attachment points ($D_{AA}$) described above. The exemplary weighting systems adjusted the club head $CG_X$ by 0.077 inch, thereby correcting shot bend by approximately 7.7 yards. The first control club head adjusted club head $CG_X$ by 0.111 inch, thereby correcting shot bend by approximately 11.1 yards. All weighting systems provided shot bend correction within desirable ranges, however the exemplary weighting systems retained club head MOI and CG far better than the first control club head. The heavier weight members and shorter-arced system of the exemplary club heads allowed the $CG_X$ to be moved while reducing the amount of $CG_Z$ movement towards the strike face by 79.6%. The exemplary club heads retained higher MOI due to the retention in $CG_Z$. Referring to $\Delta I_{XX}$ in Table 1, the exemplary weighting systems reduced $I_{XX}$ loss between weight configurations by an average of 78.0%. Further, referring to $\Delta I_{YY}$ in Table 1, the exemplary weighting systems reduced $I_{YY}$ loss between weight configurations by an average of 65.3%. The Example illustrates that a heavy weight member in a short-arced housing structure provides comparable CG adjustability without sacrificing mass properties.

II. Example 2: Performance of Exemplary Golf Club Head with Balanced Properties and Characteristics Performance characteristics were compared between the first exemplary club head of Example 1 and the first and second control club heads of Example 1. An impulse-momentum model simulated the performance of each club head. The impulse momentum model simulated golf shots at an average club head speed of 100 mph and over a variety of different delivery characteristics (i.e., angle of attack, club head path, etc.) and impact locations. The average ball speed, carry distance, and shot bend were compared for each club head and are exhibited in Table 2 below.

TABLE 2

| Performance Results | | | |
|---|---|---|---|
| | Exemplary Club Head 1 | Control Club Head 1 | Control Club Head 2 |
| Ball speed (MPH) | 144.4 | 144.4 | 144.0 |
| Carry Distance (yds.) | 256.3 | 254.4 | 251.1 |
| Shot bend (yds.) | 16.4 | 19.1 | 19.8 |

Comparing the first exemplary club head to the first control club head, the exemplary club head exhibited an identical ball speed, increased carry distance by 1.9 yards (a 0.8% increase), and reduced shot bend by 2.7 yards (a 14.1% decrease). Despite the identical ball speeds, the increases in carry distance can be attributed to improvements in launch angle and/or spin rate associated with the improved MOI and CG position. Comparing the first exemplary club head, the second exemplary club increased ball speed by 0.4 yards (a 0.3% increase), increased carry distance by 5.2 yards (a 2.1% increase), and reduced shot bend by 3.4 yards (a 17.3% increase). The Example illustrates that the improvement in physical properties achieved by the first exemplary club head (as illustrated in Example 1) increase shot distance and significantly increase forgiveness.

III. Example 3: Aerodynamic Drag for Golf Club Head with Turbulators

As discussed above, the club head of the present invention may utilize aerodynamic features such as turbulators to reduce drag during the golf swing. The golf club of the present invention comprises a relatively steep crown angle ($\alpha_C$), which is typically not desirable for reducing drag in a club head devoid of aerodynamic features on the crown. However, through the use of turbulators, the effect of having a steep crown angle ($\alpha_C$) can be mitigated and drag can be reduced. The benefits of turbulators are readily apparent when one compares a golf club head with and without turbulators.

The present example illustrates comparative results related to aerodynamic drag between an exemplary club head with turbulators and a control club head identical to the exemplary club head but for the control club head lacking turbulators. Both the exemplary club head and the control club head had identical dimensions. In particular, both club heads had a body width ($W_B$) of 4.88 inches, a body height ($H_B$) of 2.58 inches, a body depth ($D_B$) of 4.81 inches, and a crown angle ($\alpha_C$) of 70.47 degrees. The only difference between these golf club heads was the inclusion of turbulators on the exemplary club head.

The exemplary club head and control club head were subjected to a wind tunnel test to measure the drag forces experienced by each golf club head. In particular, the exemplary club head and control club head were subjected to a flow of varying speed and angles to simulate a golf downswing. In particular, to simulate the downswing, the exemplary golf club and the control golf club were subjected to a flow speed of 81.9 MPH directed at an angle of 30 degrees relative to the XY plane, a flow speed of 89.4 MPH directed at an angle of 40 degrees relative to the XY plane, a flow speed of 94.3 MPH directed at an angle of 50 degrees relative to the XY plane, a flow speed of 100 MPH directed at an angle of 70 degrees relative to the XY plane, a flow speed of 102.3 MPH directed at an angle of 80 degrees relative to the XY plane, a flow speed of 103.4 MPH directed at an angle of 85 degrees relative to the XY plane, and a flow speed of 103.8 MPH directed at an angle of 90 degrees relative to the XY plane. The set of flow speeds and orientations represent a "typical" golf swing which achieves a 102 mph club head speed. A direct comparison of the drag forces experienced by the exemplary club head and control club head can be seen below in Table 3.

TABLE 3

Wind Tunnel Test Results

| Wind Angle (relative to strike face) (degrees) | Wind speed (mph) | Drag (lbs.), Exemplary Club Head | Drag (lbs.), Control Club Head | % Reduction in Drag |
|---|---|---|---|---|
| 90 | 103.8 | 1.39363 | 1.67900 | 17.0% |
| 85 | 103.4 | 1.19581 | 1.48697 | 19.6% |
| 80 | 102.3 | 1.37172 | 1.39755 | 1.8% |
| 70 | 100 | 1.32315 | 1.32033 | −0.2% |
| 50 | 94.3 | 1.20792 | 1.16324 | −3.8% |
| 40 | 89.4 | 1.09203 | 1.04828 | −4.2% |
| 30 | 81.9 | 0.92382 | 0.88362 | −4.5% |

As shown in Table 3, the control club head experiences significantly greater drag forces at the bottom of the down swing (when the airflow is oriented between 85-90 degrees relative to the strike face). These increased drag forces correspond to a loss in club head speed and, thereby, a decrease in ball speed. The loss of club head speed as a result of drag forces can be calculated according to Equations 1-3, described below. Equation 1 below is Newton's second law, where F is the force experienced by an object, m is the object's mass, and a is the acceleration experienced by the object.

$$F = ma \qquad \text{Equation 1}$$

Since acceleration is the change in velocity over time, Equation 1 can be written as Equation 2 below, where v is the velocity of the object and t is time.

$$F = m\frac{\Delta v}{\Delta t} \qquad \text{Equation 2}$$

Furthermore, taking the integral of Equation 2 with respect to time can be taken which yields Equation 3, below.

$$\int F dt = \int m\frac{\Delta v}{\Delta t} dt \qquad \text{Equation 3}$$

Since the values of drag force and club head mass are known, Equation 3 can be simplified to Equation 4 below, where $F_D$ is drag force.

$$\Delta F_D = m\Delta v \qquad \text{Equation 4}$$

Using Equation 4, the change in velocity of the club head can be calculated as a result of the change in drag forces between the data points of Table 3. To perform this calculation the time it takes the club head to travel throughout the down swing must be known. Using data from a group of test players with 100+ mph driver club head speeds, these times were recorded and are included in Table 4 below. Impact with the golf ball (which occurs at a 90 degree wind angle) was assumed to occur at 0 seconds, and the rest of the downswing was recorded with negative values for the times before impact. The loss of club head speed throughout the swing as a result of drag was thereby calculated and is shown in Table 4 below.

TABLE 4

Club Head Speed Results

| Time (s) | Wind Angle (relative to strike face) (degrees) | Wind speed (mph) | Loss of Velocity (mph), Exemplary Club Head | Loss of Velocity (mph), Control Club Head |
|---|---|---|---|---|
| 0 | 90 | 103.8 | 0.12 | 0.15 |
| −0.00276 | 85 | 103.4 | 0.30 | 0.35 |
| −0.00763 | 80 | 102.3 | 0.76 | 0.82 |
| −0.01876 | 70 | 100 | 1.64 | 1.67 |
| −0.05216 | 50 | 94.3 | 2.19 | 2.21 |
| −0.07861 | 40 | 89.4 | 2.88 | 2.87 |
| −0.13288 | 30 | 81.9 | — | — |

Table 4 shows that, over the course of the downswing, the exemplary club head retained 0.17 mph more club head speed, due to decreased drag, when compared to the control club head. This translates to a velocity retention increase of 2.1% due to decreased drag forces for the exemplary club head compared to the control club head.

In summary, the exemplary club head and the control club head were substantially similar except the exemplary club head had turbulators and the control club head did not. The exemplary club head retained 2.1% more velocity, due to decreased drag forces, when compared to the control club head. Thereby, the turbulators were effective at mitigating club head speed losses due to drag.

IV. Example 4: Golf Club Head with Insert Ribs Vs. Golf Club Head with Internal Bridges Further described herein is a comparison of a finite element analysis performed on two golf club heads comprising different internal reinforcement structures. The finite element analysis (FEA) simulated the vibrational response of each golf club head. The purpose of the FEA was to demonstrate the performance of insert ribs as compared to integral bridges and frame ribs. As discussed above, the insert ribs provide a lightweight structure capable of controlling vibrations in the body without significantly increasing the structural mass. Further, the discussion below illustrates the ease of manufacturing a discrete sole insert that includes insert ribs.

The exemplary club head was substantially similar to the golf club head illustrated in FIGS. 25A and 25B. The exemplary club head comprised a frame, a discrete crown insert, and a discrete sole insert. The frame included a heel-side external bridge and a toe-side external bridge and defined a crown opening and a sole opening. The crown insert was received within the crown opening and included a heel-side crown wrap and a toe-side crown wrap. The sole insert was received within the sole opening and included two insert ribs extending diagonally across an inner surface of the sole insert in a front-heel to rear-toe direction. The insert ribs included a forward insert rib extending from near the toe-side external bridge to near the forward sole return, and a rearward insert rib extending from near the toe-side external bridge to near the heel-side external bridge. The insert ribs were located only on the inner surface of the sole insert and did not extend onto portions of the frame. The insert ribs were formed from a lightweight, composite material. The insert ribs were formed separately from the sole insert and were epoxied to the inner surface of the sole insert. The combined mass of the epoxy and the insert ribs was approximately 2.8 grams.

The control golf club head (hereafter referred to as the "control club") was substantially similar to the golf club head illustrated in FIGS. 20A-20C. The control club was devoid of any insert ribs. Instead, the control club comprised two internal bridges and two frame ribs extending diagonally across the sole opening in a front-heel to rear-toe direction. The frame included a forward internal bridge including a forward frame rib and a rearward internal bridge including a rearward frame rib extending from near the toe-side external bridge to near the forward sole return. The frame ribs were formed integrally with the internal bridges. The internal bridges extended across the sole opening such that they contacted portions of the sole ledge. The internal bridges and frame ribs were formed integrally with the frame such that they were formed from the same material as the frame. The combined mass of the internal bridges and the frame ribs was approximately 5.5 grams.

The overall body shape and crown inserts of the control club head and the exemplary club heads were similar. Further, the sizing and positioning of the internal reinforcement structures were kept constant to isolate the difference in performance caused by the different internal reinforcement structures. Specifically, the location of each internal reinforcement structure relative to the sole opening, the front-heel to rear-toe directionality, and the rib heights were kept constant. Table 5 compares the vibrational response of the exemplary club head and the control club head.

TABLE 5

| Frequency Results | | |
|---|---|---|
| | Exemplary Club Head | Control Club Head |
| Frequency [Hz] | 3807 | 3896 |
| Internal Reinforcing Structure Mass [g] | 2.8 | 5.5 |

A high frequency correlates to a more acoustically pleasing high-pitched sound at impact, rather than a low, dull sound at impact. The control and exemplary club heads performed similarly. The exemplary club head exhibited a frequency of 3807 Hz, while the control club head exhibited a frequency of 3896 Hz. The comparison illustrates that the inclusion of the insert ribs on the sole insert reduced the structural mass of the exemplary club by 2.7 grams, while providing a similar vibrational response. As discussed above, the insert ribs provide a lightweight structure capable of controlling vibrations within the body without significantly increasing the structural mass.

The exemplary club head exhibited similar performance to the control club head, but the exemplary club head is cheaper and easier to manufacture than the control club head. The insert ribs of the exemplary club head were easier to manufacture because they can comprise a complex geometry that can be separately formed from the sole insert and thereafter attached. In comparison, the frame ribs were integrally formed with the frame, which requires their complex geometry to be cast with the frame. Furthermore, the insert ribs were located within the boundary of the sole insert and did not extend on to other portions of the frame. This construction provides a simple sole insert geometry that can be easily attached to the sole opening during assembly without any complicated, overlapping structures.

V. Example 5: Golf Club Head with Optimized Bulge and Roll Curvatures

An exemplary club head comprising a strike face with optimized bulge and roll curvatures in accordance with the present invention was compared to a control club head comprising standard bulge and roll curvatures that were not optimized for the club head's particular properties and characteristics. The exemplary club head was identical to the exemplary club head of Example 1, and the control club head was substantially similar to the exemplary club head of Example 1, but for differences in bulge and roll curvatures. The exemplary club head and the control club head comprised identical characteristics (i.e., identical MOI, CG position, body shape, etc.), but for the differences in bulge and roll curvatures. The exemplary club head comprised a bulge radius of 11 inches, an upper roll radius of 12 inches, and a lower roll radius of 8 inches. The control club head comprised a bulge radius of 12 inches and a roll radius of 12 inches, which are typical prior-art curvatures for a driver-type club head. The optimized bulge and roll radii of the exemplary club heads satisfied relations 1, 2, and 3 specified in the description above.

An impulse-momentum model simulated the performance of each club head. The impulse momentum model simulated golf shots at an average club head speed of 100 mph and over a variety of different delivery characteristics (i.e., angle of attack, club head path, etc.) and impact locations. The average ball speed, carry distance, and shot bend were compared for each club head and are exhibited in Table 6 below.

TABLE 6

| Bulge and Roll Results | | |
|---|---|---|
| | Exemplary Club Head 1 | Exemplary Club Head 2 |
| Ball speed (MPH) | 144.4 | 144.2 |
| Carry Distance (yds.) | 256.3 | 255.1 |
| Shot bend (yds.) | 16.4 | 16.6 |

As shown (above), the exemplary club head provides increases in both carry distance and offline distance in comparison to the control club head. The exemplary club head increased carry distance by 1.2 yards (a 0.5% increase) over the control club head. The exemplary club head increased ball speed by 0.2 MPH (a 0.15% increase) over the control club head. The exemplary club head reduced shot bend by 0.2 yards (a 1.4% decrease) over the control club head. The results indicate that applying an industry standard bulge and roll curvatures (12 inches) fails to maximize ball speed, carry distance, and shot bend. In comparison, the exemplary club heads, which include optimized bulge and roll curvatures, improve ball speed, carry distance, and shot bend.

CLAUSES

Clause 1. A golf club head comprising a strike face comprising a face center, a leading edge, and a loft plane; a body, a club head CG, a ground plane, and a total club head mass; wherein the body comprises a frame, a crown insert, and a sole insert, the body forming a crown, a sole, a heel end, a toe end, and a rear end; the frame comprising: a forward frame and a rearward frame; wherein the forward frame comprises a forward crown return that forms a forward portion of the crown, and a forward sole return that forms a forward portion of the sole; wherein the rearward frame comprises a rearward crown return that forms a rearward portion of the crown, and a rearward sole return that forms a rearward portion of the sole; a heel-side external bridge connecting the forward sole return and the rearward sole return the heel end; a toe-side external bridge connecting the forward sole return and the rearward sole return near the toe end; a crown opening formed by the forward frame, the rearward frame, the heel-side external bridge, and the toe-side external bridge; a sole opening formed by the forward frame, the rearward frame, the heel-side external bridge, and the toe-side external bridge; wherein the crown insert is received within the crown opening, and the crown insert comprises: a crown insert heel wrap that forms at least a portion of the sole near the heel end; a crown insert toe wrap that forms at least a portion of the sole near the toe end; wherein the sole insert is received within the sole opening; a weight member coupled to the rearward frame, proximate the rear end and the sole; wherein the weight member comprises a mass greater than 30 grams; wherein the weight member comprises a weight member center of gravity located at a $CG_{WZ}$ greater than 4.6 inches; a perimetrical centroid; a coordinate system centered about the club head CG, the coordinate system defining: an X'-axis extending in a heel-to-toe direction, parallel to the ground plane; a Y'-axis extending in a crown-to-sole direction, orthogonal to the X'-axis and the ground plane; a Z'-axis extending in a strike face-to-rear direction, orthogonal to both the X'-axis and the Y'-axis; a loft-normal axis extending through the face center, substantially normal to the strike face; wherein the weight member center of gravity is located below the loft-normal axis; wherein the club head CG comprises: a distance between the club head CG and the perimetrical centroid less than 0.50 inch; an absolute value of a CG loft-normal distance less than 0.050 inch; an $I_{YY}$ moment of inertia greater than 5700 g-cm$^2$; and an $I_{XX}/I_{YY}$ ratio between 0.77 and 1.

Clause 2. The golf club head of clause 1, wherein the golf club head further comprises: a body depth; a midsection bounded by a midsection front plane and a midsection rear plane, wherein: the midsection front plane and the midsection rear plane are each vertical planes extending in a heel end-to-toe end direction, parallel to the X'-axis; the midsection front plane is spaced rearward of the leading edge by 15% of the body depth; and the midsection rear plane is spaced forward of a rearmost point of the body by 15% of the body depth; and a central mass zone defined by an imaginary cylinder centered about the Y'-axis and extending through the body from the crown to the sole, wherein; the central mass zone comprises a central mass zone radius of 1.00 inch; and between 25% and 50% of the total club head mass is located within the midsection and 5% and 15% of the total club head mass is located within the central mass zone.

Clause 3. The golf club head of clause 2, wherein the frame further comprises: a forward internal bridge a rearward internal bridge that extend diagonally across the sole opening between the toe-side external bridge and the forward sole return; and a mass pad suspended between the forward internal bridge and the rearward internal bridge.

Clause 4. The golf club head of clause 3, wherein the mass pad comprises a mass between 10 grams and 60 grams.

Clause 5. The golf club head of clause 4, wherein the mass pad is entirely bounded within the central mass zone.

Clause 6. The golf club head of clause 1, wherein the golf club head further comprises: a crown surface area, a sole surface area, and a body perimeter; wherein the crown insert defines between 50% and 85% of the crown surface area and between 25% and 75% of the body perimeter; and wherein the sole insert defines between 25% and 75% of the sole surface area.

Clause 7. The golf club head of clause 1, wherein the golf club head further comprises: a club head volume and a club head mass; and an upper hemisphere located above a plane defined by the loft-normal axis, and a lower hemisphere located below the plane; wherein a ratio of the club head volume in the upper hemisphere to club head volume in the lower hemisphere is between 1.20 and 2.00; and wherein a ratio of the club head mass in the upper hemisphere to club head mass in the lower hemisphere is between 0.70 and 1.00.

Clause 8. The golf club head of clause 1, wherein between 15% and 50% of the sole insert is located above the weight member center of gravity.

Clause 9. The golf club head of clause 1, wherein the crown insert and the sole insert are formed from a first material, the frame is formed from a second material, and the second material is denser than the first material.

Clause 10. The golf club head of clause 1, wherein the weight member is located at a distance $D_{WFC}$ greater than 4.4 inches.

Clause 11. A golf club head comprising a strike face comprising a face center, a leading edge, and a loft plane; a body, a club head CG, a ground plane, and a total club head mass; wherein the body comprises a frame, a crown insert, and a sole insert, the body forming a crown, a sole, a heel end, a toe end, and a rear end; the frame comprising: a forward frame and a rearward frame; wherein the forward frame comprises a forward crown return that forms a forward portion of the crown, and a forward sole return that forms a forward portion of the sole; wherein the rearward frame comprises a rearward crown return that forms a rearward portion of the crown, and a rearward sole return that forms a rearward portion of the sole; a heel-side external bridge connecting the forward sole return and the rearward sole return the heel end; a toe-side external bridge connecting the forward sole return and the rearward sole return near the toe end; a crown opening formed by the forward frame, the rearward frame, the heel-side external bridge, and the toe-side external bridge; a sole opening formed by the forward frame, the rearward frame, the heel-side external bridge, and the toe-side external bridge; wherein the crown insert is received within the crown opening, and the crown insert comprises: a crown insert heel wrap that forms at least a portion of the sole near the heel end; a crown insert toe wrap that forms at least a portion of the sole near the toe end; wherein the sole insert is received within the sole opening; a weight member coupled to the rearward frame, proximate the rear end and the sole; wherein the weight member comprises a mass greater than 30 grams; wherein the weight member comprises a weight member center of gravity located at a $CG_{WZ}$ greater than 4.6 inches; a coordinate system centered about the club head CG, the coordinate system defining: an X'-axis extending in a heel-to-toe direction, parallel to the ground plane; a Y'-axis extending in a crown-to-sole direction, orthogonal to the X'-axis and the ground plane; a Z'-axis extending in a strike face-to-rear direction, orthogonal to both the X'-axis and the Y'-axis; a body depth between 4.4 inches and 5.0 inches; a midsection bounded by a midsection front plane and a midsection rear plane, wherein: the midsection front plane and the midsection rear plane are each vertical planes extending in a heel end-to-toe end direction, parallel to the X'-axis; the midsection front plane is spaced rearward of the leading edge by 15% of the body depth; the midsection rear plane is spaced forward of a rearmost point of the body by 15% of the body depth; the crown insert and the sole insert together form greater than 50% of an exterior surface area of the midsection; a loft-normal axis extending through the face center, substantially normal to the strike face; wherein the weight member center of gravity is located below the loft-normal axis; wherein the club head CG comprises: a CG leading edge depth between 2.0 inches and 2.5 inches; an absolute value of a CG loft-normal distance less than 0.050 inch; an $I_{YY}$ moment of inertia greater than 5700 g-cm$^2$; and an $I_{XX}/I_{YY}$ ratio between 0.77 and 1.

Clause 12. The golf club head of clause 11, wherein the golf club head further comprises: a crown surface area, a sole surface area, and a body perimeter; wherein the crown insert defines between 50% and 85% of the crown surface area and between 25% and 75% of the body perimeter; and wherein the sole insert defines between 25% and 75% of the sole surface area.

Clause 13. The golf club head of clause 11, wherein the golf club head further comprises: a club head volume and a club head mass; and an upper hemisphere located above a plane defined by the loft-normal axis, and a lower hemisphere located below the plane; wherein a ratio of the club head volume in the upper hemisphere to club head volume in the lower hemisphere is between 1.20 and 2.00; and wherein a ratio of the club head mass in the upper hemisphere to club head mass in the lower hemisphere is between 0.70 and 1.00.

Clause 14. The golf club head of clause 13, wherein the crown insert and sole insert together form greater than 50% of a surface area of the upper hemisphere.

Clause 15. The golf club head of clause 13, wherein the crown insert and sole insert together form greater than 50% of a surface area of the lower hemisphere.

Clause 16. The golf club head of clause 11, wherein the crown insert comprises a crown insert mass between 5 grams and 12 grams, and the sole insert comprises a sole insert mass between 4 grams and 12 grams.

Clause 17. The golf club head of clause 11, wherein the golf club head further comprises a perimetrical centroid, and wherein an absolute value of a distance between the club head CG and the perimetrical centroid is less than 0.50 inch.

Clause 18. The golf club head of clause 11, wherein between 15% and 50% of the sole insert is located above the weight member center of gravity.

Clause 19. The golf club head of clause 11, wherein the crown insert and the sole insert are formed from a first material, the frame is formed from a second material, and the second material is denser than the first material.

Clause 20. The golf club head of clause 11, wherein the weight member is located at a distance $D_{WFC}$ greater than 4.4 inches.

Clause 21. A golf club head comprising: a strike face comprising a face center, a leading edge, and a loft plane; a body, a club head CG, a ground plane, and a total club head mass; wherein the body comprises a frame, a crown insert, and a sole insert, the body forming a crown, a sole, a heel end, a toe end, a rear end, and a hollow interior cavity; the frame comprising: a forward frame and a rearward frame; wherein the forward frame comprises a forward crown return that forms a forward portion of the crown, and a forward sole return that forms a forward portion of the sole; wherein the rearward frame comprises a rearward crown return that forms a rearward portion of the crown, and a rearward sole return that forms a rearward portion of the sole; a heel-side external bridge connecting the forward sole return and the rearward sole return the heel end; a toe-side external bridge connecting the forward sole return and the rearward sole return near the toe end; a crown opening formed by the forward frame, the rearward frame, the heel-side external bridge, and the toe-side external bridge; a sole opening formed by the forward frame, the rearward frame, the heel-side external bridge, and the toe-side external bridge; wherein the crown insert is received within the crown opening, and the crown insert comprises: a crown insert heel wrap that forms at least a portion of the sole near the heel end; a crown insert toe wrap that forms at least a portion of the sole near the toe end; wherein the sole insert is received within the sole opening, and the sole insert comprises: an interior surface oriented to the hollow interior cavity; a first insert rib extending along the interior surface in a diagonal direction relative to the strike face; a second insert rib extending along the interior surface in a diagonal direction relative to the strike face; wherein the first insert rib and the second insert rib are parallel to one another; wherein each of the first insert rib and the second insert rib comprises an insert rib length between 1.00 inch and 5.00 inches; a body width between 4.4 inches and 5.0 inches; wherein the insert rib length is between 25% and 90% of the body width; a weight member coupled to the rearward frame, proximate the rear end and the sole; wherein the weight member comprises a mass greater than 30 grams; wherein the weight member comprises a weight member center of gravity located at a $CG_{WZ}$ greater than 4.6 inches; a coordinate system centered about the club head CG, the coordinate system defining: an X'-axis extending in a heel-to-toe direction, parallel to the ground plane; a Y'-axis extending in a crown-to-sole direction, orthogonal to the X'-axis and the ground plane; a Z'-axis extending in a strike face-to-rear direction, orthogonal to both the X'-axis and the Y'-axis; a loft-normal axis extending through the face center, substantially normal to the strike face; wherein the weight member center of gravity is located below the loft-normal axis; wherein the club head CG comprises: a CG leading edge depth between 2.0 inches and 2.5 inches; an absolute value of a CG loft-normal distance less than 0.050 inch; an $I_{YY}$ moment of inertia greater than 5700 g-cm$^2$; and an $I_{XX}/I_{YY}$ ratio between 0.77 and 1.

Clause 21. A golf club head comprising: a strike face comprising a face center, a leading edge, and a loft plane; a body, a club head CG, a ground plane, and a total club head mass; wherein the body comprises a frame and a central insert, the body forming a crown, a sole, a heel end, a toe end, and a rear end; the frame comprising: a forward frame and a rearward frame; wherein the forward frame comprises a forward crown return that forms a forward portion of the crown, and a forward sole return that forms a forward portion of the sole; wherein the rearward frame comprises a rearward crown return that forms a rearward portion of the crown, and a rearward sole return that forms a rearward portion of the sole; a central opening formed between the forward frame and the rearward frame; wherein the central insert is received within the central opening, and the central insert comprises: a central insert outer surface that forms at least a portion of the crown, a portion of the heel end, a portion of the toe end, and a portion of the sole; a weight member coupled to the rearward frame, proximate the rear end and the sole; wherein the weight member comprises a mass greater than 30 grams; wherein the weight member comprises a weight member center of gravity located at a $CG_{WZ}$ greater than 4.6 inches; a coordinate system centered about the club head CG, the coordinate system defining: an X'-axis extending in a heel-to-toe direction, parallel to the ground plane; a Y'-axis extending in a crown-to-sole direction, orthogonal to the X'-axis and the ground plane; a Z'-axis extending in a strike face-to-rear direction, orthogonal to both the X'-axis and the Y'-axis; a body depth between 4.4 inches and 5.0 inches; a midsection bounded by a midsection front plane and a midsection rear plane, wherein: the midsection front plane and the midsection rear plane are each vertical planes extending in a heel end-to-toe end direction, parallel to the X'-axis; the midsection front plane is spaced rearward of the leading edge by 15% of the body depth; the midsection rear plane is spaced forward of a rearmost point of the body by 15% of the body depth; the central insert forms greater than 50% of an exterior surface area of the midsection; a loft-normal axis extending through the face center, substantially normal to the strike face; wherein the weight member center of gravity is located below the loft-normal axis; wherein the club head CG comprises: a CG leading edge depth between 2.0 inches and 2.5 inches; an absolute value of a CG loft-normal distance less than 0.050 inch; an $I_{YY}$ moment of inertia greater than 5700 g-cm$^2$; and an $I_{XX}/I_{YY}$ ratio between 0.77 and 1.

The invention claimed is:

1. A golf club head comprising:

a strike face comprising a face center, a leading edge, and a loft plane;

a body, a club head CG, a ground plane, and a total club head mass;

wherein the body comprises a frame, a crown insert, and a sole insert, the body forming a crown, a sole, a heel end, a toe end, and a rear end;

the frame comprising:

a forward frame and a rearward frame;

wherein the forward frame comprises a forward crown return that forms a forward portion of the crown, and a forward sole return that forms a forward portion of the sole;

wherein the rearward frame comprises a rearward crown return that forms a rearward portion of the crown, and a rearward sole return that forms a rearward portion of the sole;

a heel-side external bridge connecting the forward sole return and the rearward sole return the heel end;

a toe-side external bridge connecting the forward sole return and the rearward sole return near the toe end;

a crown opening formed by the forward frame, the rearward frame, the heel-side external bridge, and the toe-side external bridge;

a sole opening formed by the forward frame, the rearward frame, the heel-side external bridge, and the toe-side external bridge;

wherein the crown insert is received within the crown opening, and the crown insert comprises:

a crown insert heel wrap that forms at least a portion of the sole near the heel end;

a crown insert toe wrap that forms at least a portion of the sole near the toe end;

wherein the sole insert is received within the sole opening;

a weight member coupled to the rearward frame, proximate the rear end and the sole;

wherein the weight member comprises a mass greater than 30 grams;

wherein the weight member comprises a weight member center of gravity located at a $CG_{WZ}$ greater than 4.6 inches;

a perimetrical centroid;

a coordinate system centered about the club head CG, the coordinate system defining:

an X'-axis extending in a heel-to-toe direction, parallel to the ground plane;

a Y'-axis extending in a crown-to-sole direction, orthogonal to the X'-axis and the ground plane;

a Z'-axis extending in a strike face-to-rear direction, orthogonal to both the X'-axis and the Y'-axis;

a loft-normal axis extending through the face center, substantially normal to the strike face;

wherein the weight member center of gravity is located below the loft-normal axis;

wherein the club head CG comprises:

a distance between the club head CG and the perimetrical centroid less than 0.50 inch;

an absolute value of a CG loft-normal distance less than 0.050 inch;

an $I_{YY}$ moment of inertia greater than 5700 g-cm$^2$; and an $I_{XX}/I_{YY}$ ratio between 0.77 and 1.

2. The golf club head of claim 1, wherein the golf club head further comprises:

a body depth;

a midsection bounded by a midsection front plane and a midsection rear plane, wherein:

the midsection front plane and the midsection rear plane are each vertical planes extending in a heel end-to-toe end direction, parallel to the X'-axis;

the midsection front plane is spaced rearward of the leading edge by 15% of the body depth; and the midsection rear plane is spaced forward of a rearmost point of the body by 15% of the body depth; and a central mass zone defined by an imaginary cylinder centered about the Y'-axis and extending through the body from the crown to the sole, wherein;

the central mass zone comprises a central mass zone radius of 1.00 inch; and between 25% and 50% of the total club head mass is located within the midsection and 5% and 15% of the total club head mass is located within the central mass zone.

3. The golf club head of claim 2, wherein the frame further comprises:

a forward internal bridge a rearward internal bridge that extend diagonally across the sole opening between the toe-side external bridge and the forward sole return; and a mass pad suspended between the forward internal bridge and the rearward internal bridge.

4. The golf club head of claim 3, wherein the mass pad comprises a mass between 10 grams and 60 grams.

5. The golf club head of claim 4, wherein the mass pad is entirely bounded within the central mass zone.

6. The golf club head of claim 1, wherein the golf club head further comprises:

a crown surface area, a sole surface area, and a body perimeter;

wherein the crown insert defines between 50% and 85% of the crown surface area and between 25% and 75% of the body perimeter; and wherein the sole insert defines between 25% and 75% of the sole surface area.

7. The golf club head of claim 1, wherein the golf club head further comprises:

a club head volume and a club head mass; and an upper hemisphere located above a plane defined by the loft-normal axis, and a lower hemisphere located below the plane;

wherein a ratio of the club head volume in the upper hemisphere to club head volume in the lower hemisphere is between 1.20 and 2.00; and wherein a ratio of the club head mass in the upper hemisphere to club head mass in the lower hemisphere is between 0.70 and 1.00.

8. The golf club head of claim 1, wherein between 15% and 50% of the sole insert is located above the weight member center of gravity.

9. The golf club head of claim 1, wherein the crown insert and the sole insert are formed from a first material, the frame is formed from a second material, and the second material is denser than the first material.

10. The golf club head of claim 1, wherein the weight member is located at a distance $D_{WFC}$ greater than 4.4 inches.

11. A golf club head comprising:

a strike face comprising a face center, a leading edge, and a loft plane;

a body, a club head CG, a ground plane, and a total club head mass;

wherein the body comprises a frame, a crown insert, and a sole insert, the body forming a crown, a sole, a heel end, a toe end, and a rear end;

the frame comprising:

a forward frame and a rearward frame;

wherein the forward frame comprises a forward crown return that forms a forward portion of the crown, and a forward sole return that forms a forward portion of the sole;

wherein the rearward frame comprises a rearward crown return that forms a rearward portion of the crown, and a rearward sole return that forms a rearward portion of the sole;

a heel-side external bridge connecting the forward sole return and the rearward sole return the heel end;

a toe-side external bridge connecting the forward sole return and the rearward sole return near the toe end;

a crown opening formed by the forward frame, the rearward frame, the heel-side external bridge, and the toe-side external bridge;

a sole opening formed by the forward frame, the rearward frame, the heel-side external bridge, and the toe-side external bridge;

wherein the crown insert is received within the crown opening, and the crown insert comprises:

a crown insert heel wrap that forms at least a portion of the sole near the heel end;

a crown insert toe wrap that forms at least a portion of the sole near the toe end;

wherein the sole insert is received within the sole opening;

a weight member coupled to the rearward frame, proximate the rear end and the sole;

wherein the weight member comprises a mass greater than 30 grams;

wherein the weight member comprises a weight member center of gravity located at a $CG_{WZ}$ greater than 4.6 inches;

a coordinate system centered about the club head CG, the coordinate system defining:

an X'-axis extending in a heel-to-toe direction, parallel to the ground plane;

a Y'-axis extending in a crown-to-sole direction, orthogonal to the X'-axis and the ground plane;

a Z'-axis extending in a strike face-to-rear direction, orthogonal to both the X'-axis and the Y'-axis;

a body depth between 4.4 inches and 5.0 inches;

a midsection bounded by a midsection front plane and a midsection rear plane, wherein:

the midsection front plane and the midsection rear plane are each vertical planes extending in a heel end-to-toe end direction, parallel to the X'-axis;

the midsection front plane is spaced rearward of the leading edge by 15% of the body depth;

the midsection rear plane is spaced forward of a rearmost point of the body by 15% of the body depth;

the crown insert and the sole insert together form greater than 50% of an exterior surface area of the midsection;

a loft-normal axis extending through the face center, substantially normal to the strike face;

wherein the weight member center of gravity is located below the loft-normal axis;

wherein the club head CG comprises:

a CG leading edge depth between 2.0 inches and 2.5 inches;

an absolute value of a CG loft-normal distance less than 0.050 inch;

an $I_{YY}$ moment of inertia greater than 5700 g-cm$^2$; and an $I_{XX}/I_{YY}$ ratio between 0.77 and 1.

12. The golf club head of claim 11, wherein the golf club head further comprises:

a crown surface area, a sole surface area, and a body perimeter;

wherein the crown insert defines between 50% and 85% of the crown surface area and between 25% and 75% of the body perimeter; and wherein the sole insert defines between 25% and 75% of the sole surface area.

13. The golf club head of claim 11, wherein the golf club head further comprises:

a club head volume and a club head mass; and an upper hemisphere located above a plane defined by the loft-normal axis, and a lower hemisphere located below the plane;

wherein a ratio of the club head volume in the upper hemisphere to club head volume in the lower hemisphere is between 1.20 and 2.00; and wherein a ratio of the club head mass in the upper hemisphere to club head mass in the lower hemisphere is between 0.70 and 1.00.

14. The golf club head of claim 13, wherein the crown insert and sole insert together form greater than 50% of a surface area of the upper hemisphere.

15. The golf club head of claim 13, wherein the crown insert and sole insert together form greater than 50% of a surface area of the lower hemisphere.

16. The golf club head of claim 11, wherein the crown insert comprises a crown insert mass between 5 grams and 12 grams, and the sole insert comprises a sole insert mass between 4 grams and 12 grams.

17. The golf club head of claim 11, wherein the golf club head further comprises a perimetrical centroid, and wherein an absolute value of a distance between the club head CG and the perimetrical centroid is less than 0.50 inch.

18. The golf club head of claim 11, wherein between 15% and 50% of the sole insert is located above the weight member center of gravity.

19. The golf club head of claim 11, wherein the crown insert and the sole insert are formed from a first material, the frame is formed from a second material, and the second material is denser than the first material.

20. The golf club head of claim 11, wherein the weight member is located at a distance $D_{WFC}$ greater than 4.4 inches.

* * * * *